US008221205B2

(12) United States Patent
Yoshizawa

(10) Patent No.: US 8,221,205 B2
(45) Date of Patent: Jul. 17, 2012

(54) GAMING MACHINE AND CARD GAME MACHINE

(75) Inventor: Kazumasa Yoshizawa, Tokyo (JP)

(73) Assignee: Universal Entertainment Corporation, Koto-Ku, Tokyo (JP)

( * ) Notice: Subject to any disclaimer, the term of this patent is extended or adjusted under 35 U.S.C. 154(b) by 703 days.

(21) Appl. No.: 12/402,990

(22) Filed: Mar. 12, 2009

(65) Prior Publication Data

US 2009/0258688 A1 Oct. 15, 2009

Related U.S. Application Data

(60) Provisional application No. 61/035,959, filed on Mar. 12, 2008, provisional application No. 61/036,345, filed on Mar. 13, 2008, provisional application No. 61/036,356, filed on Mar. 13, 2008, provisional application No. 61/037,445, filed on Mar. 18, 2008, provisional application No. 61/037,457, filed on Mar. 18, 2008, provisional application No. 61/037,465, filed on Mar. 18, 2008.

(51) Int. Cl.
*A63F 9/24* (2006.01)

(52) U.S. Cl. ..... 463/11; 463/31; 463/35; 463/42

(58) Field of Classification Search ..... None
See application file for complete search history.

(56) References Cited

U.S. PATENT DOCUMENTS

| | | | | |
|---|---|---|---|---|
| 7,727,060 | B2 * | 6/2010 | Mills | 463/13 |
| 2002/0094869 | A1 * | 7/2002 | Harkham | 463/42 |
| 2002/0173352 | A1 * | 11/2002 | Oliveras | 463/13 |
| 2003/0003997 | A1 * | 1/2003 | Vuong et al. | 463/42 |
| 2006/0084505 | A1 | 4/2006 | Yoseloff et al. | |
| 2008/0081682 | A1 * | 4/2008 | Yoshizawa | 463/11 |
| 2008/0176613 | A1 * | 7/2008 | Yoshizawa | 463/11 |
| 2008/0176614 | A1 * | 7/2008 | Yoshizawa | 463/11 |

* cited by examiner

*Primary Examiner* — David E Graybill
(74) *Attorney, Agent, or Firm* — Lexyoume IP Meister, PLLC.

(57) ABSTRACT

A gaming machine lets a player who has satisfied a predetermined condition select one dealer image among six dealer images. The gaming machine subsequently displays the selected image in a front display and executes a game. As a bet-accepting period started, the gaming machine accepts the player's operation of giving a tip to the dealer displayed on the front display separately from a bet operation for getting a prize. If the player gives the dealer a tip, the gaming machine generates an individual image corresponding to an image of the dealer who acts according to the player's personal data and a game history, and an individual sound corresponding to the voice of the dealer according to the player's personal data and a game history, and then outputs the generated individual image and individual sound at a predetermined timing.

9 Claims, 95 Drawing Sheets

FIG. 10

| TIP AMOUNT | DEALER'S BEHAVIOR PATTERN |
|---|---|
| 1 ~ 5 | CALL OUT PLAYER'S NAME |
| 6 ~ 10 | CALL OUT PLAYER'S NAME + TELL PLAY HOURS OR PLAY NUMBER |
| 11 ~ 15 | CALL OUT PLAYER'S NAME + TELL TOTAL BET AMOUNT |
| 16 ~ 20 | CALL OUT PLAYER'S NAME + TELL WINNING RATE OR TOTAL WIN AMOUNT |
| 21 ~ | CALL OUT PLAYER'S NAME + GIVE AN ADVICE |

FIG. 24

| TIP AMOUNT | DEALER'S BEHAVIOR PATTERN |
|---|---|
| 1 ~ 5 | CALL OUT PLAYER'S NAME |
| 6 ~ 10 | CALL OUT PLAYER'S NAME + TELL PLAY HOURS OR PLAY NUMBER |
| 11 ~ 15 | CALL OUT PLAYER'S NAME + TELL TOTAL BET AMOUNT |
| 16 ~ 20 | CALL OUT PLAYER'S NAME + TELL WINNING RATE OR TOTAL WIN AMOUNT |
| 21 ~ 25 | CALL OUT PLAYER'S NAME + GIVE AN ADVICE |
| 26 ~ | CALL PLAYER'S NAME + CHANGE DEALT CARD TO ANOTHER CARD ON PLAYER'S REQUEST (NOTE: THIS OCCURS RANDOMLY.) |

FIG. 28

| RANDOM NUMBER VALUE | JUDGMENT OF RIGHT-TO-CHANGE-CARD AWARDING |
|---|---|
| 0~127 | AWARD RIGHT |
| 128~2559 | AWARD NO RIGHT |

FIG. 39

| TIP AMOUNT | DEALER'S BEHAVIOR PATTERN |
|---|---|
| 1 ~ 5 | CALL OUT PLAYER'S NAME |
| 6 ~ 10 | CALL OUT PLAYER'S NAME + TELL PLAY HOURS OR PLAY NUMBER |
| 11 ~ 15 | CALL OUT PLAYER'S NAME + TELL TOTAL BET AMOUNT |
| 16 ~ 20 | CALL OUT PLAYER'S NAME + TELL WINNING RATE OR TOTAL WIN AMOUNT |
| 21 ~ 25 | CALL OUT PLAYER'S NAME + GIVE AN ADVICE |
| 26 ~ | CALL OUT PLAYER'S NAME + RAISE MAXIMUM-BET AMOUNT AT DOUBLE DOWN |

FIG. 99

| DEALER'S NAME | PRIZE AMOUNT |
|---|---|
| ○○○ | 670 |
| ○○△ | 18970 |
| ○△○ | 21050 |
| △○○ | 567005 |
| △△○ | 10 |
| △△△ | 358 |

GAMING MACHINE AND CARD GAME MACHINE

CROSS-REFERENCE TO RELATED APPLICATIONS

This application is based upon and claims a priority from the U.S. Provisional Patent Application No. 61/035,959 filed on Mar. 12, 2008, the U.S. Provisional Patent Application No. 61/036,345 filed on Mar. 13, 2008, the U.S. Provisional Patent Application No. 61/036,356 filed on Mar. 13, 2008, the U.S. Provisional Patent Application No. 61/037,445 filed on Mar. 18, 2008, the U.S. Provisional Patent Application No. 61/037,457 filed on Mar. 18, 2008 and the U.S. Provisional Patent Application No. 61/037,465 filed on Mar. 18, 2008, the entire contents of which are incorporated herein by reference.

BACKGROUND

1. Field of the Invention

A gaming machine according to one or more aspects of the present invention relates to a gaming machine that runs a game based on the running of a dealer displayed on a display.

The present invention relates to a card gaming machine which has a display which displays a card game progressing by a dealer.

2. Description of Related Art

Conventionally, in a casino or game parlor, etc. is placed a gaming machine or a table wherein a dealer and players participate in and execute a game called a poker, roulette, baccarat, or blackjack.

For example, in US Patent Application Publication No. 2006/0084505, a card gaming machine, in which a pai gow poker is executed, is described.

Now, among conventional gaming machines, some display a dealer's image on the display so as to enhance realistic sensation. However, a dealer's image displayed on the display always repeated same actions according to the progress of a game. In the following, taking a poker gaming machine as an example, description is made on a dealer's actions in one game.

(A) First, when a card game is started, a predetermined number of cards are dealt to a dealer and players respectively.

(B) Next, when a player wishes to change cards, the dealer deals new cards to the player who wished the change.

(C) Then, when dealing of cards ends, the dealer cards are disclosed.

(D) Thereafter, if a player has won, a prize is awarded to the player. In contrast, when a player has lost, a gaming value which has been bet by the player is collected.

Then, the dealer being displayed on the conventional card gaming machine repeated from the actions of above (A) to the actions of above (D).

Accordingly, compared to a game which is really progressed by a dealer of human at a casino and the like, a game which is progressed by a dealer being displayed on a card gaming machine tended to be easy for coming to a monotonous game. Also, tension sense of a player or sensation sense of a player comes to be diluted. Furthermore, a player could not empathize with a dealer being displayed on the display, and could not find a motivation for betting either. Hence, even if a dealer is displayed on a display, an entertainment quality or an operation rate is not improved sufficiently by the displayed dealer.

It is the first object of the present invention to provide a gaming machine that can encourage a dealer displayed on the display to behave according to player's personal data or gaming history by giving a tip not associated with a prize to the dealer and that enables enhancement of entertainment quality or increase in the operating rate, which have not been possible with the prior art.

Furthermore, in a gaming machine in which gaming progresses using disposed cards of the suit and the number (e.g., hearts and A), such as Pai Gow Poker or blackjack, contents of a prize to be awarded to the player is determined based on a hand of cards dealt to the player or that of cards dealt to the dealer. Thus, a kind of cards dealt to the player was an important parameter that dictates gaming result.

The present invention can allow the dealer displayed on the display to behave according to the player's personal data or gaming history by giving the dealer a tip that is not associated with a prize. Furthermore, it is the second object of the present invention to provide a gaming machine that has enabled enhancement of entertainment quality and increase in the operating rate, which have not been possible with the prior art described above, by awarding the player who gave the tip with a right-to-change dealt card with another card.

Furthermore, content of a prize to be awarded to the player in the above gaming machine varies depending on the amount of gaming value bet by the player (hereinafter referred to the bet amount). In fact, if the player bets a large amount of gaming value, a prize to be awarded will be of high value even when the same condition of awarding the prize is satisfied.

Thus, the bet amount is an important parameter that has a great influence on game results, and it is an important selection for the player how much bet amount to be set. Basically, this bet amount is set through the player's operation before the start of a game. However, it was also possible to execute an additional bet operation of increasing the bet amount while the game is in progress, such as "Raise" of poker and "Double Down" of blackjack.

The present invention can make the dealer displayed on the display behave according to player's personal data or gaming history by giving a tip that is not associated with a prize. In addition, it is the third object of the invention to provide a gaming machine that enables enhancement of entertainment quality or increase in the operating rate, which has not been possible with the prior art as described above, by awarding the player with a right to place an additional bet of the bet amount increased more than usual.

SUMMARY

It is the fourth object of the present invention to provide a card gaming machine in which a dealer being displayed on a display or a monitor can act according to a player's personal data or gaming history by being given a tip which is not associated with a prize to the dealer, and which can improve an entertainment quality and an operation rate, which have not been possible with the described prior art.

Therefore, in order to achieve the first object, according to a gaming machine of the present invention encompassing one or more aspects thereof, there is provided a gaming machine. The gaming machine comprises a display device that displays a screen of a game dealt by a dealer, a tipping operation device that receives an operation of giving the dealer a tip not associated with a prize by a player, a memory device that stores one of personal data and a gaming history of the player, and a processor. The processor accepts the operation of giving the tip by the player based on an operation of the tipping operation device. The processor reads from the memory device one of the personal data and the gaming history of a tip-giver player who has given the tip to the dealer. The processor displays on the display device an image in which the dealer acts in accordance with one of the personal data and the gaming history of the tip-giver player that is read from the memory device. As a result, the above gaming machine increases player's sense of tension or sensations to the game. It also allows the player to empathize with the dealer displayed on the display, and enables improved entertainment quality or increased operating rate.

According to the present invention encompassing one or more aspects, there is provided a gaming machine. The gaming machine comprises a display device that displays a screen of a game dealt by a dealer; a speaker that outputs a voice of the dealer displayed on the display device; a tipping operation device that receives an operation of giving the dealer a tip not associated with a prize by a player; a memory device that stores one of personal data and a gaming history of the player; and a processor. The processor accepts the operation of giving the tip by the player based on an operation of the tipping operation device. The processor reads from the memory device one of the personal data and the gaming history of a tip-giver player who has given the tip to the dealer. The processor displays on the display device an image in which the dealer acts in accordance with one of the personal data and the gaming history of the tip-giver player that is read from the memory device. The processor outputs a voice of the dealer in accordance with one of the personal data and the gaming history of the tip-giver player that is read from the memory device. As a result, the above gaming machine increases player's sense of tension or sensations to the game. It also allows the player to empathize with the dealer displayed on the display, and enables improved entertainment quality or increased operating rate.

According to the present invention encompassing one or more aspects, there is provided a gaming machine. The gaming machine comprises a display device that displays a screen of a game dealt by one dealer among a plurality of dealers; a bet operation device that receives an operation of betting for winning a prize by a player; a tipping operation device that receives an operation of giving the dealer a tip not associated with the prize by the player; a memory device that stores one of personal data and a gaming history of the player; and a processor. The processor accepts the operation of betting by the player based on an operation of the betting operation device. The processor lets the player select one dealer among the plurality of dealers when a predetermined condition is satisfied. The processor accepts the operation of giving the tip by the player based on an operation of the tipping operation device. The processor reads from the memory device one of the personal data and the gaming history of a tip-giver player who has given the tip to the dealer. The processor displays on the display device an image in which the dealer acts in accordance with one of the personal data and the gaming history of the tip-giver player that is read from the memory device. The processor awards the prize to the player based on the player's bet operation and a game result. As a result, the above gaming machine increases player's sense of tension or sensations to the game. It also allows the player to empathize with the dealer displayed on the display, and enables improved entertainment quality or increased operating rate. Further, as dealer's behavior varies in many ways depending on the tip amount to be given, a new taste can be offered to players.

Therefore, in order to achieve the second object, according to a gaming machine of the present invention encompassing one or more aspects thereof, there is provided a gaming machine. The gaming machine comprises a display device that displays a screen of a card game dealt by a dealer; a tipping operation device that receives an operation of giving the dealer a tip not associated with a prize by a player; a memory device that stores one of personal data and a gaming history of the player; and a processor. The processor accepts the operation of giving the tip by the player based on an operation of the tipping operation device. The processor reads from the memory device one of the personal data and the gaming history of a tip-giver player who has given the tip to the dealer. The processor displays on the display device an image in which the dealer acts in accordance with one of the personal data and the gaming history of the tip-giver player that is read from the memory device. The processor displays on the display device a predetermined number of cards dealt to the player. The processor changes a card dealt to the tip-giver player to another card. As a result, the above gaming machine increases player's sense of tension or sensations to the game. It also allows the player to empathize with the dealer displayed on the display, and enables improved entertainment quality or increased operating rate. Furthermore, as a tip-giver player who has given the tip to the dealer is awarded with the right-to-change the dealt card with another card, entertainment quality, which has not been possible with the prior art, can be enhanced.

According to the present invention encompassing one or more aspects, there is provided a gaming machine. The gaming machine comprises a display device that displays a screen of a card game dealt by a dealer; a speaker that outputs voice of the dealer displayed on the display device; a tipping operation device that receives an operation of giving the dealer a tip not associated with a prize by a player; a memory device that stores one of personal data and a gaming history of the player; and a processor. The processor accepts the operation of giving the tip by the player based on an operation of the tipping operation device. The processor reads from the memory device one of the personal data and the gaming history of a tip-giver player who has given the tip to the dealer. The processor displays on the display device an image in which the dealer acts in accordance with the one of the personal data and the gaming history of the tip-giver player that is read from the memory device. The processor outputs the voice of the dealer in accordance with the one of personal data and the gaming history of the tip-giver player that is read from the memory device. The processor displays on the display device a predetermined number of cards dealt to the player. The processor changes a card dealt to the tip-giver player to another card if the tip-giver player wants to. As a result, the above gaming machine increases player's sense of tension or sensations to the game. It also allows the player to empathize with the dealer displayed on the display, and enables improved entertainment quality or increased operating rate. Furthermore, as a tip-giver player who has given the tip to the dealer is awarded with the right-to-change the dealt card with another card, entertainment quality, which has not been possible with the prior art, can be enhanced.

According to the present invention encompassing one or more aspects, there is provided a gaming machine. The gaming machine comprises a display device that displays a screen of a card game dealt by a dealer; a bet operation device that receives an operation of betting for winning a prize by a player; a tipping operation device that receives an operation of giving the dealer a tip not associated with the prize by the player; a memory device that stores one of personal data and a gaming history of the player; and a processor. The processor accepts the operation of betting by the player based on an operation of the betting operation device. The processor accepts the operation of giving a tip by the player based on an operation of the tipping operation device. The processor reads from the memory device one of the personal data and the gaming history of a tip-giver player who has given the tip to the dealer. The processor displays on the display device an image in which the dealer acts in accordance with the one of the personal data and the gaming history of the tip-giver player that is read from the memory device. The processor displays on the display device a predetermined number of cards dealt to the player. The processor holds a lottery to determine whether to give a right to change a dealt card to another card to the tip-giver player. The processor changes a card dealt to the tip-giver player to another card if a result of the lottery is determined to give the right the tip-giver player and if the tip-giver player wants to. The processor awards the prize to the player based on the player's bet operation and a game result. As a result, the above gaming machine increases player's sense of tension or sensations to the game. It also allows the player to empathize with the dealer displayed on the display, and enables improved entertainment quality or increased operating rate. Further, as dealer's behavior varies in many ways depending on the tip amount to be given, a new taste can be offered to players. Furthermore, as a tip-giver player who has given the tip to the dealer is awarded with the right-to-change the dealt card with another card, entertainment quality, which has not been possible with the prior art, can be enhanced.

Therefore, in order to achieve the third object, according to a gaming machine of the present invention encompassing one or more aspects thereof, there is provided a gaming machine. The gaming machine comprises a display device that displays a screen of a card game dealt by a dealer; a bet operation device that receives an operation of betting for winning a prize by a player; a tipping operation device that receives an operation of giving the dealer a tip not associated with the prize by the player; a memory device that stores one of personal data and a gaming history of the player; and a processor. The processor accepts the operation of betting by the player based on an operation of the betting operation device. The processor accepts the operation of additional betting by the player increasing a predetermined amount of betting amount. The processor accepts the operation of giving the tip by the player based on an operation of the tipping operation device. The processor reads from the memory device one of the personal data and the gaming history of a tip-giver player who has given the tip to the dealer. The processor displays on the display device an image in which the dealer acts in accordance with the one of the personal data and the gaming history of the tip-giver player that is read from the memory device. The processor accepts an additional betting operation by the tip-giver player increasing betting amount higher than the predetermined amount when the operation of giving the tip is accepted. The processor awards the prize to the player based on the bet operation by the player and a game result. As a result, the above gaming machine increases player's sense of tension or sensations to the game. It also allows the player to empathize with the dealer displayed on the display, and enables improved entertainment quality or increased operating rate. Furthermore, as a tip-giver player who has given the tip to the dealer is awarded with the right-to-change the dealt card with another card, entertainment quality, which has not been possible with the prior art, can be enhanced.

According to the present invention encompassing one or more aspects, there is provided a gaming machine. The gaming machine comprises a display device that displays a screen of a card game dealt by a dealer; a speaker that outputs a voice of the dealer displayed on the display device; a bet operation device that receives an operation of betting for winning a prize by a player; a tipping operation device that receives an operation of giving the dealer a tip not associated with the prize by the player; a memory device that stores one of personal data and a gaming history of the player; and a processor. The processor accepts the operation of betting by the player based on an operation of the betting operation device. The processor accepts the operation of additional betting by the player increasing a predetermined amount of betting amount. The processor accepts the operation of giving the tip by the player based on an operation of the tipping operation device. The processor reads from the memory device one of the personal data and the gaming history of a tip-giver player who has given the tip to the dealer. The processor displays on the display device an image in which the dealer acts in accordance with the one of the personal data and the gaming history of the tip-giver player that is read from the memory device. The processor outputs a voice of the dealer in accordance with the one of personal data and the gaming history of the tip-giver player that is read from the memory device. The processor accepts an additional betting operation by the tip-giver player increasing betting amount higher than the predetermined amount when the operation of giving the tip is accepted. The processor awards the prize to the player based on the bet operation by the player and a game result. The processor changes a card dealt to the tip-giver player to another card if the tip-giver player wants to. As a result, the above gaming machine increases player's sense of tension or sensations to the game. It also allows the player to empathize with the dealer displayed on the display, and enables improved entertainment quality or increased operating rate. Furthermore, as a tip-giver player who has given the tip to the dealer is awarded with the right-to-change the dealt card with another card, entertainment quality, which has not been possible with the prior art, can be enhanced.

According to the present invention encompassing one or more aspects, there is provided a gaming machine. The gaming machine comprises a display device that displays a screen of a card game dealt by a dealer; a bet operation device that receives an operation of betting for winning a prize by a player; a tipping operation device that receives an operation of giving the dealer a tip not associated with the prize by the player; a memory device that stores one of personal data and a gaming history of the player; and a processor. The processor accepts the operation of betting by the player based on an operation of the betting operation device. The processor accepts the operation of additional betting by the player increasing a predetermined amount of betting amount. The processor accepts the operation of giving the tip by the player based on an operation of the tipping operation device. The processor reads from the memory device one of the personal data and the gaming history of a tip-giver player who has given the tip to the dealer. The processor displays on the display device an image in which the dealer acts in accordance with the one of the personal data and the gaming history of the tip-giver player that is read from the memory device. The processor lets the tip-giver player select the bet amount increased within an higher range than the predetermined amount when the operation of giving the tip is accepted. The processor accepts the operation of additional betting by the tip-giver player increasing the selected amount of betting amount. The processor awards the prize to the player based on the bet operation by the player and a game result. As a result, the above gaming machine increases player's sense of tension or sensations to the game. It also allows the player to empathize with the dealer displayed on the display, and enables improved entertainment quality or increased operating rate. Further, as dealer's behavior varies in many ways depending on the tip amount to be given, a new taste can be offered to players. Furthermore, as a tip-giver player who has given the tip to the dealer is awarded with the right-to-bet additionally bet amount greater than usual, entertainment quality, which has not been possible with the prior art, can be enhanced.

To achieve the fourth object of the present invention, there is provided a card gaming machine comprising: a main display for displaying a card game which is progressed by one of a plurality of dealers; a plurality of stations each provided with: a sub display for outputting an image relating to the card game; a speaker for outputting sounds relating to the card game; a tip indication device with which a player indicates a tip amount for the dealer who is a facilitator of the card game; an input device with which a player inputs information which is used to progress the card game; and a sub memory for storing personal data of a player who plays the card game or game history of the player; and a processor which is programmed for awarding a right of changing the dealer of the facilitator to another dealer to one of players who is playing at one of the stations and satisfies a predetermined condition, and which is programmed, for controlling progressing simultaneously the same card game in each of the stations, to execute each of processes from the process of (1) below to the process of (4) below: in the station where personal data of a player or game history of the player is stored in the sub memory by an inputting of the player with the input device before a start of the simultaneous progress of the same card game; (1) generating individual image information or individual sounds information, each information relating to the player, based on the personal data or game history that stored in the sub memory; (2) outputting an image of the individual image information at the sub display or outputting sounds of the individual sounds information at the speaker; (3) outputting at the sub display a game image which shows the player some of the cards that are dealt to the dealer of the facilitator with face-down cards whose suits and rank are shut out from the player, while the same card game is progressed; and (4) outputting at the sub display a first special image informing the player of the suit or rank of the face-down card by turning up a part of the face-down cards by the dealer of the facilitator upon completing an operation of indicating a tip amount for the dealer of the facilitator by the player using the tip indication device.

Furthermore, according to another aspect of the present invention, there is provided a card gaming machine comprising: a main display for displaying a card game which is progressed by one of a plurality of dealers; a plurality of stations each provided with: a sub display for outputting an image relating to the card game; a speaker for outputting sounds relating to the card game; a tip indication device with which a player indicates a tip amount for the dealer who is a facilitator of the card game; an input device with which a player inputs information which is used to progress the card game; and a sub memory for storing personal data of a player who plays the card game or game history of the player; and a processor which is programmed for awarding a right of changing the dealer of the facilitator to another dealer to one of players who is playing at one of the stations and satisfies a predetermined condition, and which is programmed, for controlling progressing simultaneously the same card game in each of the stations, to execute each of processes from the process of (1) below to the process of (4) below: in the station where personal data of a player or game history of the player is stored in the sub memory by an inputting of the player with the input device before a start of the simultaneous progress of the same card game; (1) generating individual image information or individual sounds information, each information relating to the player, based on the personal data or game history that stored in the sub memory; (2) outputting an image of the individual image information at the sub display or outputting sounds of the individual sounds information at the speaker; (3) outputting at the sub display a game image which shows the player some of the cards that are dealt to the dealer of the facilitator with face-down cards whose suits and rank are shut out from the player, while the same card game is progressed; and (4) upon completing an operation of indicating a tip amount for the dealer of the facilitator by the player using the tip indication device: (4-1) generating, based on the personal data or game history that stored in the sub memory, specific image information which included a message being able to identify the player; (4-2) generating a composite image which included an image of the specific image information in a first special image informing the player of the suit or rank of the face-down card by turning up a part of the face-down cards by the dealer of the facilitator; and (4-3) outputting at the sub display the composite image.

To achieve the fourth object of the present invention, there is provided a card gaming machine comprising: a main monitor for displaying a card game which is progressed by one of a plurality of dealers; a plurality of stations each provided with: a sub monitor for outputting an image relating to the card game; a speaker for outputting sounds relating to the card game; a tip indication device with which a player indicates a tip amount for the dealer who is a facilitator of the card game; an input device with which a player inputs information which is used to progress the card game; a sub memory for storing personal data of a player who plays the card game or game history of the player; and a request indication device in which an operation is invalidated under normal conditions; and a processor which is programmed for awarding a right of changing the dealer of the facilitator to another dealer to one of players who is playing at one of the stations and satisfies a predetermined condition, and which is programmed, for controlling progressing simultaneously the same card game in each of the stations, to execute each of processes from the process of (1) below to the process of (4) below: in the station where personal data of a player or game history of the player is stored in the sub memory by an inputting of the player with the input device before a start of the simultaneous progress of the same card game; (1) generating individual image information or individual sounds information, each information relating to the player, based on the personal data or game history that stored in the sub memory; (2) outputting an image of the individual image information at the sub display or outputting sounds of the individual sounds information at the speaker; (3) outputting at the sub display a first game image which shows the player the cards that are dealt to the player with face-up cards whose suits and rank are shown up, while the same card game is progressed; (4) validating an operation in the request indication device upon completing an operation of indicating a tip amount for the dealer of the facilitator by the player using the tip indication device; and (5) upon completing operations of the player in the request indication device: (5-1) outputting at the sub monitor a second game image which shows the player second player cards which are a copy of a first player cards which are composed of cards being dealt to the player by arranging the second player cards in parallel with the first player cards; and (5-2) progressing the card game such that the player can play with using both the first player cards and the second player cards.

Furthermore, according to another aspect of the present invention, there is provided a card gaming machine comprising: a main monitor for displaying a card game which is progressed by one of a plurality of dealers; a plurality of stations each provided with: a sub monitor for outputting an image relating to the card game; a speaker for outputting sounds relating to the card game; a tip indication device with which a player indicates a tip amount for the dealer who is a facilitator of the card game; an input device with which a player inputs information which is used to progress the card game; a sub memory for storing personal data of a player who plays the card game or game history of the player; and a request indication device in which an operation is invalidated under normal conditions; and a processor which is programmed for awarding a right of changing the dealer of the facilitator to another dealer to one of players who is playing at one of the stations and satisfies a predetermined condition, and which is programmed, for controlling progressing simultaneously the same card game in each of the stations, to execute each of processes from the process of (1) below to the process of (4) below: in the station where personal data of a player or game history of the player is stored in the sub memory by an inputting of the player with the input device before a start of the simultaneous progress of the same card game; (1) generating individual image information or individual sounds information, each information relating to the player, based on the personal data or game history that stored in the sub memory; (2) outputting an image of the individual image information at the sub display or outputting sounds of the individual sounds information at the speaker; (3) outputting at the sub display a first game image which shows the player the cards that are dealt to the player with face-up cards whose suits and rank are shown up, while the same card game is progressed; (4) validating an operation in the request indication device upon completing an operation of indicating a tip amount for the dealer of the facilitator by the player using the tip indication device; and (5) upon completing operations of the player in the request indication device: (5-1) generating, based on the personal data or game history that stored in the sub memory, specific image information which included a message being able to identify the player; (5-2) generating a composite image which included an image of the specific image information in a second game image which shows the player second player cards which are a copy of a first player cards which are composed of cards being dealt to the player by arranging the second player cards in parallel with the first player cards; (5-3) outputting at the sub display the composite image; and (5-4) progressing the card game such that the player can play with using both the first player cards and the second player cards.

To achieve the fourth object of the present invention, there is provided a card gaming machine comprising: a main monitor for displaying a card game which is progressed by one of a plurality of dealers; a main memory which stored dealer information relating to each of the dealers; a plurality of progressive jackpot prizes that are provided for each of the dealers; a plurality of stations each provided with: a sub monitor for outputting an image relating to the card game; a speaker for outputting sounds relating to the card game; a tip indication device with which a player indicates a tip amount for the dealer who is a facilitator of the card game; an input device with which a player inputs information which is used to progress the card game; and a sub memory for storing personal data of a player who plays the card game or game history of the player; and a processor which is programmed for awarding a right of changing the dealer of the facilitator to another dealer to one of players who is playing at one of the stations and satisfies a predetermined condition, and which is programmed, for controlling progressing simultaneously the same card game in each of the stations, to execute each of processes from the process of (1) below to the process of (4) below: in the station where personal data of a player or game history of the player is stored in the sub memory by an inputting of the player with the input device before a start of the simultaneous progress of the same card game; (1) generating individual image information or individual sounds information, each information relating to the player, based on the personal data or game history that stored in the sub memory; (2) outputting an image of the individual image information at the sub monitor or outputting sounds of the individual sounds information at the speaker; (3) upon completing an operation of indicating a tip amount for the dealer of the facilitator by the player using the tip indication device: (3-1) including the tip amount to the progressive jackpot prize of the dealer of the facilitator; (3-2) outputting at the sub monitor a designated image informing the player of a combination of predetermined cards that are designated by the dealer of the facilitator or outputting at the speaker designated sounds informing the player of a combination of predetermined cards that are designated by the dealer of the facilitator; (3-3) generating, based on the dealer information stored in the main memory and based on the personal data stored in the sub memory or the game history stored in the sub memory, success rate image information informing the player of a success rate of making the combination of predetermined cards in case that the player plays against the dealer of the facilitator; and (3-4) outputting an image of the success rate image information at the sub monitor; and (4) awarding the progressive jackpot prize of the dealer of the facilitator to the player if the player makes the combination of predetermined cards by cards that are dealt to the player during the same card game.

Furthermore, according to another aspect of the present invention, there is provided a card gaming machine comprising: a main monitor for displaying a card game which is progressed by one of a plurality of dealers; a main memory which stored dealer information relating to each of the dealers; a plurality of progressive jackpot prizes that are provided for each of the dealers; a plurality of stations each provided with: a sub monitor for outputting an image relating to the card game; a speaker for outputting sounds relating to the card game; a tip indication device with which a player indicates a tip amount for the dealer who is a facilitator of the card game; an input device with which a player inputs information which is used to progress the card game; and a sub memory for storing personal data of a player who plays the card game or game history of the player; and a processor which is programmed for awarding a right of changing the dealer of the facilitator to another dealer to one of players who is playing at one of the stations and satisfies a predetermined condition, and which is programmed, for controlling progressing simultaneously the same card game in each of the stations, to execute each of processes from the process of (1) below to the process of (4) below: in the station where personal data of a player or game history of the player is stored in the sub memory by an inputting of the player with the input device before a start of the simultaneous progress of the same card game; (1) generating individual image information or individual sounds information, each information relating to the player, based on the personal data or game history that stored in the sub memory; (2) outputting an image of the individual image information at the sub monitor or outputting sounds of the individual sounds information at the speaker; (3) upon completing an operation of indicating a tip amount for the dealer of the facilitator by the player using the tip indication device: (3-1) including the tip amount to the progressive jackpot prize of the dealer of the facilitator; (3-2) outputting at the sub monitor a designated image informing the player of a combination of predetermined cards that are designated by the dealer of the facilitator or outputting at the speaker designated sounds informing the player of a combination of predetermined cards that are designated by the dealer of the facilitator; (3-3) generating, based on the dealer information stored in the main memory and based on the personal data stored in the sub memory or the game history stored in the sub memory, success rate image information informing the player of a success rate of making the combination of predetermined cards in case that the player plays against the dealer of the facilitator; (3-4) generating, based on the personal data or game history that stored in the sub memory, specific image information which included a message being able to identify the player; (3-5) generating a composite image which included an image of the specific image information in an image of the success rate image information; and (3-6) outputting at the sub monitor the composite image; and (4) awarding the progressive jackpot prize of the dealer of the facilitator to the player if the player makes the combination of predetermined cards by cards that are dealt to the player during the same card game.

To achieve all of the objects of the present invention, there is provided a gaming machine comprises a display device that displays a screen of a game dealt by a dealer; a tipping operation device that receives an operation of giving the dealer a tip by a player; a memory device that stores one of personal data and a gaming history of the player; and a processor that executes processes as follows: (a) a process of accepting the operation of giving the tip by the player based on an operation of the tipping operation device; (b) a process of reading from the memory device one of the personal data and the gaming history of a tip-giver player who has given the tip to the dealer; and (c) a process of displaying on the display device an image in which the dealer acts in accordance with one of the personal data and the gaming history of the tip-giver player that is read from the memory device.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention.

FIG. 10 is a view showing a virtual dealer's behavior pattern displayed on a gaming machine according to one embodiment of the present invention;

The accompanying drawings, which are incorporated in and constitute a part of this specification illustrate embodiments of the invention and, together with the description, serve to explain the objects, advantages and principles of the invention.

Figure 15:
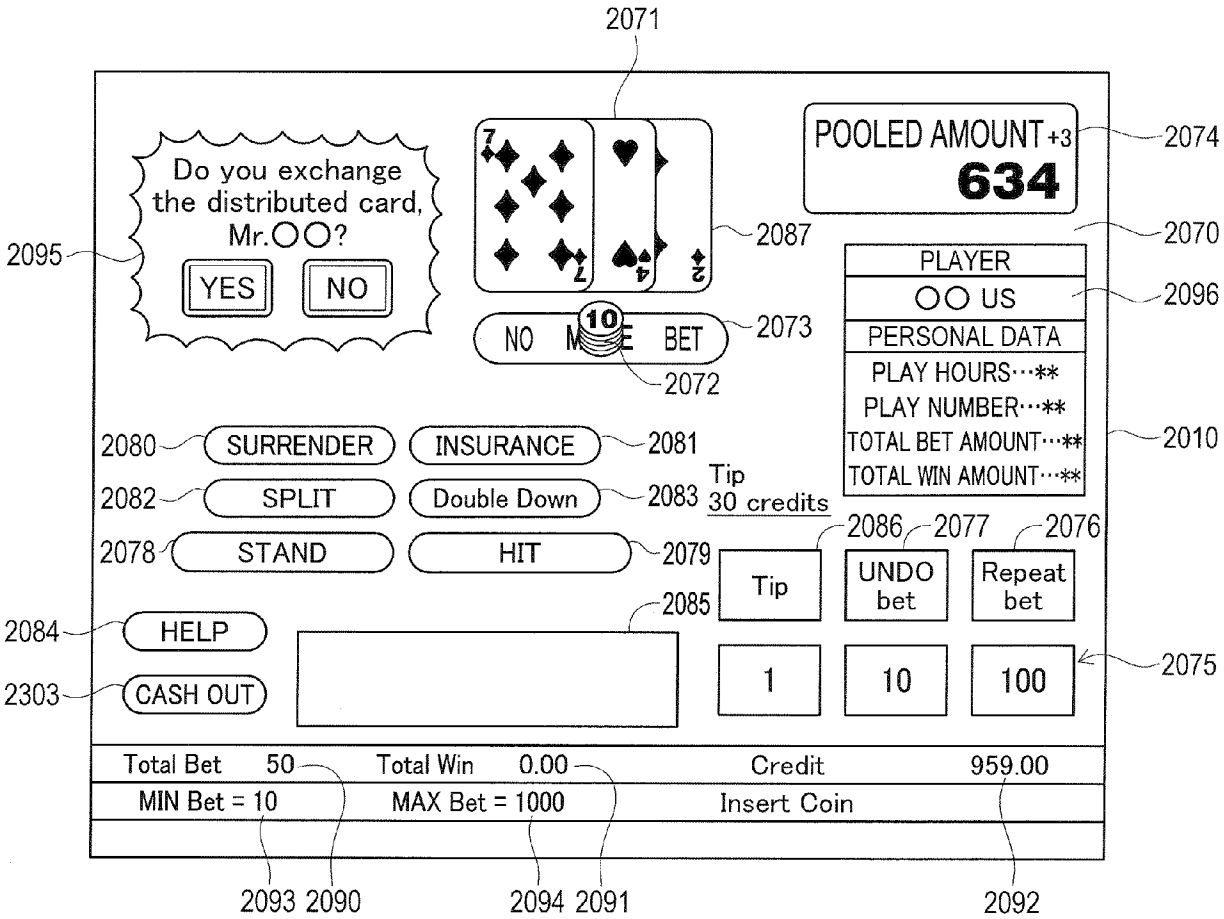
Figure 16:
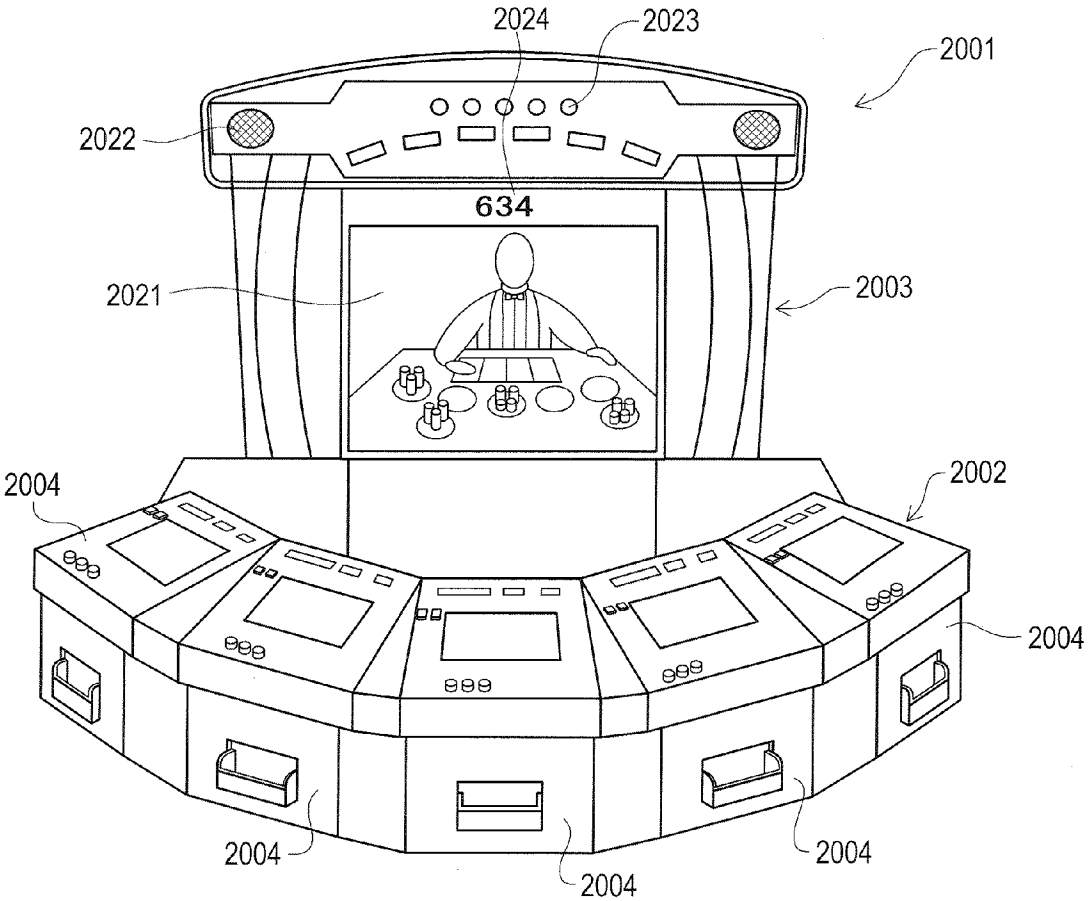
Figure 17:
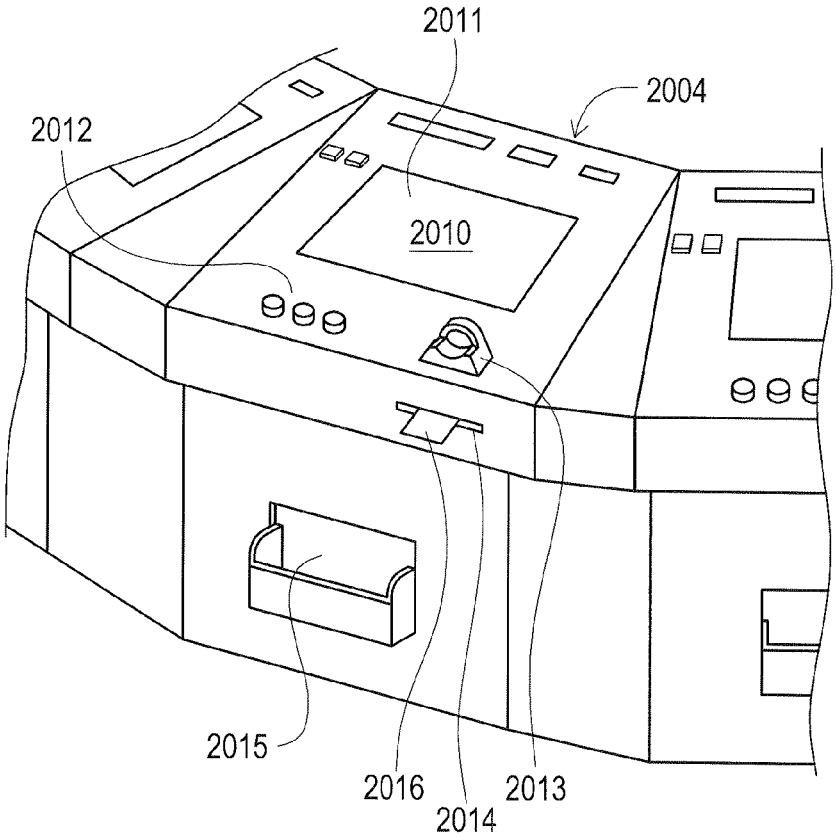
Figure 18:
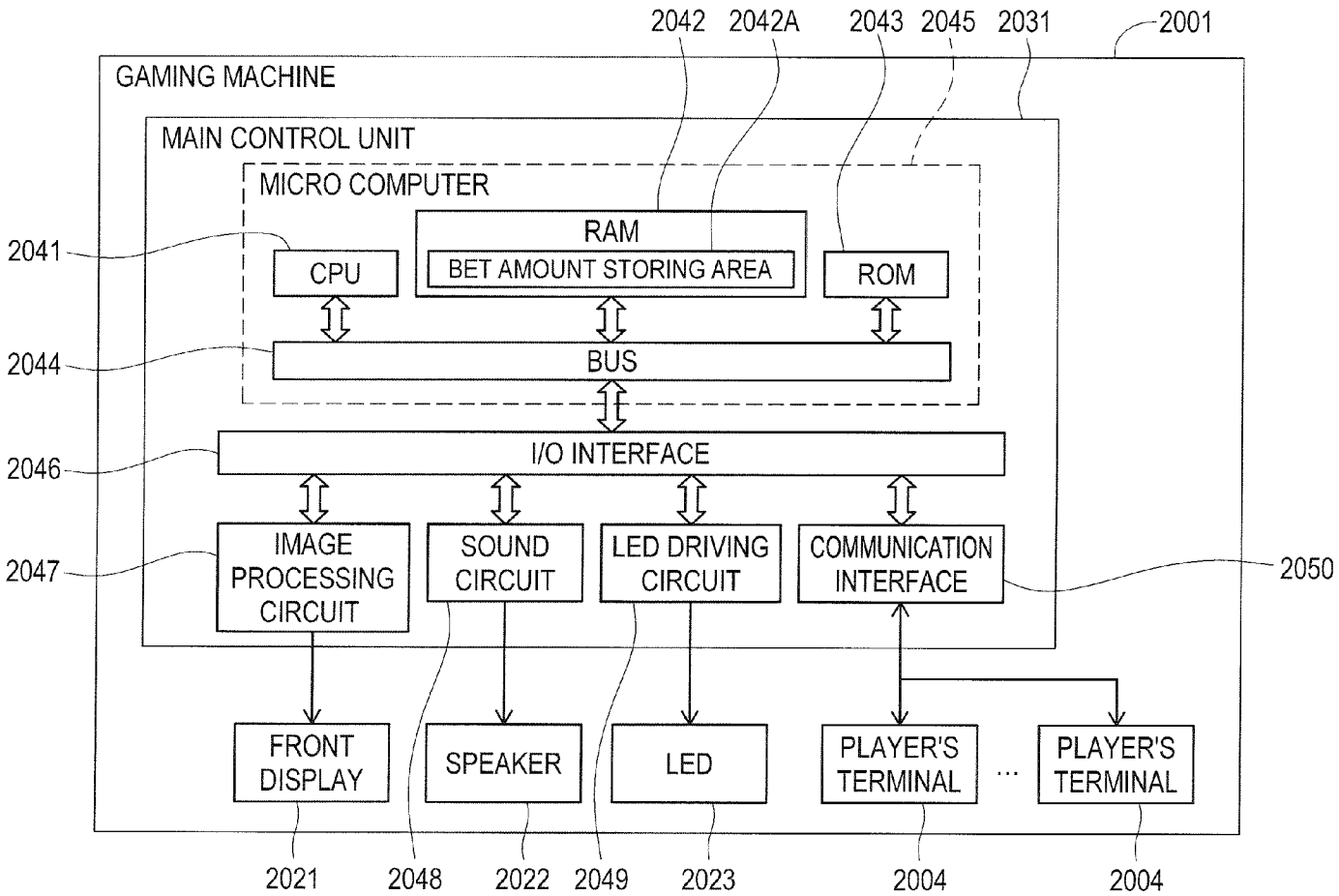
Figure 19:
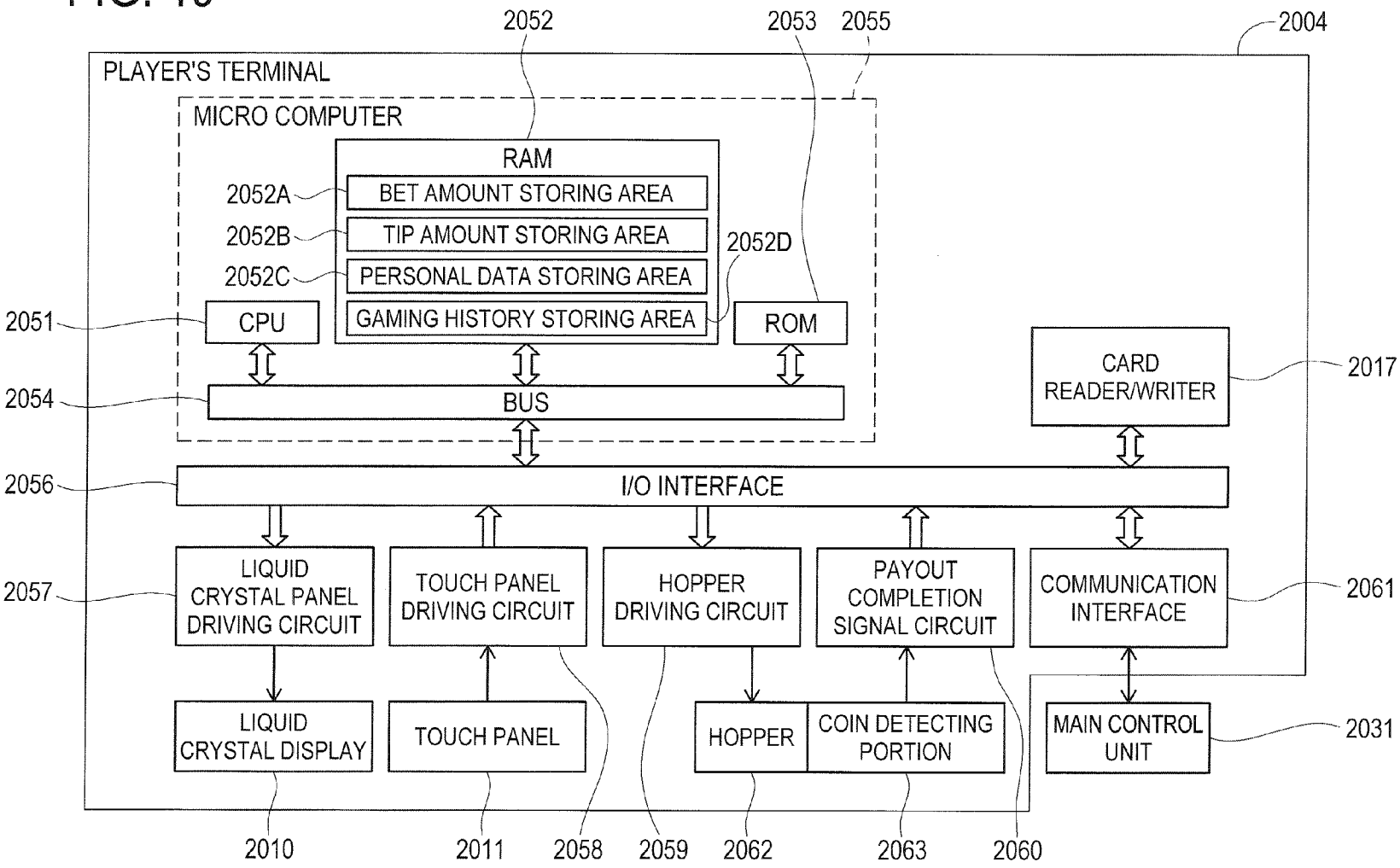
Figure 20:
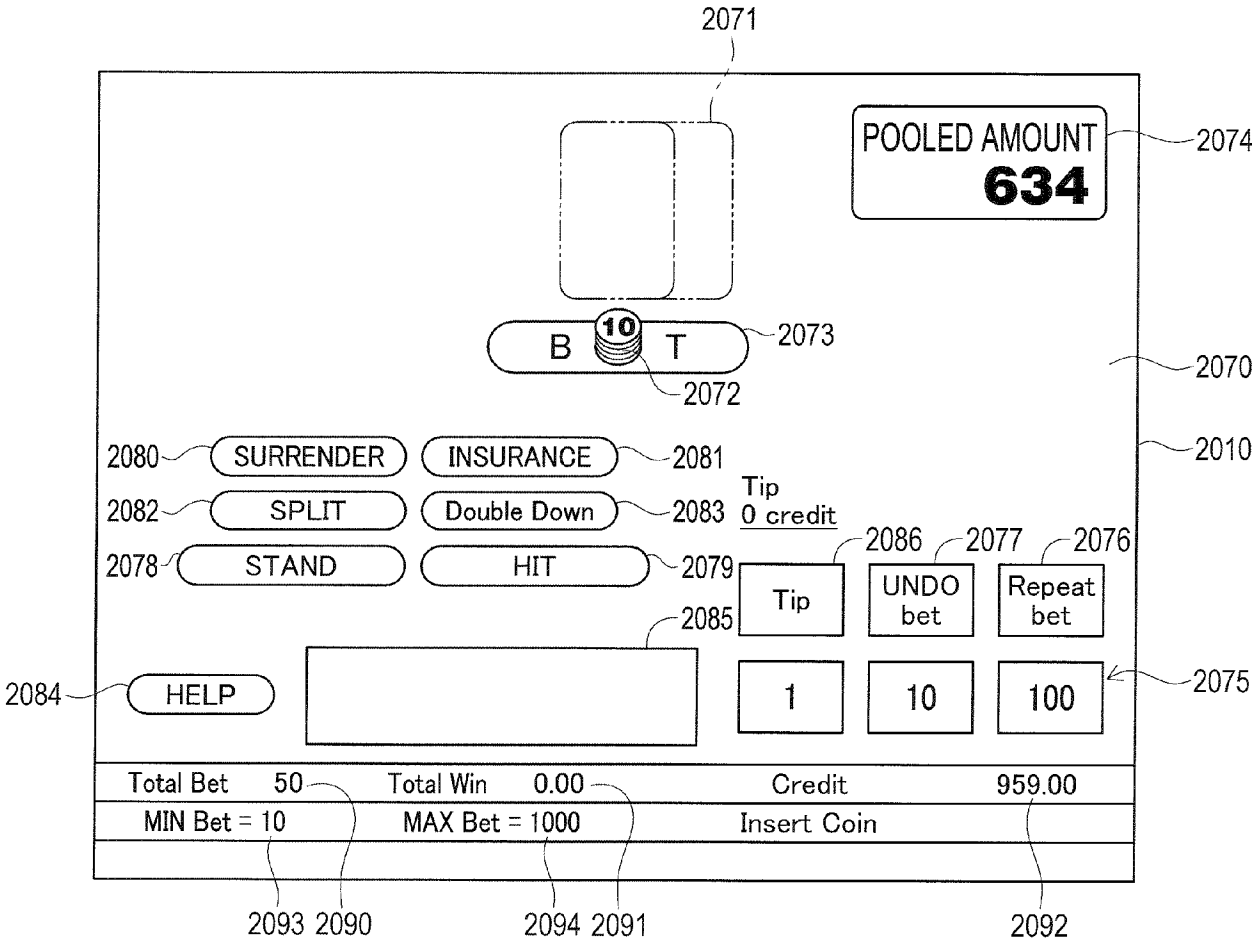
Figure 21:
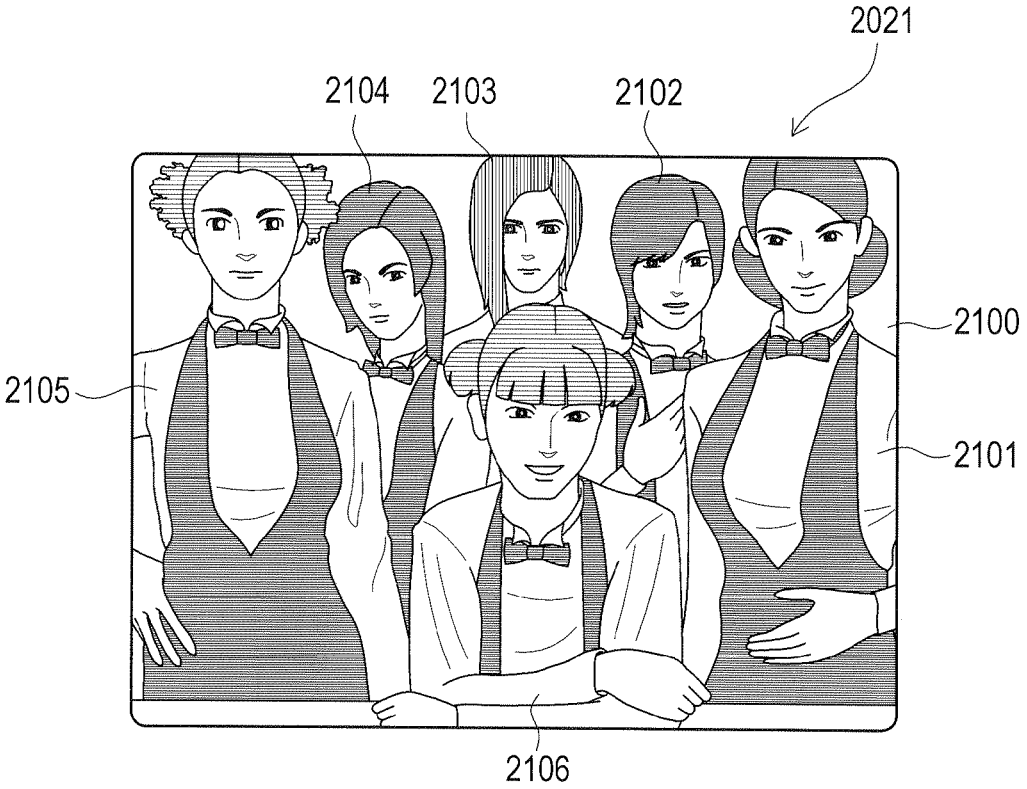
Figure 22:
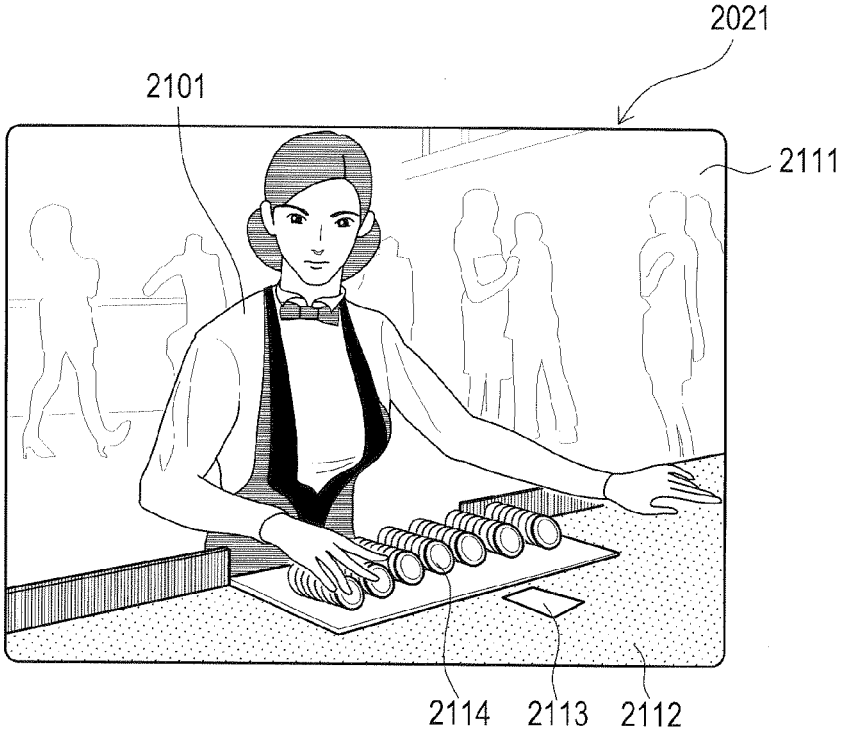
Figure 23:
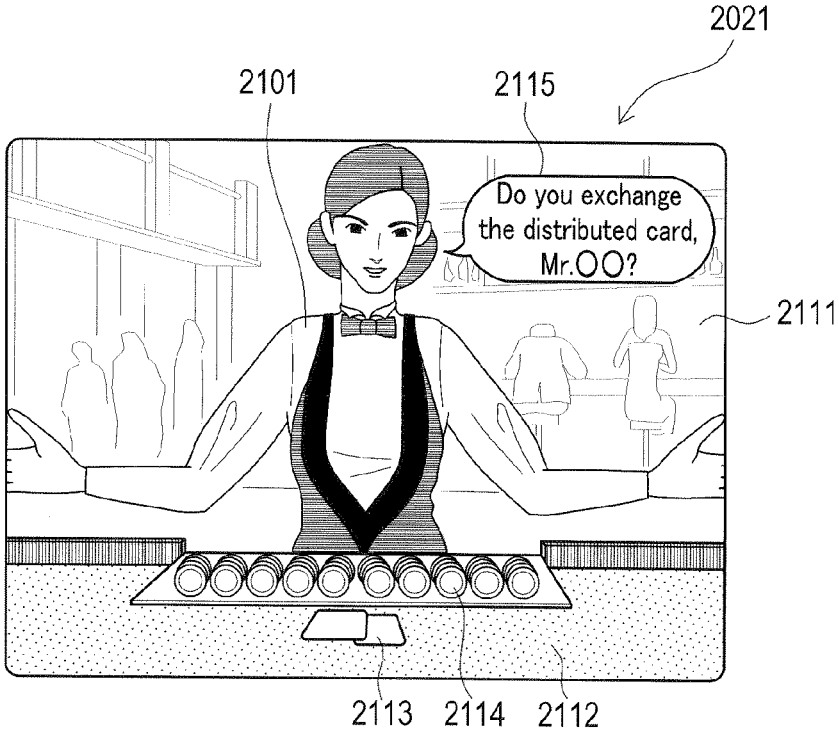
Figure 25:
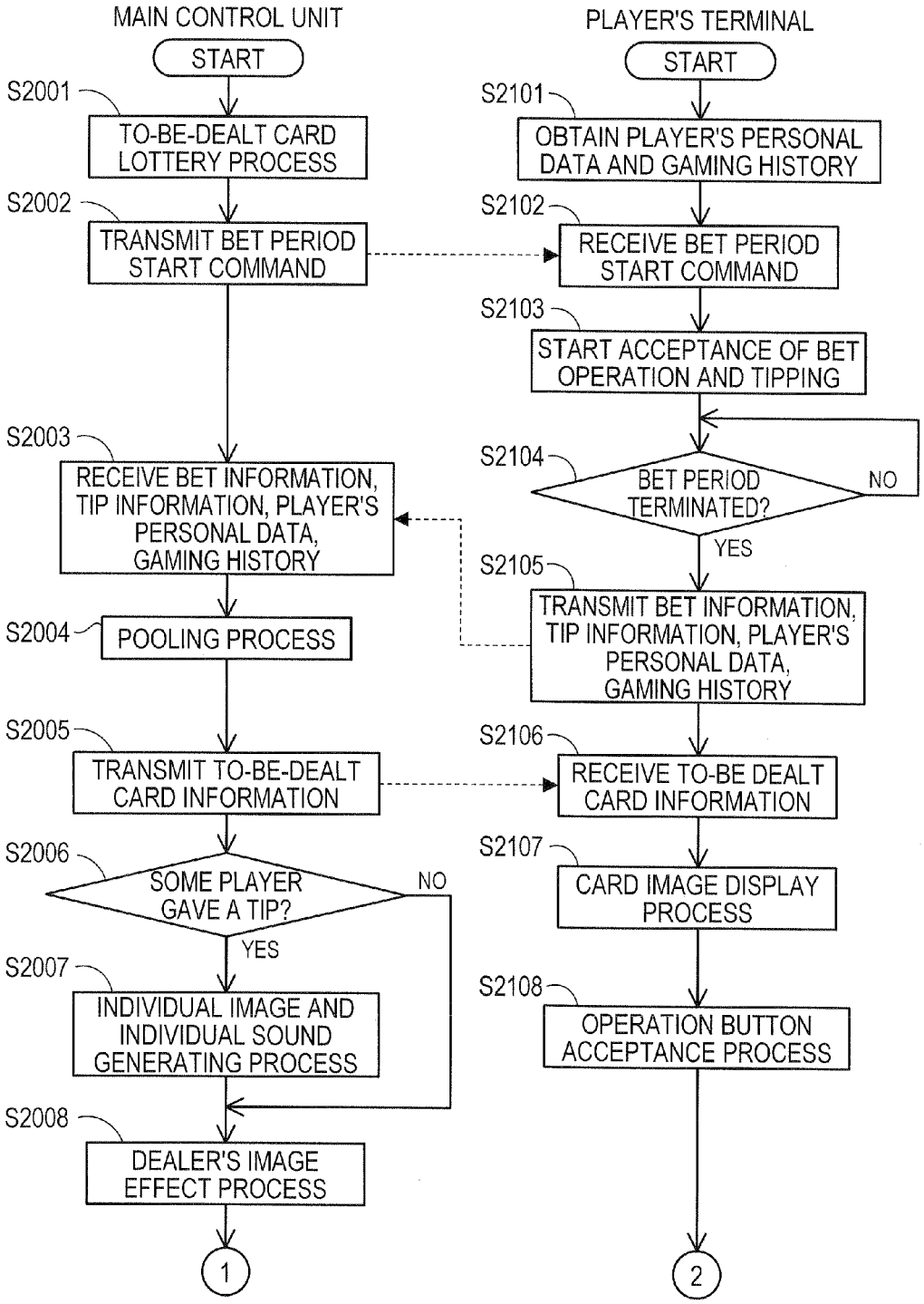
Figure 26:
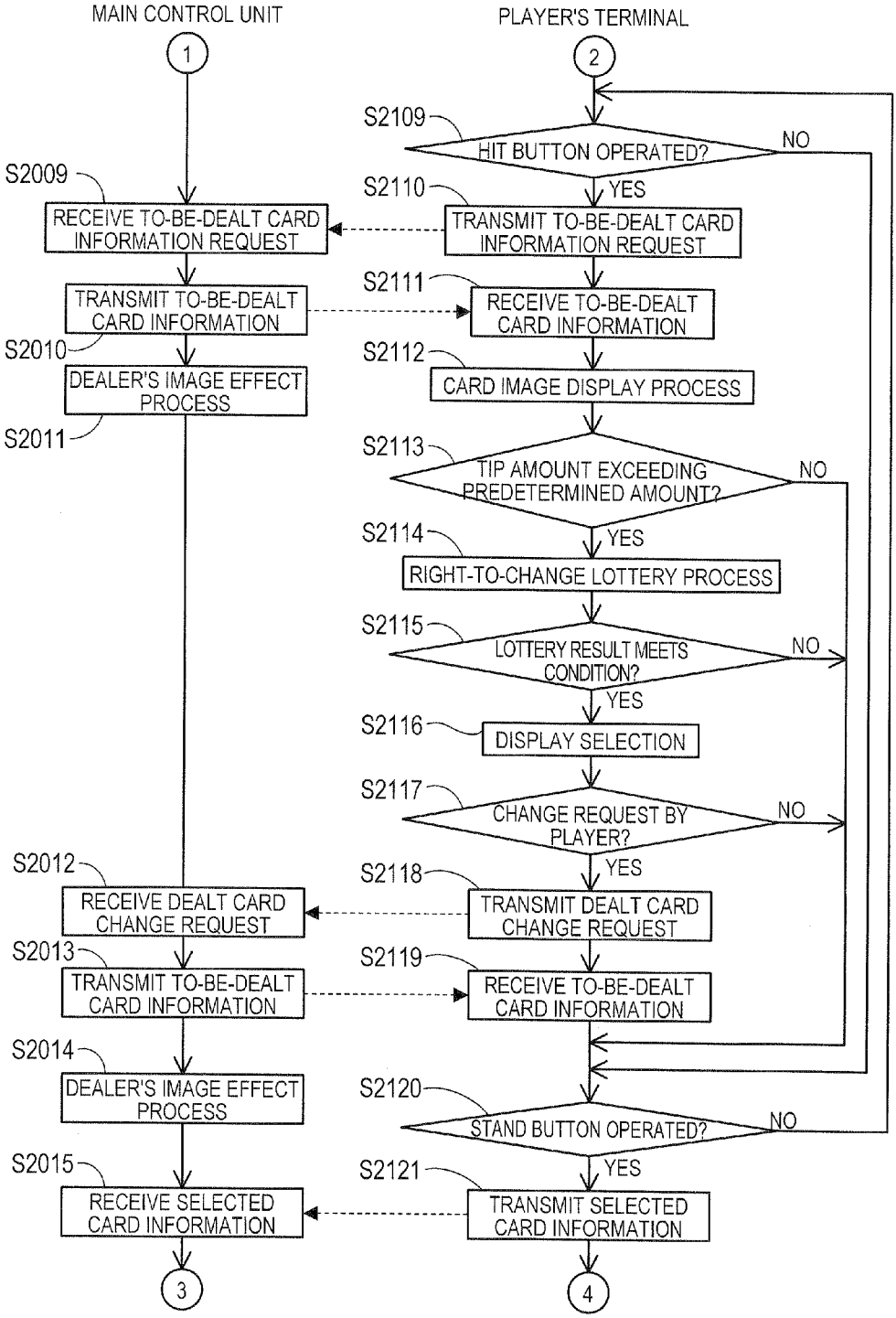
Figure 27:
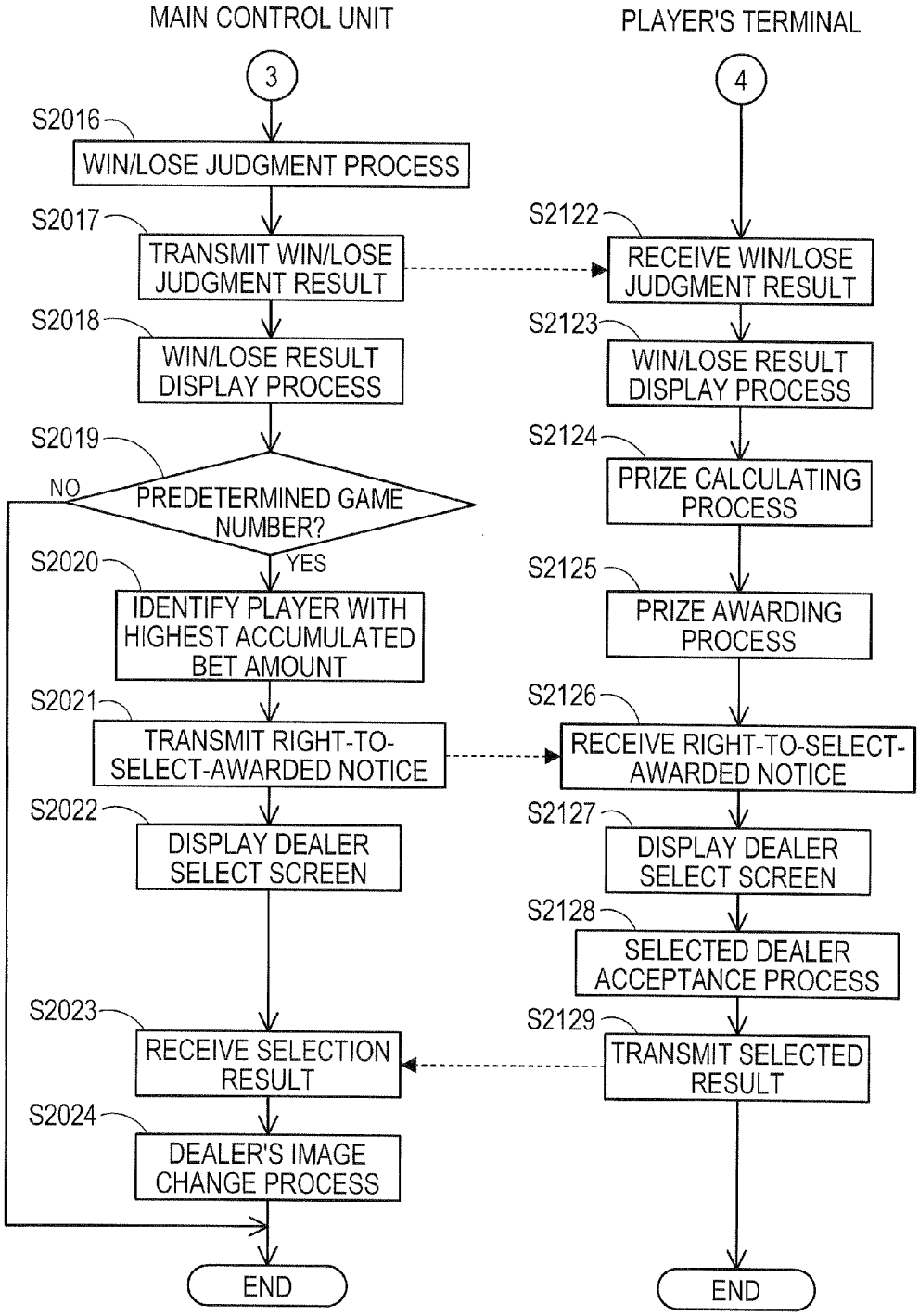
Figure 29:
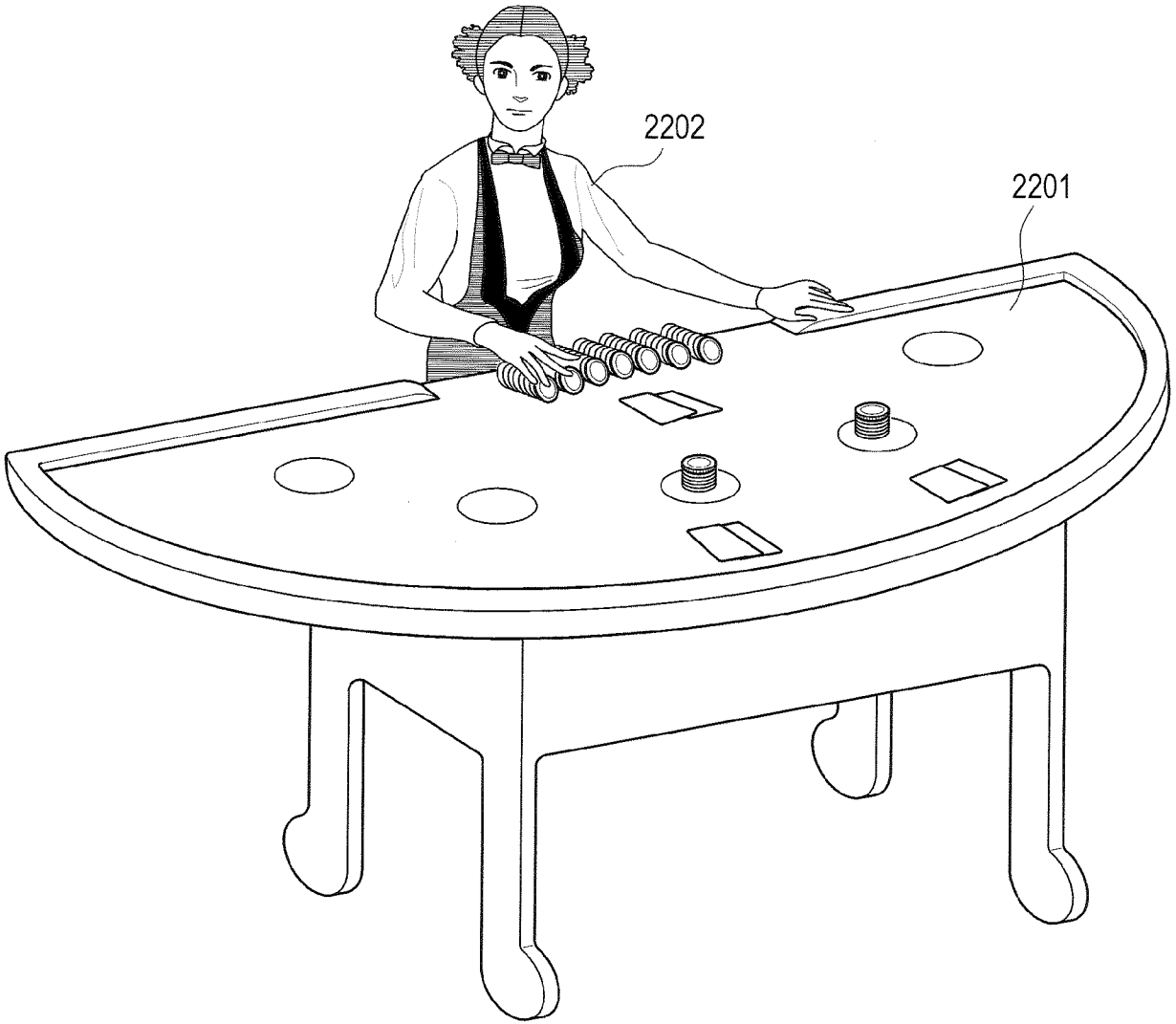

FIG. 15 is a view showing a bet screen which is displayed on a liquid crystal display in a player's terminal according to one embodiment of the present invention;

FIG. 16 is an external view of a gaming machine according to one embodiment of the present invention;

FIG. 17 is an external view of a player's terminal according to one embodiment of the present invention;

FIG. 18 is an explanatory view showing a control system of a gaming machine according to one embodiment of the present invention;

FIG. 19 is an explanatory view concerning a control system of a player's terminal according to one embodiment of the present invention;

FIG. 20 is a view showing a bet screen which is displayed on a liquid crystal display in a player's terminal according to one embodiment of the present invention;

FIG. 21 is a view showing a dealer select screen which is displayed on a front display according to one embodiment of the present invention;

FIG. 22 is a view showing an image of a virtual dealer displayed on a gaming machine according to one embodiment of the present invention;

FIG. 23 is a view showing an image of a virtual dealer displayed on a gaming machine according to one embodiment of the present invention;

FIG. 24 is a view showing a virtual dealer's behavior pattern displayed on a gaming machine according to one embodiment of the present invention;

FIG. 25 is a flowchart of a game process program according to one embodiment of the present invention;

FIG. 26 is a flowchart of a game process program according to one embodiment of the present invention;

FIG. 27 is a flowchart of a game process program according to one embodiment of the present invention;

FIG. 28 is a lottery table used by a gaming machine according to one embodiment of the present invention; and FIG. 29 is an example of a gaming table applied to the present invention.

The accompanying drawings, which are incorporated in and constitute a part of this specification illustrate embodiments of the invention and, together with the description, serve to explain the objects, advantages and principles of the invention.

Figure 30:
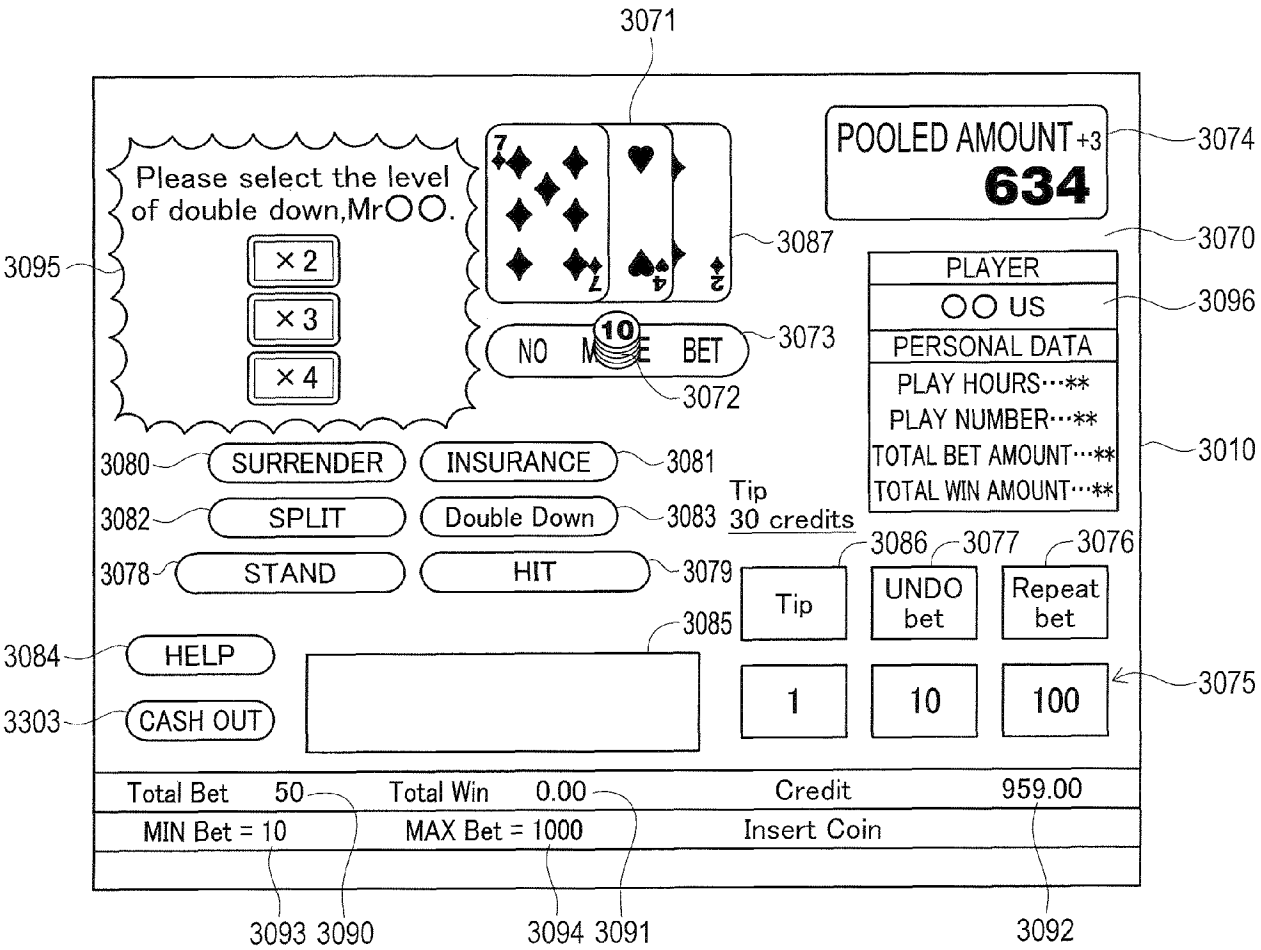
Figure 31:
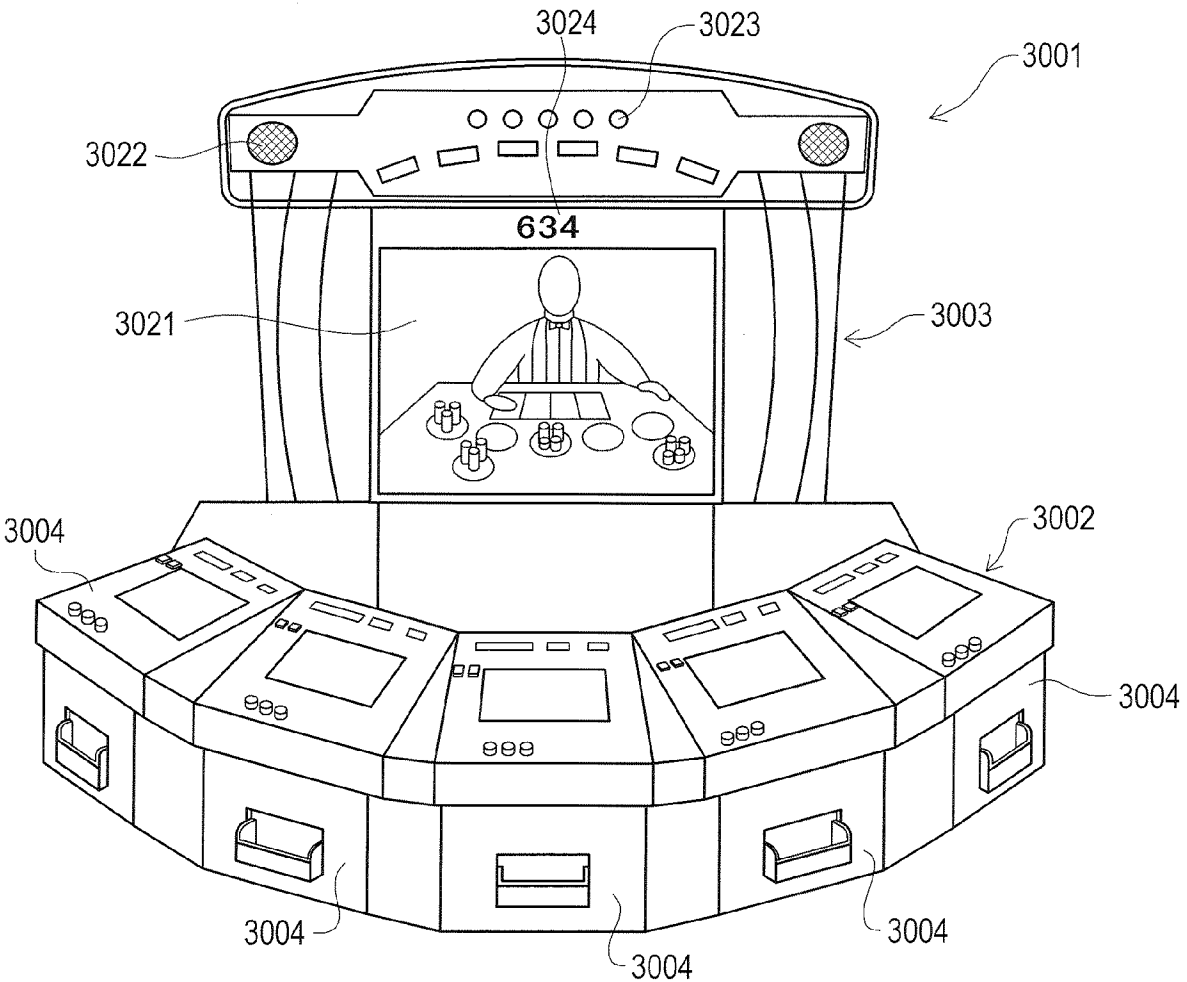
Figure 32:
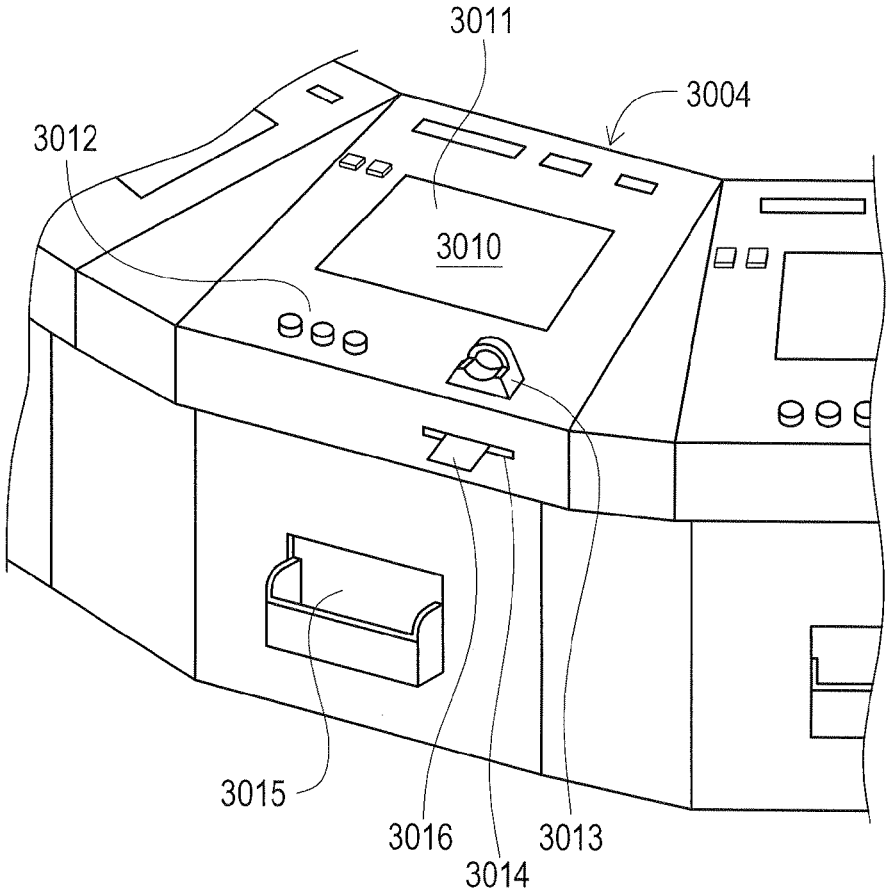
Figure 33:
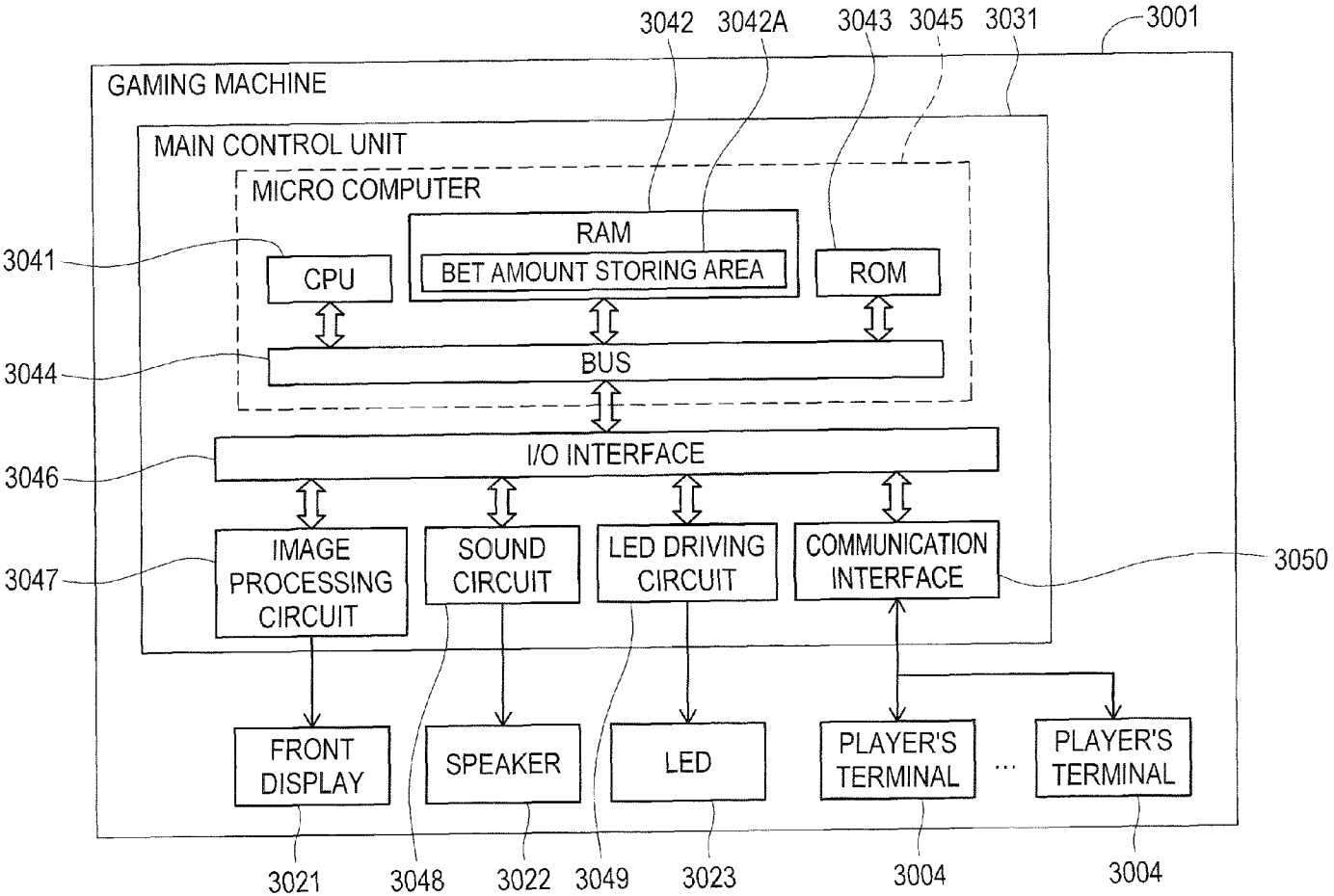
Figure 34:
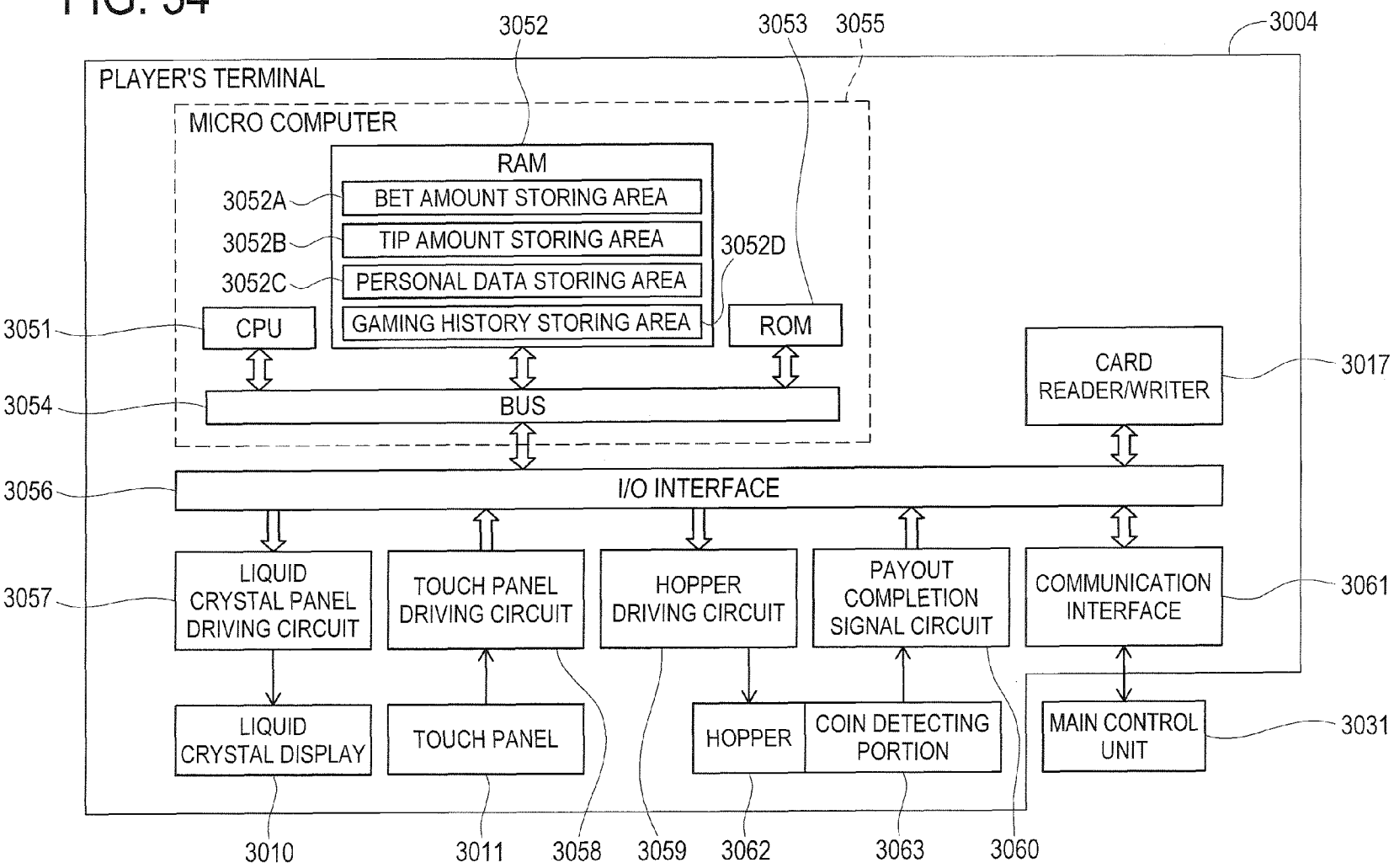
Figure 35:
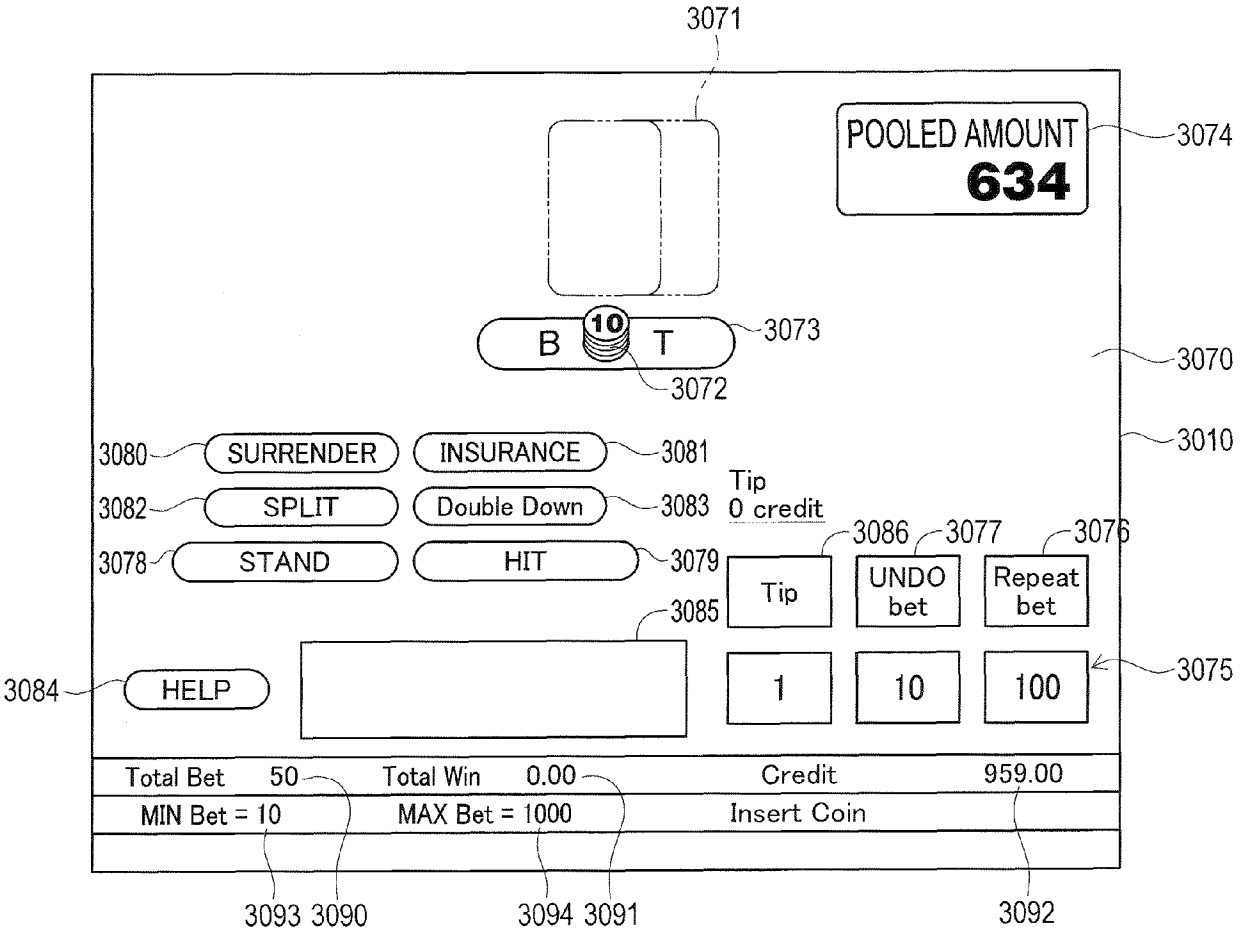
Figure 36:
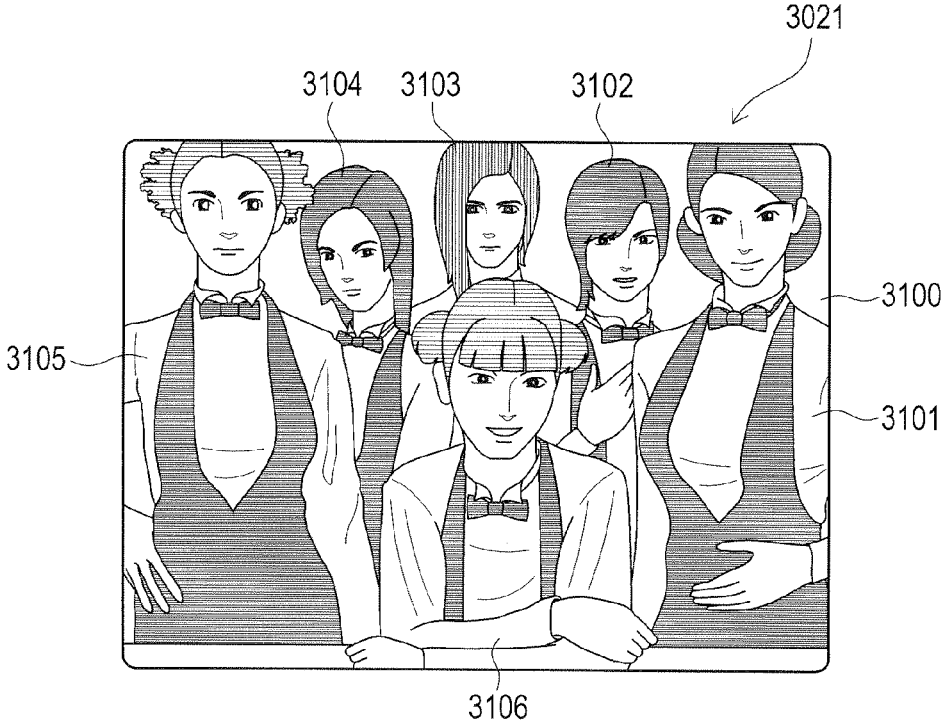
Figure 37:
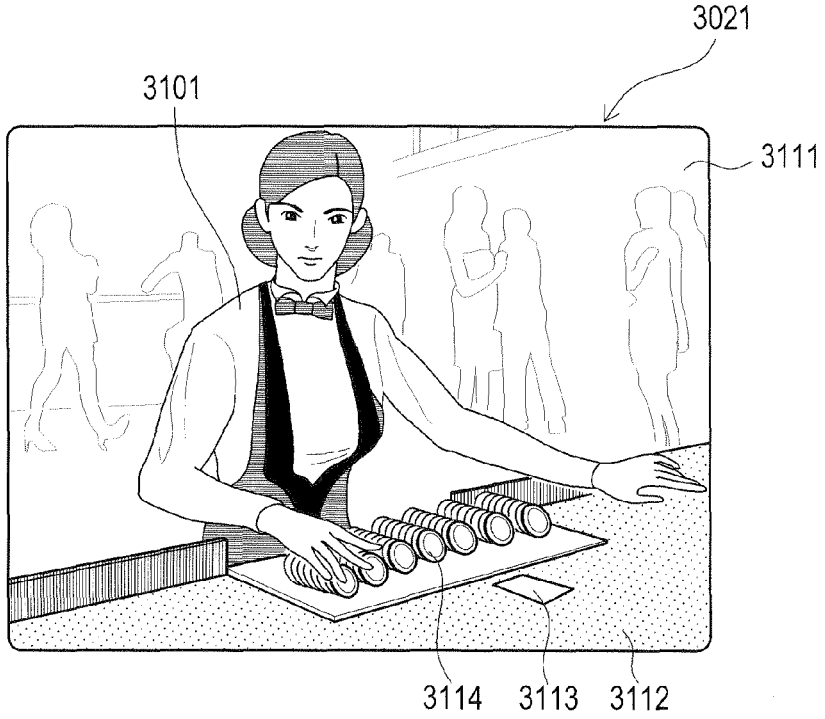
Figure 38:
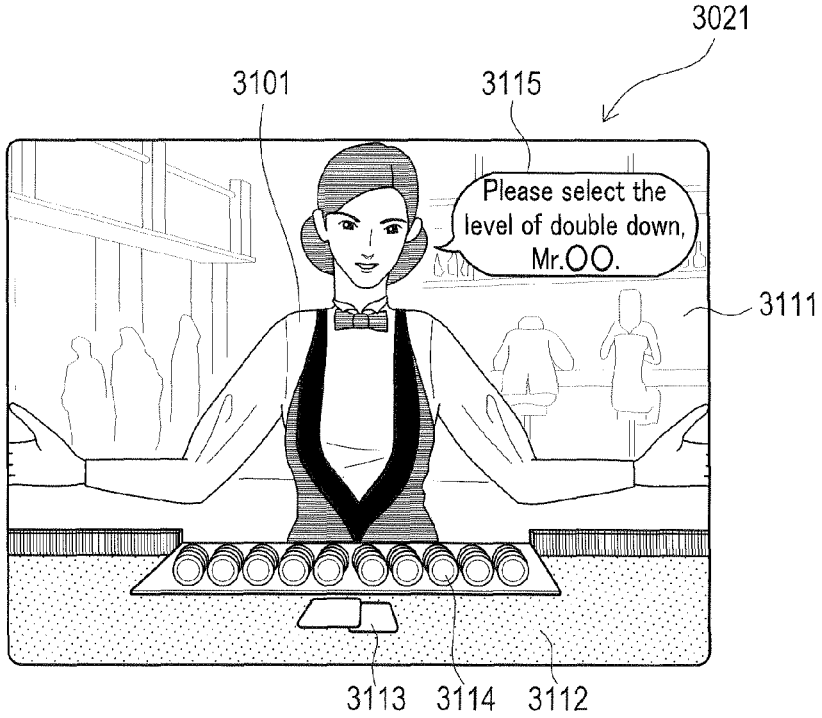
Figure 40:
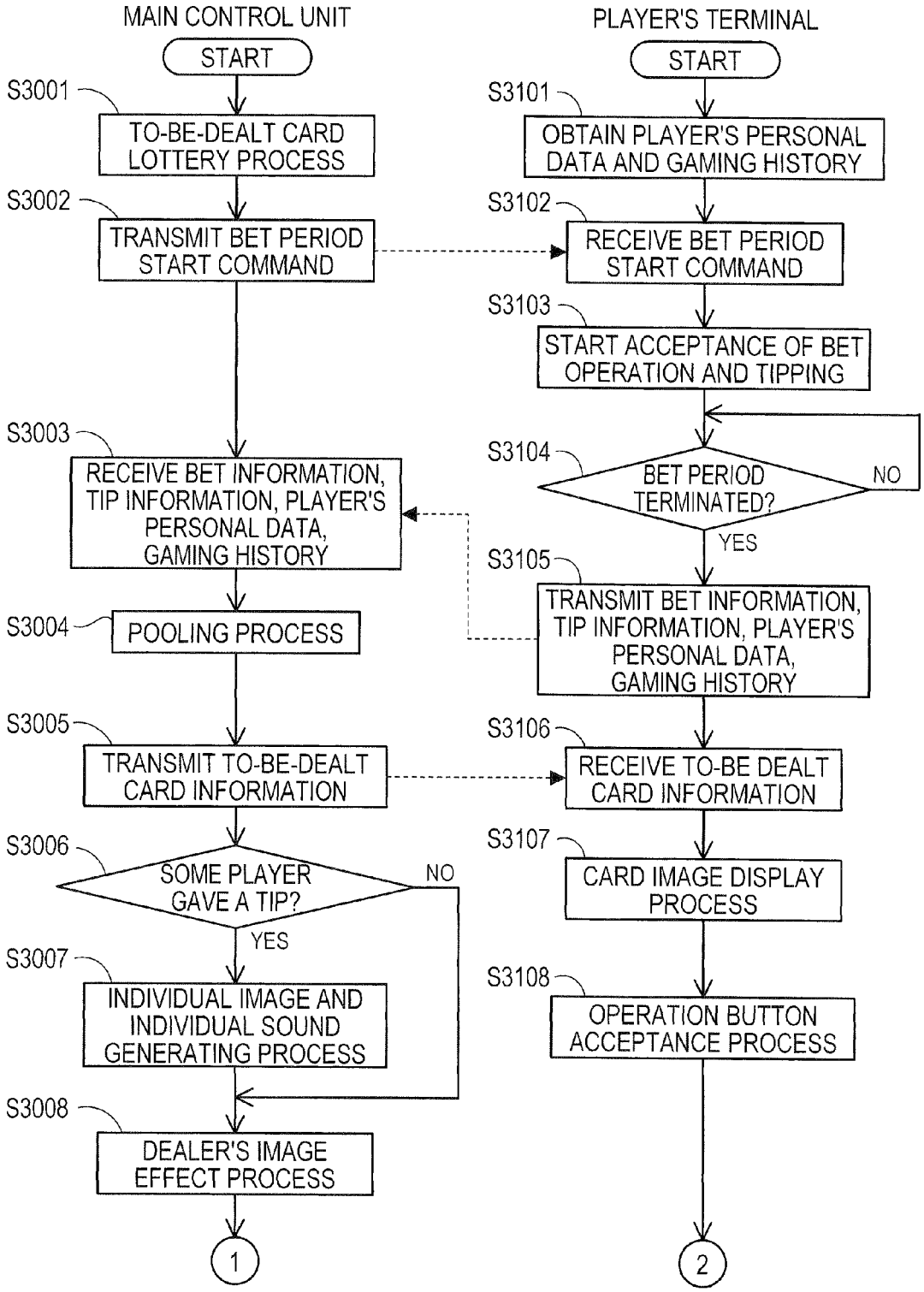
Figure 41:
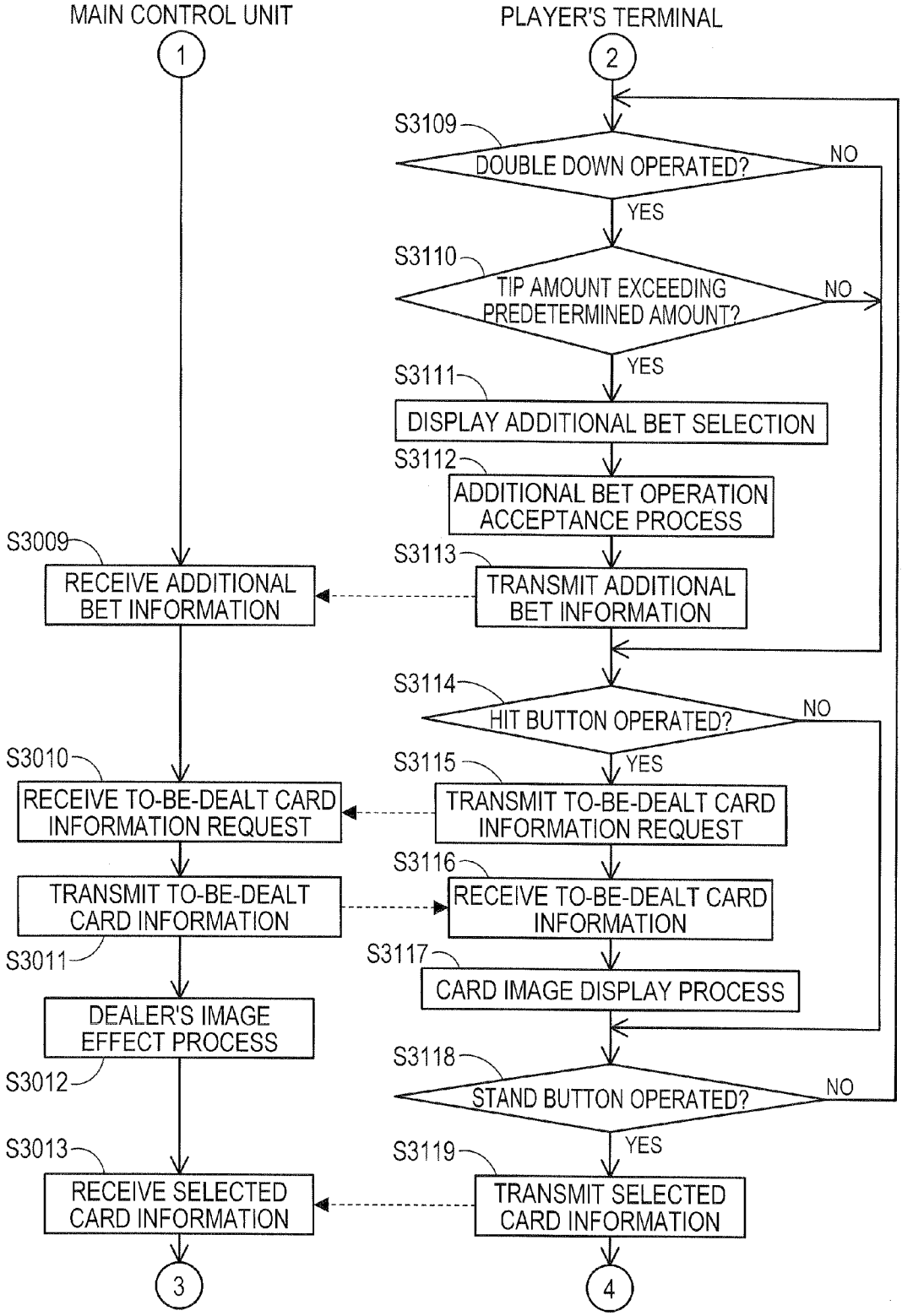
Figure 42:
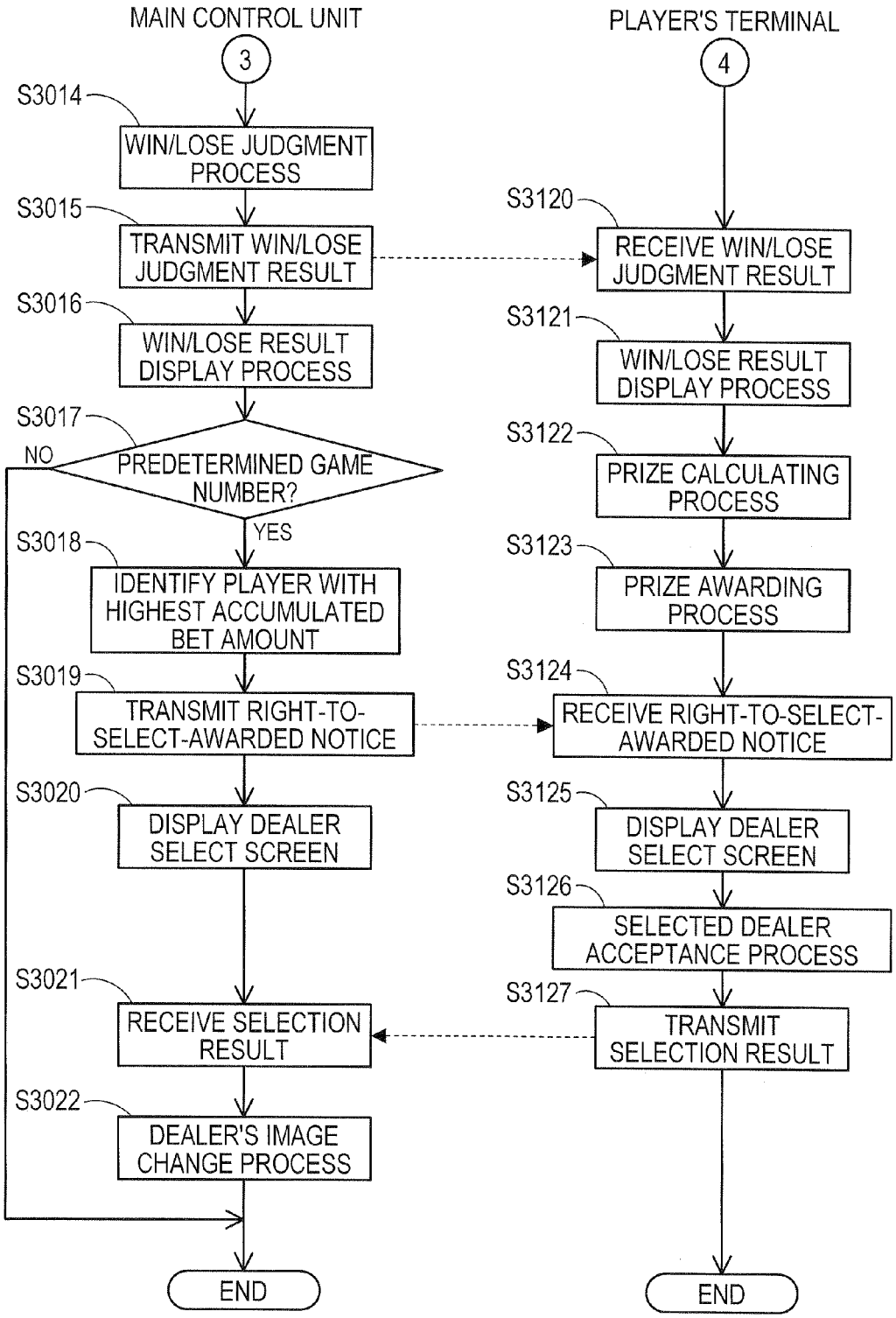
Figure 43:
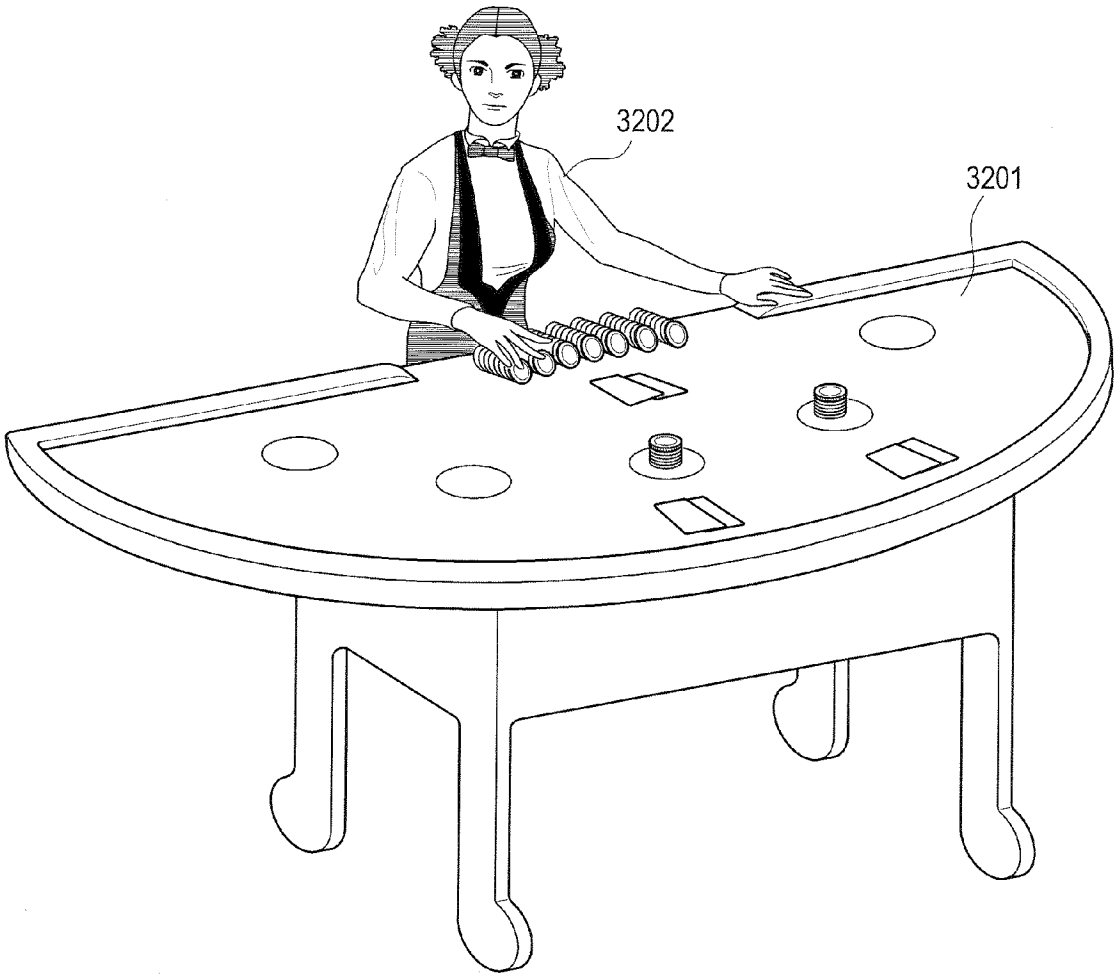

FIG. 30 is a view showing a bet screen which is displayed on a liquid crystal display in a player's terminal according to one embodiment of the present invention;

FIG. 31 is an external view of a gaming machine according to one embodiment of the present invention;

FIG. 32 is an external view of a player's terminal according to one embodiment of the present invention;

FIG. 33 is an explanatory view showing a control system of a gaming machine according to one embodiment of the present invention;

FIG. 34 is an explanatory view concerning a control system of a player's terminal according to one embodiment of the present invention;

FIG. 35 is a view showing a bet screen which is displayed on a liquid crystal display in a player's terminal according to one embodiment of the present invention;

FIG. 36 is a view showing a dealer select screen which is displayed on a front display according to one embodiment of the present invention;

FIG. 37 is a view showing an image of a virtual dealer displayed on a gaming machine according to one embodiment of the present invention;

FIG. 38 is a view showing an image of a virtual dealer displayed on a gaming machine according to one embodiment of the present invention;

FIG. 39 is a view showing a virtual dealer's behavior pattern displayed on a gaming machine according to one embodiment of the present invention;

FIG. 40 is a flowchart of a game process program according to one embodiment of the present invention;

FIG. 41 is a flowchart of a game process program according to one embodiment of the present invention;

FIG. 42 is a flowchart of a game process program according to one embodiment of the present invention;

FIG. 43 is an example of a gaming table applied to the present invention.

Figure 44:
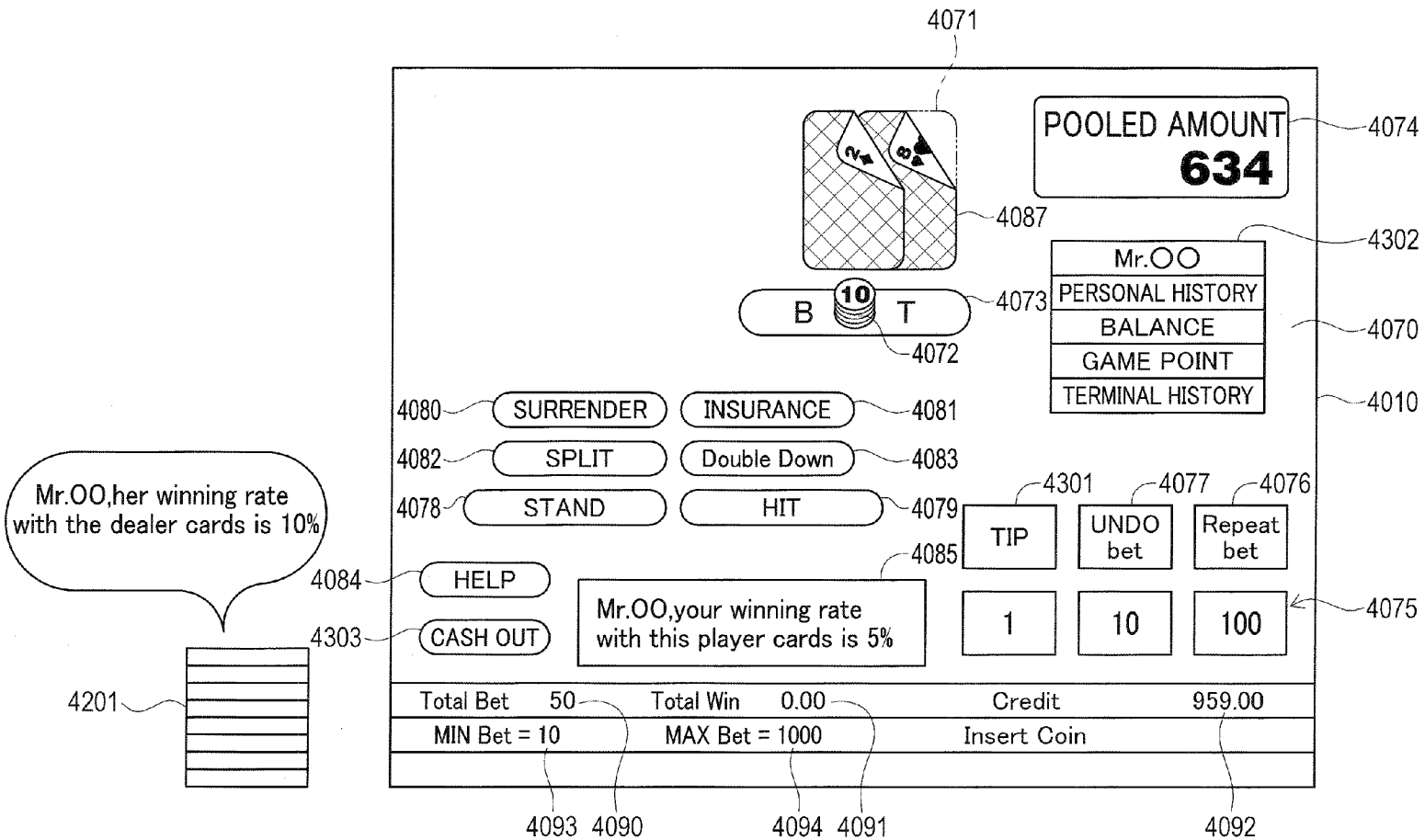
Figure 45:
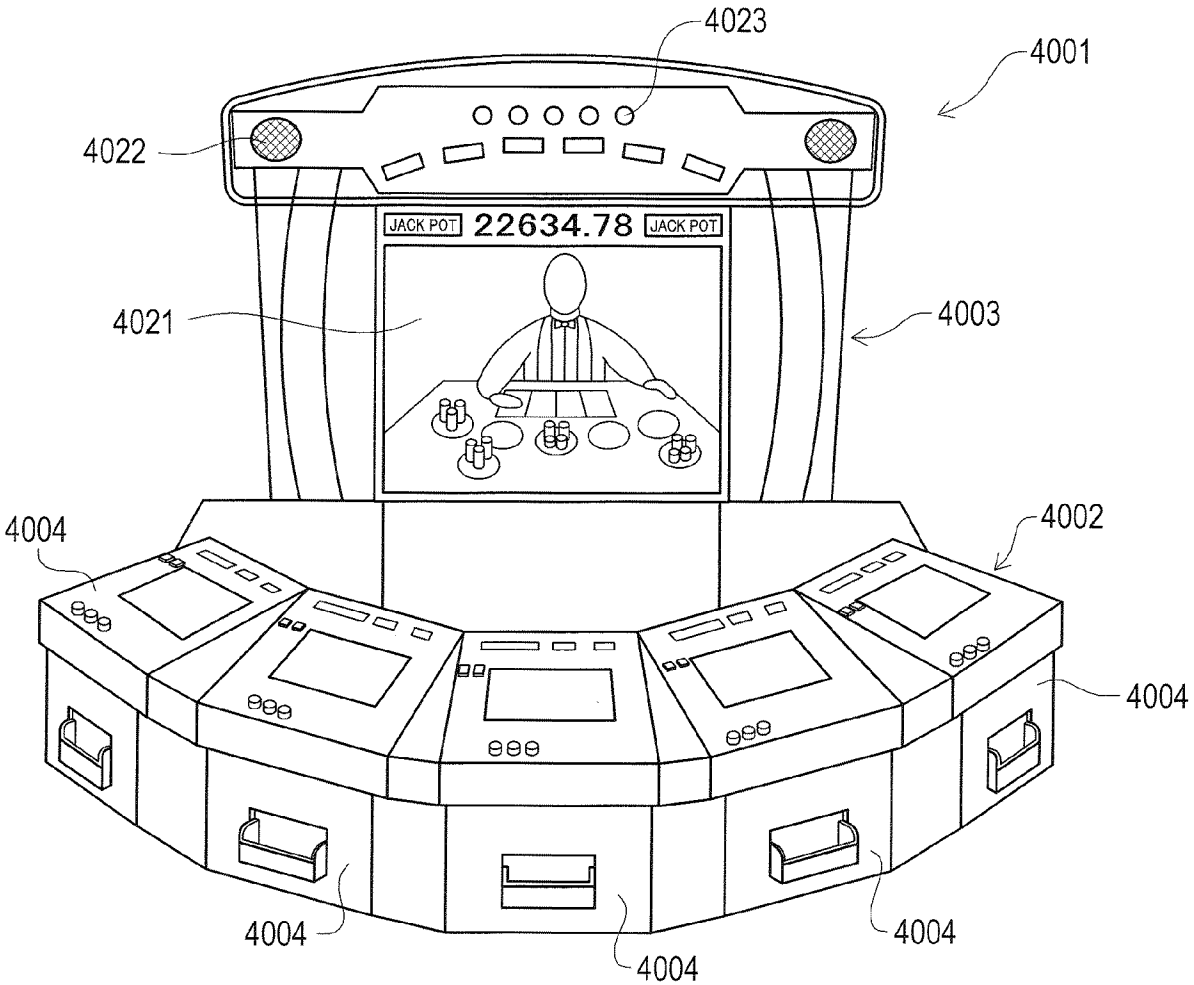
Figure 46:
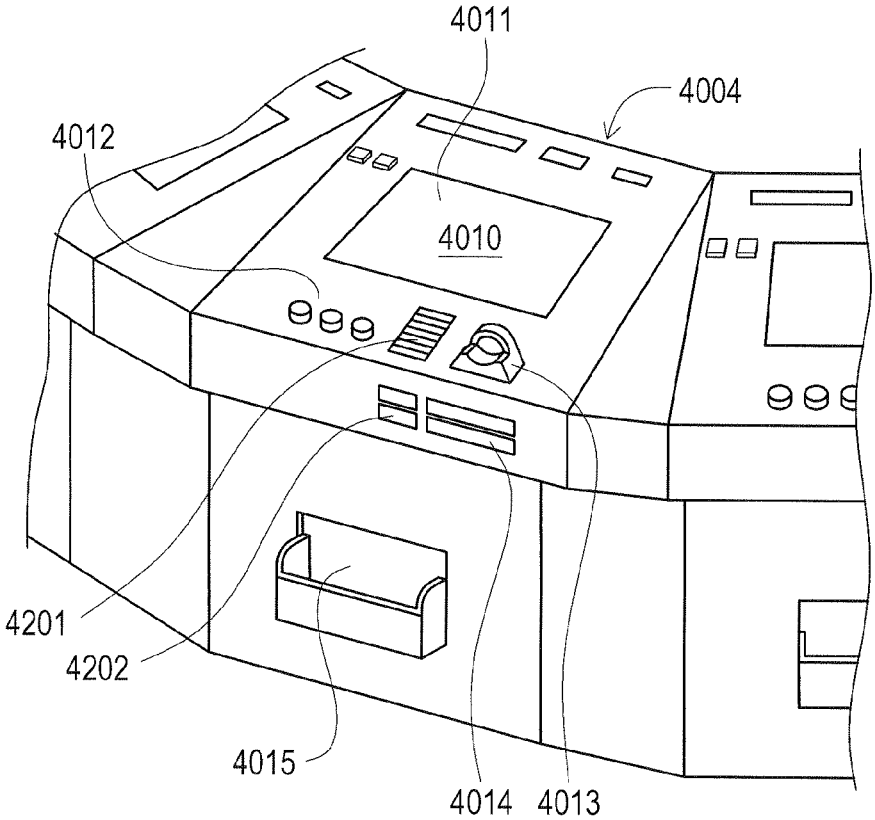
Figure 47:
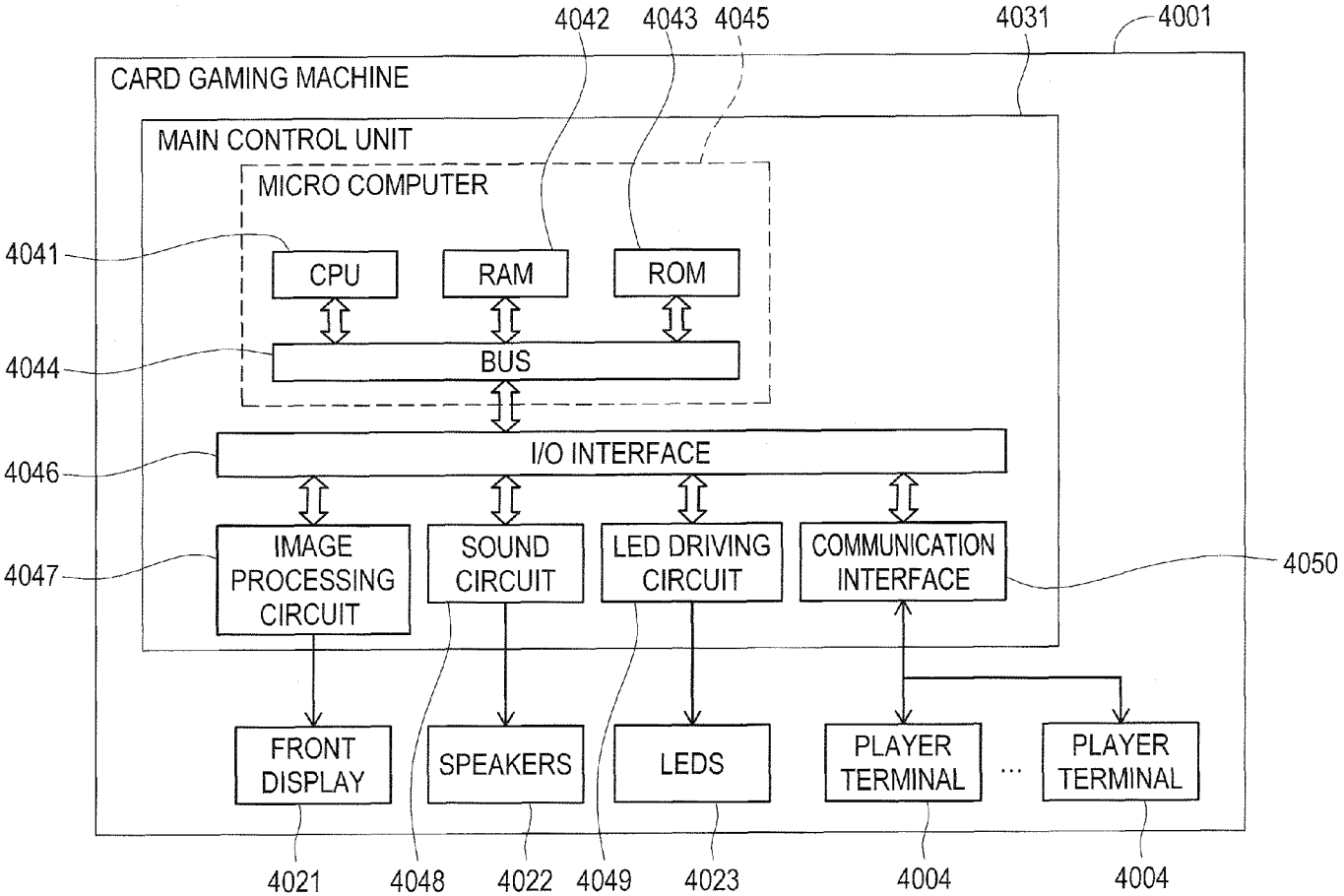
Figure 48:
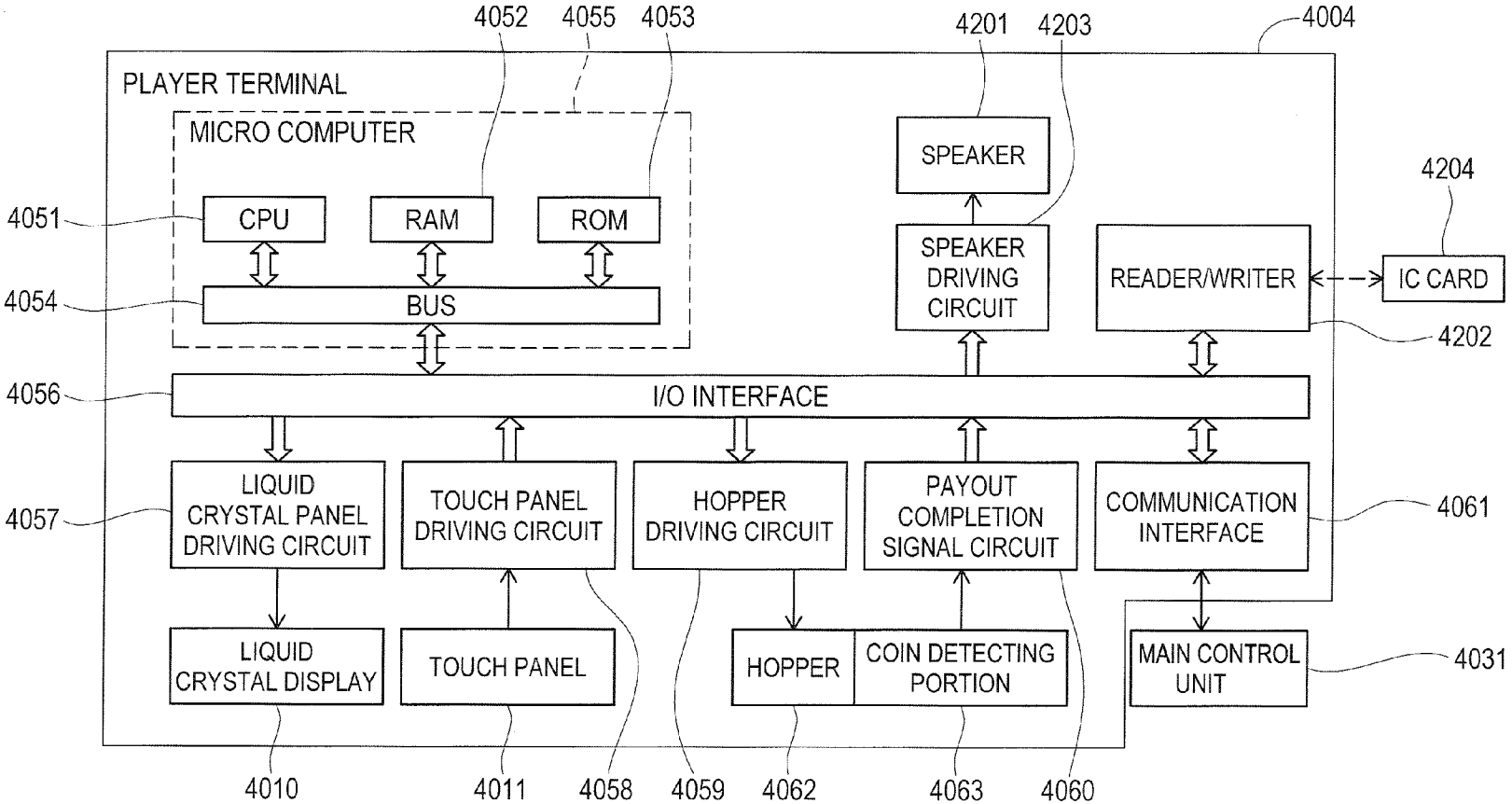
Figure 49:
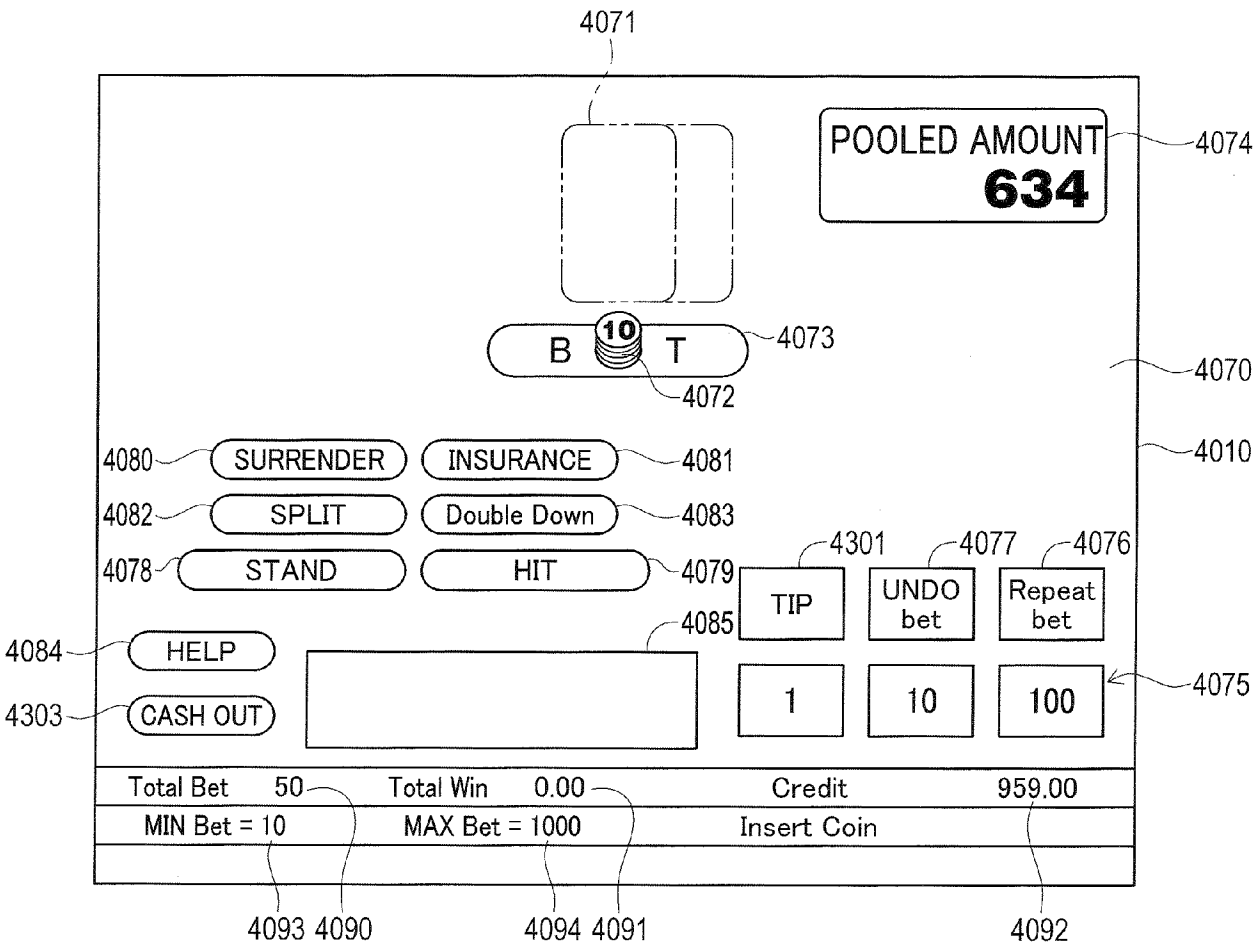
Figure 50:
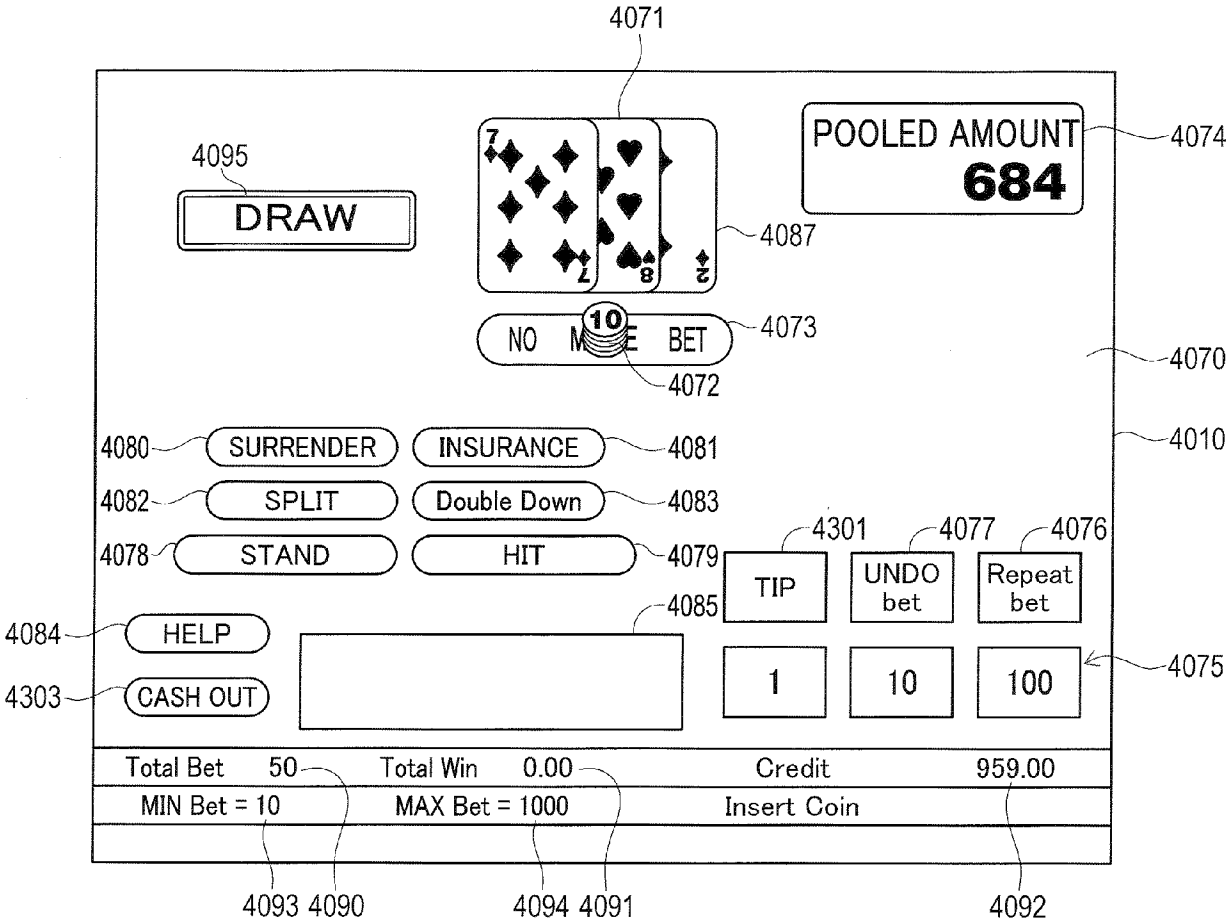
Figure 51:
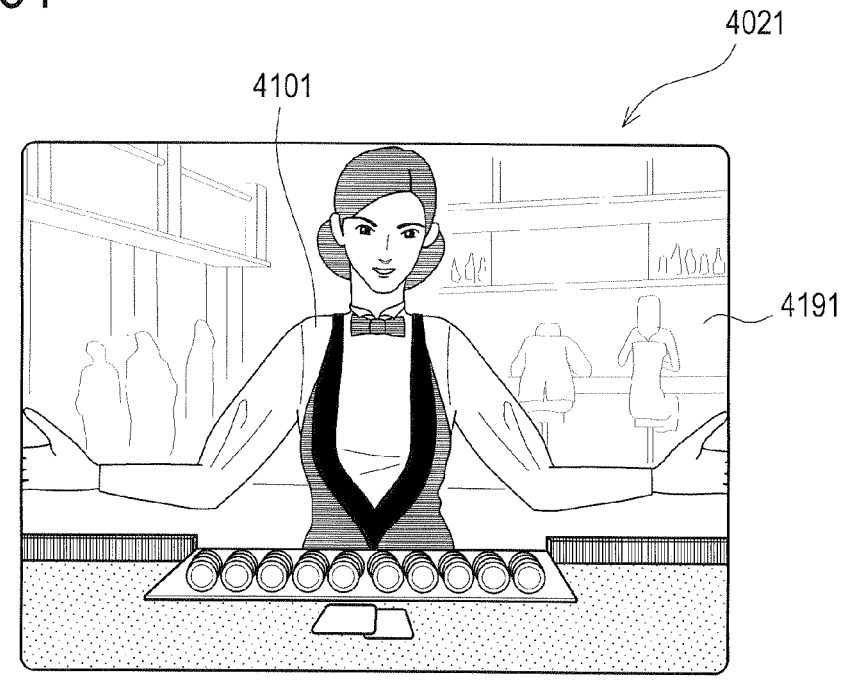

FIG. 44 is a view showing characteristics of a card gaming machine of one fourth embodiment of the present invention and an explanatory view showing a bet screen displayed on a liquid crystal display of a player terminal which the card gaming machine has;

FIG. 45 is an outline view of the card gaming machine;

FIG. 46 is an outline view of a player terminal which the card gaming machine has;

FIG. 47 is a block diagram schematically showing a control system of the card gaming machine;

FIG. 48 is a block diagram schematically showing a control system of a player terminal which the card gaming machine has;

FIG. 49 is an explanatory view showing a bet screen displayed on a liquid crystal display of a player terminal which the card gaming machine has;

FIG. 50 is an explanatory view showing a bet screen displayed on a liquid crystal display of a player terminal which the card gaming machine has;

FIG. 51 is a view showing a main screen of a case that the first dealer is selected.

Figure 52:
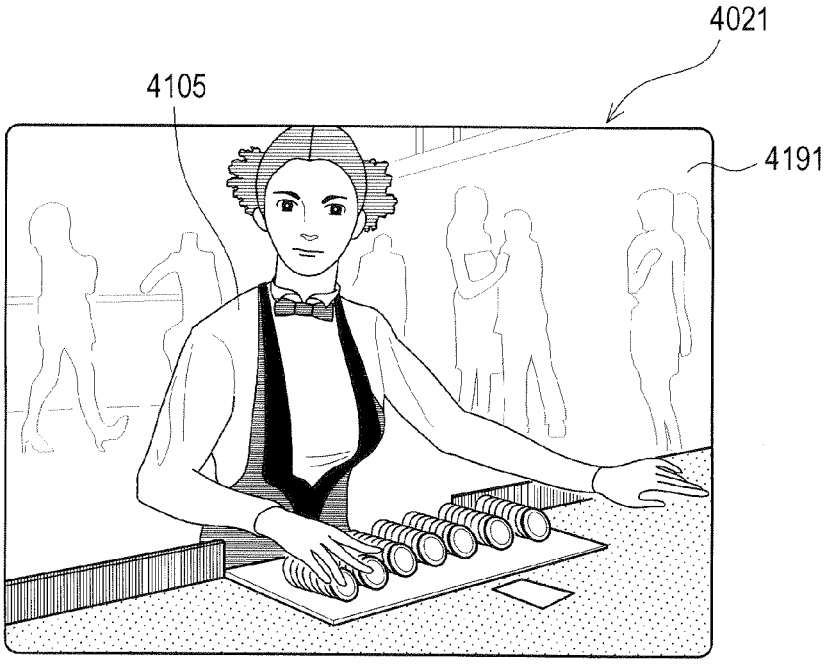

FIG. 52 is a view showing a main screen of a case that the fifth dealer is selected.

Figure 53:
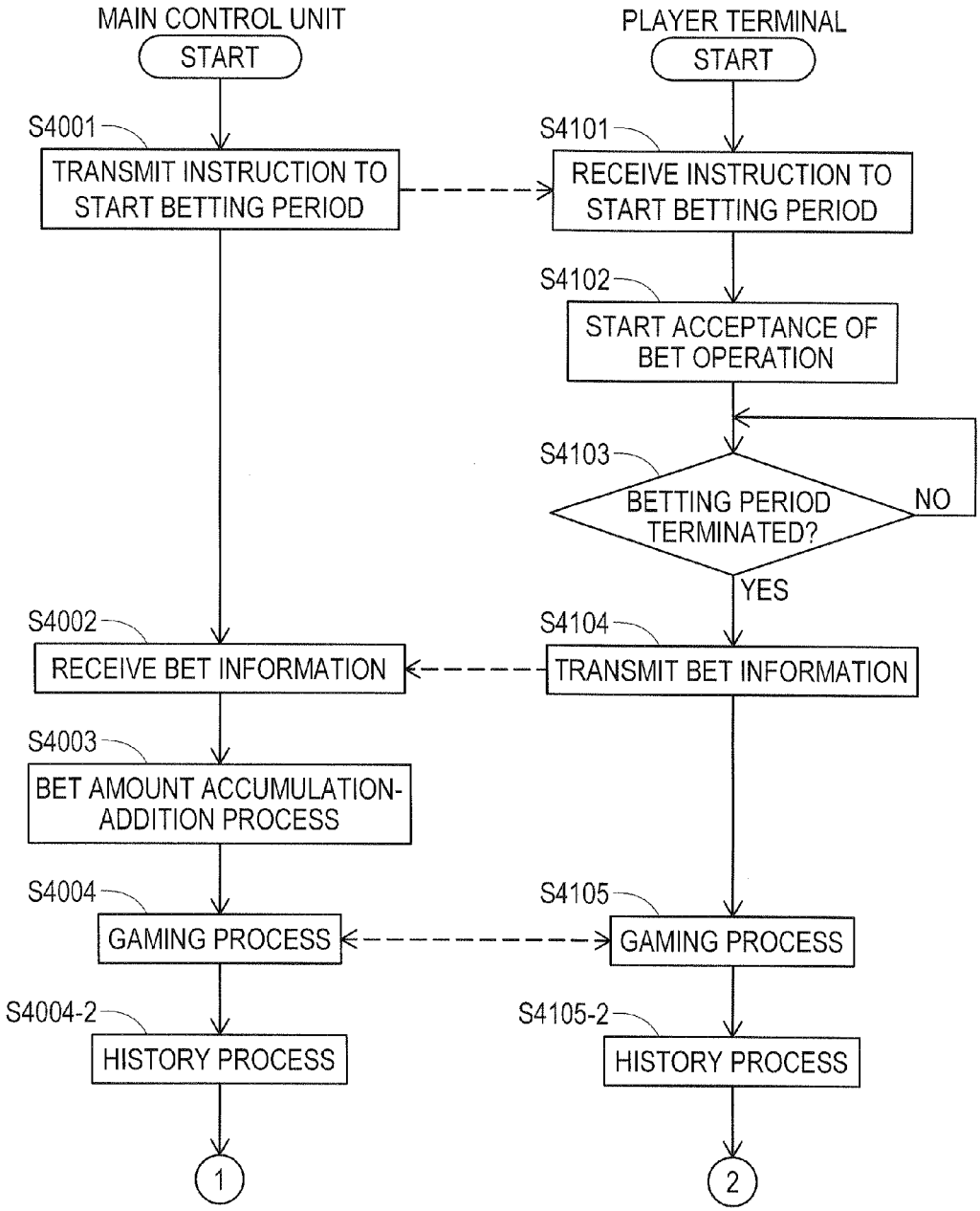
Figure 54:
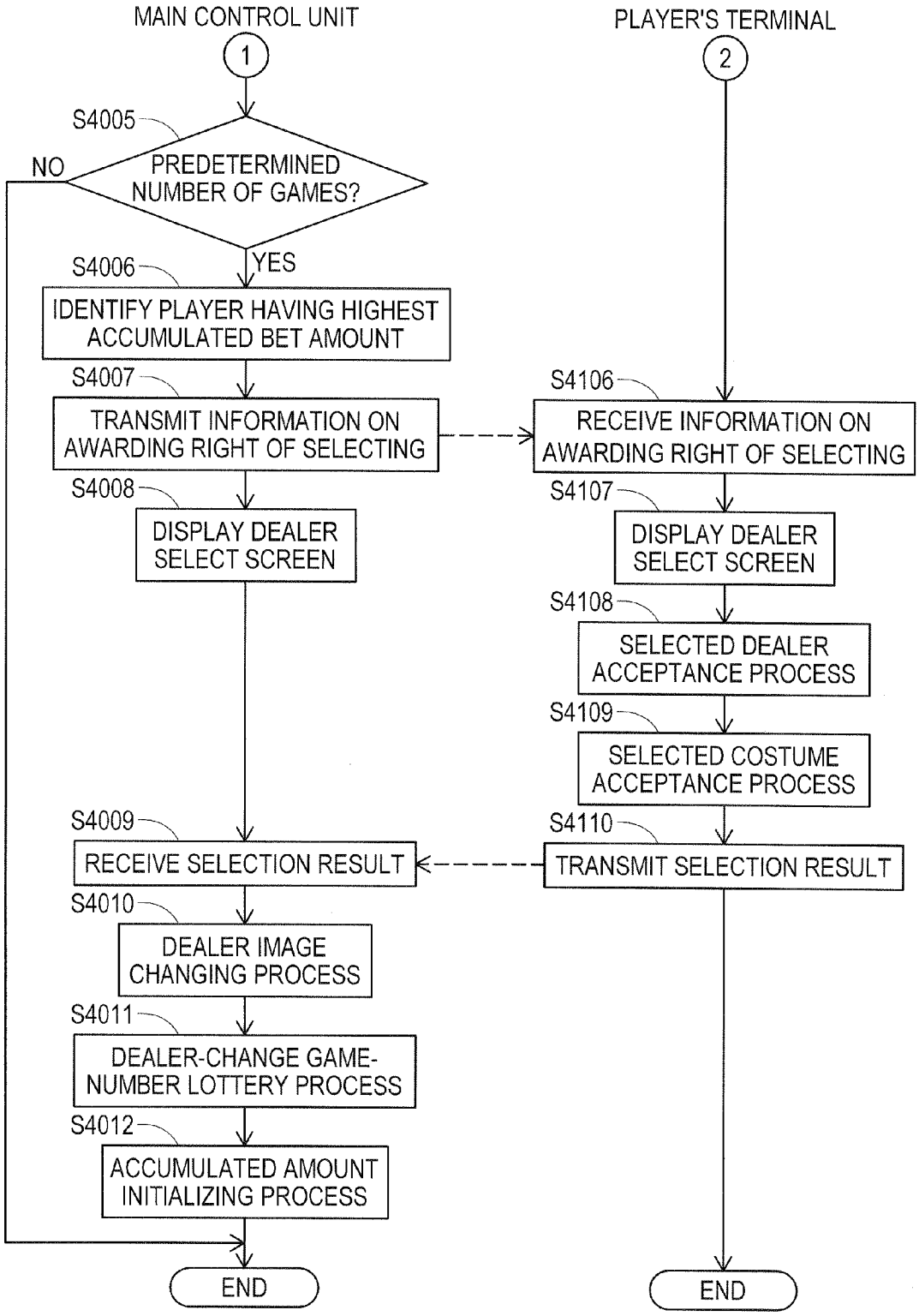
Figure 55:
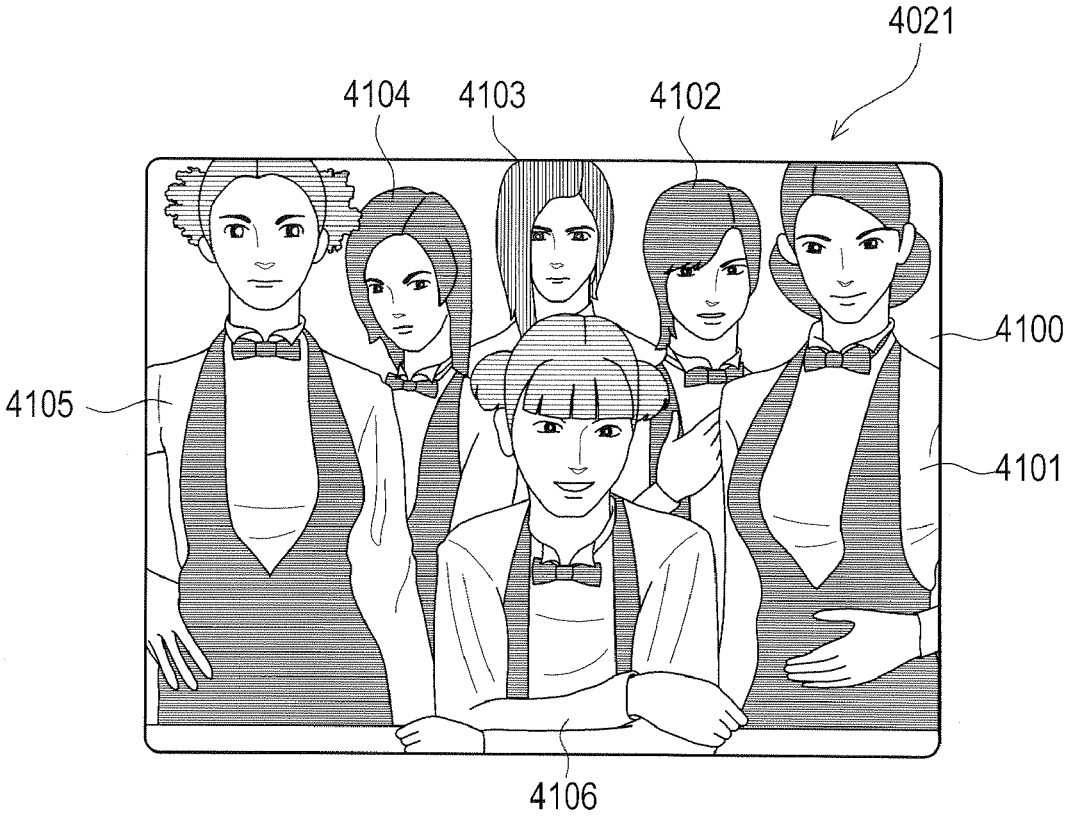
Figure 56:
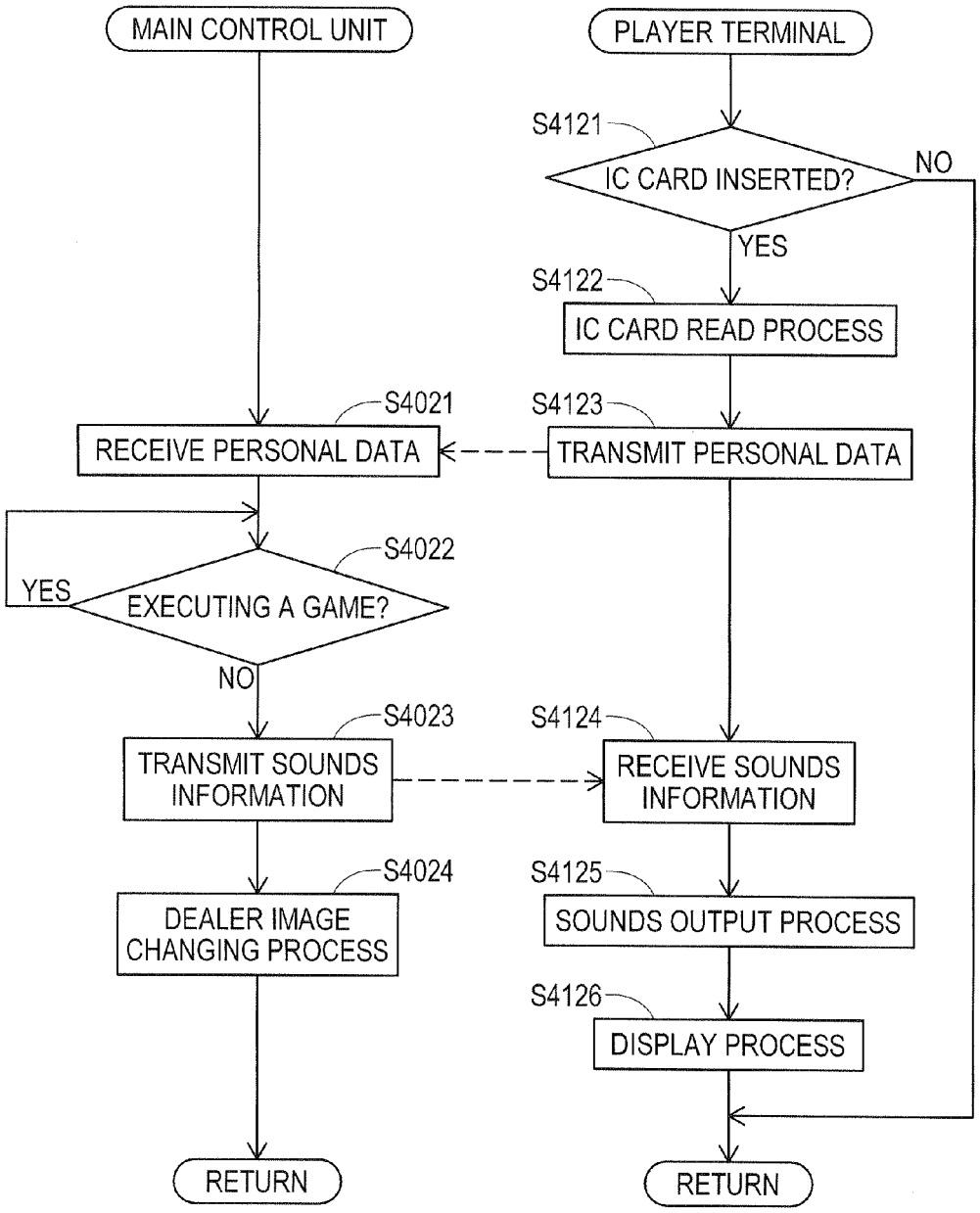
Figure 57:
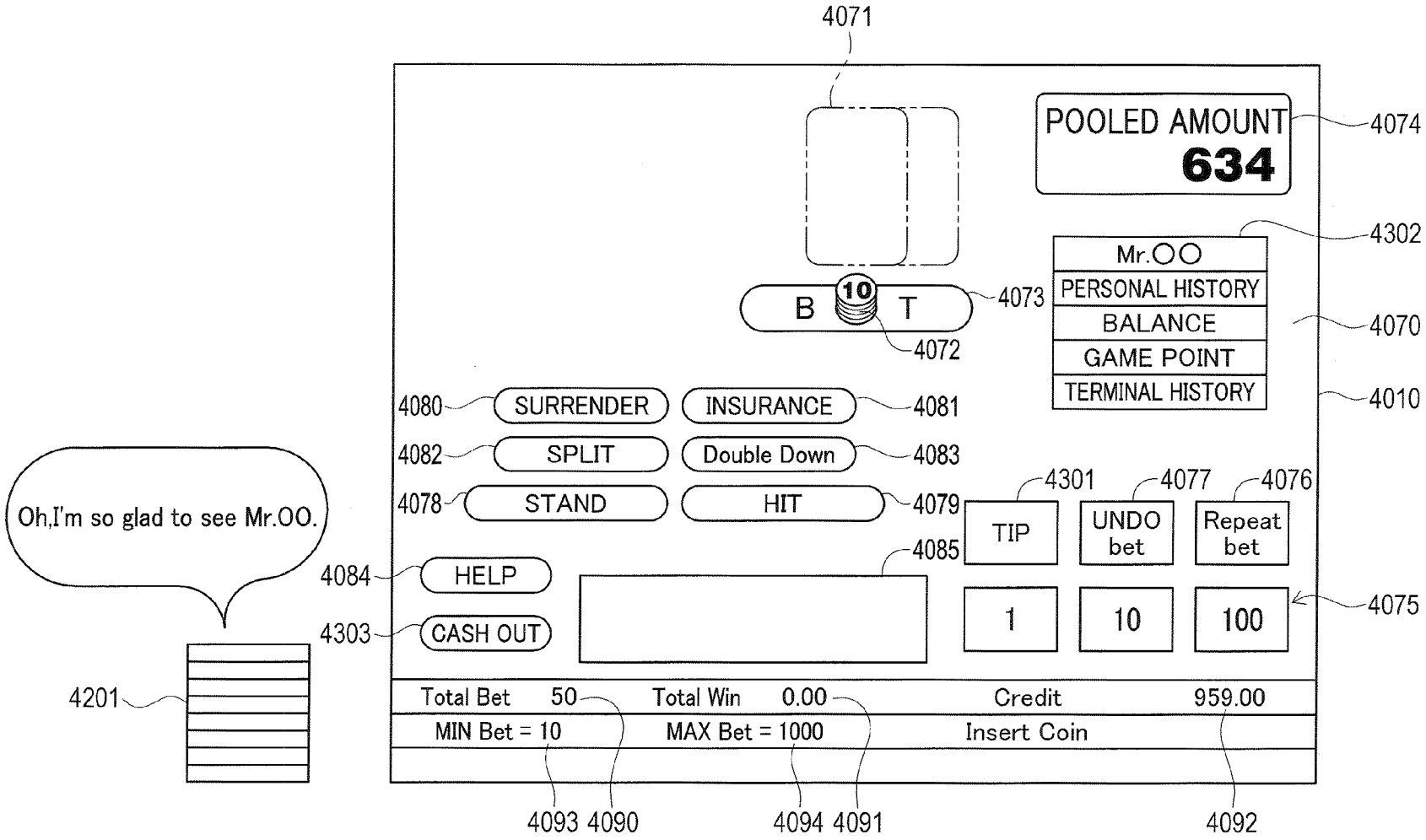
Figure 58:
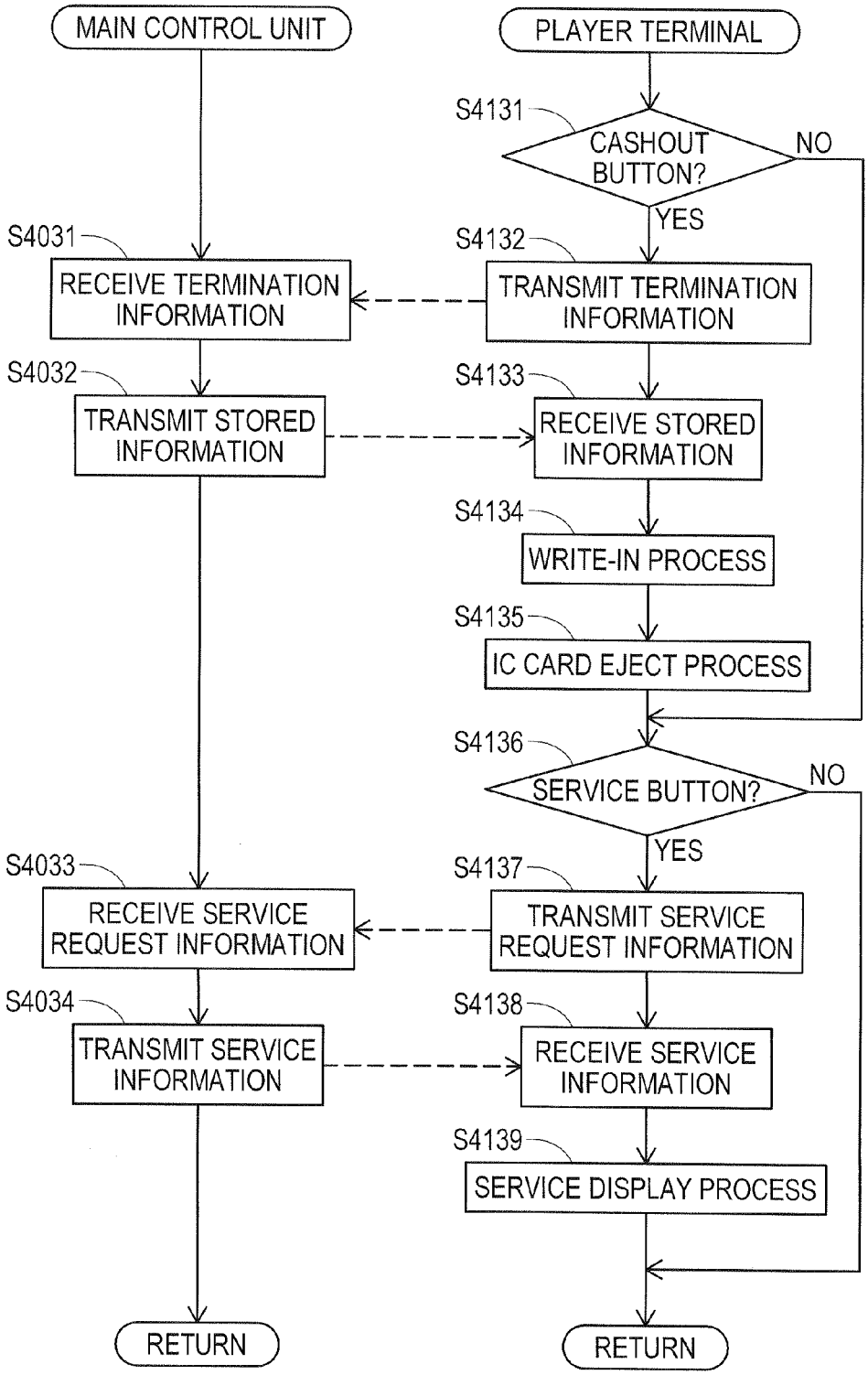
Figure 59:
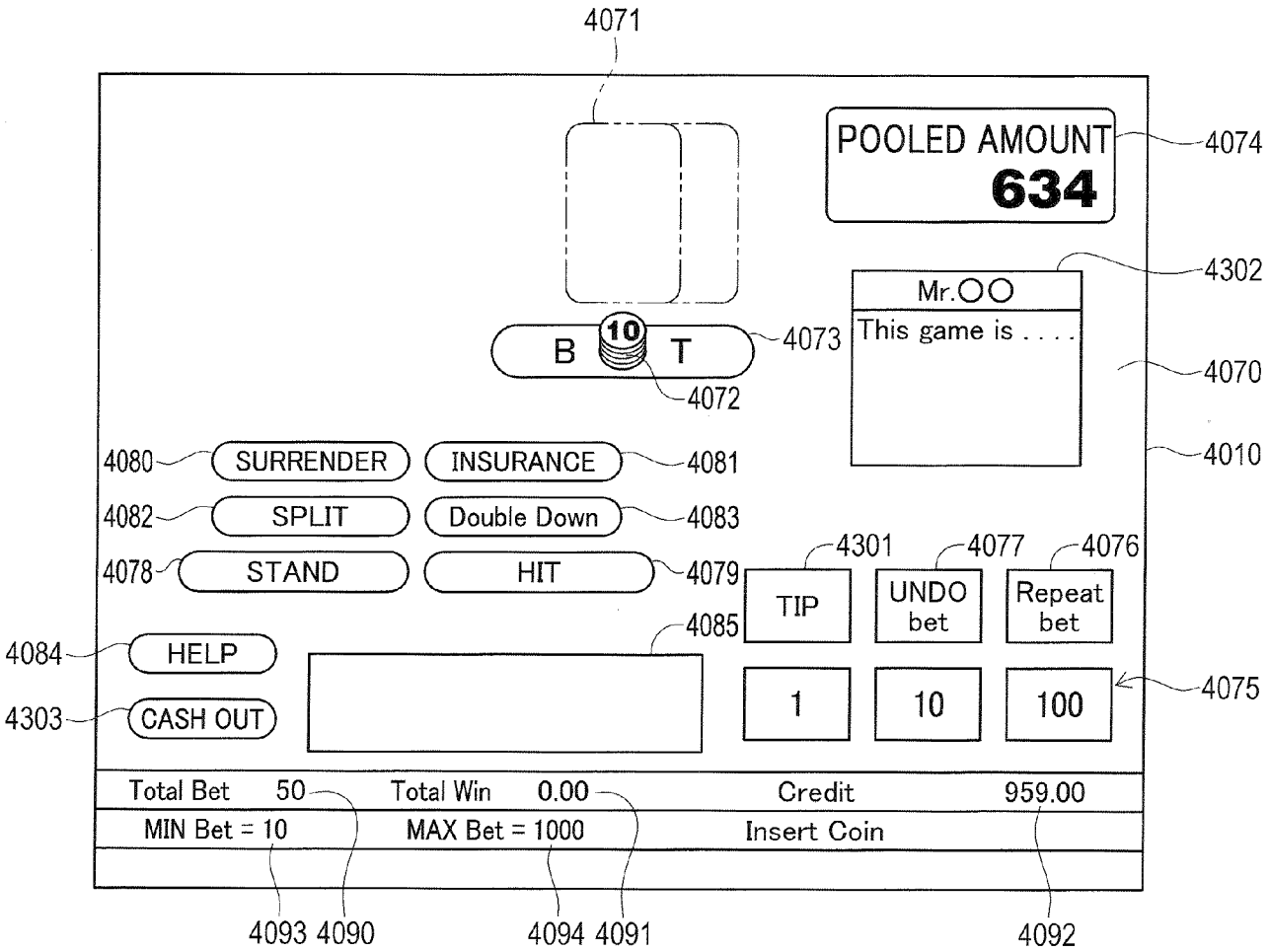
Figure 60:
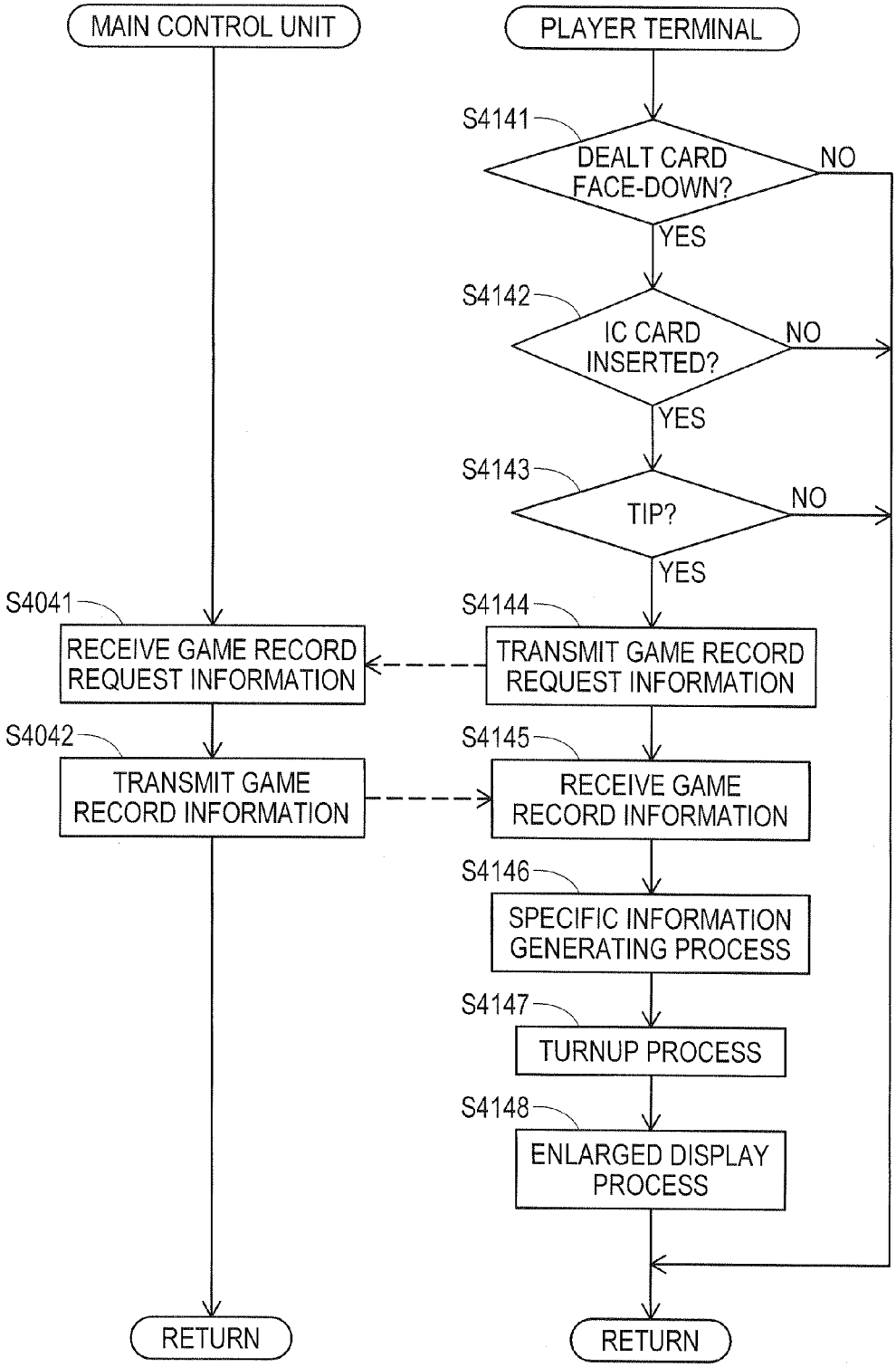
Figure 61:
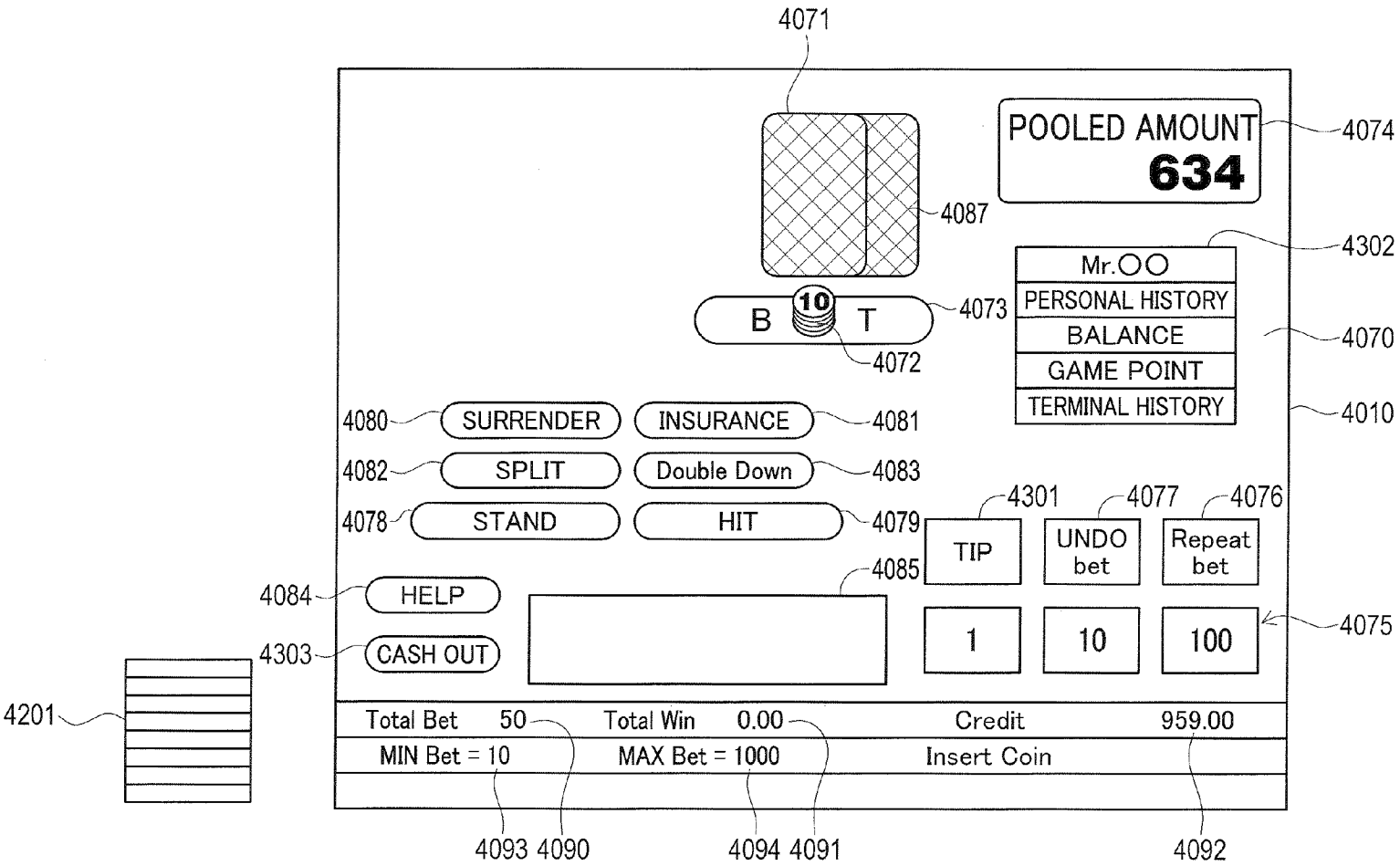
Figure 62:
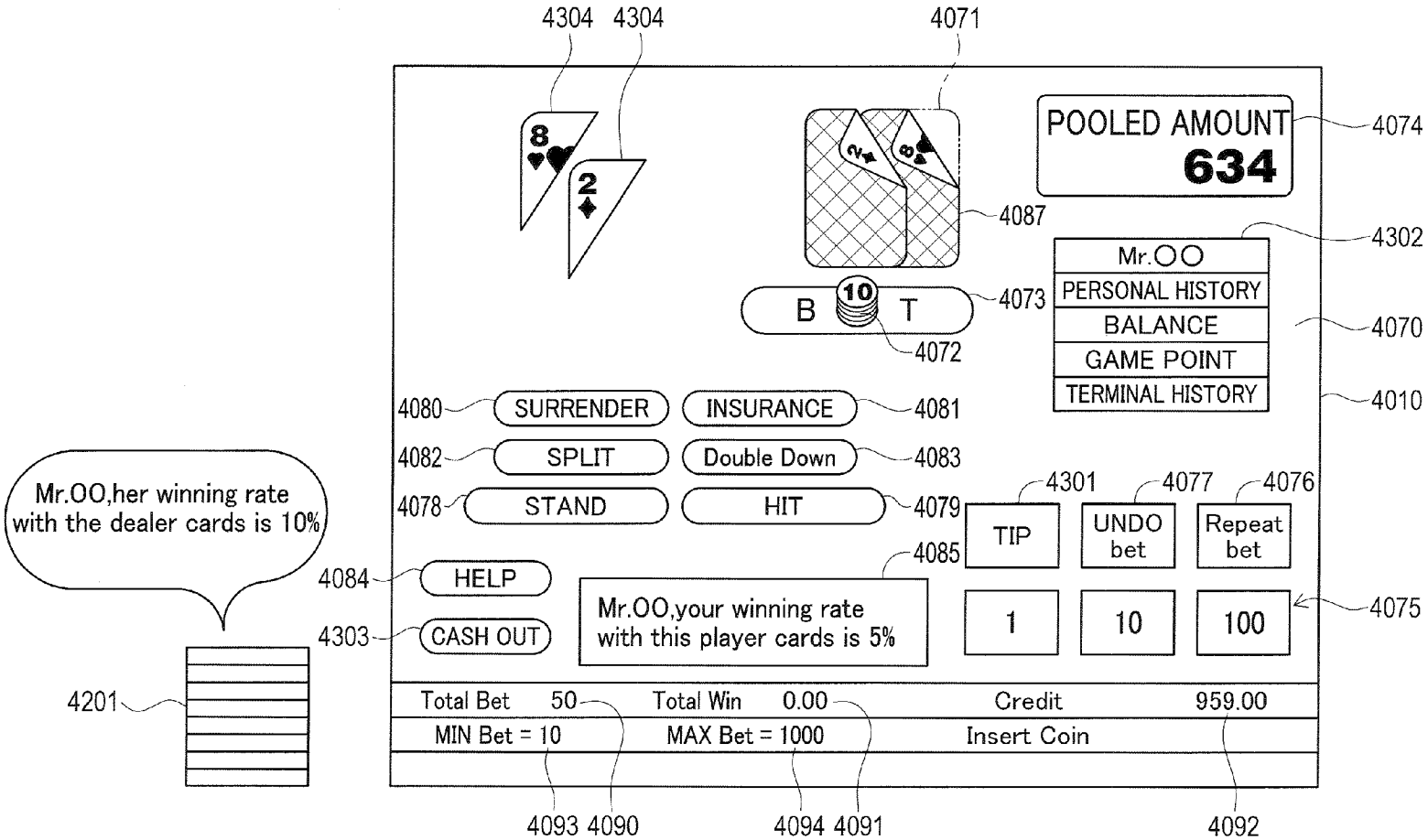

FIG. 53 is a flowchart of a main game processing program in the card gaming machine;

FIG. 54 is a flowchart of a main game processing program in the card gaming machine;

FIG. 55 is a view showing a dealer select screen of the card gaming machine;

FIG. 56 is a flowchart of an IC card processing program in the card gaming machine;

FIG. 57 is an explanatory view showing a bet screen displayed on a liquid crystal display of a player terminal which the card gaming machine has;

FIG. 58 is a flowchart of a service processing program in the card gaming machine;

FIG. 59 is an explanatory view showing a bet screen displayed on a liquid crystal display of a player terminal which the card gaming machine has;

FIG. 60 is a flowchart of a turn up processing program in the card gaming machine;

FIG. 61 is an explanatory view showing a bet screen displayed on a liquid crystal display of a player terminal which the card gaming machine has; and FIG. 62 is an explanatory view showing a bet screen displayed on a liquid crystal display of a player terminal of which the card gaming machine has.

Figure 63:
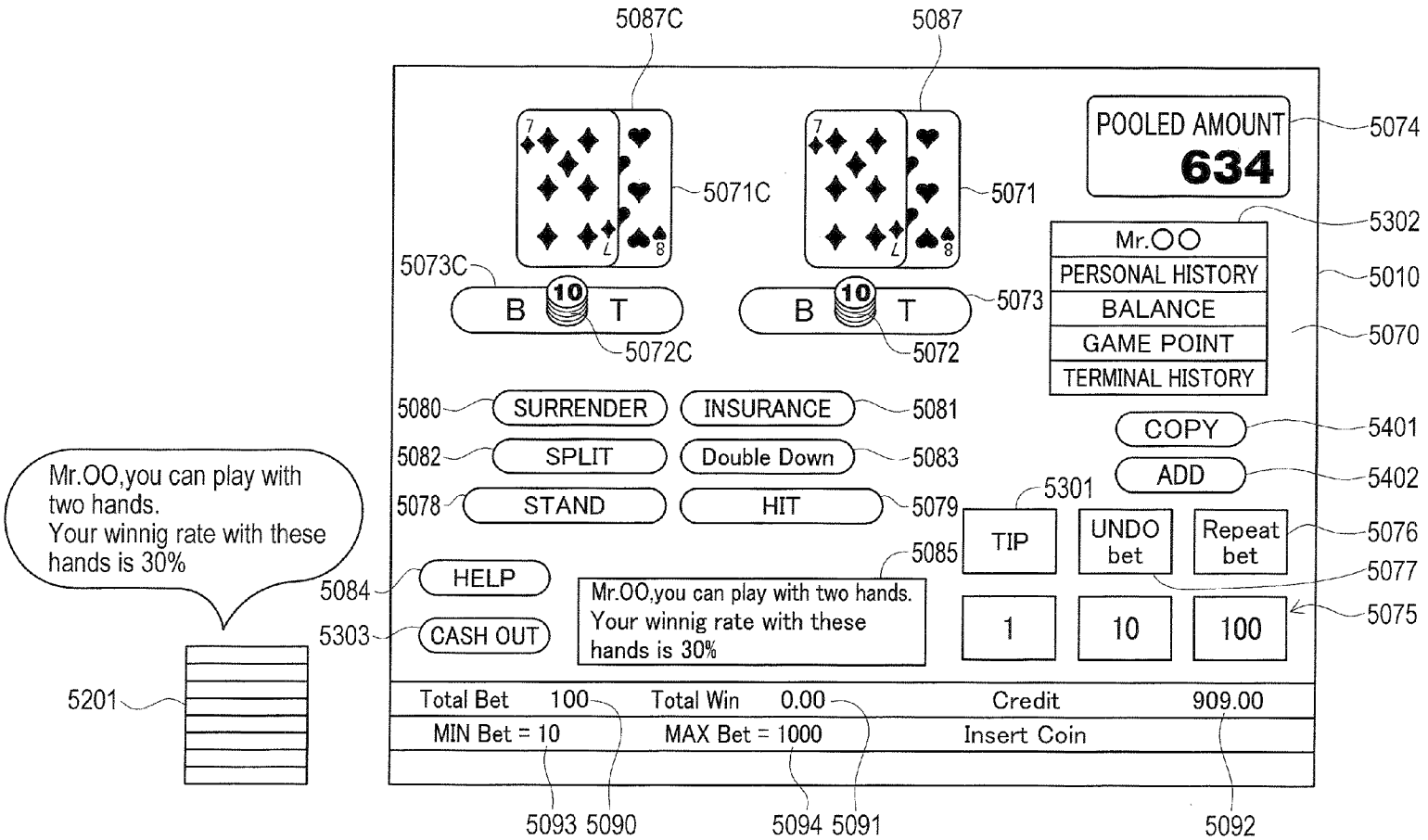
Figure 64:
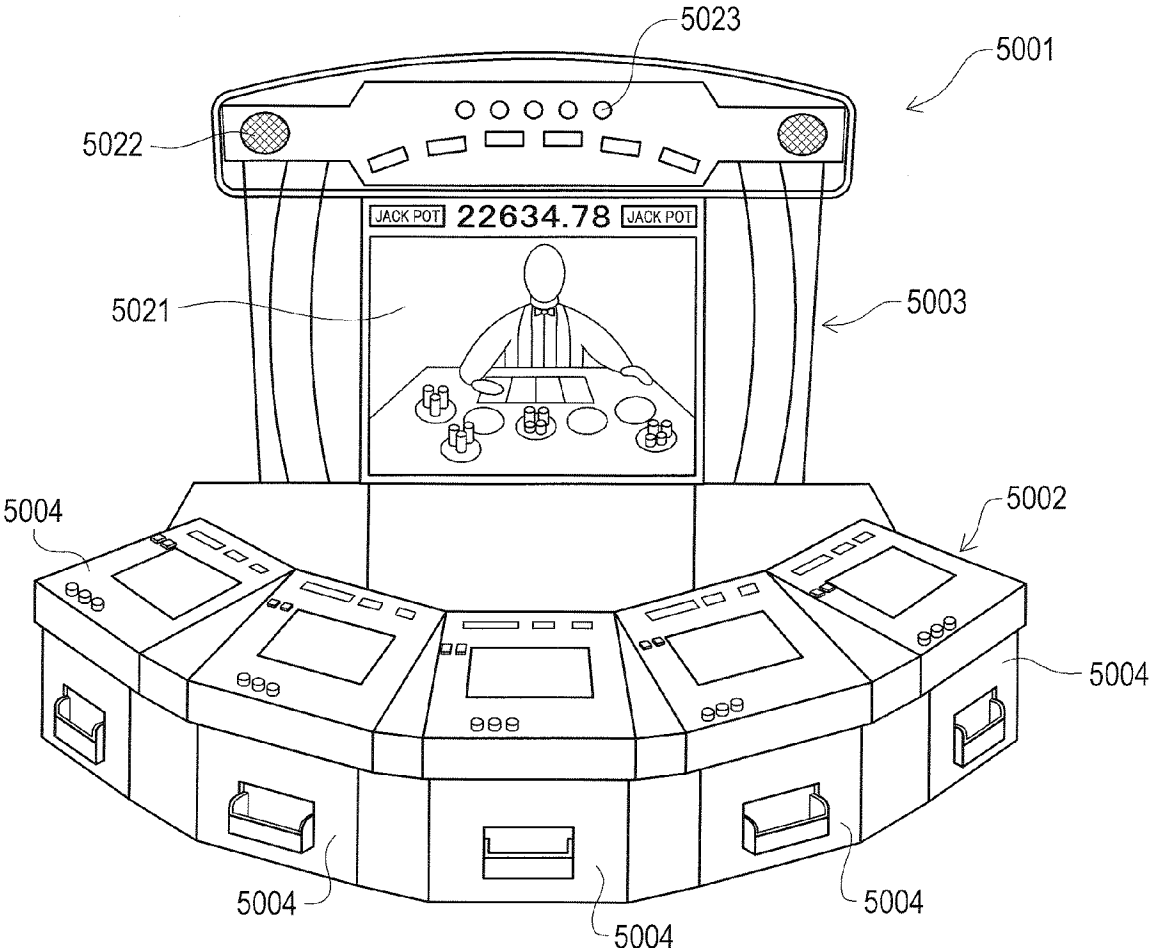
Figure 65:
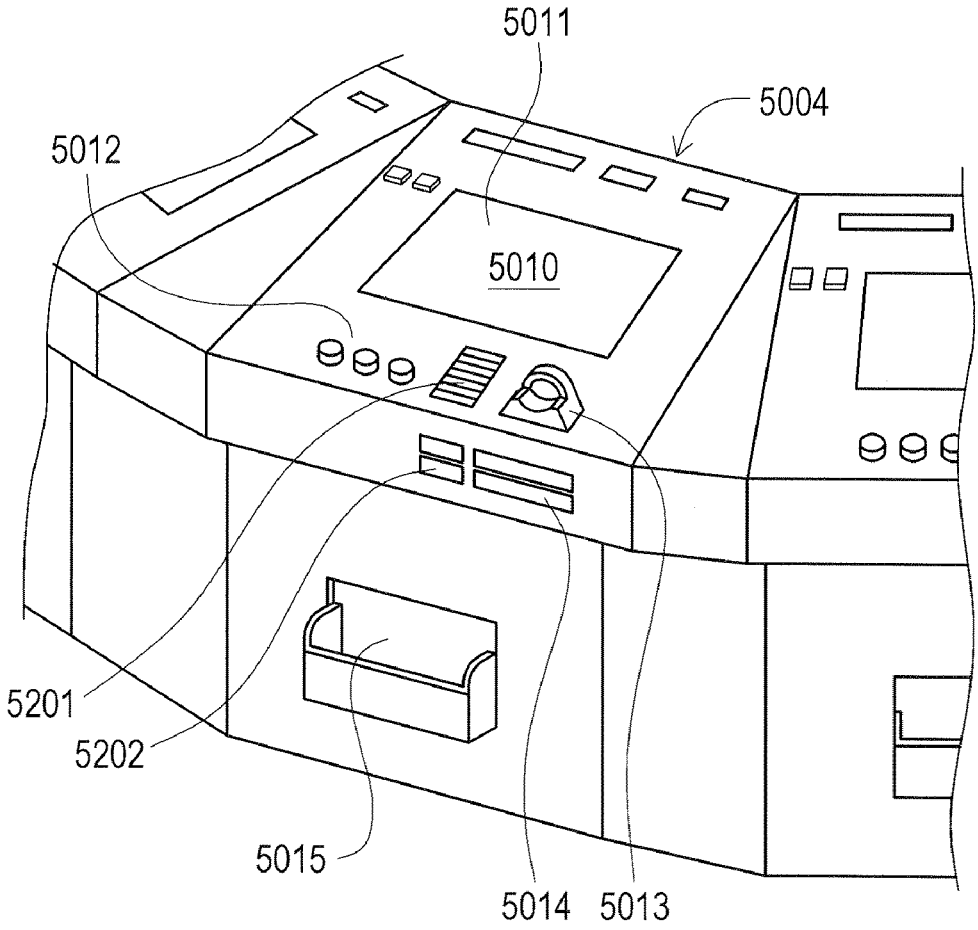
Figure 66:
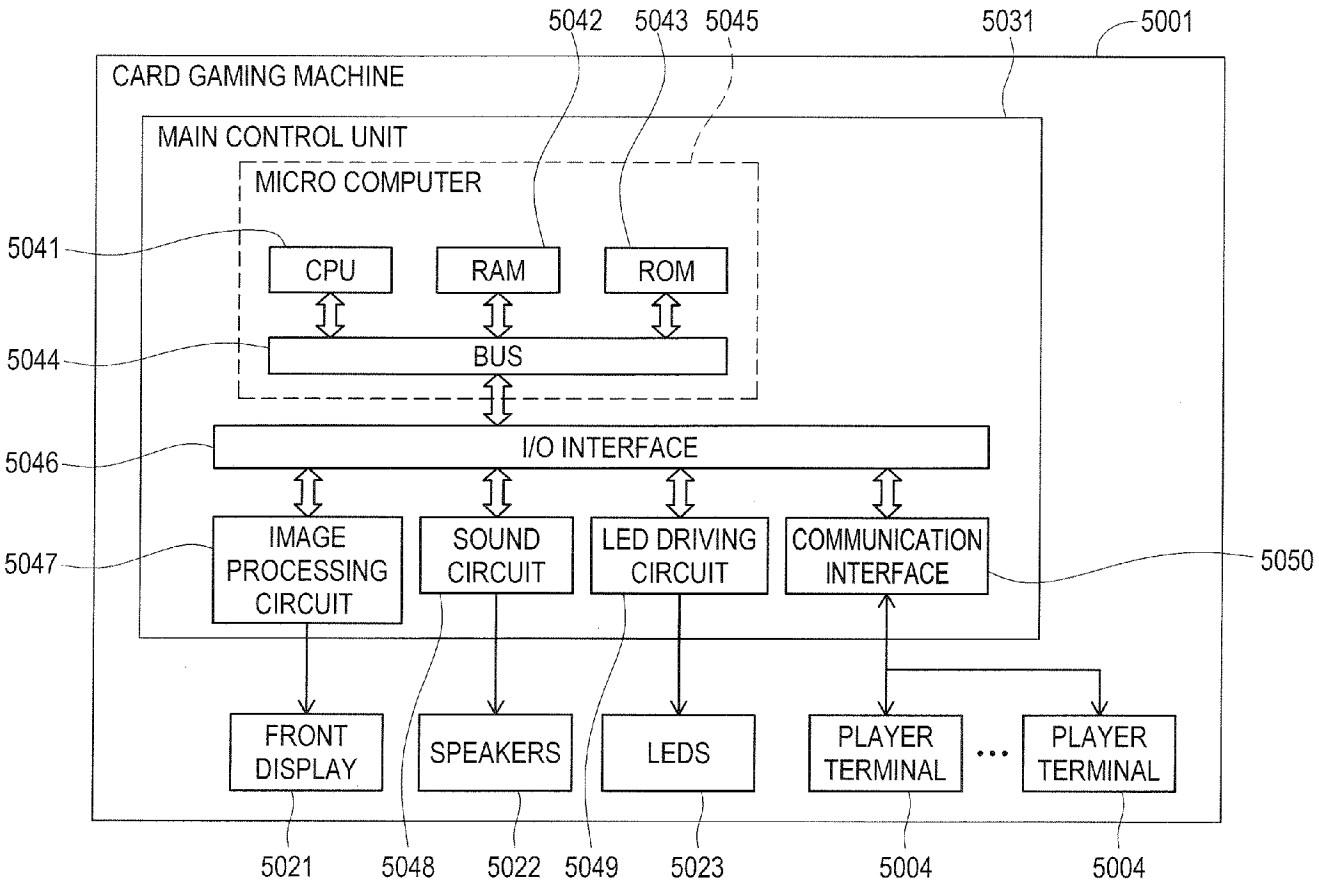
Figure 67:
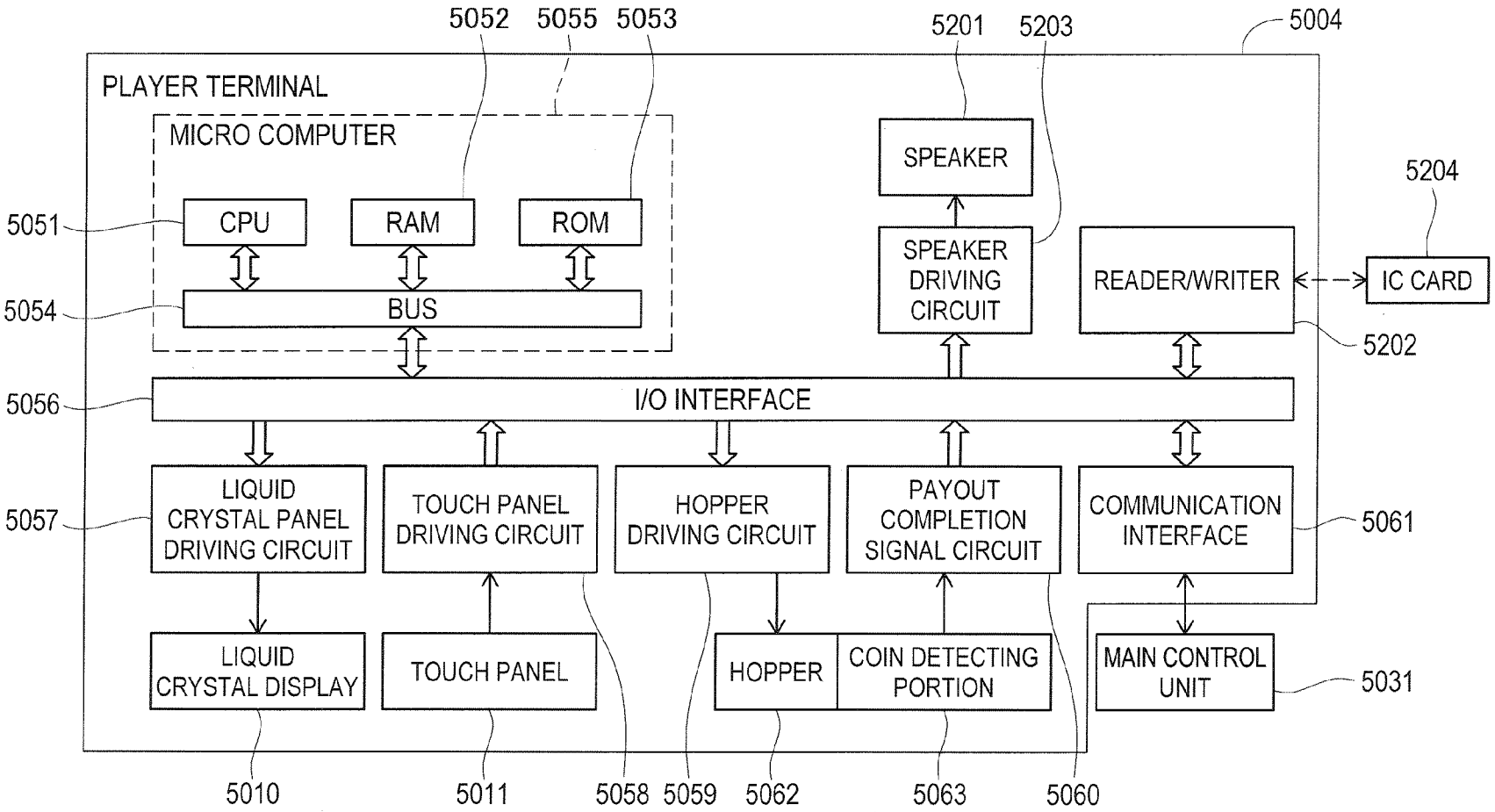
Figure 68:
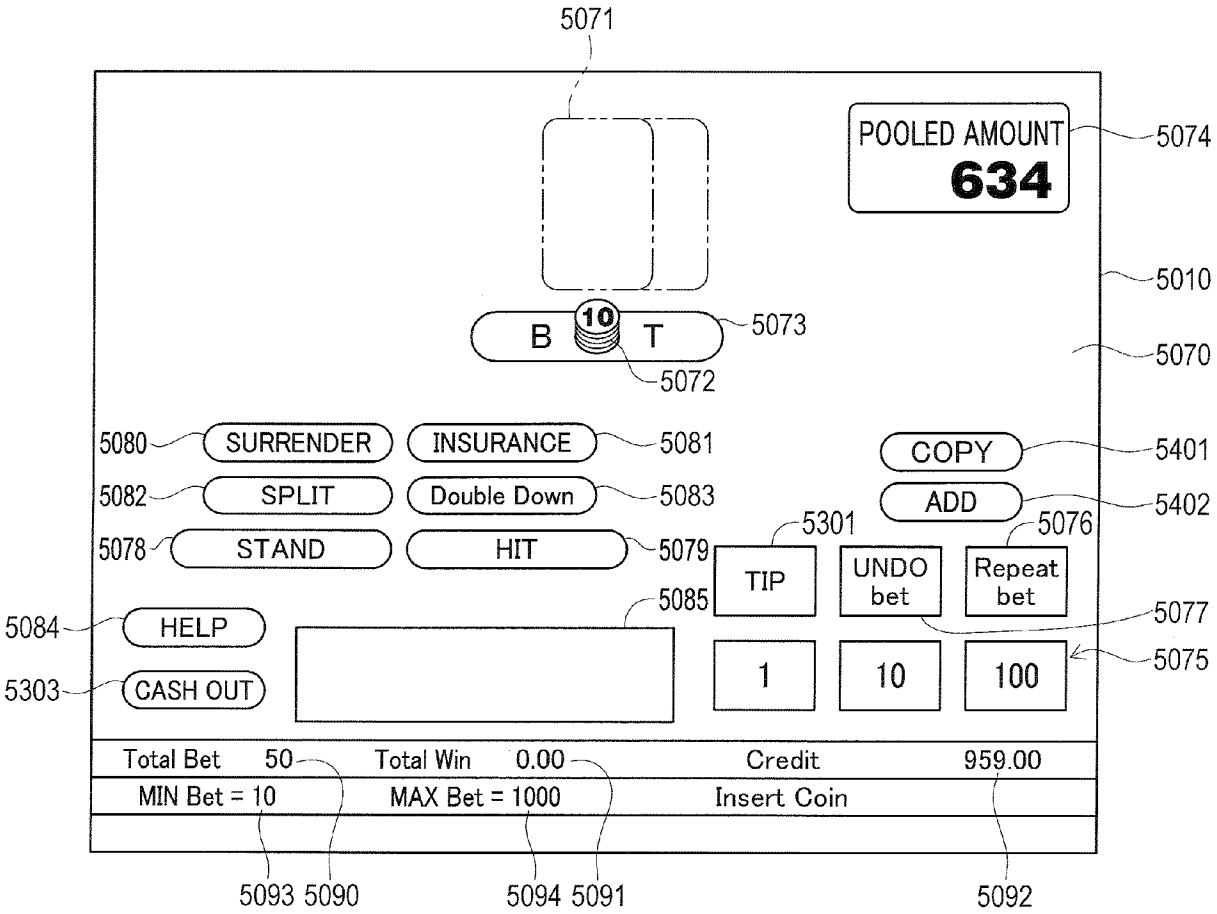
Figure 69:
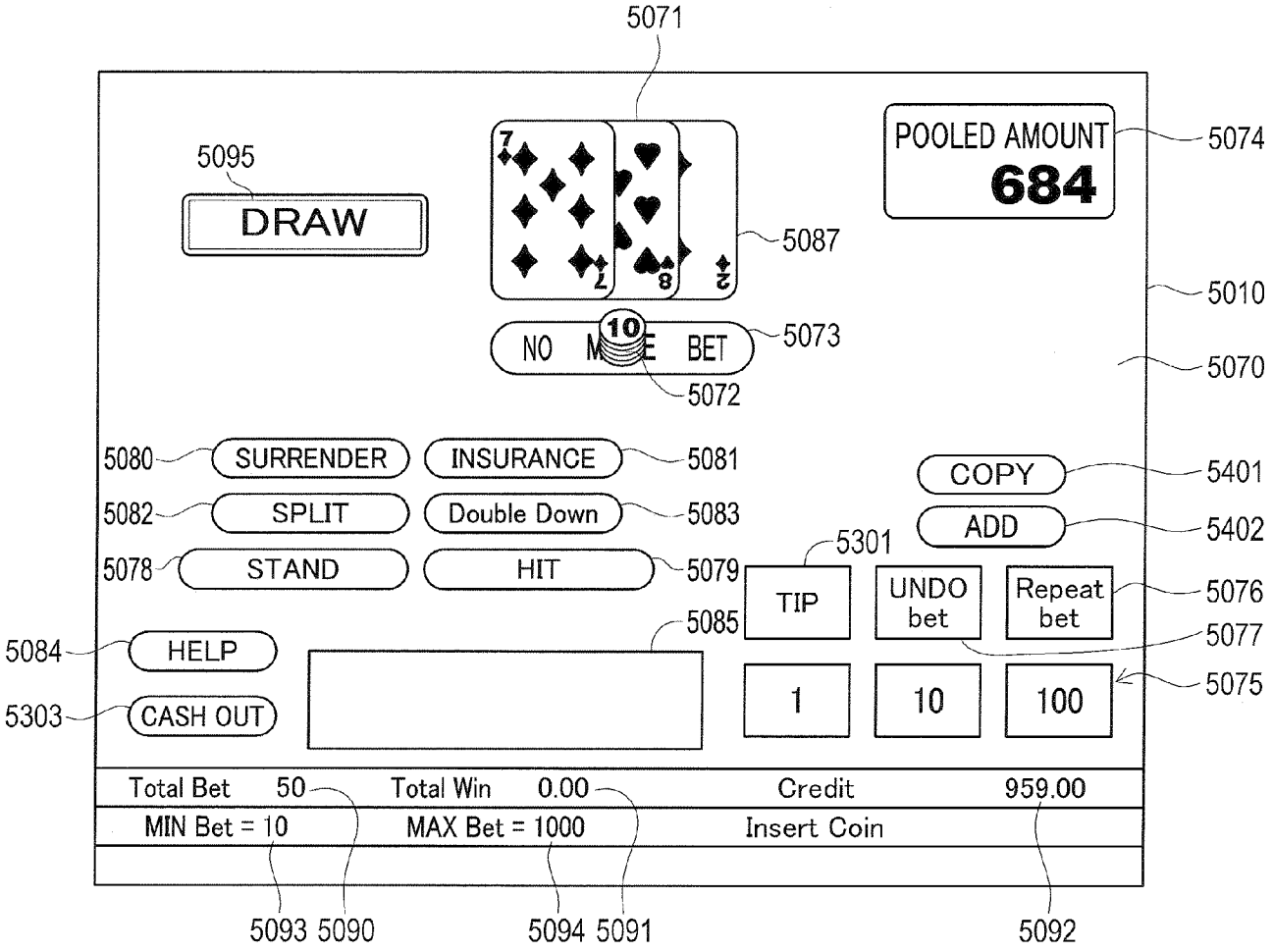
Figure 70:
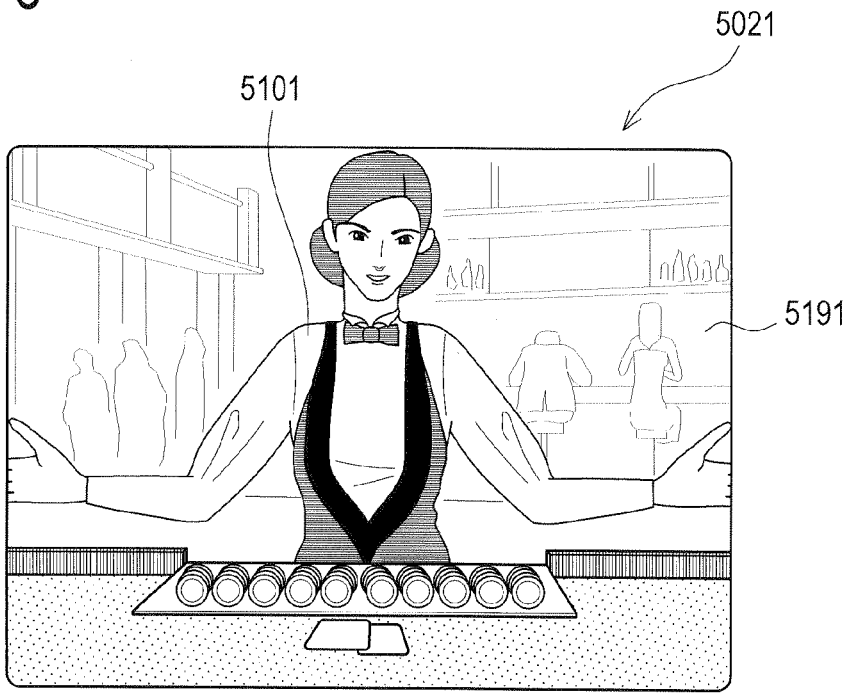

FIG. 63 is a view showing characteristics of a card gaming machine of one fifth embodiment of the present invention and an explanatory view showing a bet screen displayed on a liquid crystal display of a player terminal which the card gaming machine has;

FIG. 64 is an outline view of the card gaming machine;

FIG. 65 is an outline view of a player terminal which the card gaming machine has;

FIG. 66 is a block diagram schematically showing a control system of the card gaming machine;

FIG. 67 is a block diagram schematically showing a control system of a player terminal which the card gaming machine has;

FIG. 68 is an explanatory view showing a bet screen displayed on a liquid crystal display of a player terminal which the card gaming machine has;

FIG. 69 is an explanatory view showing a bet screen displayed on a liquid crystal display of a player terminal which the card gaming machine has;

FIG. 70 is a view showing a main screen of a case that the first dealer is selected.

Figure 71:
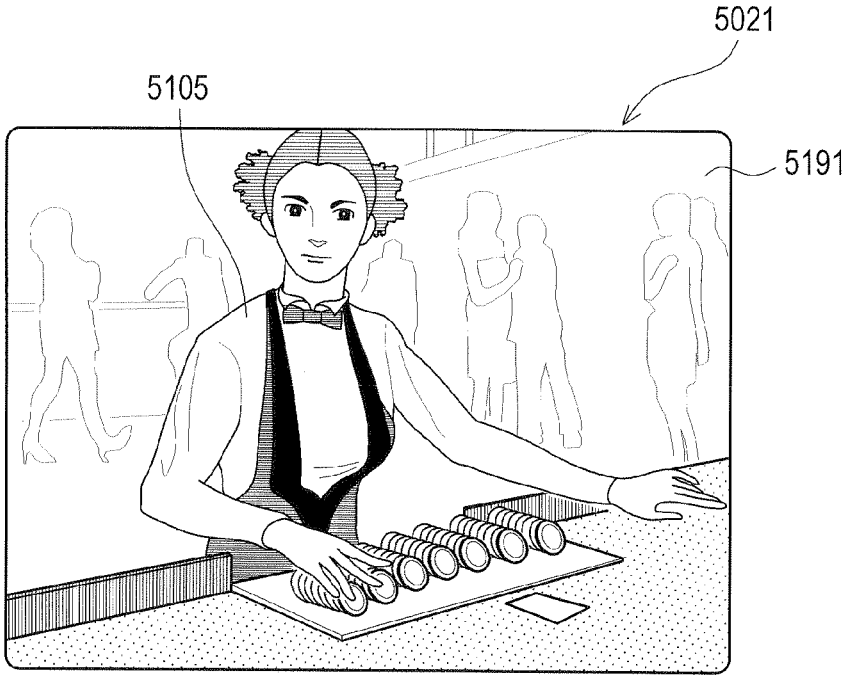

FIG. 71 is a view showing a main screen of a case that the fifth dealer is selected.

Figure 72:
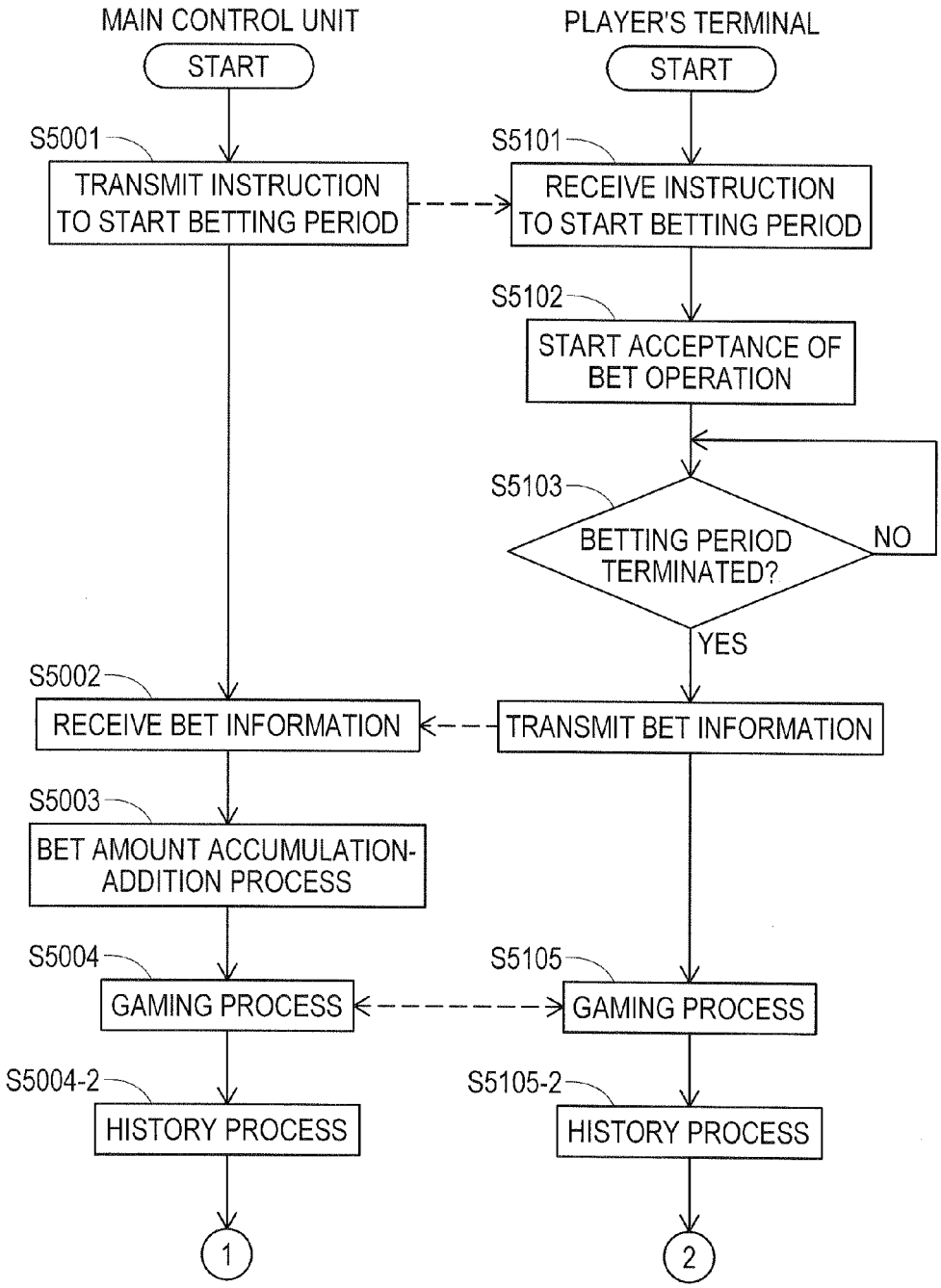
Figure 73:
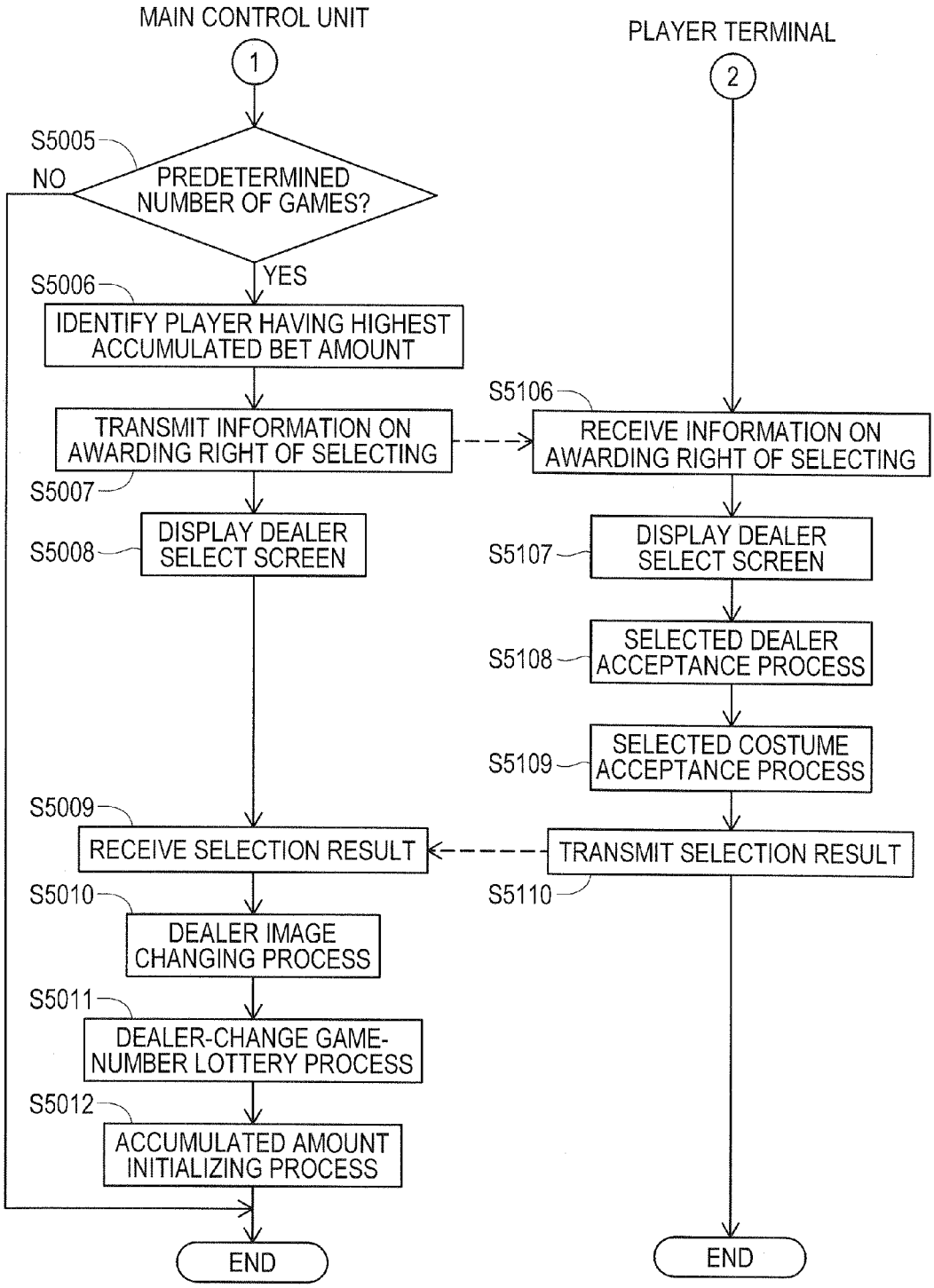
Figure 74:
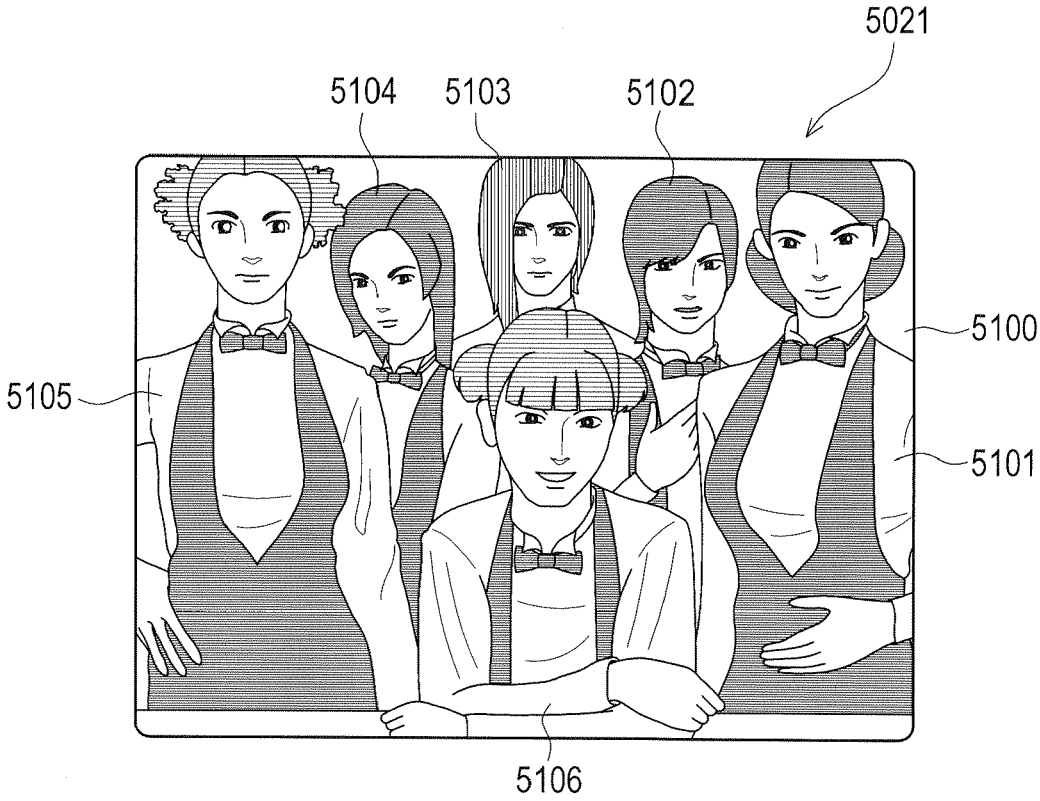
Figure 75:
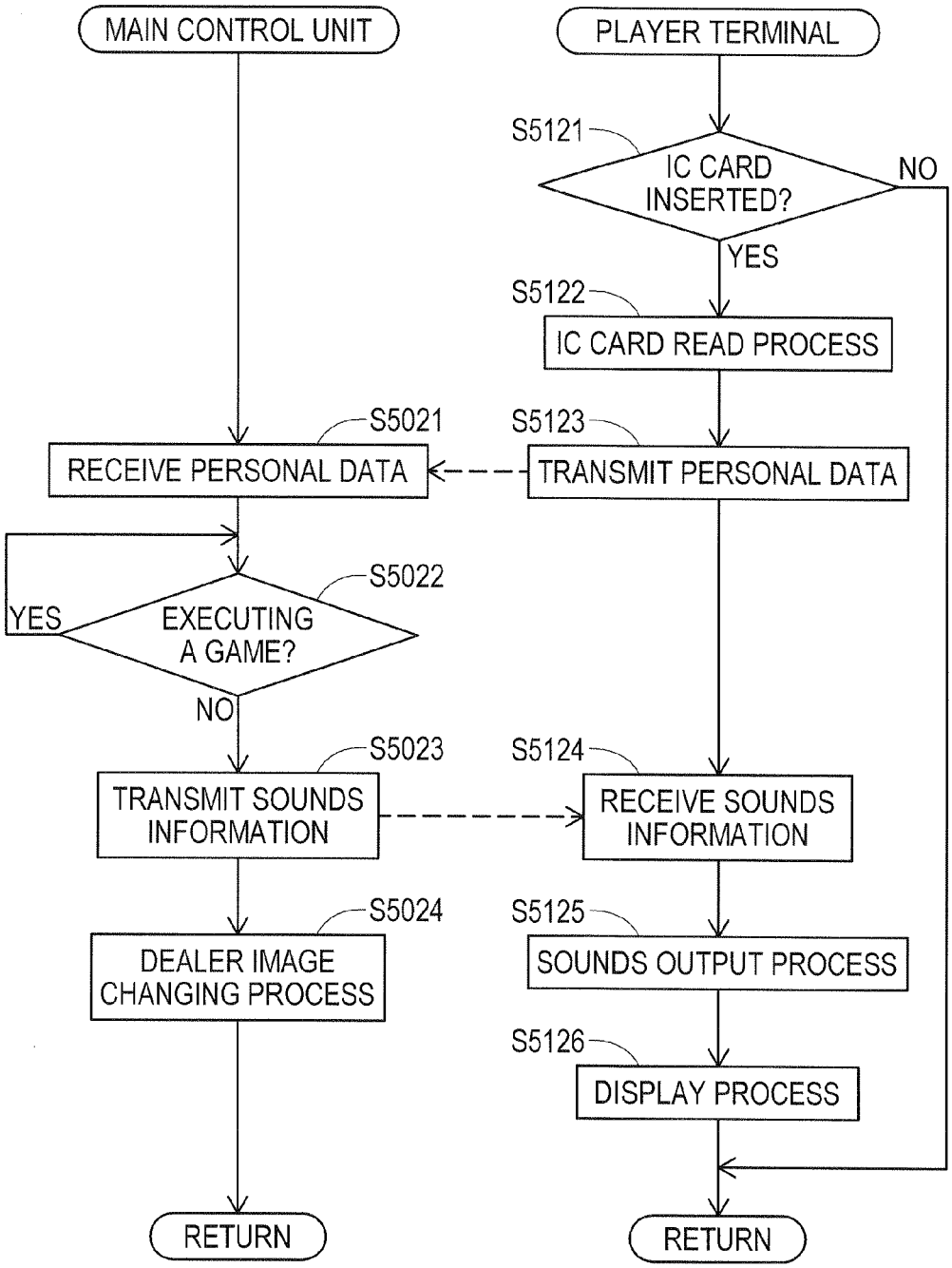
Figure 76:
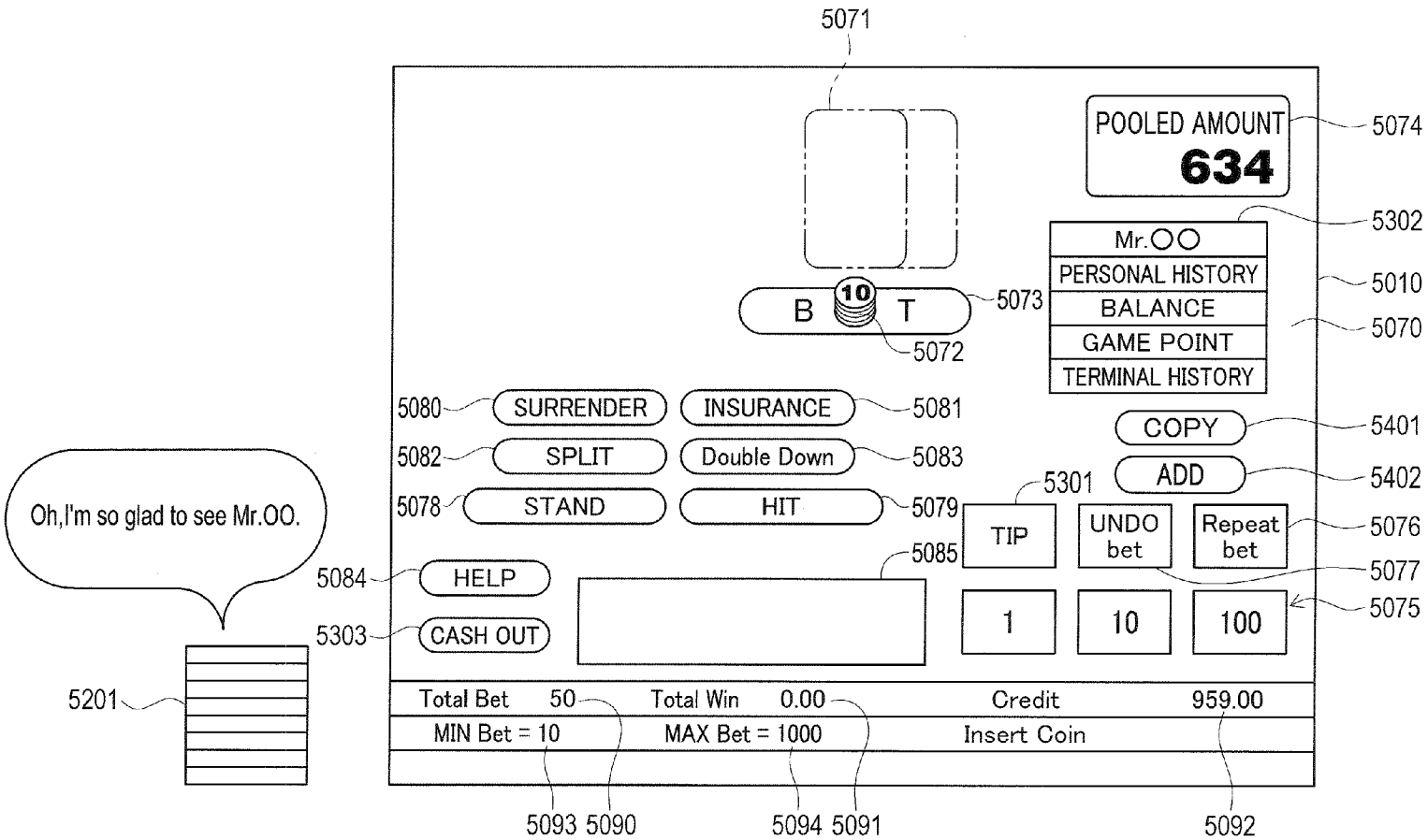
Figure 77:
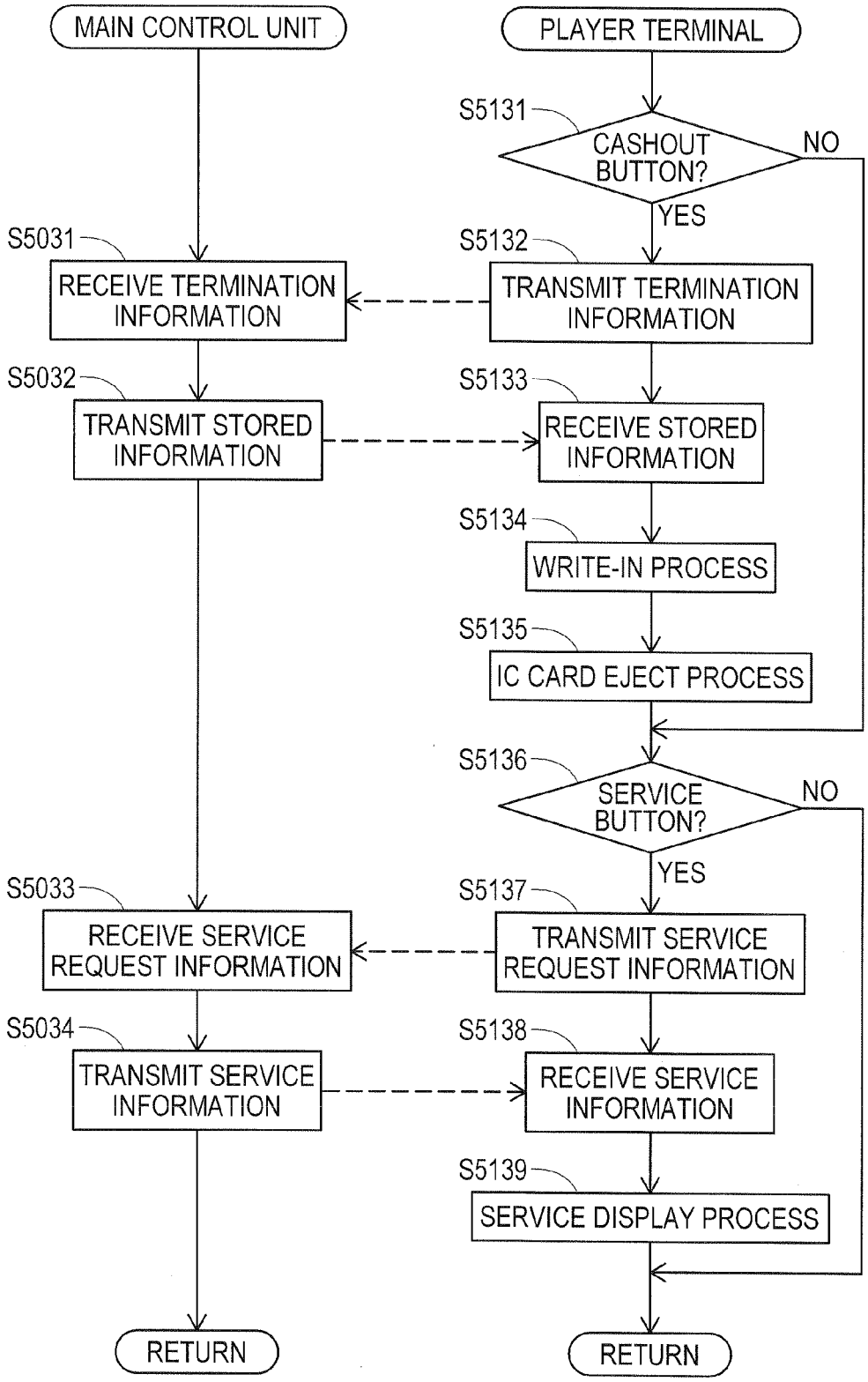
Figure 78:
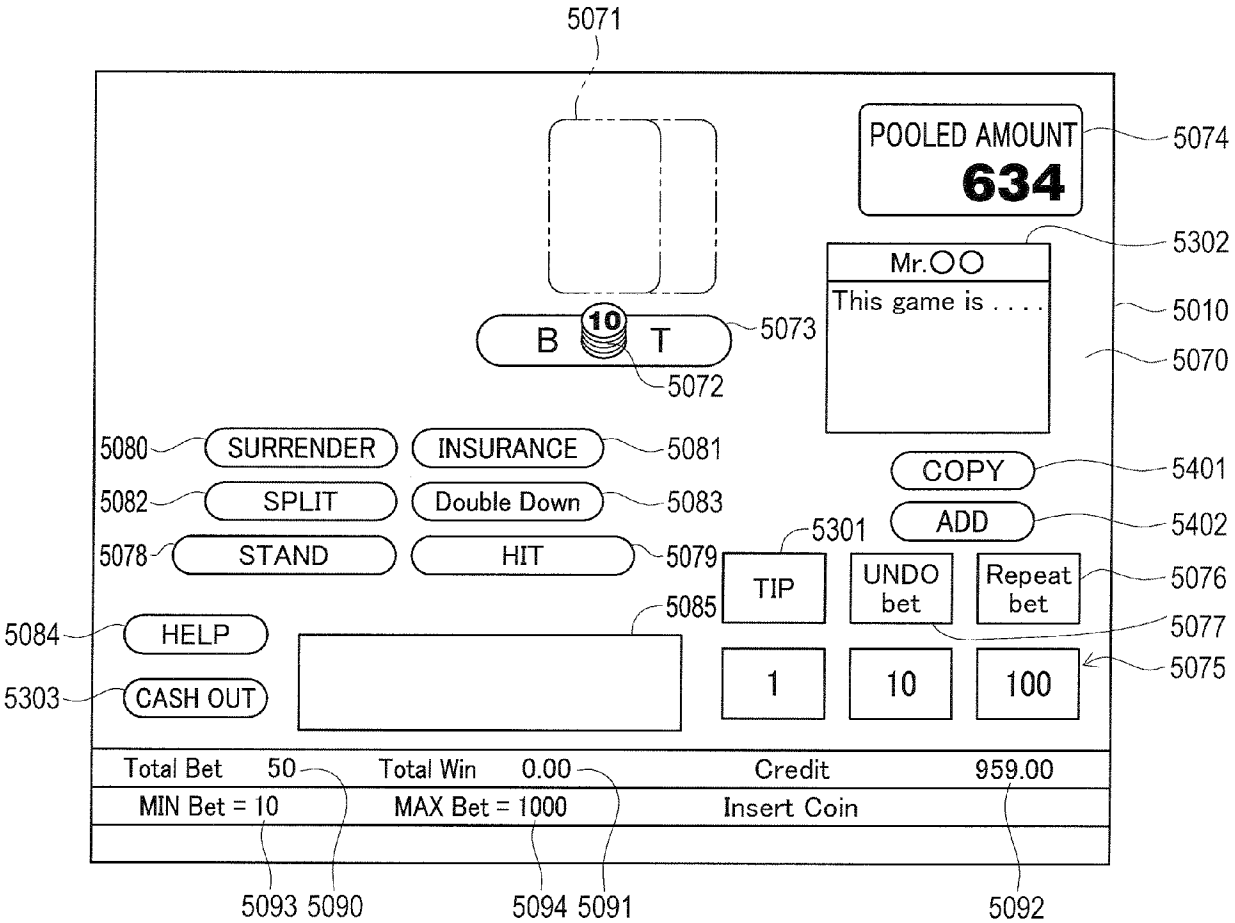
Figure 79:
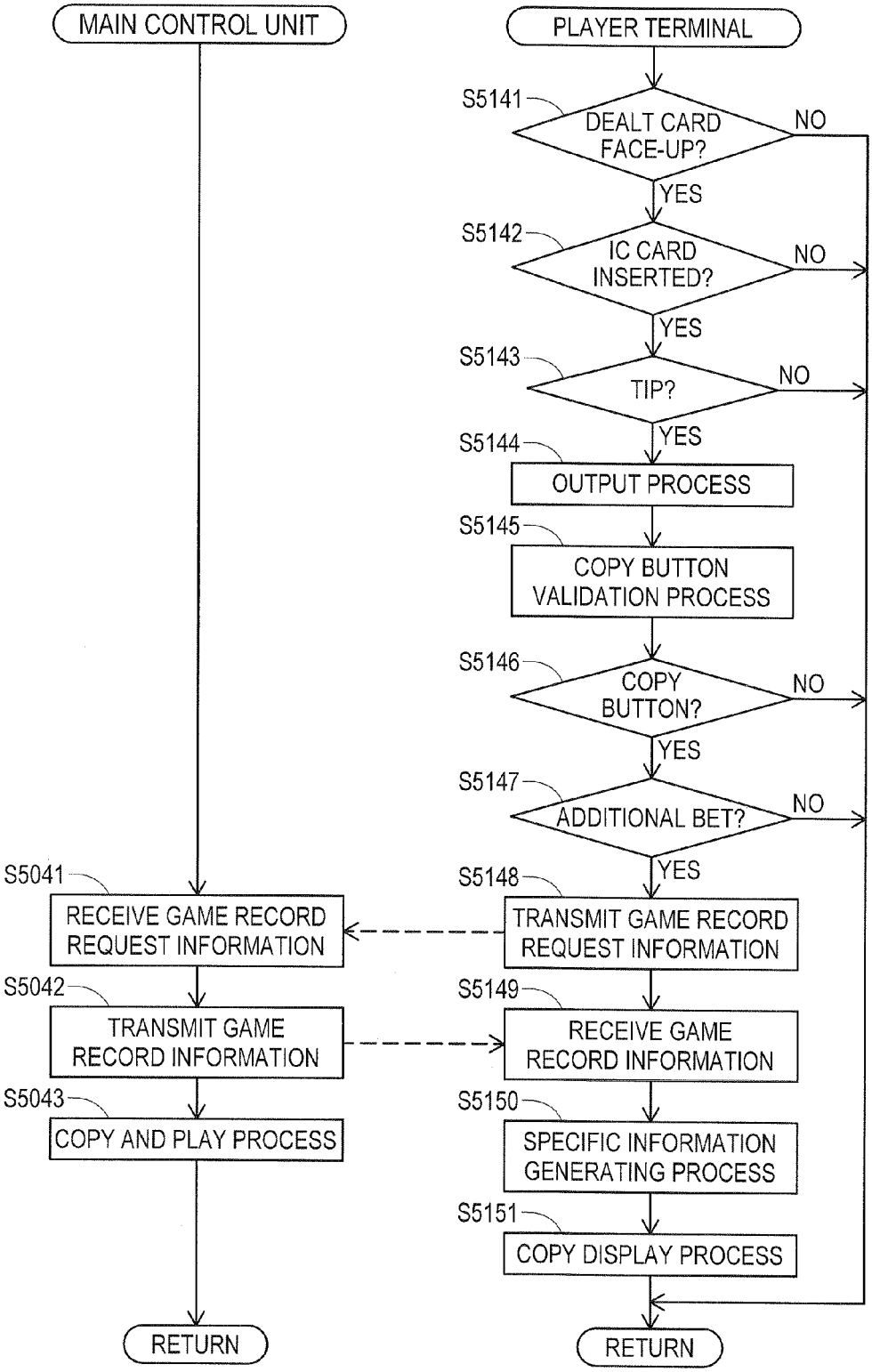
Figure 80:
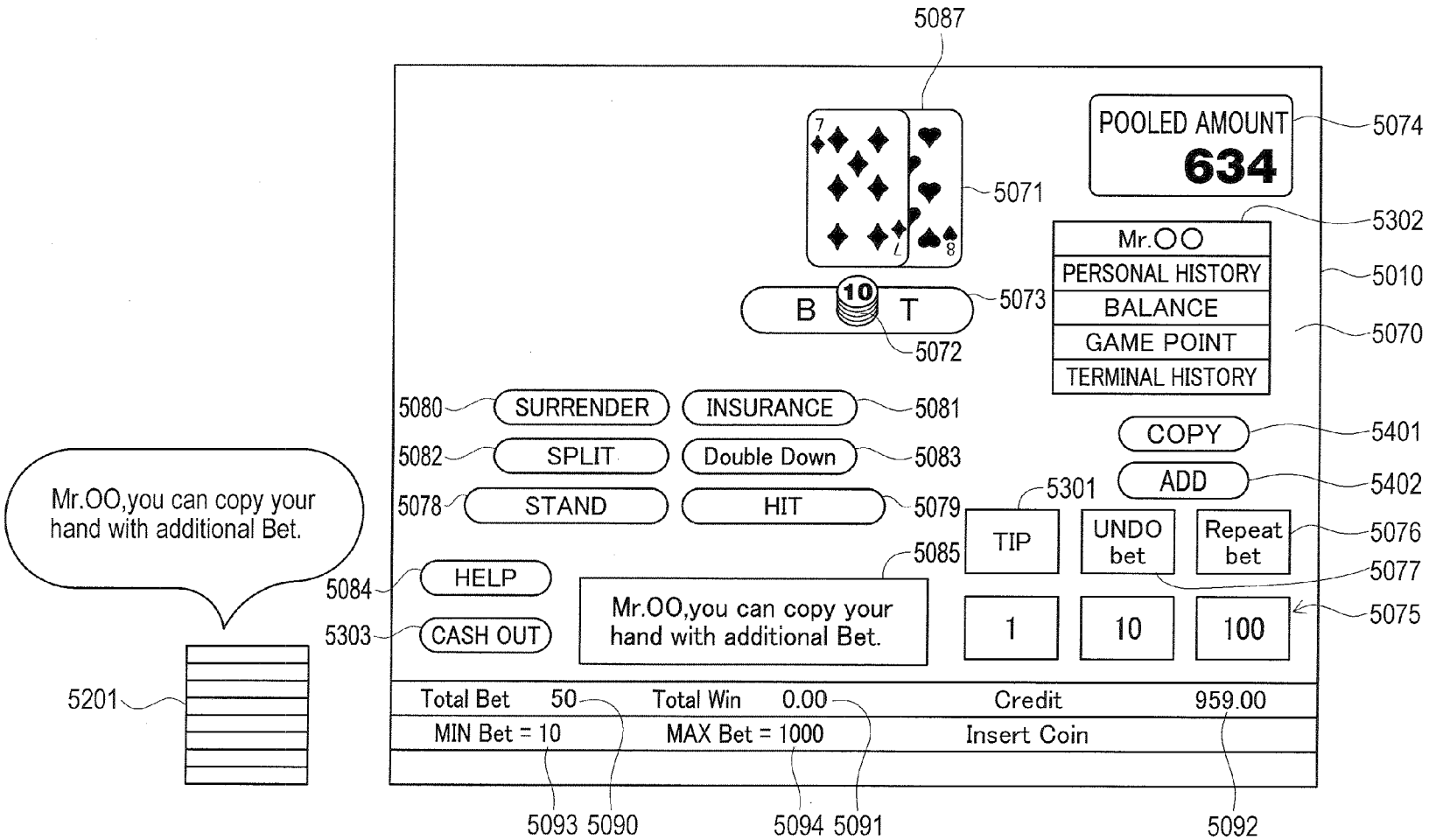

FIG. 72 is a flowchart of a main game processing program in the card gaming machine;

FIG. 73 is a flowchart of a main game processing program in the card gaming machine;

FIG. 74 is a view showing a dealer select screen of the card gaming machine;

FIG. 75 is a flowchart of an IC card processing program in the card gaming machine;

FIG. 76 is an explanatory view showing a bet screen displayed on a liquid crystal display of a player terminal which the card gaming machine has;

FIG. 77 is a flowchart of a service processing program in the card gaming machine;

FIG. 78 is an explanatory view showing a bet screen displayed on a liquid crystal display of a player terminal which the card gaming machine has;

FIG. 79 is a flowchart of a copy and play processing program in the card gaming machine; and FIG. 80 is an explanatory view showing a bet screen displayed on a liquid crystal display of a player terminal which the card gaming machine has.

Figure 81:
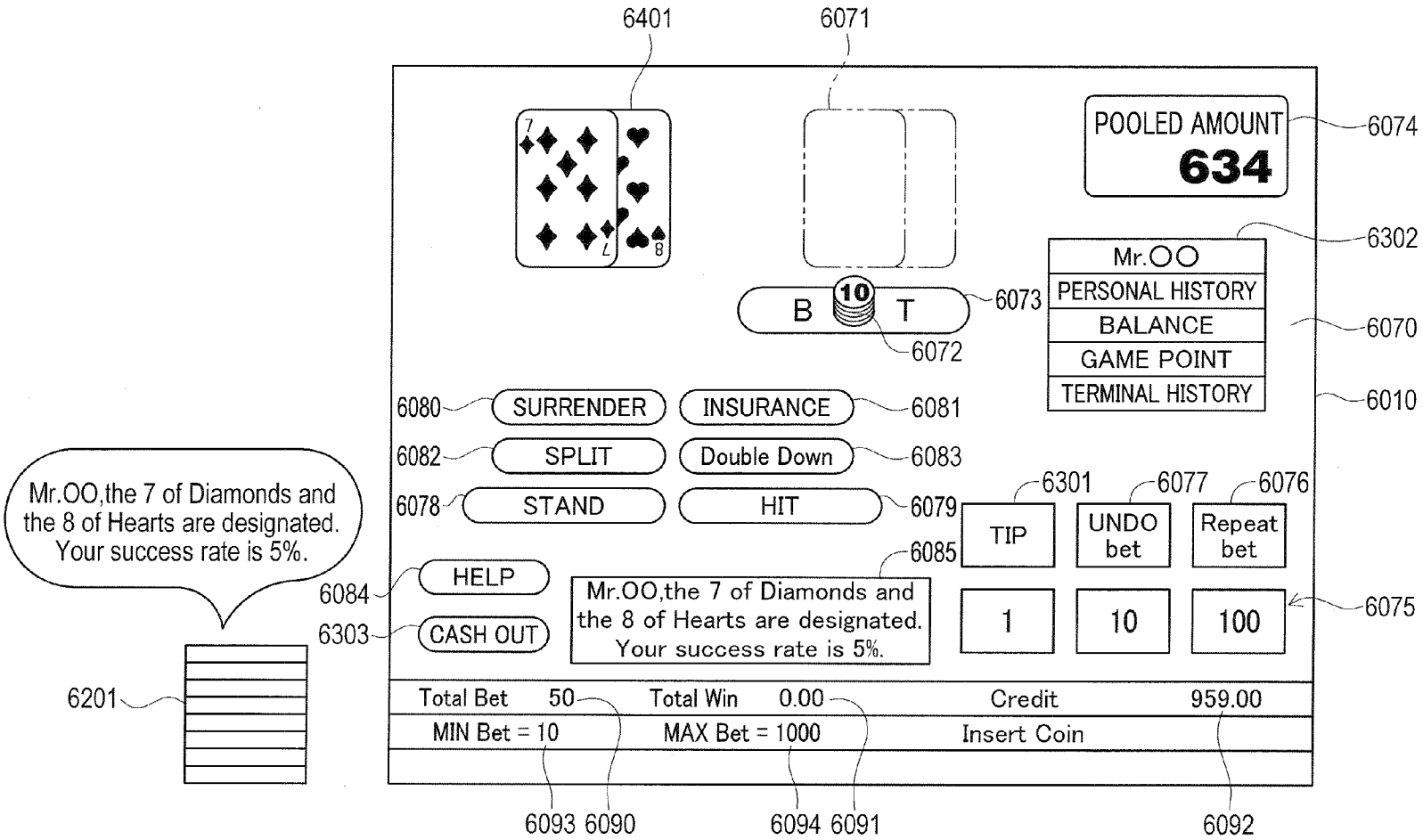
Figure 82:
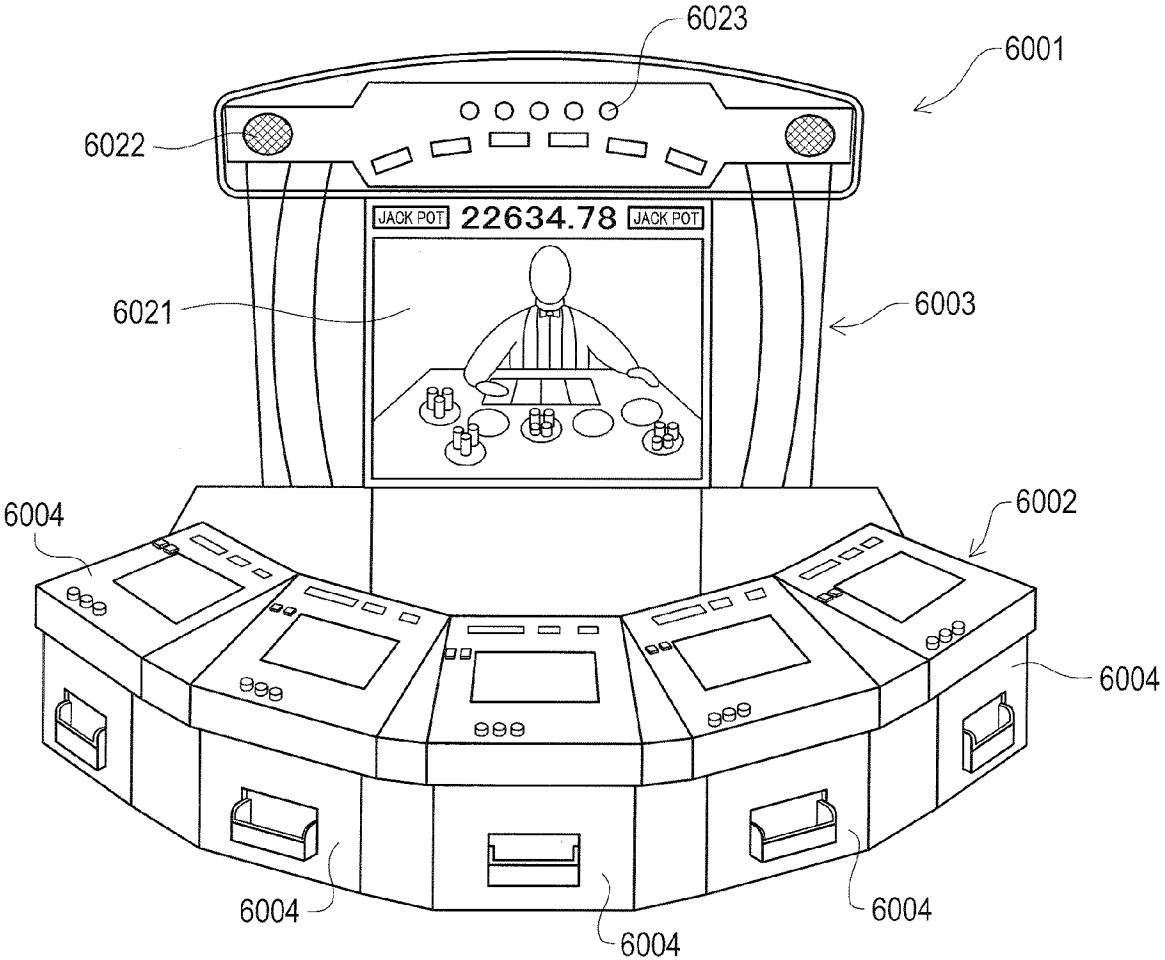
Figure 83:
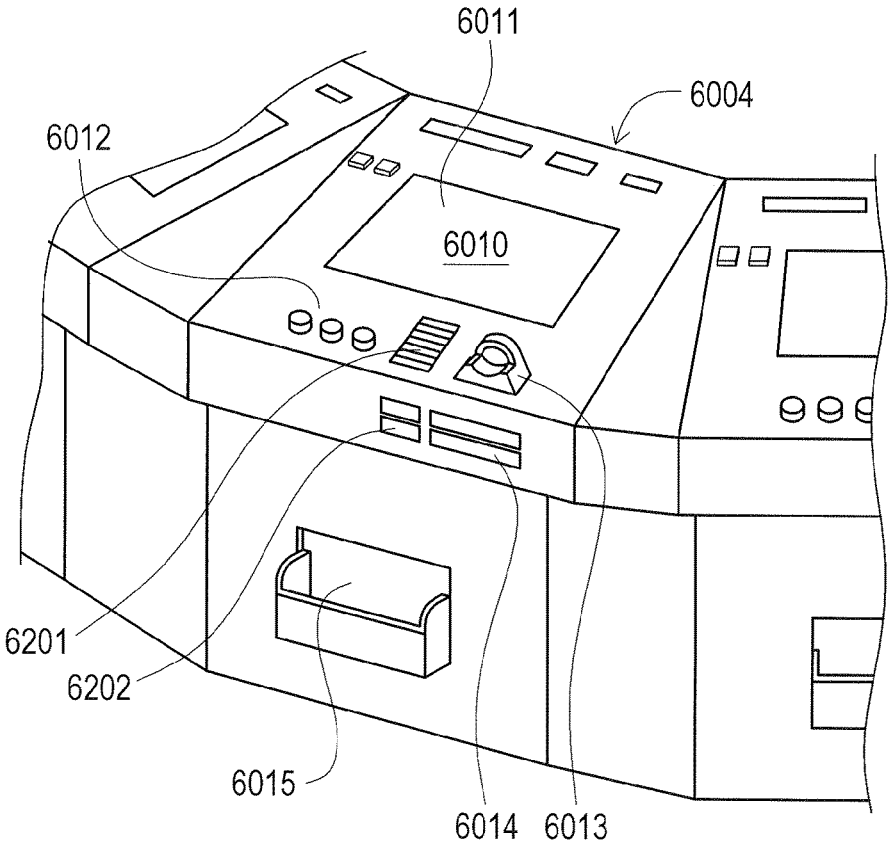
Figure 84:
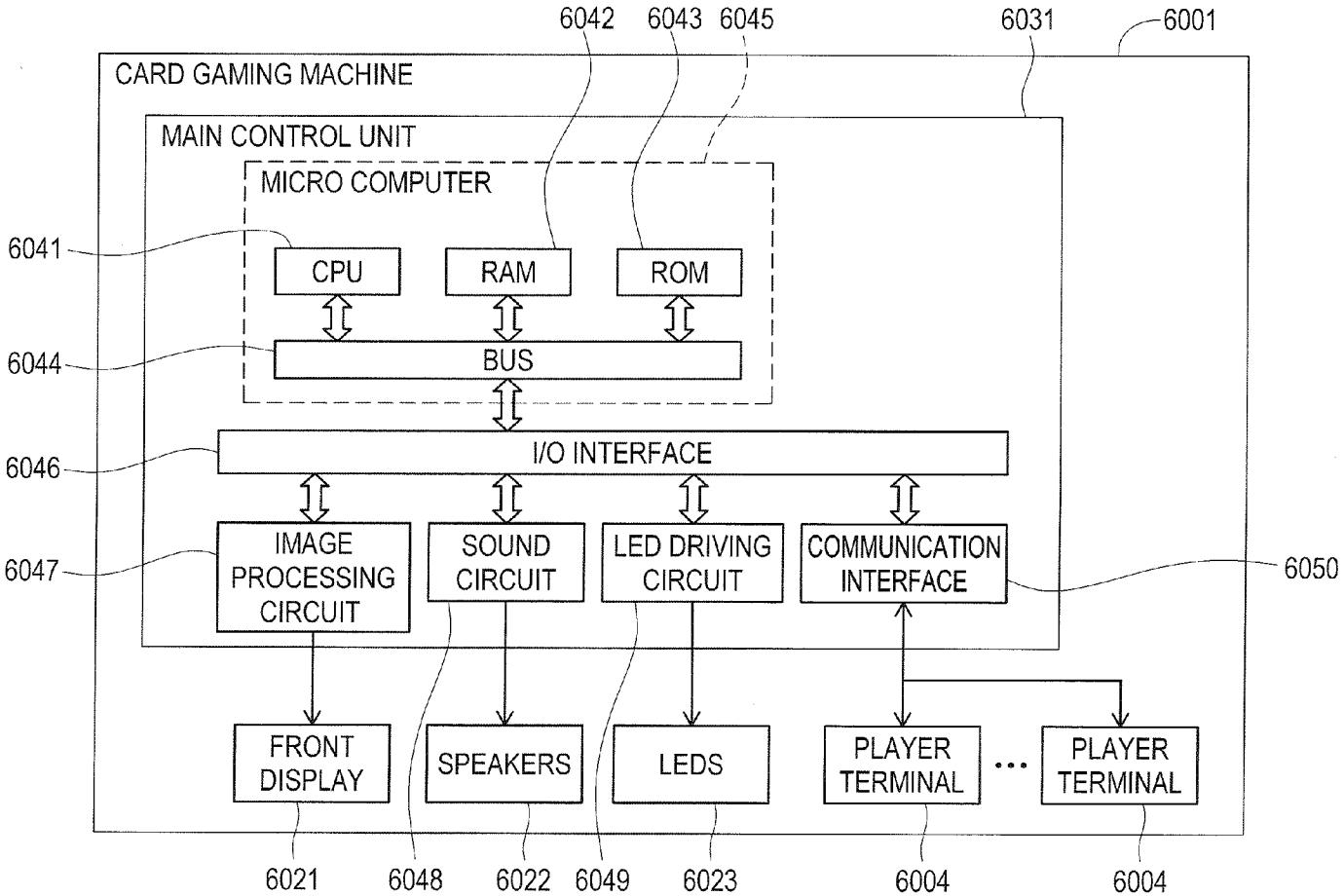
Figure 85:
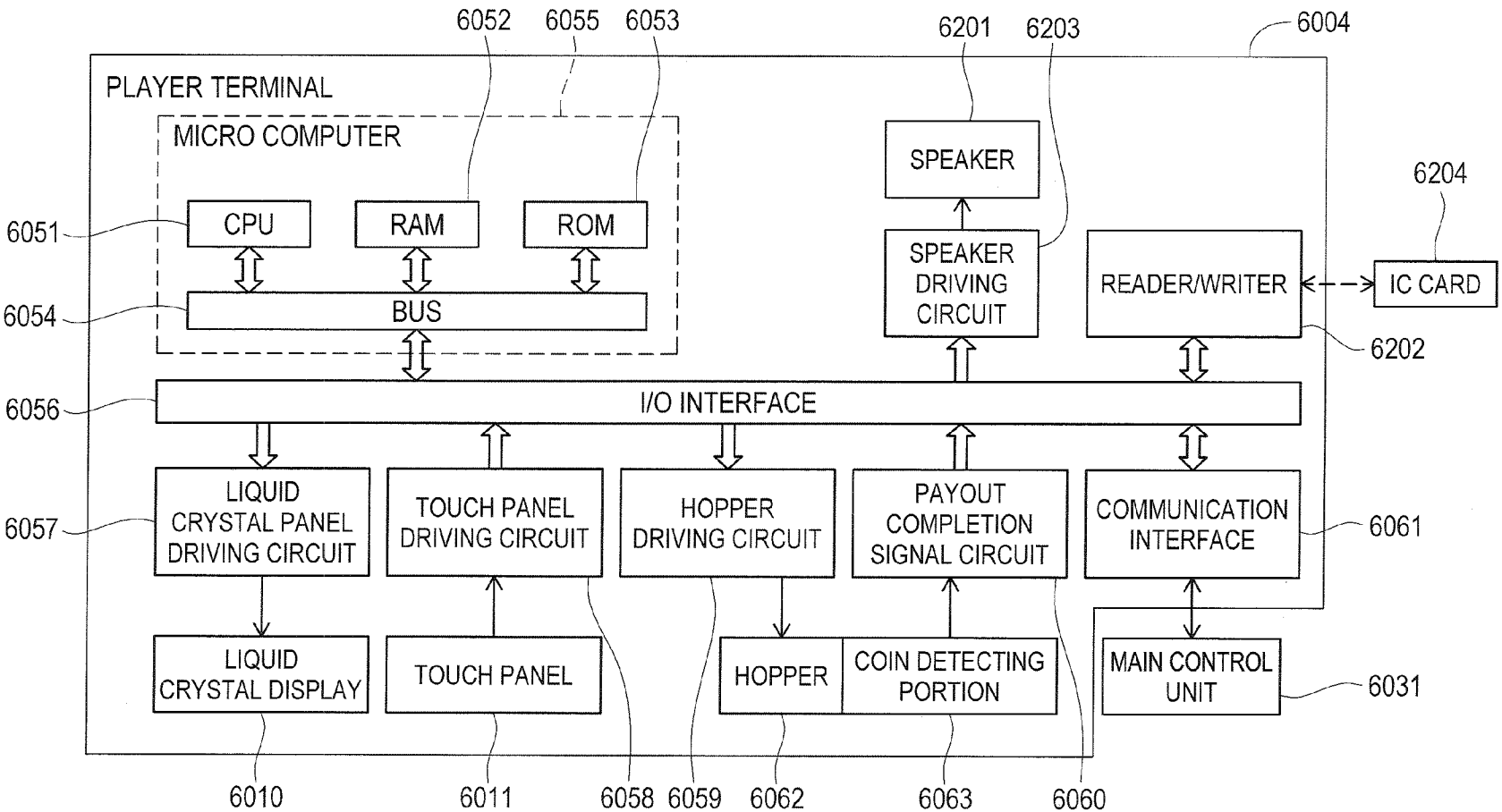
Figure 86:
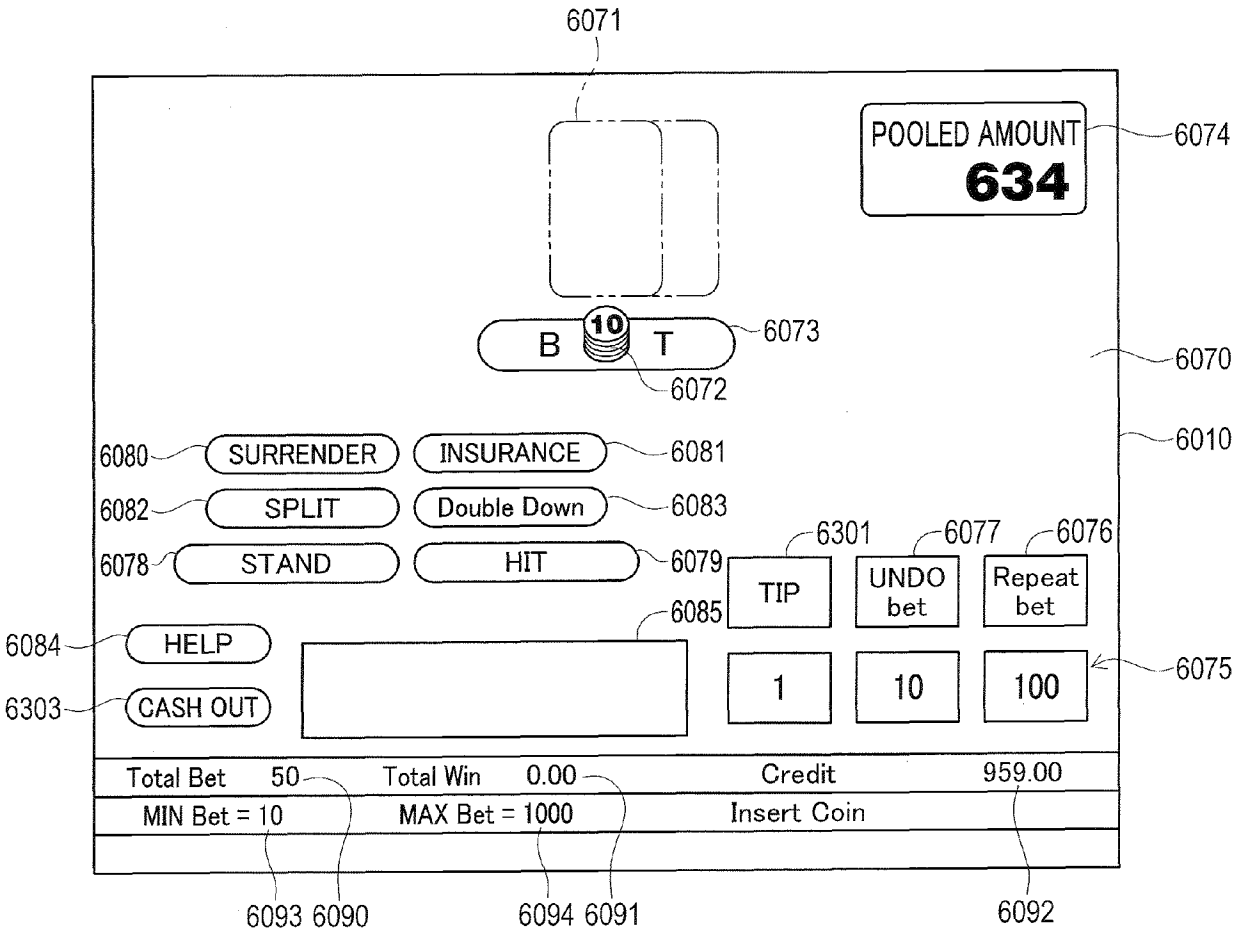
Figure 87:
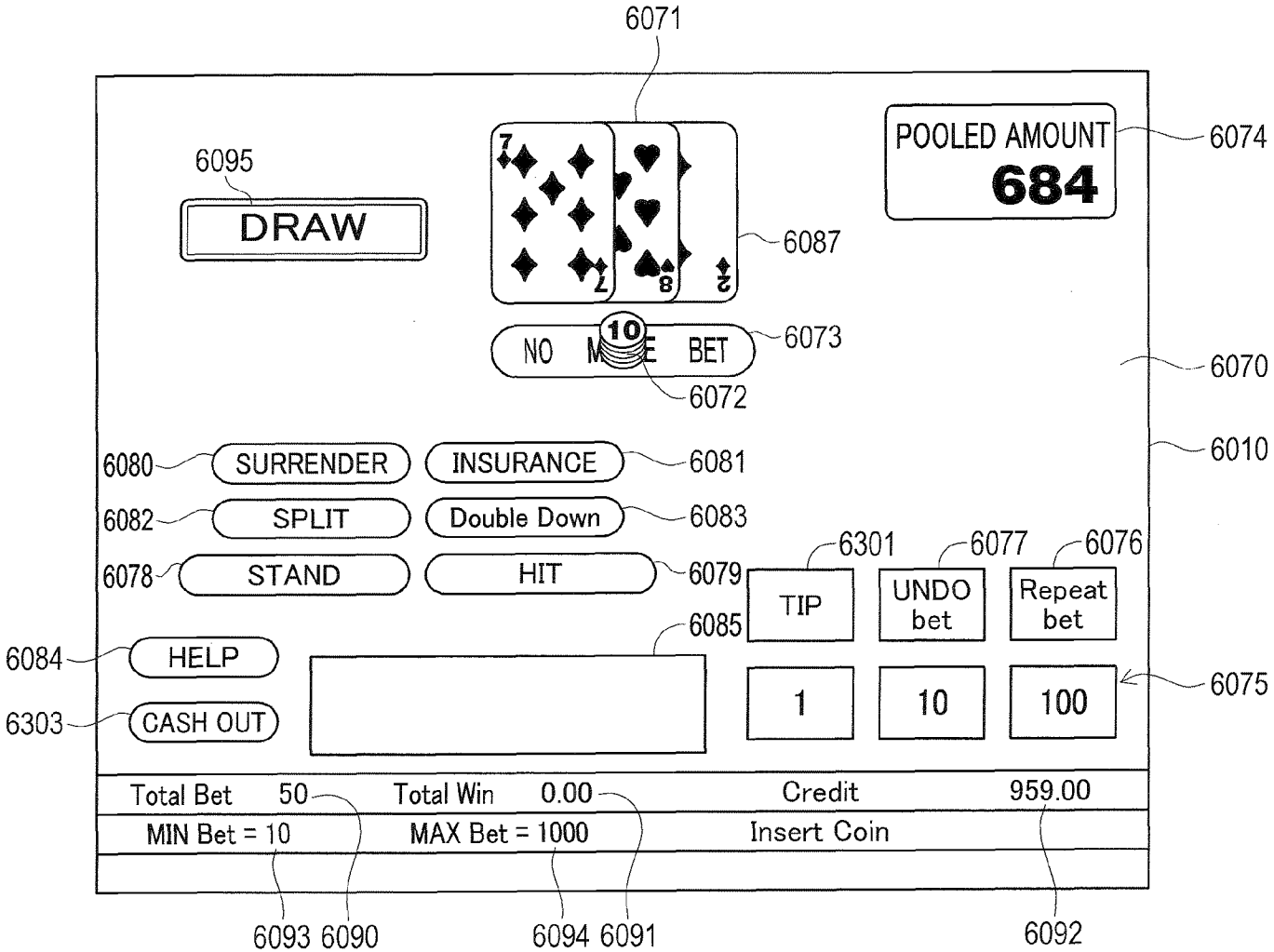
Figure 88:
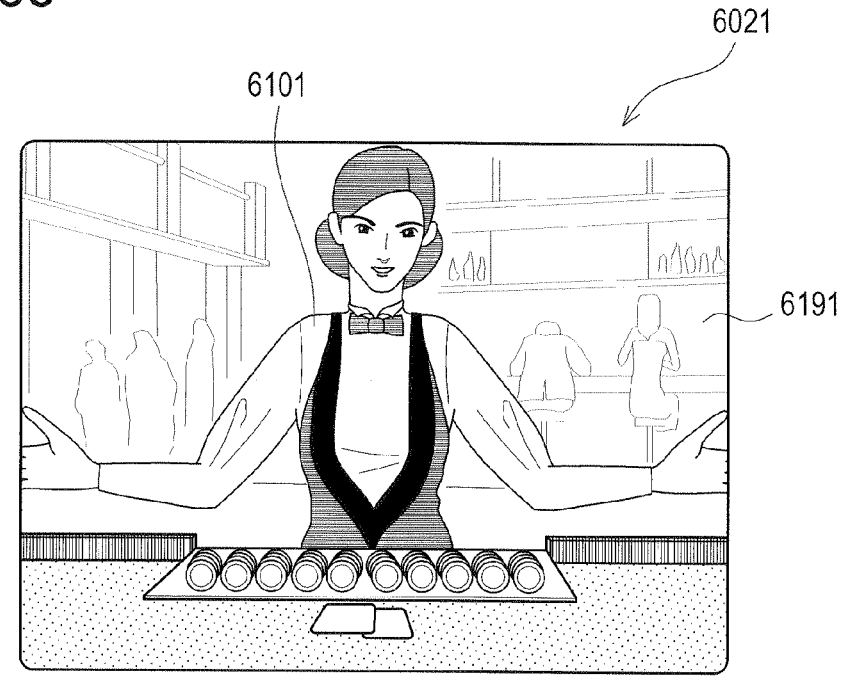

FIG. 81 is a view showing characteristics of a card gaming machine of one sixth embodiment of the present invention and an explanatory view showing a bet screen displayed on a liquid crystal display of a player terminal which the card gaming machine has;

FIG. 82 is an outline view of the card gaming machine;

FIG. 83 is an outline view of a player terminal which the card gaming machine has;

FIG. 84 is a block diagram schematically showing a control system of the card gaming machine;

FIG. 85 is a block diagram schematically showing a control system of a player terminal which the card gaming machine has;

FIG. 86 is an explanatory view showing a bet screen displayed on a liquid crystal display of a player terminal which the card gaming machine has;

FIG. 87 is an explanatory view showing a bet screen displayed on a liquid crystal display of a player terminal which the card gaming machine has;

FIG. 88 is a view showing a main screen of a case that the first dealer is selected.

Figure 89:
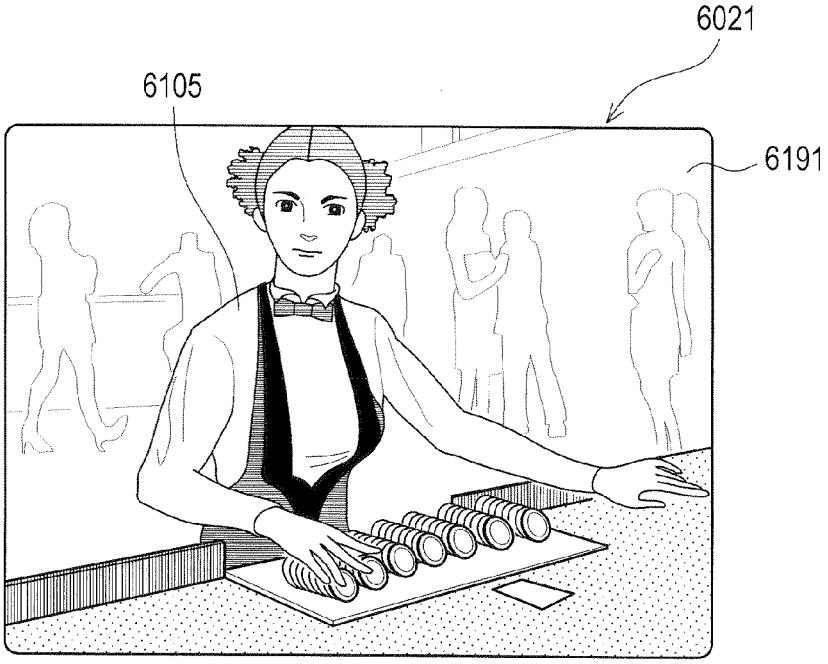

FIG. 89 is a view showing a main screen of a case that the fifth dealer is selected.

Figure 90:
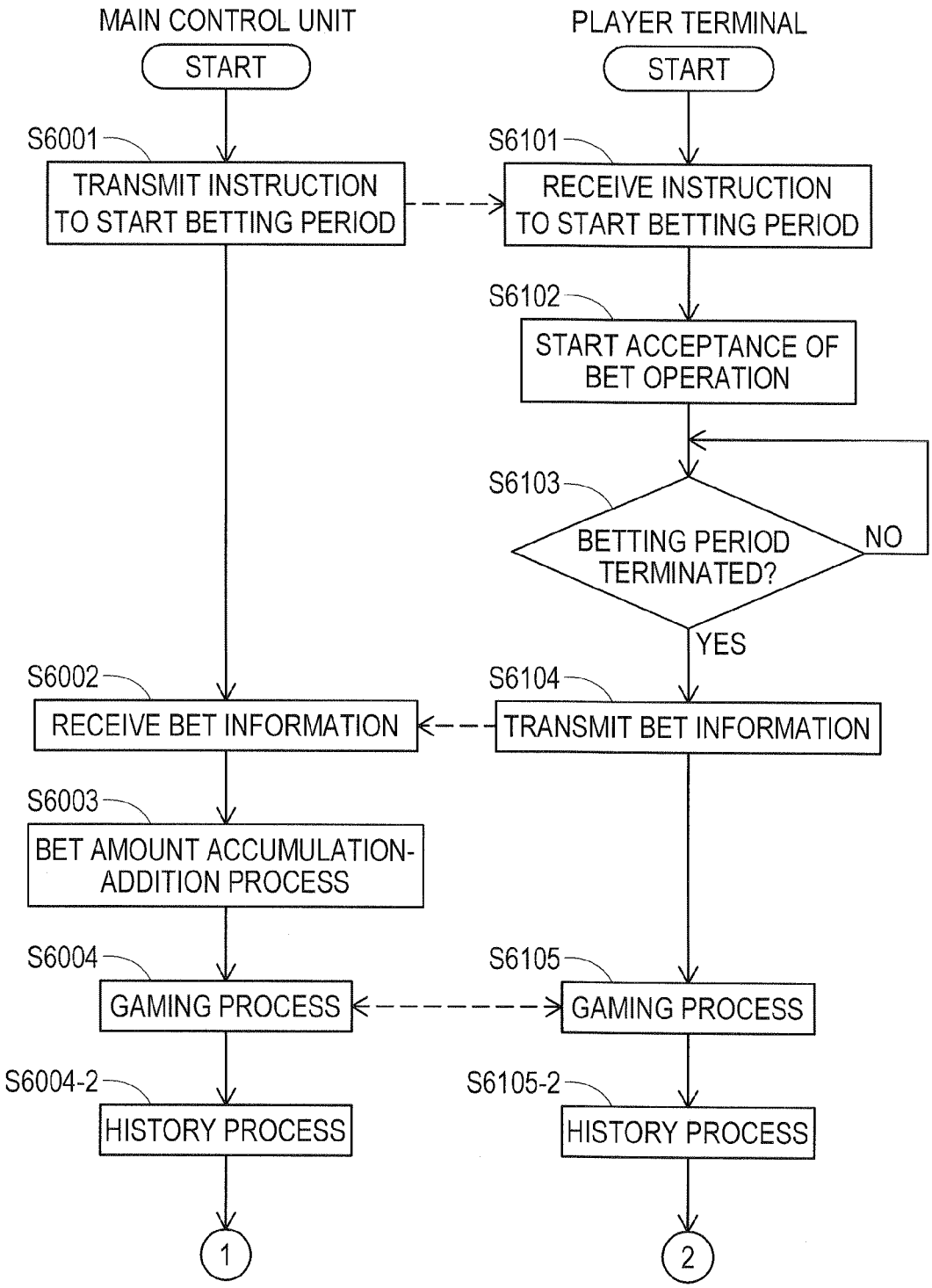
Figure 91:
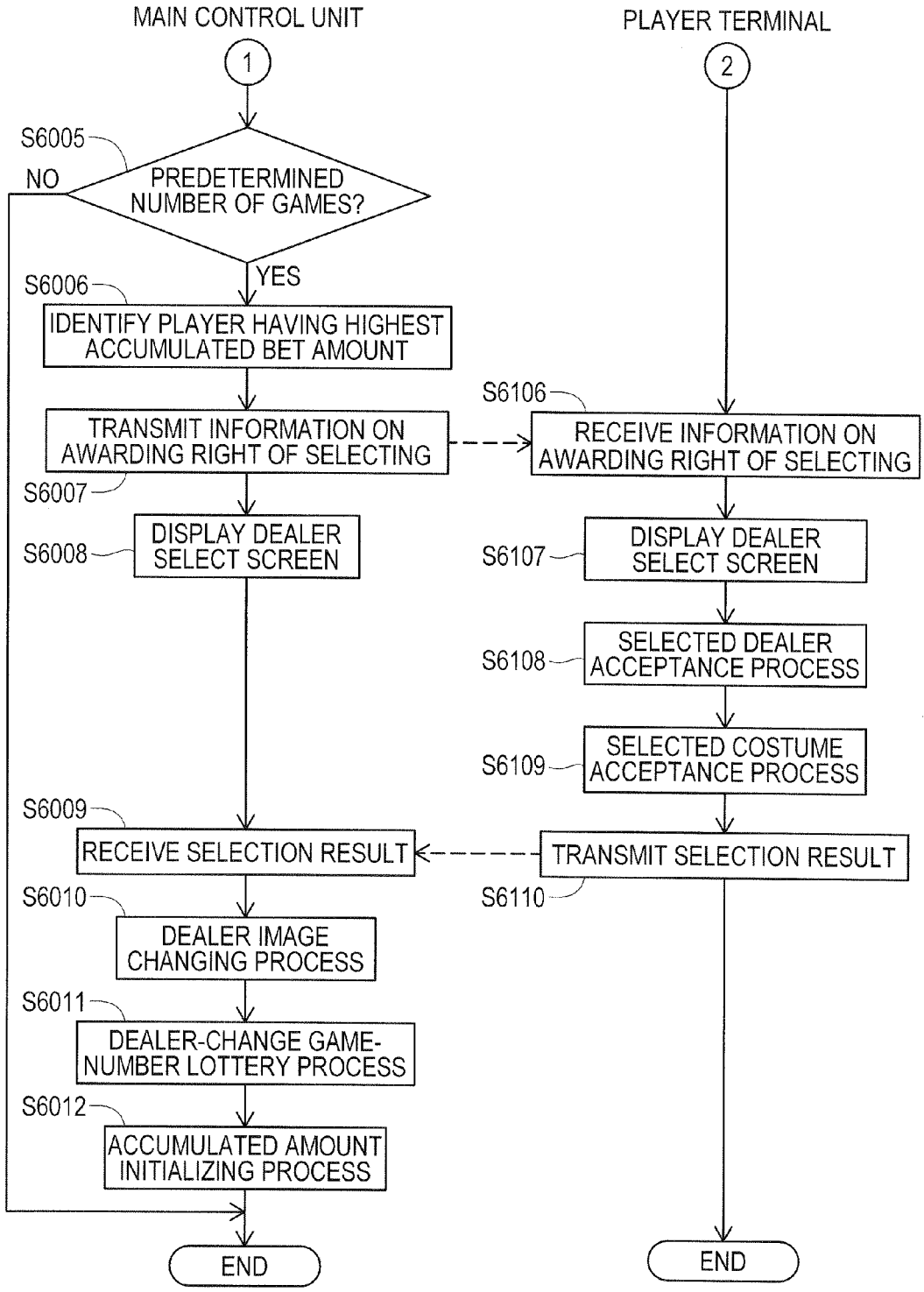
Figure 92:
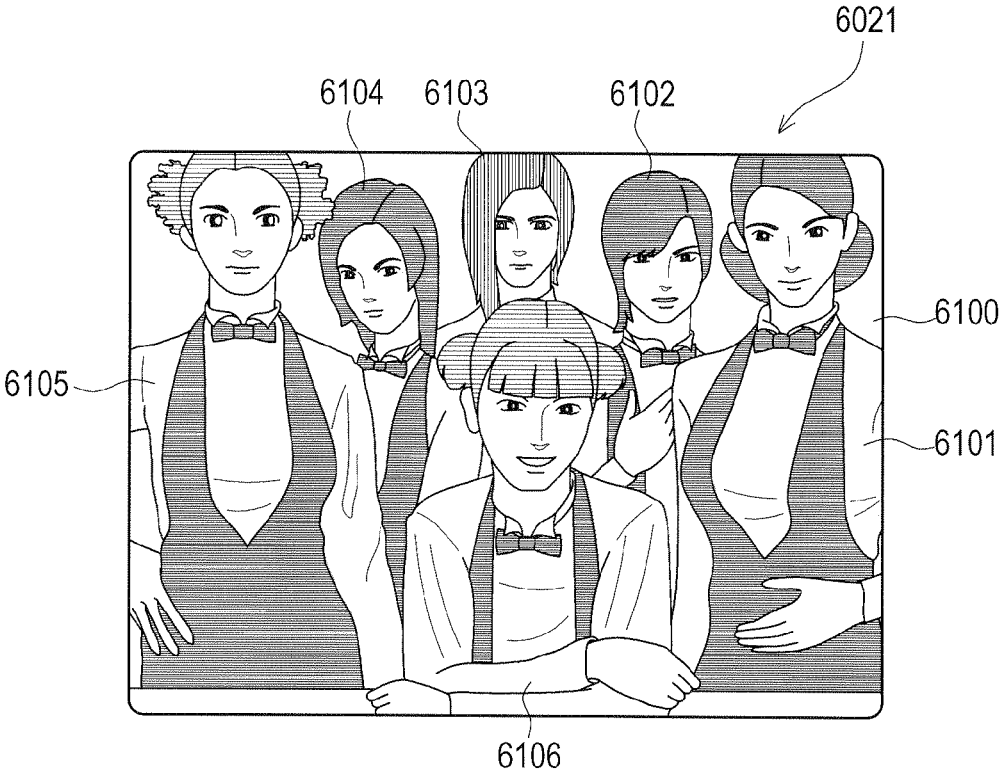
Figure 93:
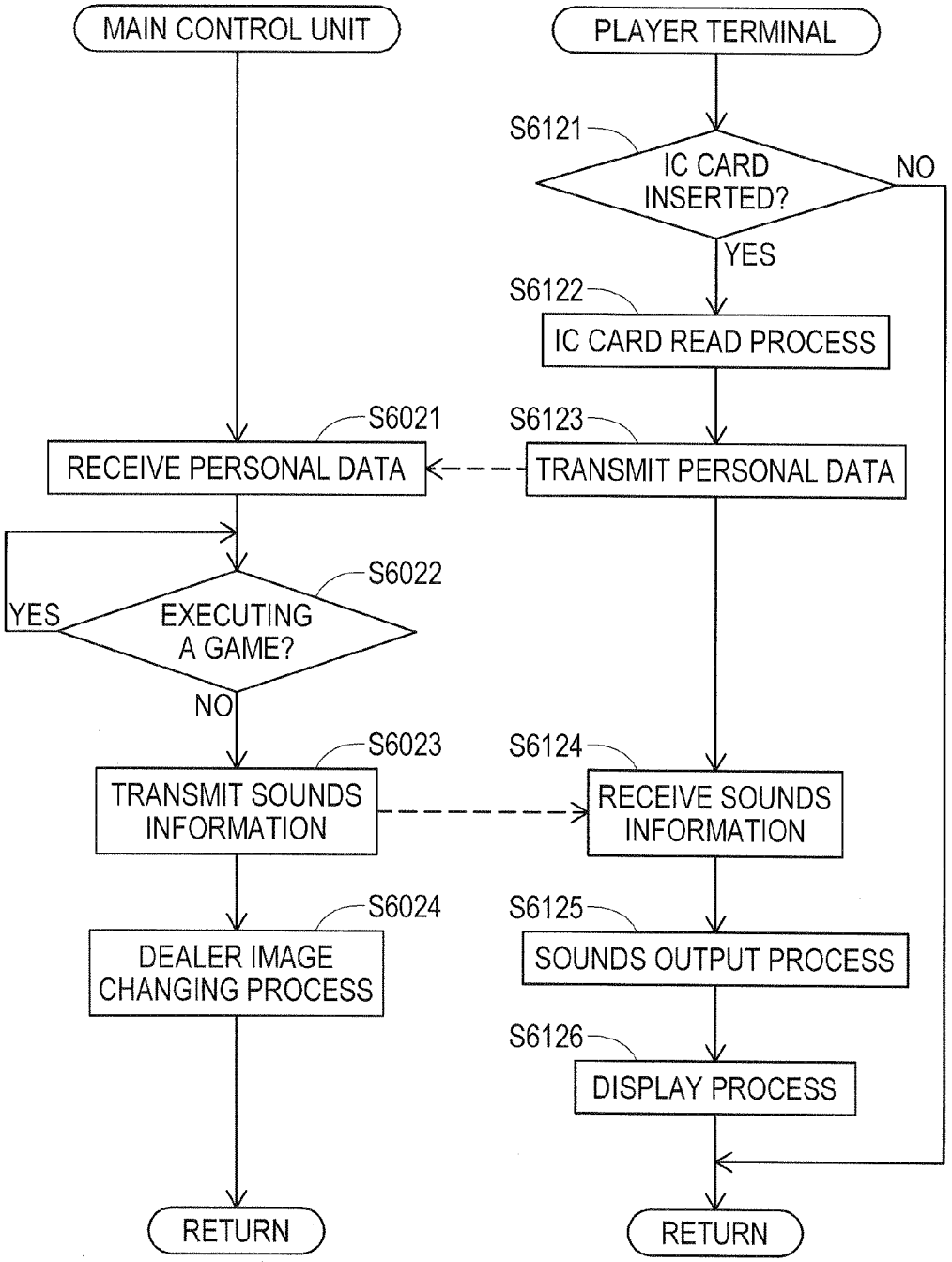
Figure 94:
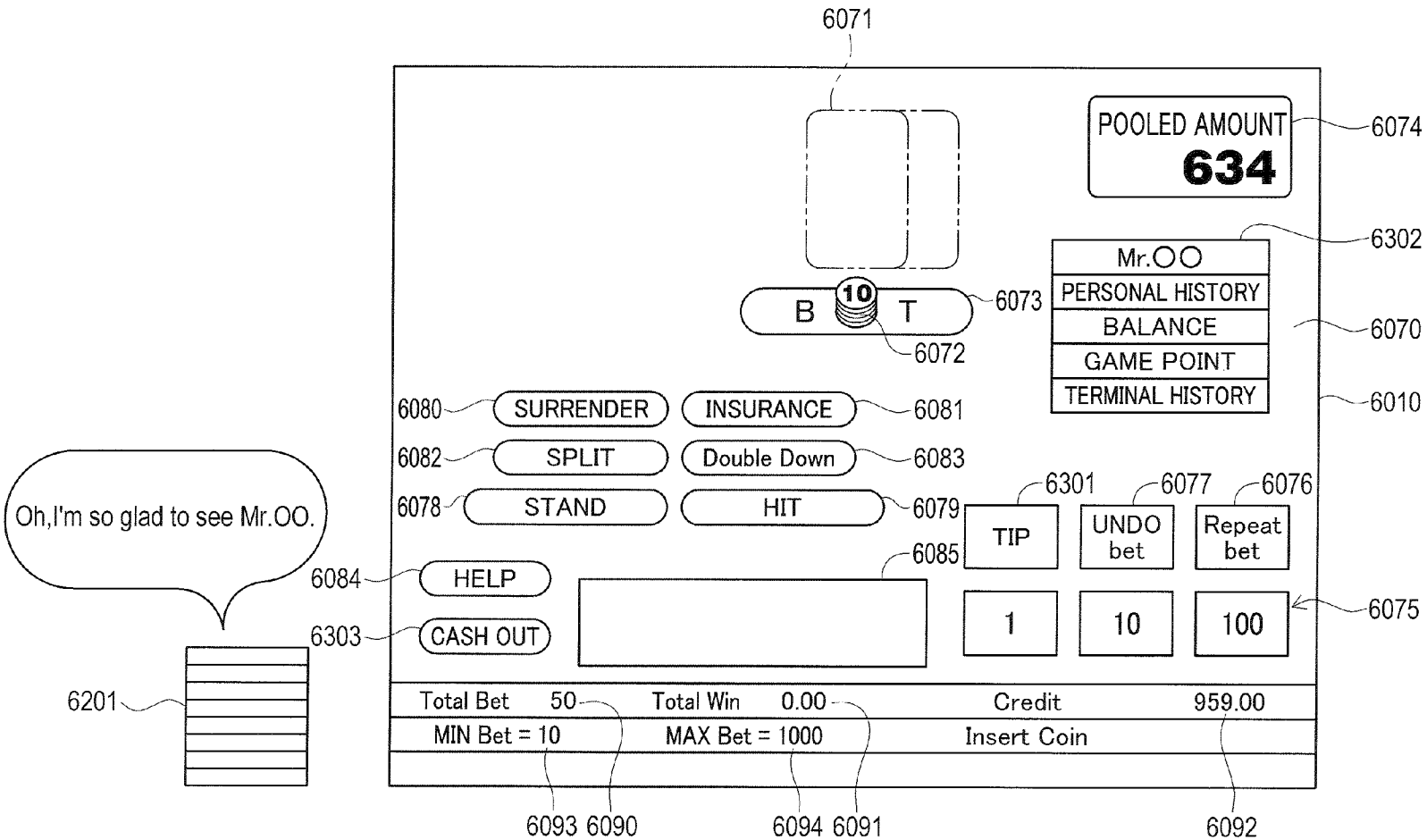
Figure 95:
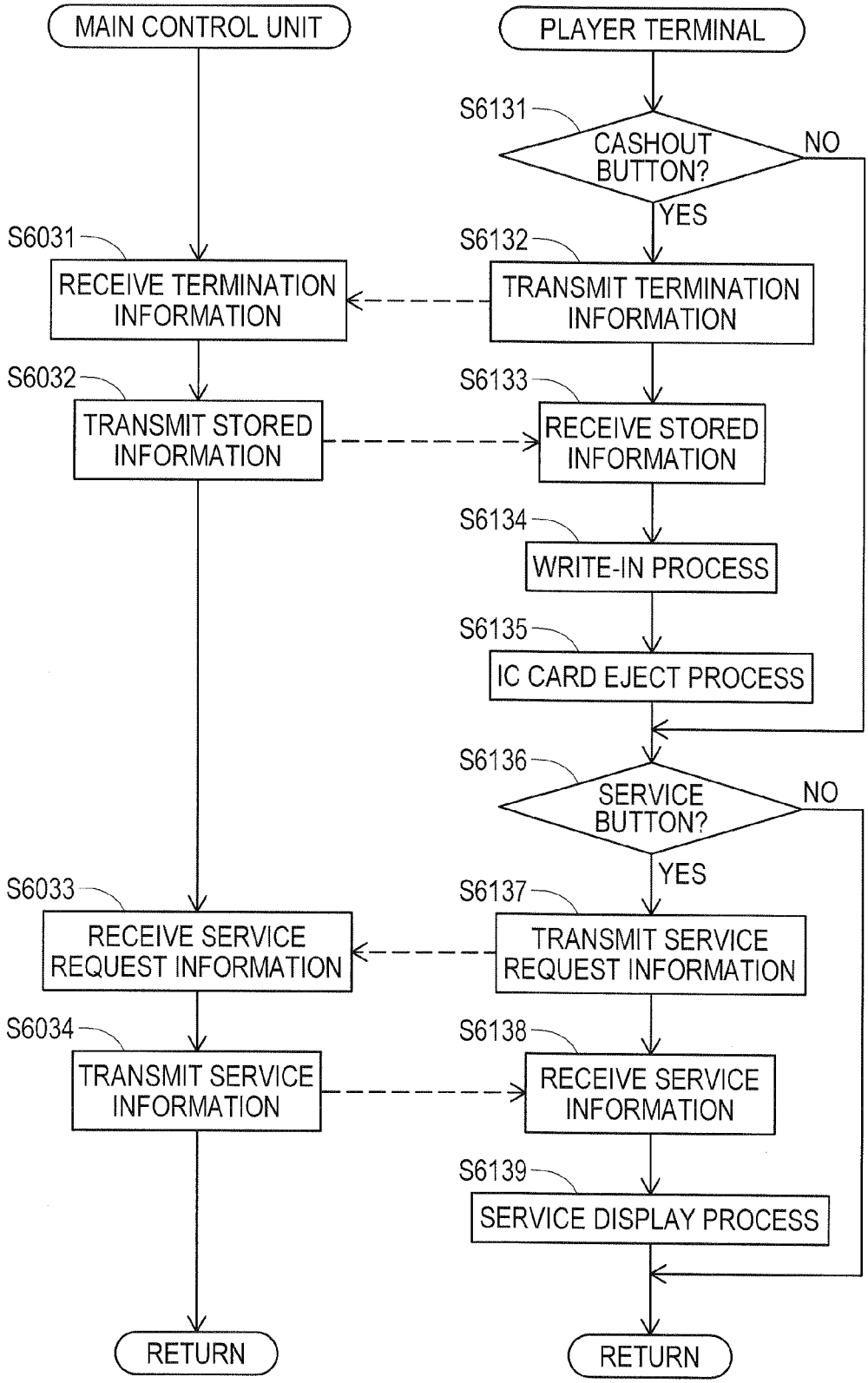
Figure 96:
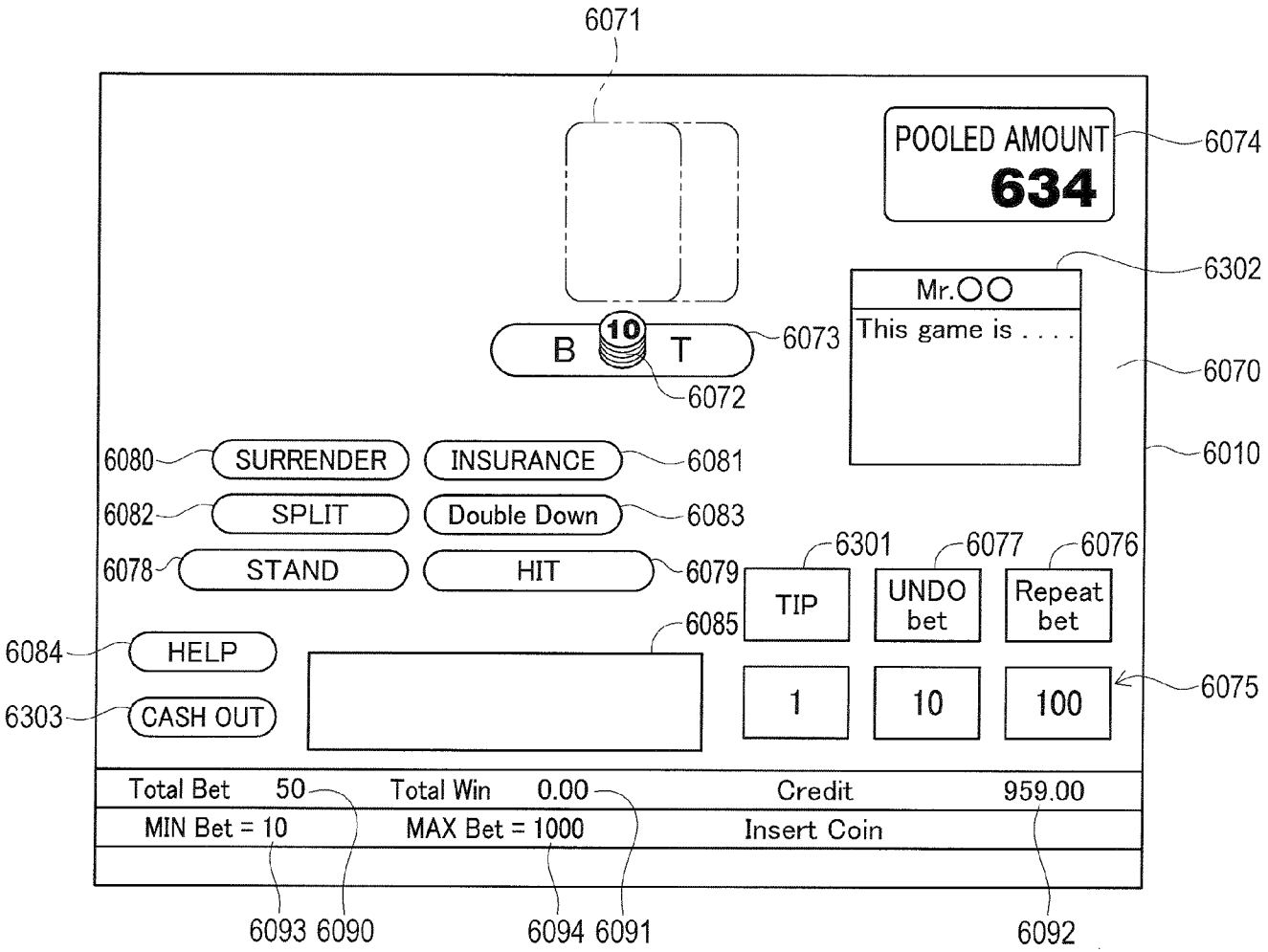
Figure 97:
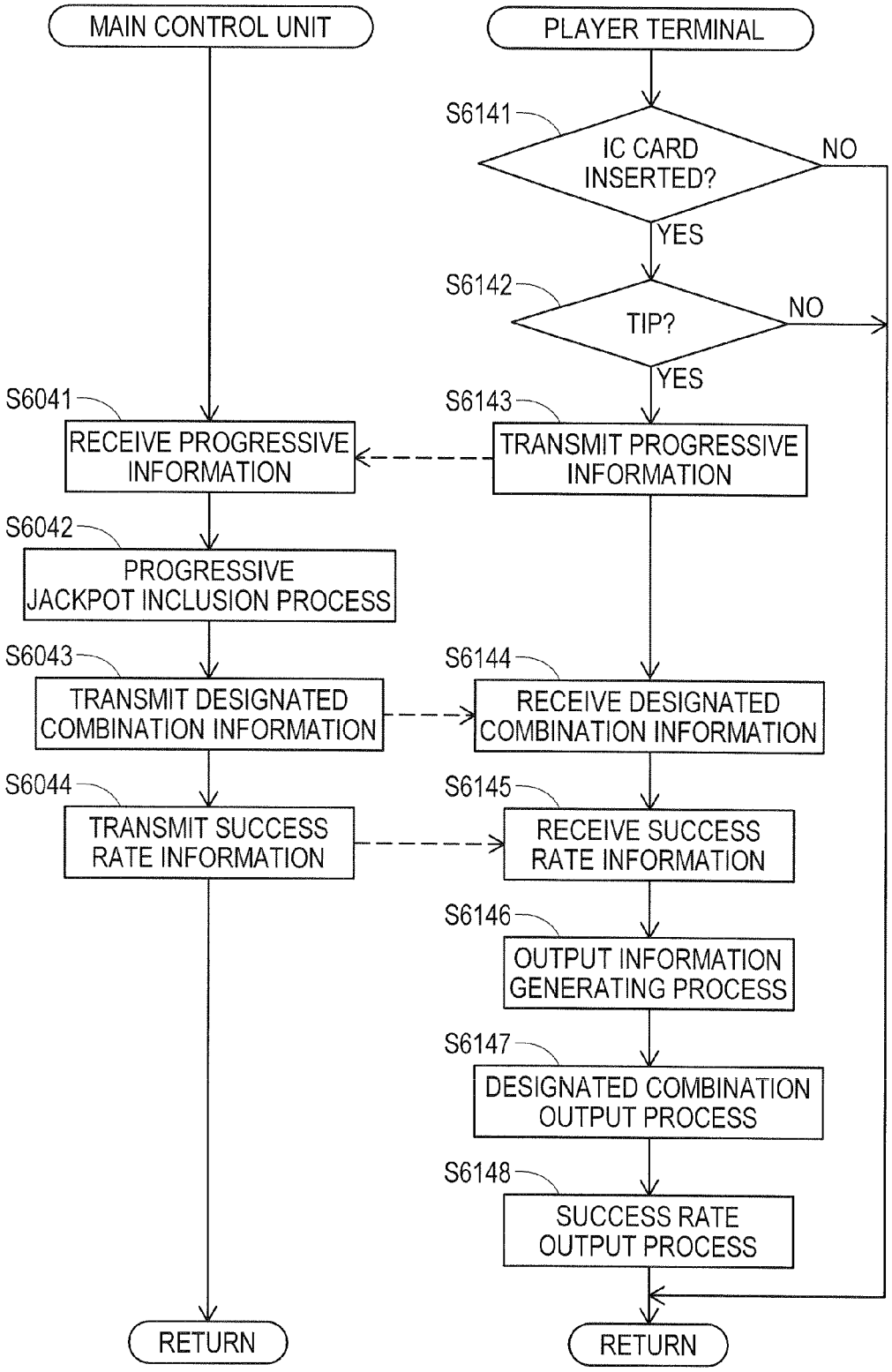
Figure 98:
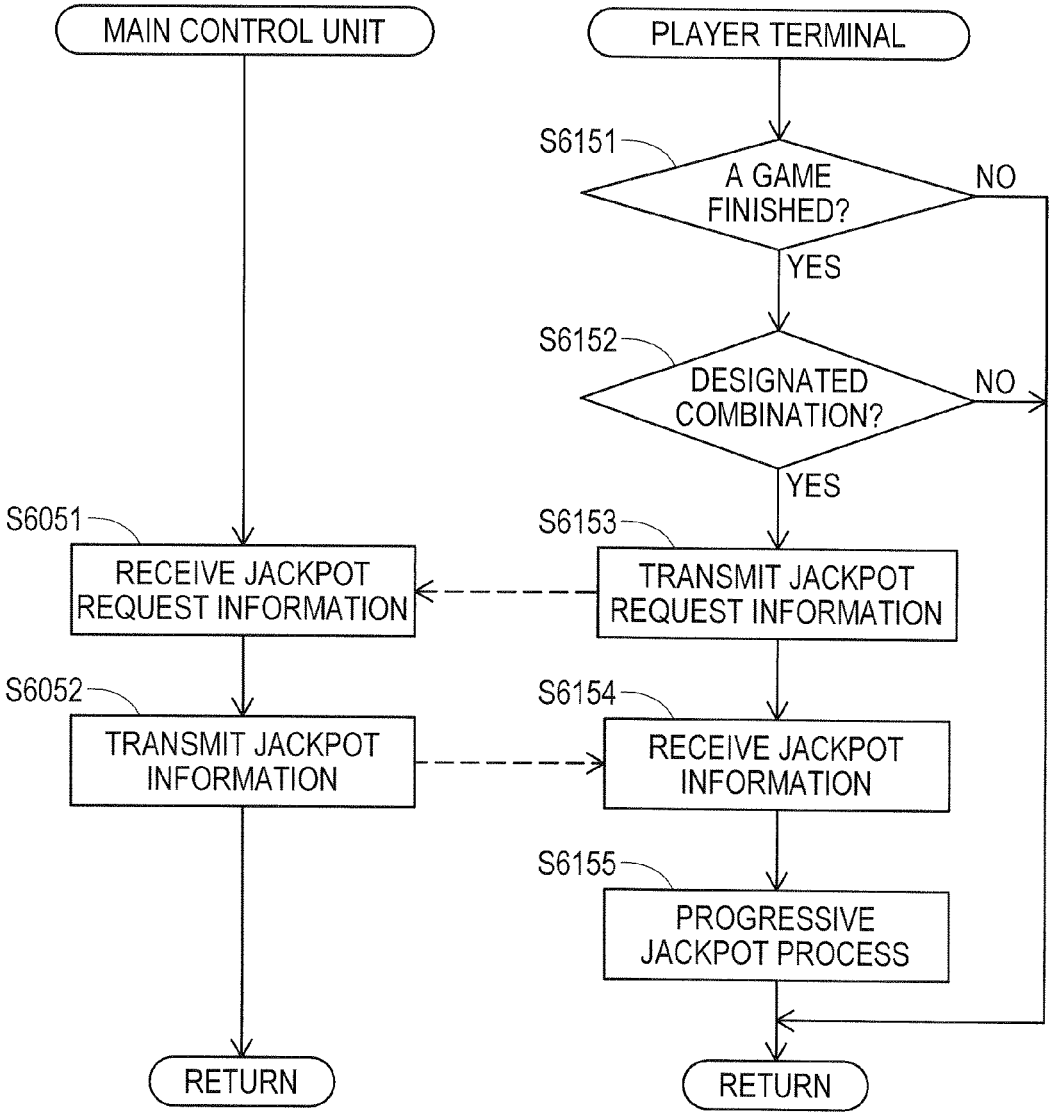
Figure 100:
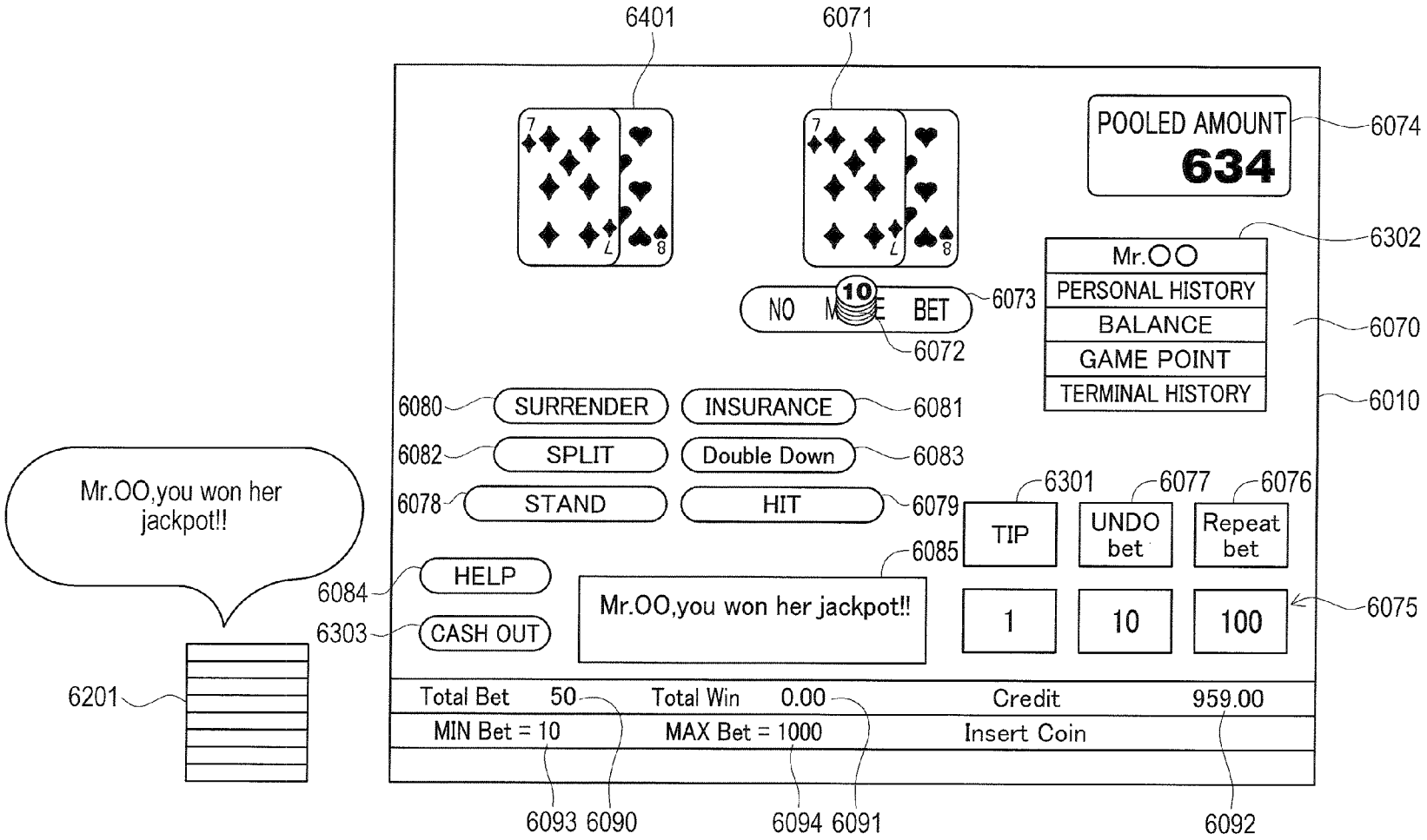

FIG. 90 is a flowchart of a main game processing program in the card gaming machine;

FIG. 91 is a flowchart of a main game processing program in the card gaming machine;

FIG. 92 is a view showing a dealer select screen of the card gaming machine;

FIG. 93 is a flowchart of an IC card processing program in the card gaming machine;

FIG. 94 is an explanatory view showing a bet screen displayed on a liquid crystal display of a player terminal which the card gaming machine has;

FIG. 95 is a flowchart of a service processing program in the card gaming machine;

FIG. 96 is an explanatory view showing a bet screen displayed on a liquid crystal display of a player terminal which the card gaming machine has;

FIG. 97 is a flowchart of a designated combination processing program in the card gaming machine;

FIG. 98 is a flowchart of a designated combination processing program in the card gaming machine;

FIG. 99 is an explanatory view showing data table which are used in the card gaming machine; and FIG. 100 is an explanatory view showing a bet screen displayed on a liquid crystal display of a player terminal of which the card gaming machine has.

DETAILED DESCRIPTION

[1. The First Embodiment]

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine, a server, and a game system according to one or more aspects of the invention will be described in detail with reference to the drawings based on an embodiment embodying one or more aspects of the invention. However, it is appreciated that one or more aspects of the present invention may be embodied in distributable (via CD and the like) or downloadable software games, console games, and the like. In this regard, the slot machine may be a virtual slot machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU", "processor", and "controller" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

In the following, based on a substantiated embodiment, description is made on a detailed description of a gaming machine according to the present invention and with reference to the drawings. Now, the gaming machine according to this embodiment is a type of a multiplayer gaming machine that comprises a plurality of player's terminals and that plays blackjack, one of card games, as a game to be executed. In the blackjack herein, first of all, each player bets a predetermined amount of gaming value. Then, if a total of numbers of subsequently dealt cards is closer to "21" than that of numbers of cards dealt to the dealer, the condition of winning a prize is satisfied, and payout of the prize according to the bet amount takes place.

Figure 1:
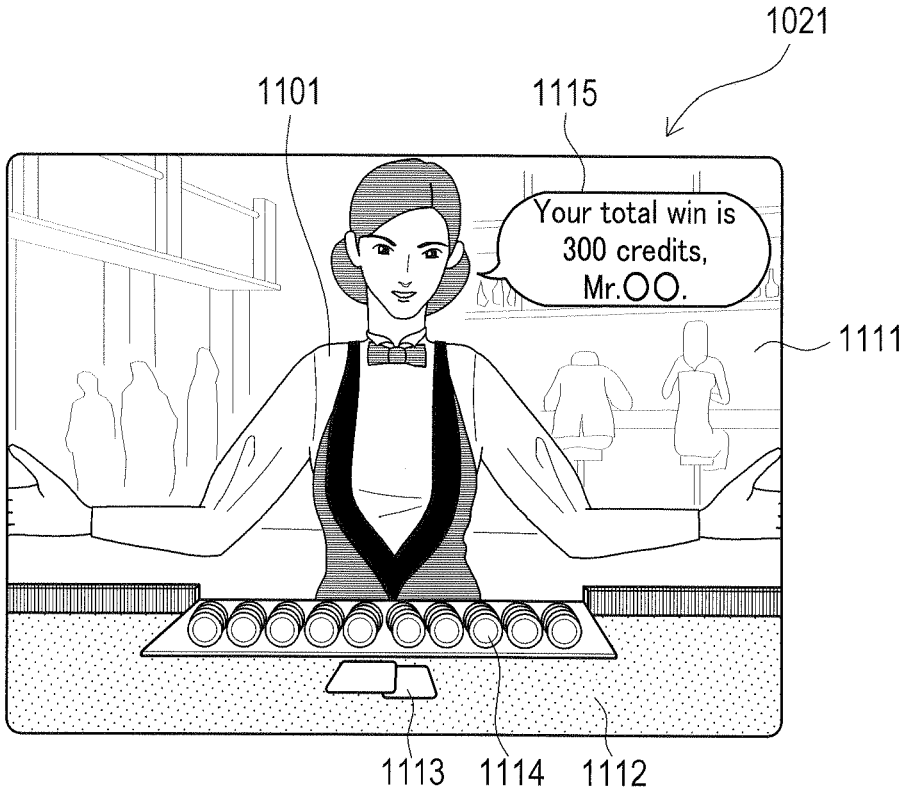
FIG. 1 is a view showing an image of a virtual dealer displayed on a gaming machine according to one embodiment of the present invention.

The gaming machine according to the invention of present application displays on a front display 1021 an image of a virtual dealer 1101 who serves to run a game, as shown in FIG. 1, in particular. The dealer displayed on the front display 1021 also takes various actions according to the progress of the game. In addition, in the gaming machine according to the invention of present application, if the player gave the dealer a tip that is not associated with a prize, separately from a bet operation for obtaining the prize, an image of the dealer who behaves according to personal data or gaming history of the player who gave the tip is displayed or dealer's voice according to personal data or gaming history of the player who gave the tip is output. For instance, an image of the dealer calling out a name of the player who gave the tip or pays an advice to the player who gave the tip is displayed on the front display 1021.

Figure 2:
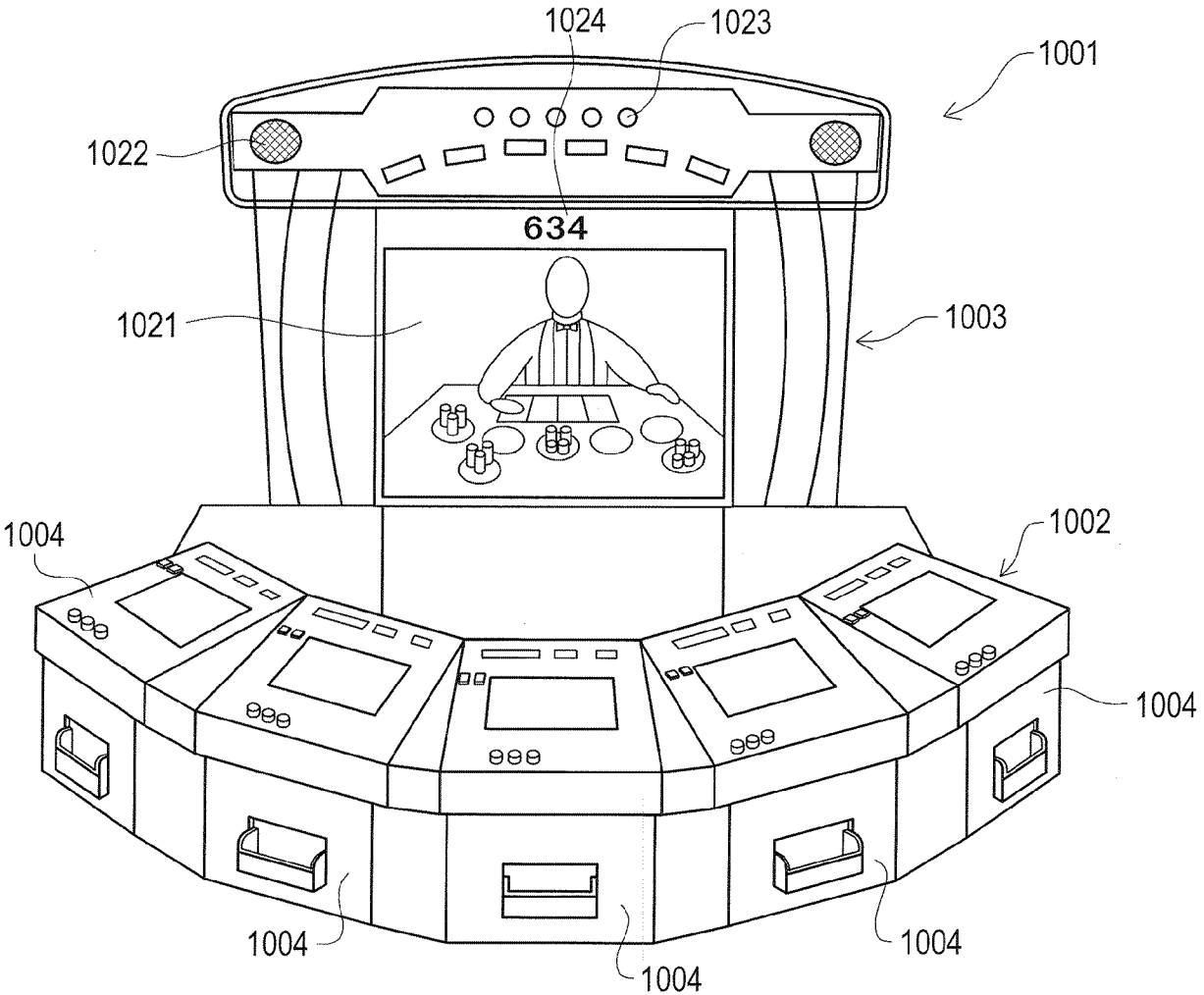
FIG. 2 is an external view of a gaming machine according to one embodiment of the present invention.

With reference to FIG. 2, description is made on the schematic configuration of a gaming machine 1001 according to this embodiment FIG. 2 is an appearance diagram of the gaming machine 1001 according to this embodiment.

Basically, a gaming machine 1001 according to this embodiment comprises a table portion 1002 where players takes a seat and plays a game, and a panel portion 1003 that is placed behind the table portion 1002 and that displays an animation picture of the dealer, etc.

Figure 3:
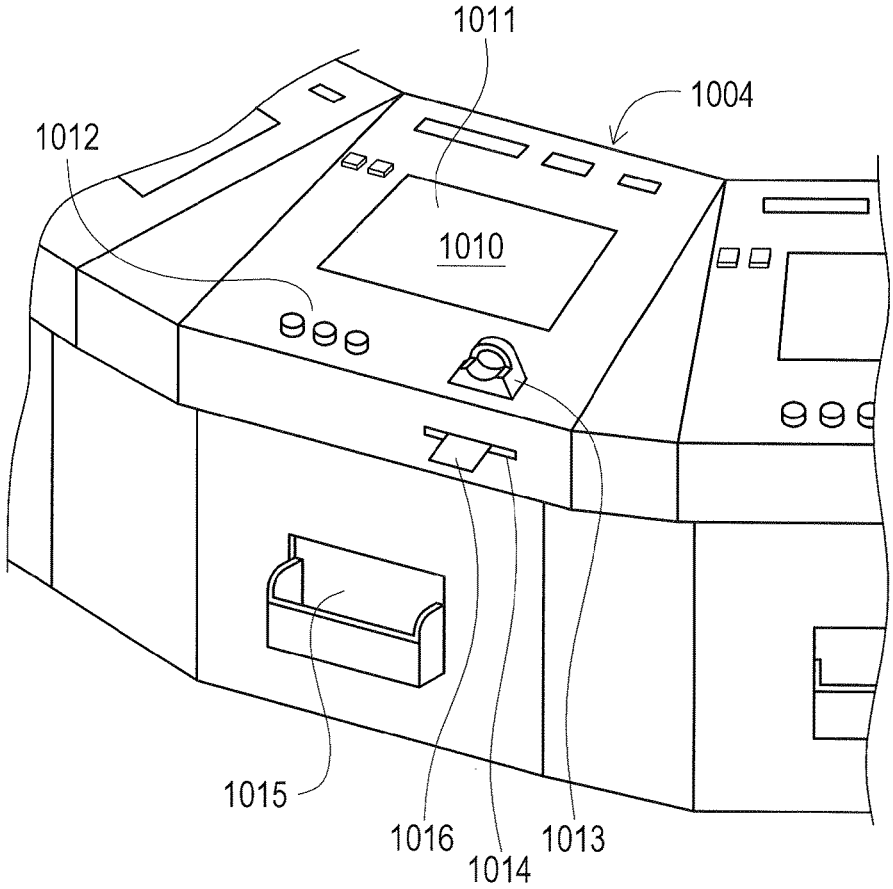
FIG. 3 is an external view of a player's terminal according to one embodiment of the present invention.

In the following, the table portion 1002 is first described. In the table portion 1002, more than one (5 units in FIG. 2) player's terminals called a satellite are positioned almost in fan-like fashion. FIG. 3 is an appearance diagram showing one player's terminal 1004 according to this embodiment.

As shown in FIG. 3, the player's terminal 1004 comprises a liquid crystal display 1010 for displaying a bet screen to be described later (refer to FIG. 6 and FIG. 7) or gaming results, etc., a touch panel 1011 that is positioned on the front face of the liquid crystal display 1010 and that is used in selecting a button to be displayed on the liquid crystal display 1010 when selecting a bet target or setting a bet amount, operation buttons 1012 for executing payout operation, etc., a coin insertion slot 1013 through which a coin or medal is inserted, a card insertion slot 1014 into which an ID card containing player's personal data is inserted, and a coin payout port 1015 that pays out a coin or medal corresponding to credit being pooled when the payout operation is executed.

Furthermore, as shown in FIG. 2, the panel portion 1003 comprises the front display 1021 that displays an image of a dealer who deals cards or passes CHIPS, or contents of dealt card, speakers 1022 that are positioned on the upper part of the front display 1021 and output music, sound effect, and the dealer's voice in accordance with the progress of a game, and LEDs 1023 that are turned on during various types of effects.

Additionally, a pooled amount display portion 1024 is provided on the upper part of the front panel 1021. In the gaming machine 1001 according to this embodiment, as will be described below, when the player gave a tip to the dealer, a predetermined percentage of the given a tip (e.g., 10%) is pooled in the pot, and is paid out collectively when the hand (combination) of the player's card achieves "blackjack" of spades. Then, the currently pooled amount is displayed on the pooled amount display portion 1024.

Figure 7:
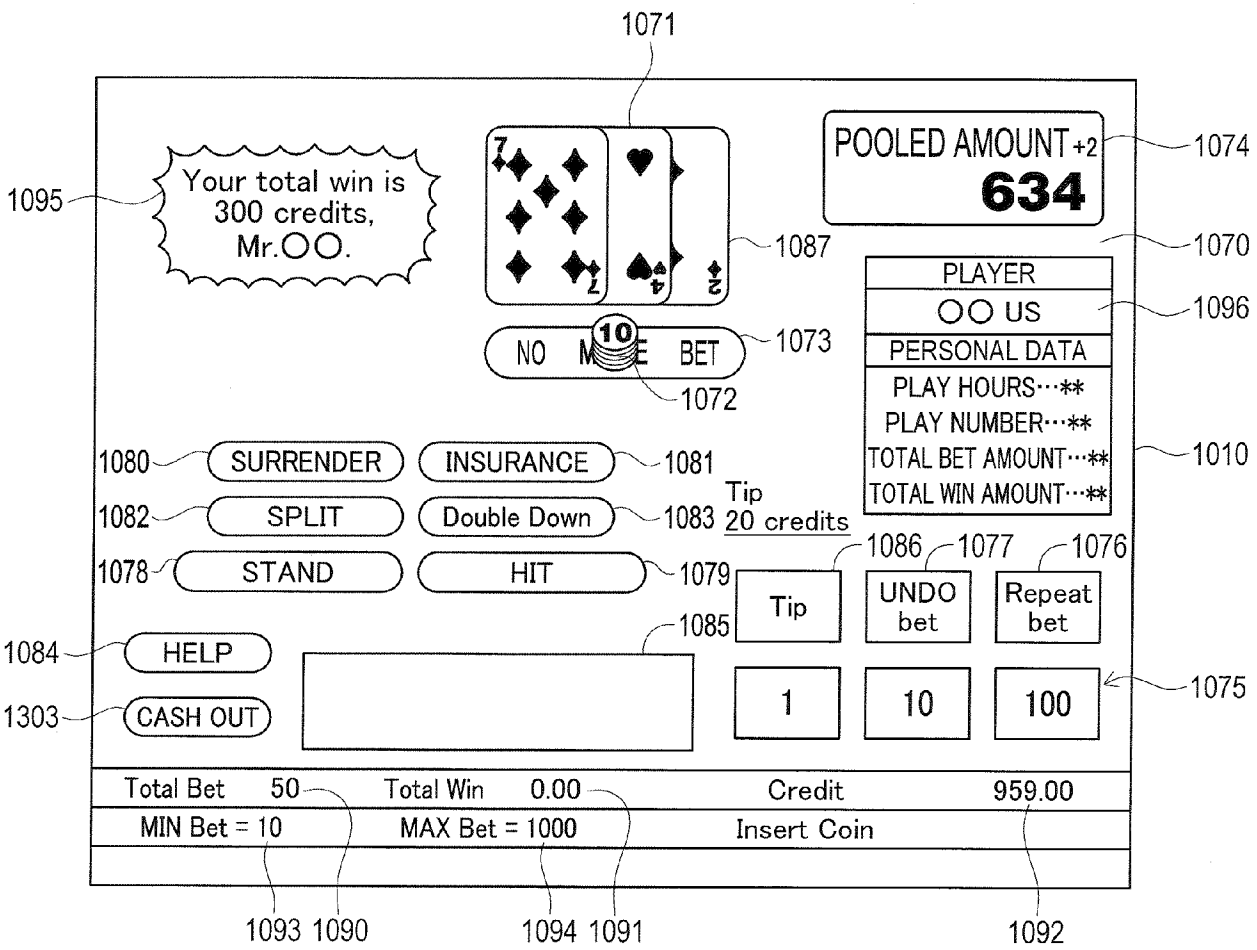
FIG. 7 is a view showing a bet screen which is displayed on a liquid crystal display in a player's terminal according to one embodiment of the present invention.

Here, the cards to be used in the gaming machine 1001 according to the present embodiment are the tramp cards which are generally employed, and display a "mark" consisting of a "suit" and "number" (refer to FIG. 7).

Here, "suit" refers to the mark of a tramp card and includes the spade, heart, diamond and club.

The "number" refers to the number or alphabetical character on the tramp cards and includes A (Ace, corresponding to 1), 2, 3, 4, 5, 6, 7, 8, 9, 10, J (Jack, corresponding to 11), Q (Queen, corresponding to 12) and K (King, corresponding to 13).

The "mark" refers to the card's type which is decided based on the combination of the "suit" and "number" of the tramp card, and includes, for instance, "A of hearts", "K of spades" and the like.

Furthermore, the card insertion slot 1014 provided in the player's terminal 1004 is an insertion slot into which an ID card 1016 is inserted. The ID card 1016 is a card in which player's personal data or gaming history is stored, and a player obtains it in advance in a shop either being charged or free of charge. When a player obtains an ID card and enters his/her name, sex, age, nationality, etc., the personal data is stored in the ID card 1016. At the same time, by the player playing a game with his/her ID card 1016 inserted into the card insertion slot 1014, the gaming history (e.g., the number of games played with the gaming machine 1001, game hours, gaming value used in the games, winning rate, total won prizes, etc.) is stored or updated in the ID card 1016.

Furthermore, the gaming machine 1001 has a card reader/writer 1017 which is read or writes a data is stored in the ID card 1016 into the card insertion slot 1014 (refer to FIG. 1).

Furthermore, in the gaming machine 1001 according to this embodiment, if a player gave a tip to a dealer, personal data or gaming history of the player who gave the tip is acquired through the ID card 1016 and the card reader/writer 1017.

In the following, description is made on a method of playing the gaming machine 1001 configured as described above. A player who is to play a game takes a seat in front of the player's terminal 1004, and places a bet depending on a desired bet amount, using the bet screen displayed on the liquid crystal display 1010. In addition, the player can arbitrarily give a tip to the dealer, in addition to the betting operation. Then, the images of cards dealt to the player and the dealer, respectively, are displayed on the front display 1021 and respective liquid crystal displays 1010. Furthermore, if there is any player who gave a tip to the dealer, on the front display 1021 is displayed an image 1101 of the dealer who takes action that is different from normal ones according to personal data or gaming history of the player who given the tip. Furthermore, the dealer's voice that is different from normal one is output from the speakers 1022 according to the personal data or gaming history of the player who gave the tip. Then, based on kinds of dealt cards, an effect image that decides a winner from either the player or dealer, or an effect image that calls a draw is displayed. In addition, in each player's terminal 1004, if the player has beaten the dealer, as a prize he/she is awarded with credit that is twice as much as the bet amount (credit number) that was bet. In contrast, if the player was beaten by the dealer, he/she cannot be awarded with a prize. Furthermore, if the player drew with the dealer, credit equivalent to the bet amount that was bet is returned to the player. In addition, if the hand of the player's cards is blackjack, the pooled amount that has been so far pooled in the pot is paid out.

Figure 4:
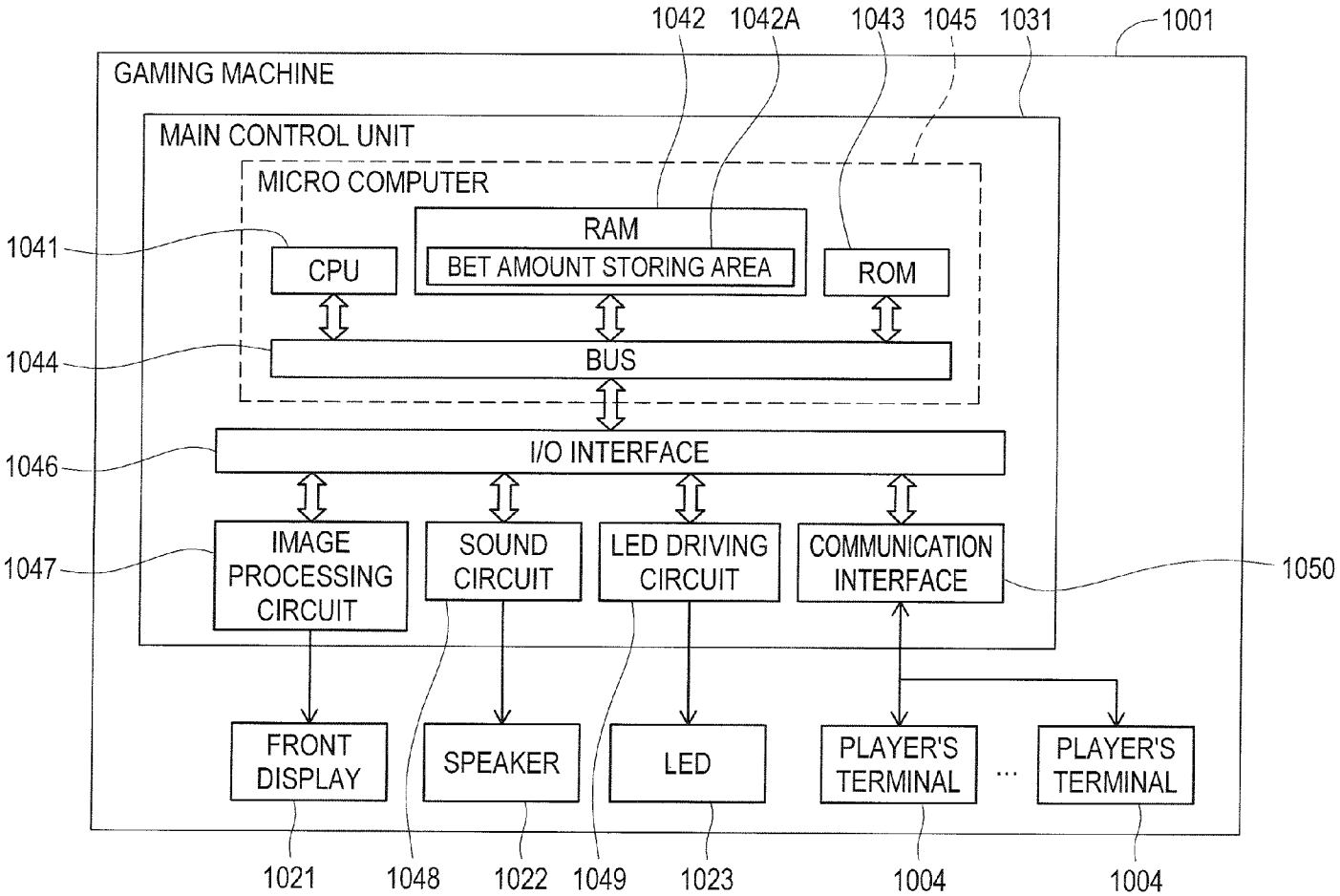
FIG. 4 is an explanatory view showing a control system of a gaming machine according to one embodiment of the present invention.

In the following, description is made on the configuration related to the control system of the gaming machine 1001 with reference to FIG. 4. FIG. 4 is a block diagram schematically showing the control system of the gaming machine 1001 according to this embodiment.

As shown in FIG. 4, the gaming machine 1001 according to this embodiment comprises a main control unit 1031, a plurality of player's terminals 1004 connected to the main control unit 1031, and various types of peripheral devices.

The main control unit 1031 comprises as a core a microcomputer 1045 basically consisting of a CPU 1041, a RAM 1042, a ROM 1043, and a bus 1044 for performing data transfers mutually among them. The ROM 1043 stores various programs, data tables, etc., for performing necessary processes in controlling the gaming machine 1001. In addition, the RAM 1042 is a memory that temporarily stores various types of data operated in the CPU 1041. Then in the RAM 1042, there is provided a pooled amount storing area 1042A in which the pooled amount that has been pooled in the pot is accumulated and stored. In addition, the CPU 1041 is connected to an image processing circuit 1047, a sound circuit 1048, an LED driving circuit 1049 and a communication interface 1050 via an I/O interface 1046.

The main control unit 1031 receives bet operation information such as the bet amount from the respective player's terminals 1004 and judges whether a game start condition is satisfied. Then, when a game is started, among 52 playing cards, a predetermined number of cards (at least 2 cards) are associated with the player and the dealer based on lottery result (on the screen, the card is dealt to the player and the dealer, respectively). Consequently, based on the hands of the associated cards, win/lose (any of player's win, dealer's win, or draw) judgment is made and the judgment result is transmitted to the respective player's terminals 1004. Then, the respective player's terminals 1004 increase or decrease the pooled credit according to the win/lose result received from the main control unit 1031.

The main control unit 1031 also outputs an image signal displayed on the front display 101021 and drivingly controls the speakers 1022 and the LEDs 1023. In addition, when the main control unit 1031 receives tipping information from the respective player's terminals 1004, it obtains player's personal data and gaming history from the player's terminals 1004. Then, individual images and individual sound are generated based on the acquired personal data and gaming history. The individual images refer to images of a dealer who behaves according to the personal data and gaming history, such as, calls out a player's name, gives an advice to a player who gave a tip. Additionally, the individual sound is the dealer's voice according to the personal data and gaming history, such as voice of a dealer calling out player's name or gives an advice to a player who gave a tip. The main control unit 1031 outputs the generated individual images and individual sound to the front display 1021 or from the speakers 1022.

Figure 5:
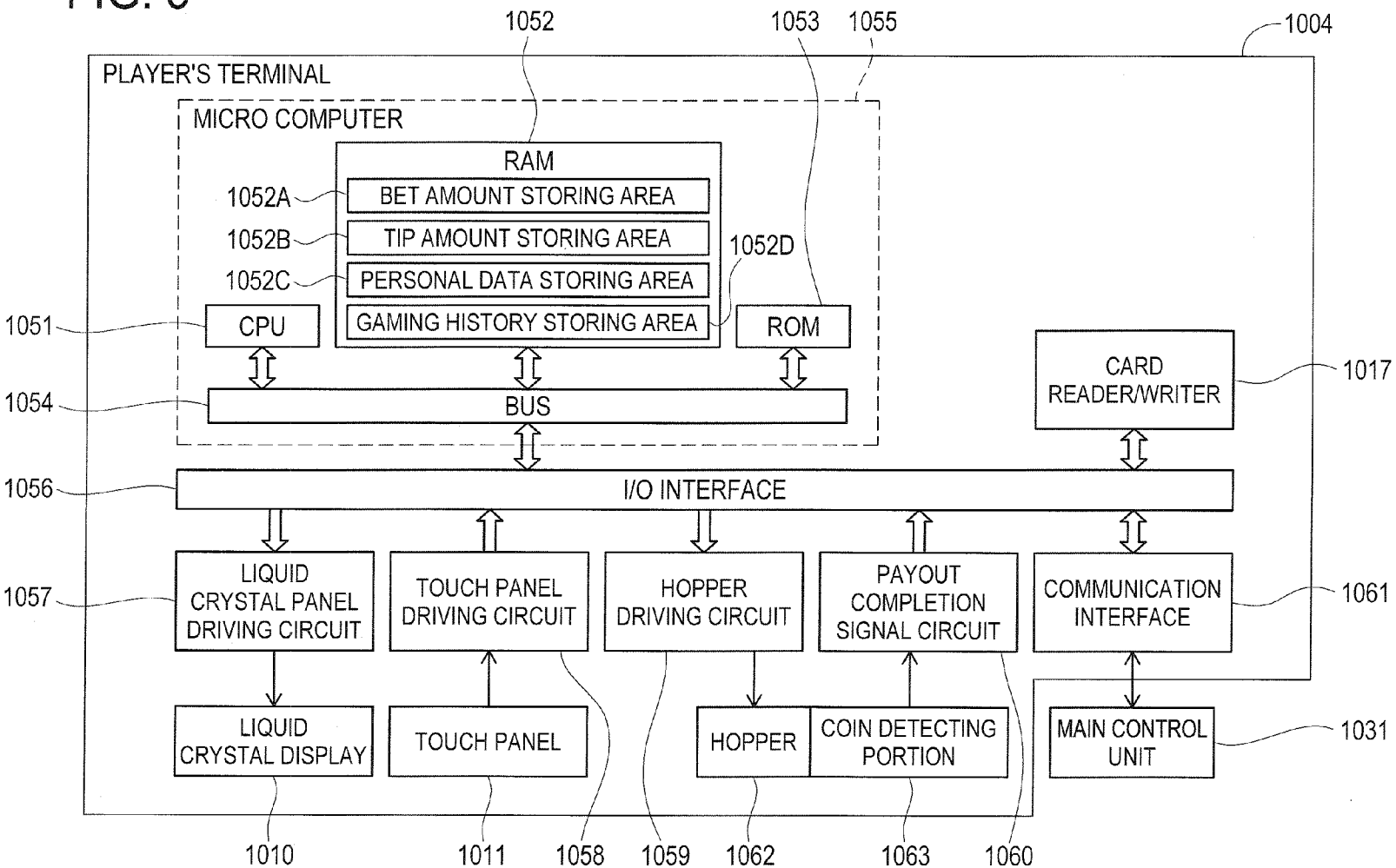
FIG. 5 is an explanatory view concerning a control system of a player's terminal according to one embodiment of the present invention.

In the following, with reference to FIG. 5 description is made on the configuration according to the control system of the player's terminal 1004. FIG. 5 is a block diagram schematically showing the control system of the player's terminal 1004 according to this embodiment.

As shown in FIG. 5, the player's terminal 1004 according to this embodiment comprises as a core a microcomputer 1055 basically consisting of a CPU 1051, a RAM 1052, a ROM 1053, and a bus 1054 for performing data transfers mutually among them. The ROM 1053 stores various programs, data tables, etc., for performing necessary processes in controlling the player's terminal 1004. In addition, the RAM 1052 is a memory that temporarily stores various types of the data operated on the CPU 1051, in addition to the credit number currently pooled on the player's terminal 1004, bet target bet by a player, and bet amount (credit number) of the bet target bet by a player. In the RAM 1052, there are provided a bet amount storing area 1052A that stores the bet amount bet by a player, a tip amount storing area 1052B that stores the tip amount that a player gave to a dealer, a personal data storing area 1052C that stores player's personal data read from the ID card 1016, and a gaming history storing area 1052D that stores player's gaming history that is similarly read from the ID card 1016 and that is updated based on game result at each end of a game.

The CPU 1051 is also connected to a liquid crystal panel driving circuit 1057, a touch panel driving circuit 1058, a hopper driving circuit 1059, a payout completion signal circuit 1060, a communication interface 1061, and a card reader/writer 1017 via an I/O interface 1056. Furthermore, the liquid crystal display 1010 is connected to the liquid crystal panel driving circuit 1057, the touch panel 1011 is connected to the touch panel driving circuit 1058, a hopper 1062 is connected to the hopper driving circuit 1059, and a coin detection portion 1063 is connected to the payout completion signal circuit 1060, respectively.

Furthermore, the card reader/writer 1017 is a device that is placed inside the card insertion slot 1014 and that executes reading/writing of information stored in the ID card 1016 inserted into the card insertion slot 1014. Then, if the ID card 1016 is inserted into the card insertion slot 1014 when a game starts, CPU 1051 reads player's personal data and gaming history stored in the ID card 1016, and stores them into the personal data storing area 1052C and the gaming history storing area 1052D, respectively. When the game ends, it also writes updated gaming history into the ID card 1016.

Based on the operation information to be output from the touch panel 1011, the CPU 1051 computes the bet amount (credit number) for which a player placed a bet, and stores it in the bet amount storing area 1052A of the RAM 1052 and transmits it to the main control unit 1031. Furthermore, following the win/lose information transmitted from the main control unit 1031, the CPU 1051 increases or decreases the pooled credit. Based on the operation information to be output from the touch panel 1011, the CPU 1051 similarly computes the tip amount (credit number) paid by a player to a dealer, and stores it in the tip amount storing area 1052B of the RAM 1052 and transmits it to the main control unit 1031.

Furthermore, the CPU 1051 outputs an image signal to be displayed on the front display 1021 and also controls payout of coins from the coin payout port 1015 by a hopper 1062 or a coin detection portion 1063.

In the following, with reference to FIG. 6 and FIG. 7, description is made on the bet screen 1070 to be displayed on the liquid crystal display 1010 of the player's terminal 1004 when blackjack is played in the gaming machine 1001 according to this embodiment.

Figure 6:
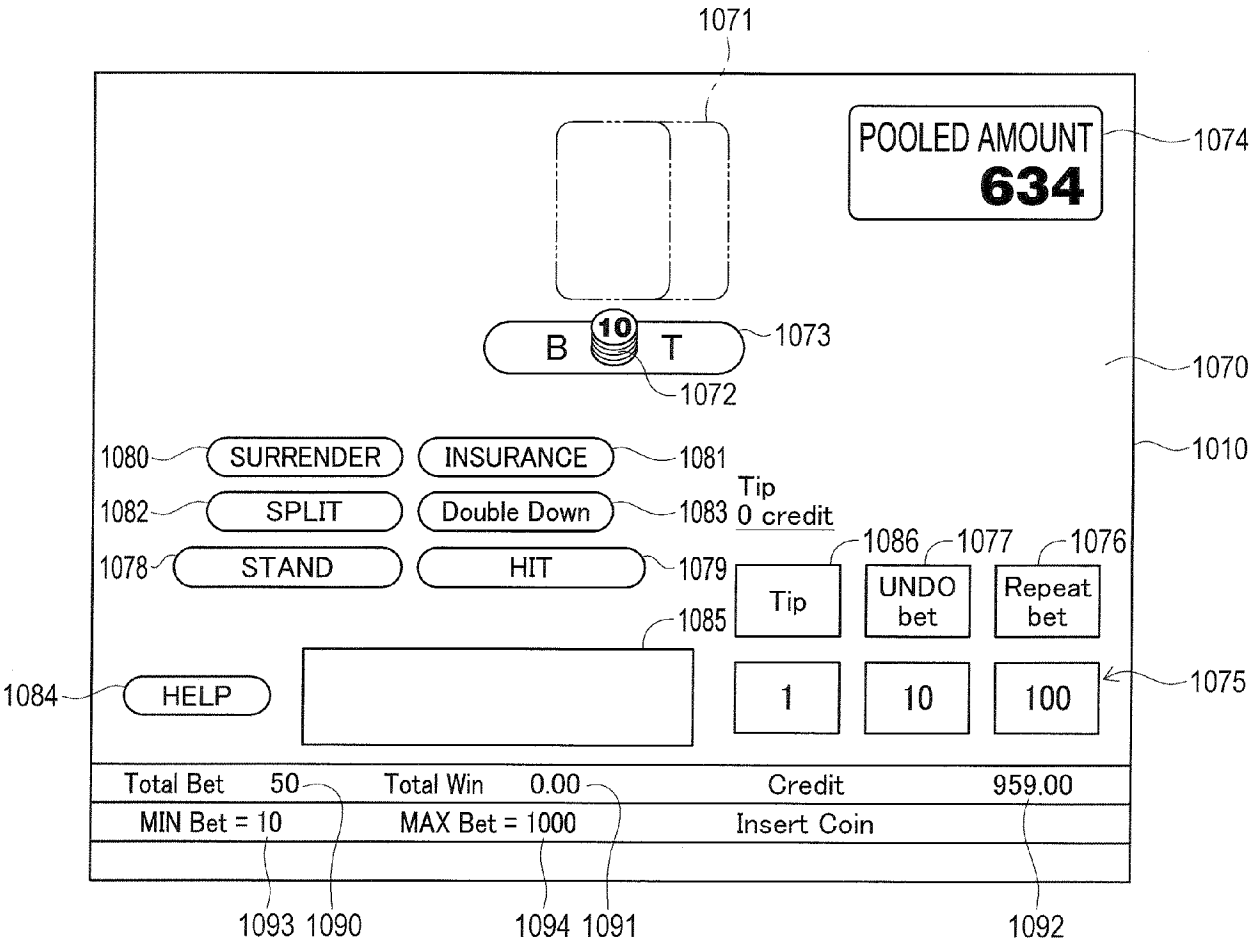
FIG. 6 is a view showing a bet screen which is displayed on a liquid crystal display in a player's terminal according to one embodiment of the present invention.

FIG. 6 and FIG. 7 are views illustrating the bet screen 1070 to be displayed on the liquid crystal display 1010 of the player's terminal 1004. Now, in the gaming machine 1001 according to this embodiment, using the bet screen 1070 and touch panel 1011, the player performs betting operation for betting credit worth of a predetermined value. The player can also perform operations of requesting for addition of the hand or increasing of the bet amount, etc.

As shown in FIG. 6 and FIG. 7, the bet screen 1070 comprises a player's card display area 1071 that displays an image 1087 of cards to be dealt to the player, CHIPS display area 1073 that displays an image 1072 of bet CHIPS, a pool amount display area 1074 that displays the pooled amount pooled in the pot, and data display area displaying various operation buttons and player's data.

The player's card display area 1071 is a display area for displaying the image 1087 of the cards dealt to the player. Then, the image 1087 of a plurality of cards displayed in the player's card display area 1071 are the cards dealt to the player who takes a seat and plays a game at this player's terminal 1004.

Furthermore, the CHIPS display area 1073 displays the image 1072 of the CHIPS that is equivalent to the bet amount bet by the player. (For instance, in FIG. 6 and FIG. 7, CHIPS worth of 50 credits are bet.) Before starting the game, the player selects the bet amount with a bet button 1075 to be described later and enters the bet amount by touching the CHIPS display area 1073. Then, the entered bet amount is transmitted to the main control unit 1031. The gaming machine 1001 determines the contents of a prize based on the bet amount entered with the bet button 1075 and the game result (any of win, loss, or draw).

Furthermore, the pooled amount display area 1074 is an area that displays the pooled amount pooled in the pot. In the gaming machine 1001 according to this embodiment, when a player gave a tip to the dealer, a predetermined percentage (e.g., 10%) of given tip is pooled in the pot.

Furthermore, a plurality of bet buttons 1075 (3 types: "1 Credit", "10 Credit" and "100 Credit" in this embodiment) are provided in the lower right part of the CHIPS display area 1073. By touching one of the bet buttons 1075, the player can select the bet amount to bet in this game.

Furthermore, a Repeat-bet button 1076, an UNDO-bet button 1077, and a Tip button 1086 are provided above the bet buttons 1075. By touching the Repeat-bet button 1076, the player can bet the same bet amount as last game. By touching the UNDO-bet button 1077, the player can also cancel the betting operation that he/she has once performed. By touching the Tip button 1086, the player can also give a tip to the dealer displayed on the front display 1021. Specifically, whenever the Tip button 1086 is pressed, one credit is given to the dealer as a tip. Above the Tip button 1086 is displayed a total value of the tip that is currently being given. However, tipping operation of the player through the Tip button 1086 can only be accepted after the player's betting operation of at least 1 credit is accepted.

In contrast, in the lower left part of the CHIPS display area 1073 are displayed a group of operation buttons to be used when the player bargains with the dealer. To be specific, as operation buttons, a STAND button 1078, a HIT button 1079, a SURRENDER button 1080, an INSURANCE button 1081, a SPLIT button 1082, and a Double Down button 1087 are provided.

The STAND button 1078 is a button to be touched when the player plays the game with the dealer, with the currently dealt cards instead of requesting any further card to be dealt. The HIT button 1079 is a button to be touched when the player requests for a new card in addition to the currently dealt cards. The HIT button 1079 can be used until a total of numbers shown on the dealt cards is "21" or more.

The SURRENDER button 1080 is a button to be touched when the player withdraw from this match of the game. When the player selects the SURRENDER button 1080, half of the bet amount at the time is collected, and the other half is returned to the player. The INSURANCE button 1081 is a button to be touched when the player insures against when cards dealt to the dealer make a blackjack.

The SPLIT button 1082 is a button to be touched when numbers shown on 2 cards dealt during the game are same, and the player wishes to divide the cards into 2 hands. Selection of the SPLIT button 1082 enables the player to play a game with the dealer by the hands of more than 1 pair of the cards. The Double Down button 1083 is a button to be touched when the player places an additional bet during a game.

Furthermore, a HELP button 1084 is provided below the STAND button 1078. The HELP button 1084 is a button to be touched when the player displays a method of operating the gaming machine 1001 on the liquid crystal display 1010. In addition, to the right side of the HELP button 1084 is provided a message area 1085 where a message supporting progress of the game is displayed.

In the lower part of the bet screen are provided a total-bet display area 1090 where the bet amount the player is currently betting is displayed, a total-win display area 1091 where the amount the player was awarded with prizes during the game is displayed, a credit display area 1092 where the credit number the player now possesses is displayed, a minimum-bet display area 1093 where the lower limit of the bet amount the player can bet is shown, and a maximum-bet display area 1094 where the upper limit of the bet amount the player can bet is shown.

Furthermore, as shown in FIG. 7, to the left side of the player's card display area 1071 is provided a message display area 1095 where contents of the dealer's voice displayed on the front display 1021 is shown.

Furthermore, as shown in FIG. 7, to the right side of the player's card display area 1071 is provided a player's data display area 1096 where player's personal data or gaming history is displayed. The data to be displayed in the player's data display area 1096 includes a player's name, sex, age, and nationality, number of games in which the gaming machine 1001 was played, game hours, gaming value used in games, winning rate, total win amount, etc. The player's personal data or gaming history is displayed in the player information display area 1096 only when the ID card 1016 is inserted into the card insertion slot 1014.

Figure 9:
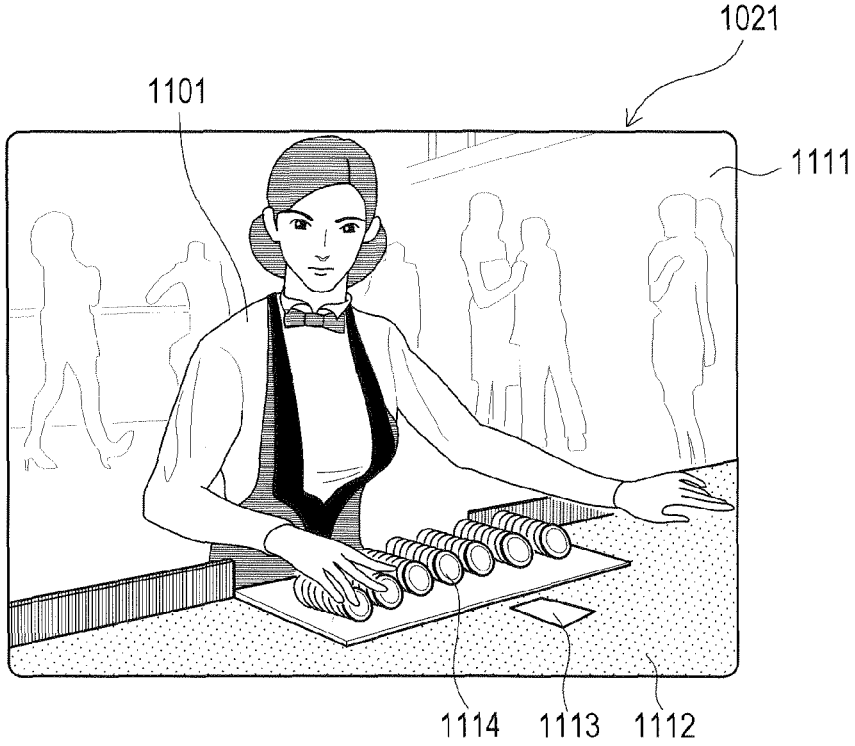
FIG. 9 is a view showing an image of a virtual dealer displayed on a gaming machine according to one embodiment of the present invention.

In the following, with reference to FIG. 1 and FIG. 9, we describe a main game screen to be displayed on the front display 101021 when blackjack is played in the gaming machine 1001 according to this embodiment. FIG. 1 and FIG. 9 are views of the main game screen to be displayed on the front display 1021.

Now, in the gaming machine 1001 according to this embodiment, images of a virtual dealer that animate dealing of cards in accordance with progress of the game to enhance realistic sensation of the game are displayed on the main game screen. These images of the dealer are changed into different types of images based on selections of a player at predetermined intervals of the number of the games.

Figure 8:
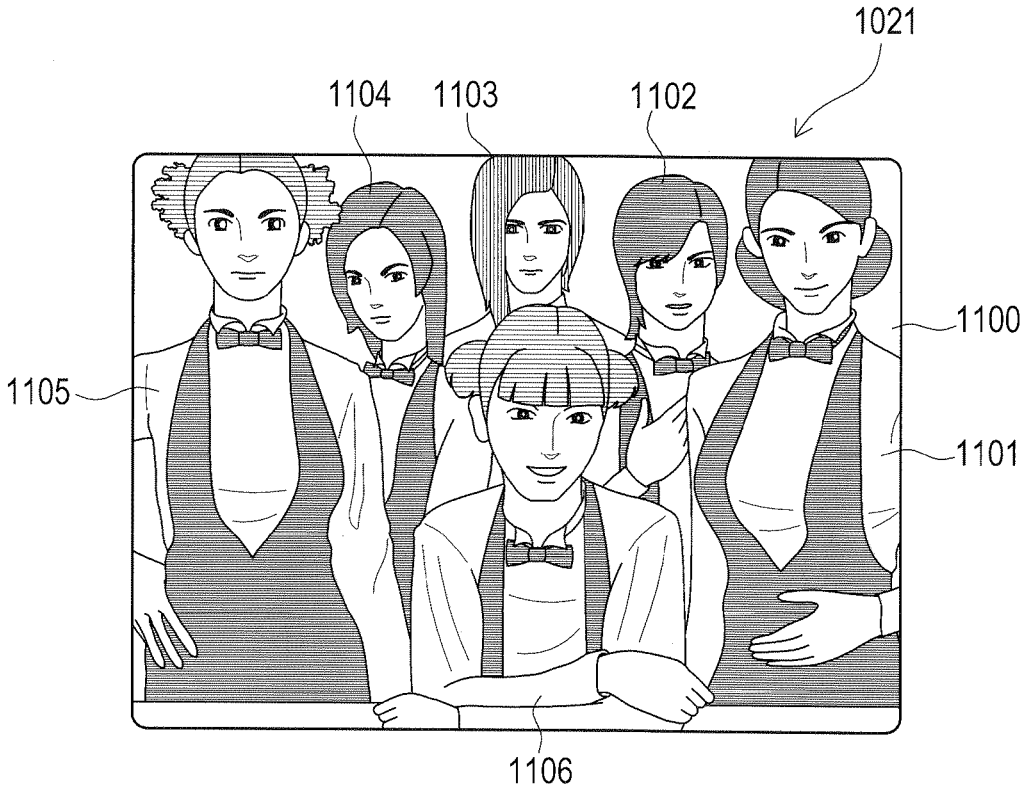
FIG. 8 is a view showing a dealer select screen which is displayed on a front display according to one embodiment of the present invention.

FIG. 8 is a view showing a dealer select screen 1100 that is displayed on the front display 1021 at predetermined intervals of the game numbers. As shown in FIG. 8, more than one type of images (in FIG. 8, 6 types of a 1st dealer's image 1101 to 6th dealer's image 1106) of virtual dealers serving to run the game is displayed on the dealer select screen 1100. Then, a player awarded with a right-to-select can select an image of virtual dealer who serves to run the game, from a plurality of dealers displayed on the dealer select screen 1100 (in other words, selecting a type of character who plays a dealer, from a plurality of types of characters). Then, with the images 1101 to 1106 of the selected dealers displayed on the front display 1021, the subsequent game progresses (refer to FIG. 1 and FIG. 9). Furthermore, in the gaming machine 1001 according to the invention of present application, a player who carried out the bet of the highest bet amount in last 10 to 20 games is awarded with the right to select a dealer image.

As shown in FIG. 8, when a dealer image is selected in the dealer select screen 1100, the dealer image selected in the dealer select screen 1100 appears in the main game screen 1111 in a predetermined number of subsequent games. FIG. 1 and FIG. 9 show the main game screen 1111 in the case that a player selected the 1st dealer image 1101 on the dealer select screen 1100.

As shown in FIG. 1 and FIG. 9, at the approximate center of the main game screen 1111 are displayed a game table image 1112, a dealer's card image 1113 that shows the dealer's hand dealt to the dealer, and a CHIPS image 1114 to be handed to/from a player. Furthermore, when the dealer let out voice, a dialog 1115 showing content of the voice is also displayed. Then, in accordance with progress of the game, the dealer image 1101 performs dealing of cards or handing of CHIPS on the game table.

Furthermore, in the gaming machine 1001 according to this embodiment, if a player has gave a tip to a dealer, an image of a dealer who behaves according to personal data or gaming history of the player who gave the tip to the dealer is displayed. At the same time, the dealer's voice according to the personal data or gaming history of the player who gave the tip is output. Specifically, as the tip amount the player given increases, an image of the dealer who takes actions that are more beneficial to the player is displayed and the dealer's voice that is more beneficial to the player is output.

FIG. 10 is a view showing the dealer's behavior pattern based on the tip amount.

For instance, if the tip amount given to the dealer is from 1 to 5 credits, an image of the dealer's behavior of calling out user's name is displayed on the front display 1021. In addition, voice of the dealer calling out the user's name is also output from the speakers 1022, such as "your playtime is an hour, Mr. XX", "I wish you the best of luck, Ms. XX.", etc.

Furthermore, if the tip amount given to the dealer is from 6 to 10 credits, an image of the dealer's behavior of calling out user's name or of telling play hours or play number of the player is displayed on the front display 1021. In addition, voice of the dealer who tells the play hours and the play number including the user's name is output from the speakers 1022, such as "Your playtime is an hour, Mr. XX", etc.

Furthermore, if the tip amount given to the dealer is 11 to 15 credits, an image of the dealer's behavior of calling out user's name and of telling the total accumulated bet amount with the gaming machine 1001 is displayed on the front display 1012. In addition, voice of the dealer who tells the total accumulated bet amount with the gaming machine 1001 including the user's name is output from the speakers 1022, such as "Your total bet amount is 450 credits, Mr. XX", etc.

Furthermore, if the tip amount given to the dealer is 16 to 20 credits, an image of the dealer's behavior of not only calling out user's name but also telling the winning rate and total win amount is displayed on the front display 1021. In addition, voice of the dealer who tells the winning rate or the total win amount including the user's name is output from the speakers 1022, such as "Your total win is 300 credits, Mr. XX".

In addition, if the tip amount given to the dealer is 21 credits or more, an image of the dealer's behavior of calling out user's name and of giving an advice to the player is displayed on the front display 1021. In addition, voice of the dealer who gives an advice including the user's name to the player is output from the speaker 1022, such as "Hadn't you better hit, Mr. XX"?, etc.

The characters to be displayed on the front display 1021 and the voice to be output from the speakers are in a language corresponding to the nationality of the player who gave the tip. For instance, if the nationality of a player who gave a tip is American or Australian, English is used as shown in FIG. 1. If the nationality of a player who gave a tip is Japanese, then Japanese is used.

Furthermore, when the game ends, an image of cards showing those dealt to the dealer is displayed on the main game screen 1111. Furthermore, an image of cards showing those dealt to respective players (up to 5 players) who plays the game at the respective player's terminals 1004, and win/lose result image that shows winning/losing of each player and the dealer are also displayed. Thus, by referring to the main game screen 1111, the player can learn kinds of cards dealt to the dealer, those of cards dealt to other players who simultaneously play the game, and win/lose result of the other players as well as his/her own win/lose result.

In the following, with reference to FIG. 11 to FIG. 13, description is made on a game processing program executed by the CPU 1041 of the main control unit 1031, and a game processing program on the side of the player's terminal executed by the CPU 1051 of the player's terminal 1004 in the gaming machine 1001 according to this embodiment having the above configuration. The respective programs shown by flow charts in these FIG. 11 to FIG. 13 are stored in the RAM 1042 or the ROM 1043 with which the main control unit 1031 is equipped or the RAM 1052 or the ROM 1053 with which the player's terminal 1004 is equipped, and executed by the CPU 1041 or the CPU 1051.

Figure 11:
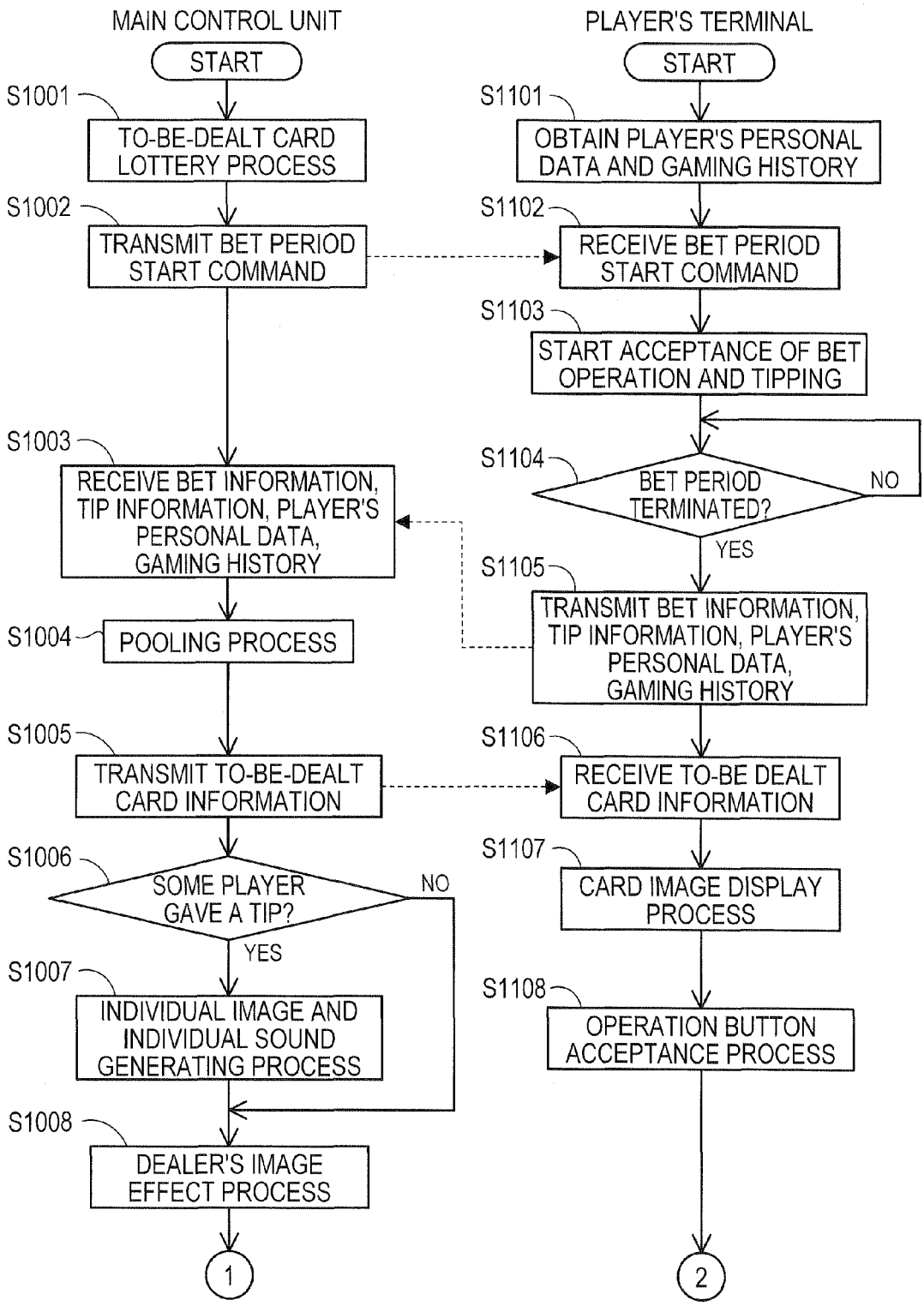
FIG. 11 is a flowchart of a game process program according to one embodiment of the present invention.
Figure 12:
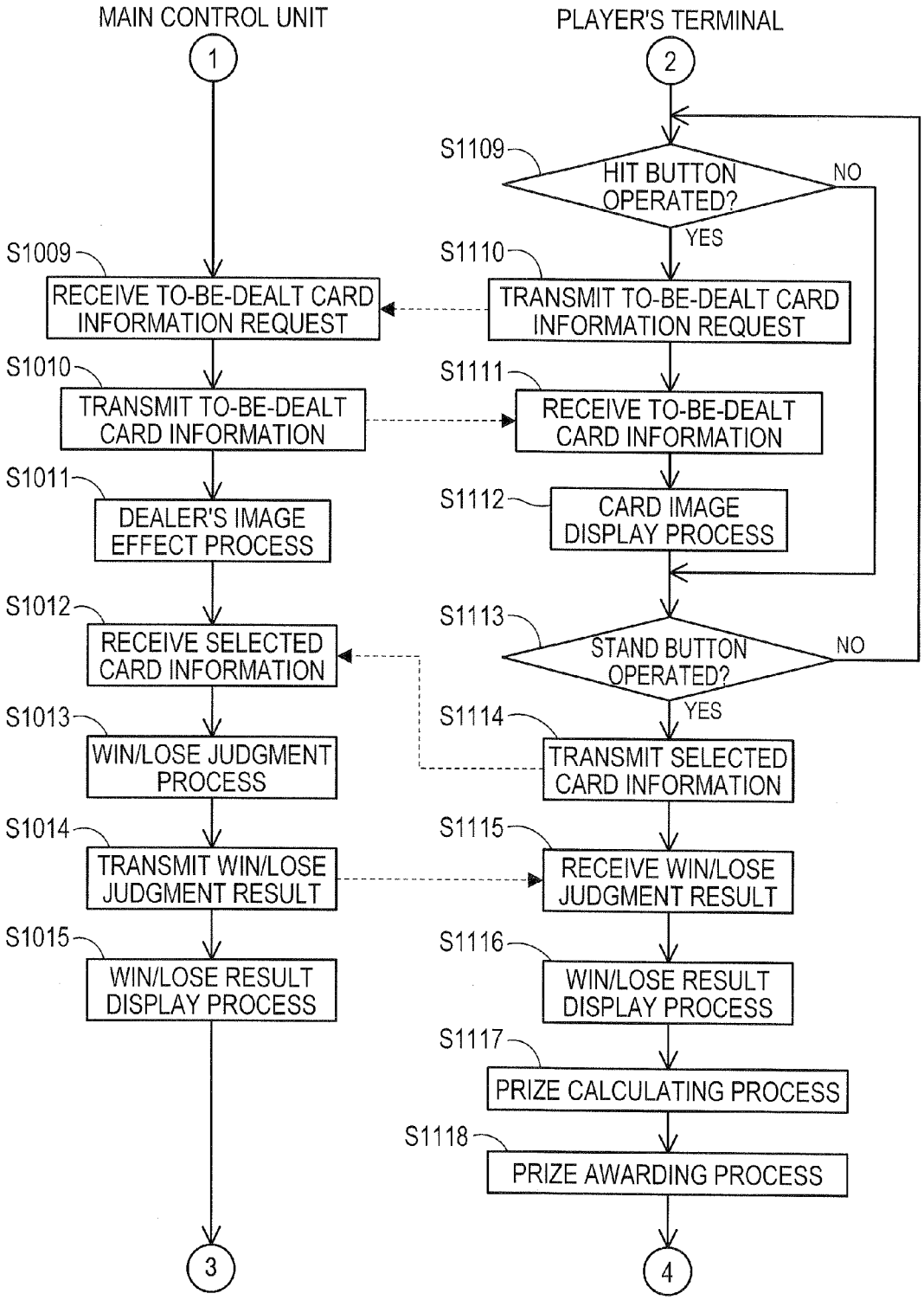
FIG. 12 is a flowchart of a game process program according to one embodiment of the present invention.
Figure 13:
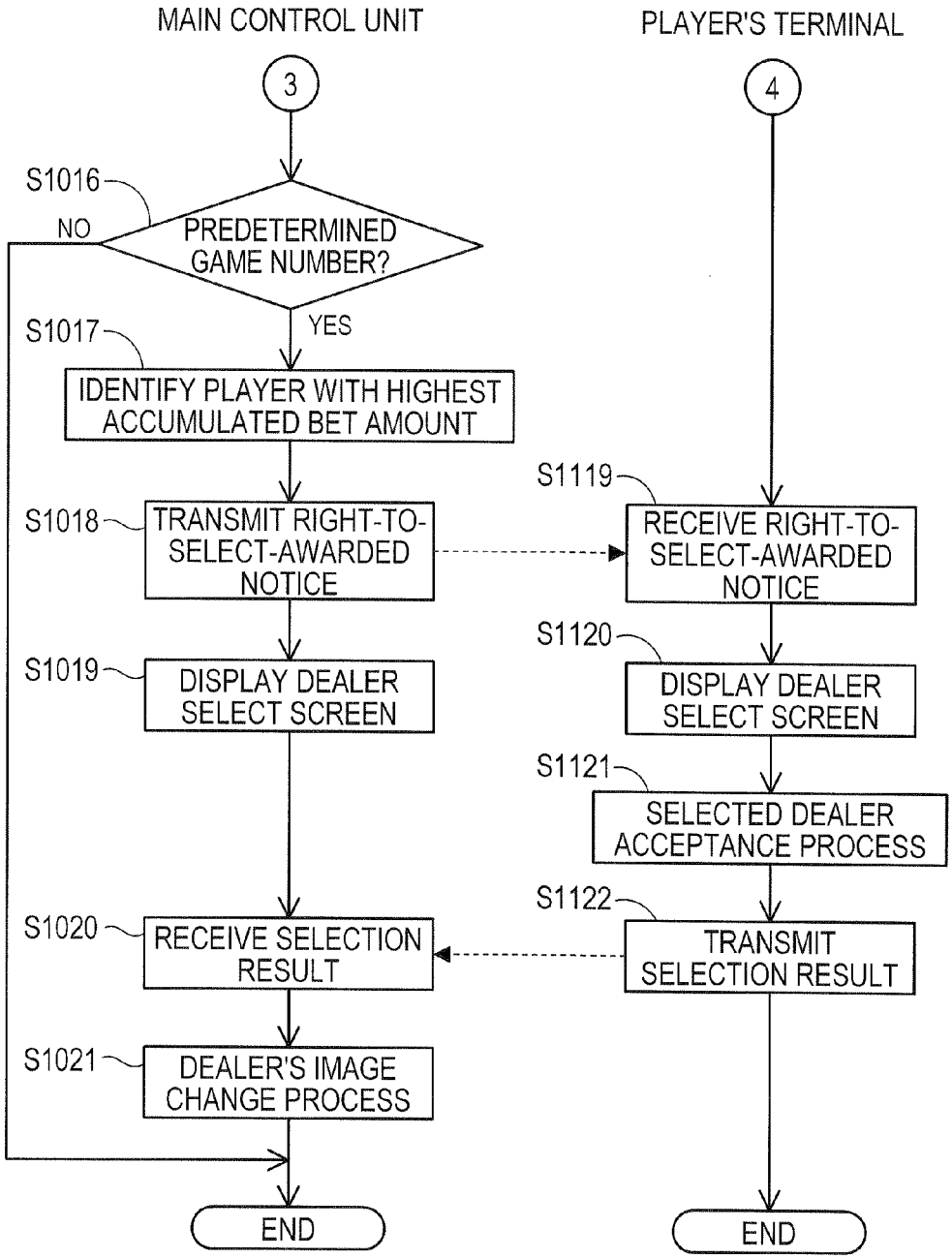
FIG. 13 is a flowchart of a game process program according to one embodiment of the present invention.

First of all, with reference to FIG. 11 to FIG. 13, description is made on the game processing program executed by the main control unit 1031. In Step (hereinafter to be abbreviated as S) 1001, the CPU 1041 performs to-be-dealt card lottery process of selecting in drawing cards to be associated with the player or dealer. Specifically, if there are N cards to be used in one game (N=52 in blackjack), each card is associated with any number (order of dealing) from 1 to N. Then, the cards are associated with the dealer or player (i.e., dealt to the dealer or player) following this order.

Then, in S1002, the CPU 1041 transmits to the respective player's terminals 1004 a bet period start command that accepts betting operation by the player.

Next, in S1003, the CPU 1041 receives the bet information, tip information, and player's personal data and gaming history that were transmitted from the respective player's terminals 1004. Now, the bet information is the information on the bet amount (credit number) the player bet in this game for obtaining a prize. In addition, the tip information is the information on the tip amount that the player gave to the dealer in this game and that is not associated with a prize. The player's personal data and the gaming history are transmitted from the player's terminal 1004 only when the player gave the tip to the dealer in this game. The received information from the respective player's terminals 1004 is once stored in the RAM 1042.

Next, in S1004, the CPU 1041 updates the pooled amount pooled in the pooled amount storing area 1042A based on the tip information received in the S1003. Specifically, it pools a predetermined percentage (e.g., 10%) of the tip amount the player gave to the dealer in this game, in the pooled amount storing area 1042A of the RAM 1042. Then, the pooled amount pooled in the pooled amount storing area 1042A will be paid out to the player's terminal 1004 of a corresponding player, when the player wins the blackjack in spades in subsequent games.

Then, in S1005, based on lottery result of the to-be-dealt card lottery process in the S1001, the CPU 1041 transmits to the respective player's terminals 1004 information on the first and the second cards (to be dealt) (e.g., "7 of hearts" or "A of spades", etc.) to be associated with the player who plays the game on the each player's terminal 1004.

Furthermore, in S1006, based on the tip information received in the S1003, the CPU 1041 judges whether or not there is some player who gave a tip to the dealer in this game, from among the players participating in the game.

As a result, if it is judged that there is a player who gave a tip to the dealer in this game (S1006: YES), the process proceeds to S1007. In contrast, if it is judged that there is no player who gave a tip to the dealer in this game (S1006: NO), the process proceeds to S1008.

In S1007, based on the personal data and the gaming history, and the tip amount of the player who gave the tip, which was received in the S1003, the CPU 1041 generates individual images and individual sound. The individual images are images of the dealer who behaves according to the player's personal data and the gaming history. Furthermore, the individual sound is the dealer's voice according to the player's personal data and the gaming history. Additionally, language to be displayed or output is language corresponding to the player's nationality. The contents of the individual images and individual sound, which have been described earlier with reference to FIG. 10, are omitted here.

Then, in S1008, an image of the dealer who deals 2 cards each to the player and the dealer is displayed as a main game screen 1111 (see FIG. 9) on the front display 1021. For the 2 cards dealt to the dealer, kinds of their marks are hidden when they were dealt. Then, if the individual images were generated in the S1007, the generated individual images are displayed by a given timing (e.g., before a card is dealt, while a card is being dealt, or after a card is dealt). Similarly, the individual sound is output from the speakers 1022 by the given timing.

Next, in S1009, the CPU 1041 receives a new request for to-be-dealt card transmitted from the player's terminal 1004. Then, in response to the request, it transmits information on the third card or later to the requesting player's terminal 1004

(S1010). Furthermore in S1011, the CPU 1041 displays on the front display 1021 an image of the dealer who deals a new card to the requesting player. In addition, if the individual image was generated in the S1007, the CPU 1041 displays the generated individual image by the given timing (e.g., before a card is dealt, or after a card is dealt). Similarly, the individual sound is output from the speakers 1022 by the given timing.

Then, in S1012, the CPU 1041 receives selected card information transmitted from the respective player's terminals 1004. The selected card information is the information to be transmitted when the player opts to play the game with the dealer with the currently dealt cards, and transmitted to the main control unit 1031 when the STAND button 1078 is selected at the player's terminal 1004, as described below.

In S1013, the CPU 1041 compares the hand of cards associated with the dealer with the hand of cards associated with the player, and judges who won the game. Specifically, as long as a sum of numbers shown on the cards does not exceed "21", one having the hand of cards whose sum of numbers is closer to "21" is judges as a winner. If both have a same sum, the game is judged as a draw.

Then, in S1014, the CPU 1041 transmits said win/lose result in the S1010 to the respective player's terminals 1004. In addition, in S1015, CPU41 displays on the front display 1021 the win/lose result image showing the result of win/lose judgment of the respective player's terminals 1004.

Next, in S1016, the CPU 1041 judges whether or not the number of games executed has reached a predetermined game number (e.g., 20 games). Then, if it is judged that the predetermined game number was not reached (S1016: NO), the main game processing is terminated. Then, the process returns to S1001 if a game continues to be played subsequently.

In contrast, if it is judged the predetermined game number was reached (S1016: YES), the process proceeds to S1017. Then, in S1017, the CPU 1041 compares the accumulated bet amount of each player's terminal 1004 after the dealer's last image was changed, and identifies the player (player's terminal 1004) with the highest accumulated bet amount.

Then, in S1018, the CPU 1041 transmits a notice instructing to award the player's terminal 1004 played by the player identified in the S1017 with the right-to-select a dealer. Furthermore, in S1019, the CPU 1041 displays on the front display 1021 a dealer select screen 1100 (see FIG. 8) showing images of 6 types of dealers that can be selected by the player.

Next, in S1020, the CPU 1041 receives the selection result of a dealer's image to be transmitted from the player's terminal 1004 of the player awarded with the right-to-select.

Then, in S1021, based on the selection result received in the S1020, the CPU 1041 exercises controls so as to change the dealer's image to be displayed on the front display 101021. Specifically, if the player selects a dealer's image that is different from the dealer's image displayed in last game, the CPU 1041 switches the image to the newly selected dealer's image. If the game continues to be played subsequently, the process returns to S1001.

In the following, with reference to FIG. 11 to FIG. 13, description is made on the game processing program executed by the player's terminal 1004. In S1101, the CPU 1051 acquires personal data and gaming history of a player who plays with the player's terminal 1004. Specifically, it obtains the player's personal data and the gaming history, by reading with the card reader/writer 1017 data stored in the ID card 1016 inserted into the card insertion slot 1014. It is also possible to have the player directly enter the player's personal data and the gaming history, using the touch panel 1011, in which case, the need for the ID card is eliminated.

Next, in S1102, the CPU 1051 receives the bet period start command before the game starts, from the main control unit 1031.

Then, in S1103, the CPU 1051 starts betting operation acceptance process, displays the bet screen 1070 (refer to FIG. 6 and FIG. 7) on the liquid crystal display 1010, and identifies the bet amount (credit number) bet based on the operation information from the touch panel 1011. The CPU 1051 also identifies the tip amount (credit number) given based on the operation information of the Tip button 1086. However, tipping operation of the player can only be accepted after the player's betting operation of at least 1 credit is accepted.

Next, in S1104, the CPU 1051 judges whether or not the bet period has been terminated. Specifically, it is judged whether or not a predetermined duration (e.g., 20 see) has elapsed since acceptance of the betting operation started in the S1103.

Then, if it is judged that the bet period did not terminate (S1104: NO), the acceptance of betting operations continues, while the process proceeds to S1105 if it is judged that the bet period has been terminated (S1104: YES).

In S1105, the CPU 1051 transmits bet information, tip information, and a player's personal data and a gaming history to the main control unit 1031. Now, the bet information is the information on the bet amount (credit number) bet for obtaining a prize in the bet operation acceptance process started in the S1103. Furthermore, the tip information is the information on the tip amount that the player similarly gave to the dealer in the betting operation acceptance process and that is not associated with a prize. The player's personal data and gaming history is the information obtained in the S1101 and transmitted only when the player gave the tip to the dealer in this game.

Next, in S1106, the CPU 1051 receives from the main control unit 1031 information (kinds of marks) on the first and second cards associated with the player who games with the player's terminal 1004. Then, in S1107, based on the card information received in the S1106, the CPU 1051 displays on the bet screen 1070 the card that is associated with the screen.

Then, in S1108, the CPU 1051 starts to accept operations of various operation buttons 1078 to 1083 displayed on the bet screen 1070. In S1109, in particular, it is judged whether or not the HIT button 1079 was selected. If it is judged that the HIT button 1079 was selected (S1109: YES), the CPU 1051 requests the main control unit 1031 to deal a new card (S1110). Next, in S111, the CPU 1051 receives card information newly transmitted from the main control unit 1031, and displays on the bet screen 1070 the card that is newly associated with the screen, based on the received card information (S1112). When the player executed Double Down, however, dealing of only one new card can be requested.

In contrast, if it is judged that the HIT button 1079 was not selected (S1109: NO), the process proceeds to S1113.

Furthermore, in S1113, it is judged whether or not the STAND button 1078 was selected. If it is judged that the STAND button 1078 was selected (S1113: YES), it is transmitted to the main control unit 1031 that the player selected to play the game with the currently displayed cards (Si114). In contrast, if it is judged that the STAND button 1078 was not selected (S1113: NO), the process returns to S1109. If any other operation button 1080 to 1084 was selected, process according to the selected button is performed.

Next, in S1115, the CPU 1051 receives win/lose judgment result transmitted from the main control unit 1031. Then, in S1116, based on the win/lose judgment result received in the S1115, the CPU 1051 displays on the liquid crystal display 1010 the win/lose judgment result of the player who plays a game with the player's terminal. Specifically, when the game ends in a draw, characters of "DRAW" appear on the bet screen 1070. In addition, when the player won, characters of "YOU WON" are displayed. Furthermore, when the player lost, characters of "YOU LOST" appear.

Then, in S1117, based on the bet amount accepted in the S1103 and win/lose judgment result, the CPU 1051 calculates a prize to be awarded to the player. In S1118, the CPU 1051 awards the prize calculated in the S1117 to the player. Specifically, when the player has beaten the dealer, the player is awarded with credit worth of twice as much as the total bet amount. In addition, when the player drew with the dealer, the player is awarded with credit equivalent to the total bet amount. Furthermore, if a predetermined condition of paying out the pooled amount pooled in the pooled amount storing area 1042A has been satisfied, the pooled amount so far pooled in the pot is awarded as a prize. Now, in the gaming machine 1001 according to this embodiment, the condition of paying out the pooled amount is that the hand of the cards associated with the player achieves blackjack in spades.

If more than one player satisfied the predetermined condition at the same time, in other words, if the hands of the cards associated with more than one player achieved blackjack in spades, the pooled amount is equally divided by a percentage for dividing the pooled amount by the number of players who satisfied the condition (e.g., 50% for two players).

Next, in S1119, the CPU 1051 receives from the main control unit 1031 a notice that the player's terminal 1004 is of the player awarded with a right-to-select. Then, in S1120, the CPU 1051 displays on the liquid crystal display 1010 the dealer select screen 1100 (refer to FIG. 8) having the same contents as the front display 1021.

In S1121, the CPU 1051 enables the operation of selecting a dealer's image by using the touch panel 1011 only in the player's terminal 1004 of the player awarded with the right-to-select identified in the S1017, and accepts the select operation. Specifically, at the player's terminal 1004 of the player awarded with the right-to-select, selecting any of a 1st dealer's image 1101 to a 6th dealer's image 1106 from the dealer select screen 1100, using the touch panel 1011 is enabled.

In S1122, the CPU 1051 transmits selected result of the player in the S1121 to the main control unit 1031. If the player awarded with the right-to-select did not perform the select operation, default select result that is determined in advance (e.g., the character is the 1st dealer's image 1101) is transmitted to the main control unit 1031.

Then, based on the transmitted select result, the main control unit 1031 displays the selected dealer's image on the front display 1021.

As described above, the gaming machine 1001 according to this embodiment causes a player who satisfied the predetermined condition to select one dealer's image from 6 types of dealer's images (S1121). The game progresses with the dealer's image selected subsequently displayed on the front display 1021 (S1021). Then, when the bet acceptance period starts, tipping operation to a dealer displayed on the front display 1021 is accepted (S1103), separately from betting operation for obtaining a prize. When the player gave the tip to the dealer, the individual image that is an image of the dealer who behaves according to personal data or gaming history of the player who gave the tip and individual sound that is the dealer's voice according to the personal data or gaming history of the player who gave the tip are generated (S1007). Then, the generated individual image and individual sound are output by the given timing (S1008, S1011). This enables the gaming machine to increase player's sense of tension or sensations to the game. It also allows the player to empathize with the dealer displayed on the display, and enables improved entertainment quality or increased operating rate.

Further, as dealer's behavior varies in many ways depending on the tip amount to be given, a new taste can be offered to players.

It is needless to say that the present invention is not limited to the first embodiment described above, and various modifications and variations can be made within the scope of the present invention.

For instance, in this embodiment, although the player's personal data or the gaming history shall be obtained from an ID card (S1101), it may be configured to cause a player to enter his/her personal data or gaming history when a game starts.

Furthermore, a dealer's image may be displayed not only on the front display 1021, but also on the liquid crystal display 1010 of the respective player's terminals 1004. Additionally, speakers that output the dealer's voice may be provided in the respective player's terminals 1004.

Additionally, the condition of paying out as a prize the pooled amount pooled in the pot may include the condition that the dealer achieves a specified hand.

Furthermore, the gaming machine according to the invention of present application can be applied in any gaming machine for playing a game to be run by the dealer, such as baccarat, draw poker, roulette game, etc., in addition to blackjack.

Furthermore, the invention of present application can be implemented as a gaming method for executing the processes described above. The present invention can also be implemented as a program for causing the gaming method to be executed on a computer and a recording medium in which the program is recorded.

Figure 14:
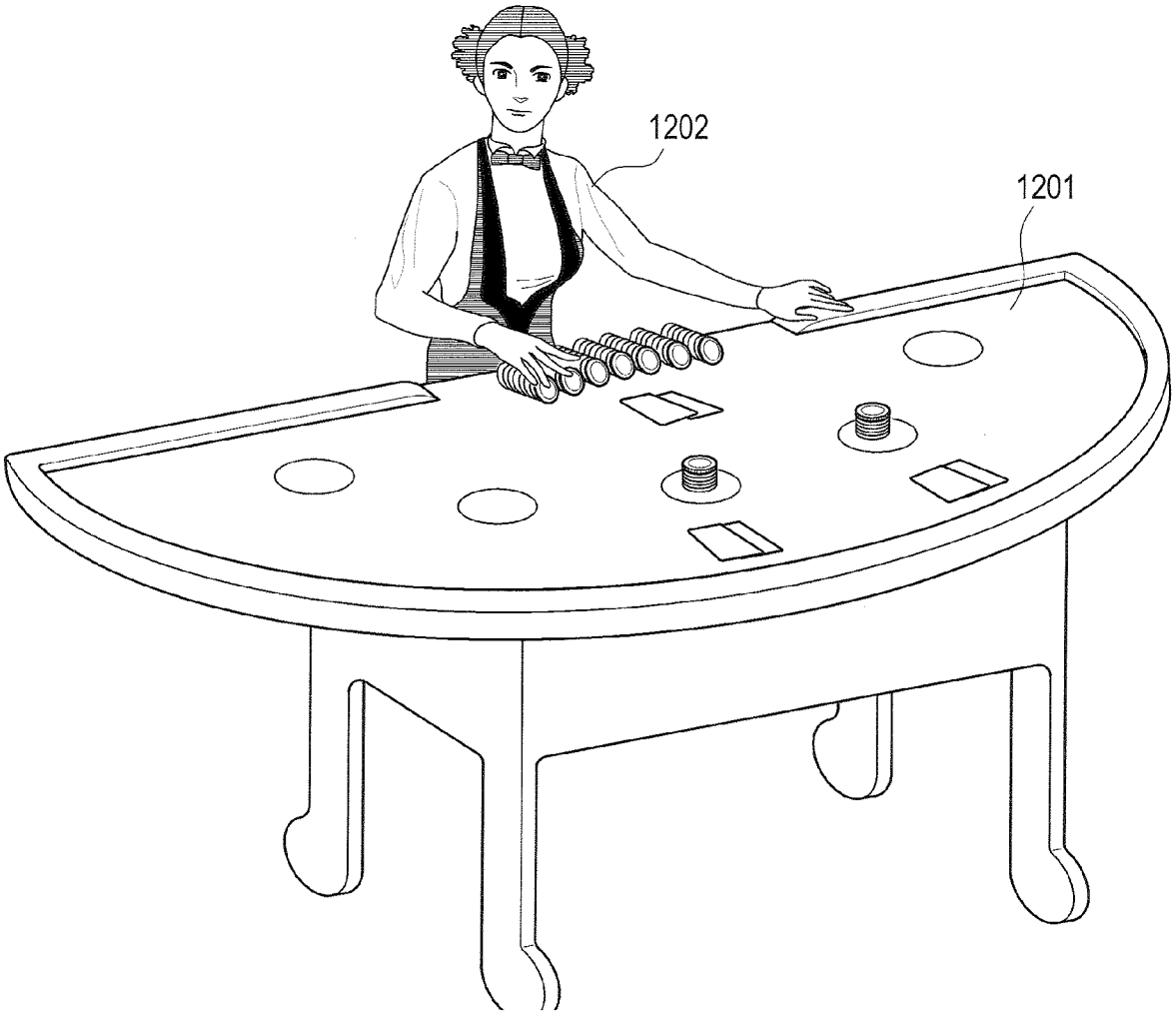
FIG. 14 is an example of a gaming table applied to the present invention.

The gaming method of the gaming machine according to the invention of present application can also be applied to blackjack (so-called table game) to be played by the dealer 1202 and a player (not shown) on the gaming table 1201, as shown in FIG. 14.

In the table game as shown in FIG. 14, the dealer 1202 deals cards to the dealer and the player, respectively, on the gaming table 1201. In contrast, the player places a bet by putting a tip in a predetermined area on the gaming table 1201.

The player can also give a tip to the dealer 1202, separately from betting. Then, the dealer gives data on gaming history or an advice to the player who gave the tip.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

[2. The Second Embodiment]

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine, a server, and a game system according to one or more aspects of the invention will be described in detail with reference to the drawings based on an embodiment embodying one or more aspects of the invention. However, it is appreciated that one or more aspects of the present invention may be embodied in distributable (via CD and the like) or downloadable software games, console games, and the like. In this regard, the slot machine may be a virtual slot machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU", "processor", and "controller" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

In the following, based on a substantiated embodiment, description is made on a detailed description of a gaming machine according to the present invention and with reference to the drawings. Now, the gaming machine according to this embodiment is a type of a multiplayer gaming machine that comprises a plurality of player's terminals and that plays blackjack, one of card games, as a game to be executed. In the blackjack herein, first of all, each player bets a predetermined amount of gaming value. Then, if a total of numbers of subsequently dealt cards is closer to "21" than that of numbers of cards dealt to the dealer, the condition of winning a prize is satisfied, and payout of the prize according to the bet amount takes place.

The gaming machine according to the invention of present application displays an image of a virtual dealer who runs the game. The dealer displayed on the display also takes various actions in accordance with the progress of the game. Furthermore, in the gaming machine according to the invention of present application, when a player gives the dealer a tip that is not associated with a prize, separately from betting operation for obtaining a prize, a right to change a once dealt card with another card is awarded to the player who gave the tip under the predetermined condition, as shown in FIG. 15.

With reference to FIG. 16, description is made on the schematic configuration of a gaming machine 2001 according to this embodiment FIG. 16 is an appearance diagram of the gaming machine 2001 according to this embodiment.

Basically, a gaming machine 2001 according to this embodiment comprises a table portion 2002 where players takes a seat and plays a game, and a panel portion 2003 that is placed behind the table portion 2002 and that displays an animation picture of the dealer, etc.

In the following, the table portion 2002 is first described. In the table portion 2002, more than one (5 units in FIG. 16) player's terminals called a satellite are positioned almost in fan-like fashion. FIG. 17 is an appearance diagram showing one player's terminal 4 according to this embodiment.

As shown in FIG. 17, the player's terminal 2004 comprises a liquid crystal display 2010 for displaying a bet screen to be described later (refer to FIG. 15 and FIG. 20) or gaming results, etc., a touch panel 2011 that is positioned on the front face of the liquid crystal display 2010 and that is used in selecting a button to be displayed on the liquid crystal display 2010 when selecting a bet target or setting a bet amount, operation buttons 2012 for executing payout operation, etc., a coin insertion slot 2013 through which a coin or medal is inserted, a card insertion slot 2014 into which an ID card containing player's personal data is inserted, and a coin payout port 2015 that pays out a coin or medal corresponding to credit being pooled when the payout operation is executed.

Furthermore, as shown in FIG. 16, the panel portion 2003 comprises the front display 2021 that displays an image of a dealer who deals cards or passes CHIPS, or contents of dealt card, speakers 2022 that are positioned on the upper part of the front display 2021 and output music, sound effect, and the dealer's voice in accordance with the progress of a game, and LEDs 2023 that are turned on during various types of effects.

Additionally, a pooled amount display portion 2024 is provided on the upper part of the front panel 2021. In the gaming machine 2001 according to this embodiment, as will be described below, when the player gave a tip to the dealer, a predetermined percentage of the given a tip (e.g., 10%) is pooled in the pot, and is paid out collectively when the hand (combination) of the player's card achieves "blackjack" of spades. Then, the currently pooled amount is displayed on the pooled amount display portion 2024.

Here, the cards to be used in the gaming machine 2001 according to the present embodiment are the tramp cards which are generally employed, and display a "mark" consisting of a "suit" and "number" (refer to FIG. 15).

Here, "suit" refers to the mark of a tramp card and includes the spade, heart, diamond and club.

The "number" refers to the number or alphabetical character on the tramp cards and includes A (Ace, corresponding to 1), 2, 3, 4, 5, 6, 7, 8, 9, 10, J (Jack, corresponding to 11), Q (Queen, corresponding to 12) and K (King, corresponding to 13).

The "mark" refers to the card's type which is decided based on the combination of the "suit" and "number" of the tramp card, and includes, for instance, "A of hearts", "K of spades" and the like.

Furthermore, the card insertion slot 2014 provided in the player's terminal 2004 is an insertion slot into which an ID card 2016 is inserted. The ID card 2016 is a card in which player's personal data or gaming history is stored, and a player obtains it in advance in a shop either being charged or free of charge. When a player obtains an ID card and enters his/her name, sex, age, nationality, etc., the personal data is stored in the ID card 2016. At the same time, by the player playing a game with his/her ID card 2016 inserted into the card insertion slot 2014, the gaming history (e.g., the number of games played with the gaming machine 2001, game hours, gaming value used in the games, winning rate, total won prizes, etc.) is stored or updated in the ID card 2016.

Furthermore, the gaming machine 2001 has a card reader/writer 2017 which is read or writes a data is stored in the ID card 2016 into the card insertion slot 2014 (refer to FIG. 15).

Furthermore, in the gaming machine 2001 according to this embodiment, if a player gave a tip to a dealer, personal data or gaming history of the player who gave the tip is acquired through the ID card 2016 and the card reader/writer 2017.

In the following, description is made on a method of playing the gaming machine 2001 configured as described above. A player who is to play a game takes a seat in front of the player's terminal 2004, and places a bet depending on a desired bet amount, using the bet screen displayed on the liquid crystal display 2010. In addition, the player can arbitrarily give a tip to the dealer, in addition to the betting operation. Then, the images of cards dealt to the player and the dealer, respectively, are displayed on the front display 2021 and respective liquid crystal displays 2010. Furthermore, if there is any player who gave a tip to the dealer, on the front display 2021 is displayed an image 2101 of the dealer who takes action that is different from normal ones according to personal data or gaming history of the player who given the tip. Furthermore, the dealer's voice that is different from normal one is output from the speakers 2022 according to the personal data or gaming history of the player who gave the tip. Furthermore, when the player has given a tip to the dealer, a right to change a once dealt card with another card is awarded to the tip-giver player under the predetermined condition. Then, based on kinds of dealt cards, an effect image that decides a winner from either the player or dealer, or an effect image that calls a draw is displayed. In addition, in each player's terminal 2004, if the player has beaten the dealer, as a prize he/she is awarded with credit that is twice as much as the bet amount (credit number) that was bet. In contrast, if the player was beaten by the dealer, he/she cannot be awarded with a prize. Furthermore, if the player drew with the dealer, credit equivalent to the bet amount that was bet is returned to the player. In addition, if the hand of the player's cards is blackjack, the pooled amount that has been so far pooled in the pot is paid out.

In the following, description is made on the configuration related to the control system of the gaming machine 2001 with reference to FIG. 18. FIG. 18 is a block diagram schematically showing the control system of the gaming machine 2001 according to this embodiment.

As shown in FIG. 18, the gaming machine 2001 according to this embodiment comprises a main control unit 2031, a plurality of player's terminals 2004 connected to the main control unit 2031, and various types of peripheral devices.

The main control unit 2031 comprises as a core a microcomputer 2045 basically consisting of a CPU 2041, a RAM 2042, a ROM 2043, and a bus 2044 for performing data transfers mutually among them. The ROM 2043 stores various programs, data tables, etc., for performing necessary processes in controlling the gaming machine 2001. In addition, the RAM 2042 is a memory that temporarily stores various types of data operated in the CPU 2041. Then in the RAM 2042, there is provided a pooled amount storing area 2042A in which the pooled amount that has been pooled in the pot is accumulated and stored. In addition, the CPU 2041 is connected to an image processing circuit 2047, a sound circuit 2048, an LED driving circuit 2049 and a communication interface 2050 via an I/O interface 2046.

The main control unit 2031 receives bet operation information such as the bet amount from the respective player's terminals 2004 and judges whether a game start condition is satisfied. Then, when a game is started, among 52 playing cards, a predetermined number of cards (at least 2 cards) are associated with the player and the dealer based on lottery result (on the screen, the card is dealt to the player and the dealer, respectively). Consequently, based on the hands of the associated cards, win/lose (any of player's win, dealer's win, or draw) judgment is made and the judgment result is transmitted to the respective player's terminals 2004. Then, the respective player's terminals 2004 increase or decrease the pooled credit according to the win/lose result received from the main control unit 2031.

The main control unit 2031 also outputs an image signal displayed on the front display 2021 and drivingly controls the speakers 2022 and the LEDs 2023. In addition, when the main control unit 2031 receives tipping information from the respective player's terminals 2004, it obtains player's personal data and gaming history from the player's terminals 2004. Then, individual images and individual sound are generated based on the acquired personal data and gaming history. The individual images refer to images of a dealer who behaves according to the personal data and gaming history, such as, calls out a player's name, gives an advice to a player who gave a tip. Additionally, the individual sound is the dealer's voice according to the personal data and gaming history, such as voice of a dealer calling out player's name or gives an advice to a player who gave a tip. The main control unit 2031 outputs the generated individual images and individual sound to the front display 2021 or from the speakers 2022. Furthermore, if the player is awarded with the right-to-change a dealt card with another card as a result of the lottery process to be described later and the player who gave the tip desires, the main control unit 2031 executes the processing of exchanging the card dealt to that player for another card.

In the following, with reference to FIG. 19 description is made on the configuration according to the control system of the player's terminal 2004. FIG. 19 is a block diagram schematically showing the control system of the player's terminal 2004 according to this embodiment.

As shown in FIG. 19, the player's terminal 2004 according to this embodiment comprises as a core a microcomputer 2055 basically consisting of a CPU 2051, a RAM 2052, a ROM 2053, and a bus 2054 for performing data transfers mutually among them. The ROM 2053 stores various programs, data tables, etc., for performing necessary processes in controlling the player's terminal 2004. In addition, the RAM 2052 is a memory that temporarily stores various types of the data operated on the CPU 2051, in addition to the credit number currently pooled on the player's terminal 2004, bet target bet by a player, and bet amount (credit number) of the bet target bet by a player. In the RAM 2052, there are provided a bet amount storing area 2052A that stores the bet amount bet by a player, a tip amount storing area 2052B that stores the tip amount that a player gave to a dealer, a personal data storing area 2052C that stores player's personal data read from the ID card 2016, and a gaming history storing area 2052D that stores player's gaming history that is similarly read from the ID card 2016 and that is updated based on game result at each end of a game.

The CPU 2051 is also connected to a liquid crystal panel driving circuit 2057, a touch panel driving circuit 2058, a hopper driving circuit 2059, a payout completion signal circuit 2060, a communication interface 2061, and a card reader/writer 2017 via an I/O interface 2056. Furthermore, the liquid crystal display 2010 is connected to the liquid crystal panel driving circuit 2057, the touch panel 2011 is connected to the touch panel driving circuit 2058, a hopper 2062 is connected to the hopper driving circuit 2059, and a coin detection portion 2063 is connected to the payout completion signal circuit 2060, respectively.

Furthermore, the card reader/writer 2017 is a device that is placed inside the card insertion slot 2014 and that executes reading/writing of information stored in the ID card 2016 inserted into the card insertion slot 2014. Then, if the ID card 2016 is inserted into the card insertion slot 2014 when a game starts, CPU 2051 reads player's personal data and gaming history stored in the ID card 2016, and stores them into the personal data storing area 2052C and the gaming history storing area 2052D, respectively. When the game ends, it also writes updated gaming history into the ID card 2016.

Based on the operation information to be output from the touch panel 2011, the CPU 2051 computes the bet amount (credit number) for which a player placed a bet, and stores it in the bet amount storing area 2052A of the RAM 2052 and transmits it to the main control unit 2031. Furthermore, following the win/lose information transmitted from the main control unit 2031, the CPU 2051 increases or decreases the pooled credit. Based on the operation information to be output from the touch panel 2011, the CPU 2051 similarly computes the tip amount (credit number) given by a player to a dealer, and stores it in the tip amount storing area 2052B of the RAM 2052 and transmits it to the main control unit 2031.

Furthermore, the CPU 2051 outputs an image signal to be displayed on the front display 2021 and also controls payout of coins from the coin payout port 2015 by a hopper 2062 or a coin detection portion 2063.

Furthermore, if the CPU 2051 accepted the operation of tipping of the predetermined amount or more, it executes the lottery process for selecting by lottery whether or not to award the right-to-change a dealt card with another card each time a card is dealt to the player who plays a game with this player's terminal.

In the following, with reference to FIG. 15 and FIG. 20, description is made on the bet screen 2070 to be displayed on the liquid crystal display 2010 of the player's terminal 2004 when blackjack is played in the gaming machine 2001 according to this embodiment.

FIG. 15 and FIG. 20 are views illustrating the bet screen 2070 to be displayed on the liquid crystal display 2010 of the player's terminal 2004. Now, in the gaming machine 2001 according to this embodiment, using the bet screen 2070 and touch panel 2011, the player performs betting operation for betting credit worth of a predetermined value. The player can also perform operations of requesting for addition of the hand or increasing of the bet amount, etc.

As shown in FIG. 15 and FIG. 20, the bet screen 2070 comprises a player's card display area 2071 that displays an image 2087 of cards to be dealt to the player, CHIPS display area 2073 that displays an image 2072 of bet CHIPS, a pool amount display area 2074 that displays the pooled amount pooled in the pot, and data display area displaying various operation buttons and player's data.

The player's card display area 2071 is a display area for displaying the image 2087 of the cards dealt to the player. Then, the image 2087 of a plurality of cards displayed in the player's card display area 2071 are the cards dealt to the player who takes a seat and plays a game at this player's terminal 2004.

Furthermore, the CHIPS display area 2073 displays the image 2072 of the CHIPS that is equivalent to the bet amount bet by the player. (For instance, in FIG. 15 and FIG. 20, CHIPS worth of 50 credits are bet.) Before starting the game, the player selects the bet amount with a bet button 2075 to be described later and enters the bet amount by touching the CHIPS display area 2073. Then, the entered bet amount is transmitted to the main control unit 2031. The gaming machine 2001 determines the contents of a prize based on the bet amount entered with the bet button 2075 and the game result (any of win, loss, or draw).

Furthermore, the pooled amount display area 2074 is an area that displays the pooled amount pooled in the pot. In the gaming machine 2001 according to this embodiment, when a player gave a tip to the dealer, a predetermined percentage (e.g., 10%) of given tip is pooled in the pot.

Furthermore, a plurality of bet buttons 2075 (3 types: "1 Credit", "10 Credit" and "100 Credit" in this embodiment) are provided in the lower right part of the CHIPS display area 2073. By touching one of the bet buttons 2075, the player can select the bet amount to bet in this game.

Furthermore, a Repeat-bet button 2076, an UNDO-bet button 2077, and a Tip button 2086 are provided above the bet buttons 2075. By touching the Repeat-bet button 2076, the player can bet the same bet amount as last game. By touching the UNDO-bet button 2077, the player can also cancel the betting operation that he/she has once performed. By touching the Tip button 2086, the player can also give a tip to the dealer displayed on the front display 2021. Specifically, whenever the Tip button 2086 is pressed, one credit is given to the dealer as a tip. Above the Tip button 2086 is displayed a total value of the tip that is currently being given. However, tipping operation of the player through the Tip button 2086 can only be accepted after the player's betting operation of at least 1 credit is accepted.

In contrast, in the lower left part of the CHIPS display area 2073 are displayed a group of operation buttons to be used when the player bargains with the dealer. To be specific, as operation buttons, a STAND button 2078, a HIT button 2079, a SURRENDER button 2080, an INSURANCE button 2081, a SPLIT button 2082, and a Double Down button 2087 are provided.

The STAND button 2078 is a button to be touched when the player plays the game with the dealer, with the currently dealt cards instead of requesting any further card to be dealt. The HIT button 2079 is a button to be touched when the player requests for a new card in addition to the currently dealt cards. The HIT button 2079 can be used until a total of numbers shown on the dealt cards is "21" or more.

The SURRENDER button 2080 is a button to be touched when the player withdraw from this match of the game. When the player selects the SURRENDER button 2080, half of the bet amount at the time is collected, and the other half is returned to the player. The INSURANCE button 2081 is a button to be touched when the player insures against when cards dealt to the dealer make a blackjack.

The SPLIT button 2082 is a button to be touched when numbers shown on 2 cards dealt during the game are same, and the player wishes to divide the cards into 2 hands. Selection of the SPLIT button 2082 enables the player to play a game with the dealer by the hands of more than 1 pair of the cards. The Double Down button 2083 is a button to be touched when the player places an additional bet during a game.

Furthermore, a HELP button 2084 is provided below the STAND button 2078. The HELP button 2084 is a button to be touched when the player displays a method of operating the gaming machine 2001 on the liquid crystal display 2010. In addition, to the right side of the HELP button 2084 is provided a message area 2085 where a message supporting progress of the game is displayed.

In the lower part of the bet screen are provided a total-bet display area 2090 where the bet amount the player is currently betting is displayed, a total-win display area 2091 where the amount the player was awarded with prizes during the game is displayed, a credit display area 2092 where the credit number the player now possesses is displayed, a minimum-bet display area 2093 where the lower limit of the bet amount the player can bet is shown, and a maximum-bet display area 2094 where the upper limit of the bet amount the player can bet is shown.

Furthermore, as shown in FIG. 15, to the left of the player's card display area 2071 is provided a message display area 2095 where the dealer's voice appearing on the front display 2021 is displayed.

Furthermore, when the player is awarded with the right-to-change a dealt card, together with the dealer's voice, selection of whether or not to change cards is also displayed in the message display area 2095. When the player opted to change cards with the selection displayed in the message display area 2095, changing the last dealt card ("2 of diamonds" in FIG. 15) with another card (i.e., to redo dealing of cards by the dealer) is enabled. In contrast, if the player opted not to change cards, the currently displayed cards are confirmed as dealt cards and the player continues to play the game.

Furthermore, as shown in FIG. 15, to the right side of the player's card display area 2071 is provided a player's data display area 2096 where player's personal data or gaming history is displayed. The data to be displayed in the player's data display area 2096 includes a player's name, sex, age, and nationality, number of games in which the gaming machine 2001 was played, game hours, gaming value used in games, winning rate, total win amount, etc. The player's personal data or gaming history is displayed in the player information display area 2096 only when the ID card 2016 is inserted into the card insertion slot 14.

In the following, with reference to FIG. 22 and FIG. 23, we describe a main game screen to be displayed on the front display 2021 when blackjack is played in the gaming machine 2001 according to this embodiment. FIG. 22 and FIG. 23 are views of the main game screen to be displayed on the front display 2021.

Now, in the gaming machine 2001 according to this embodiment, images of a virtual dealer that animate dealing of cards in accordance with progress of the game to enhance realistic sensation of the game are displayed on the main game screen. These images of the dealer are changed into different types of images based on selections of a player at predetermined intervals of the number of the games.

FIG. 21 is a view showing a dealer select screen 2100 that is displayed on the front display 2021 at predetermined intervals of the game numbers. As shown in FIG. 21, more than one type of images (in FIG. 21, 6 types of a 1st dealer's image 2101 to 6th dealer's image 2106) of virtual dealers serving to run the game is displayed on the dealer select screen 2100. Then, a player awarded with a right-to-select can select an image of virtual dealer who serves to run the game, from a plurality of dealers displayed on the dealer select screen 2100 (in other words, selecting a type of character who plays a dealer, from a plurality of types of characters). Then, with the images 2101 to 2106 of the selected dealers displayed on the front display 2021, the subsequent game progresses (refer to FIG. 22 and FIG. 23). Furthermore, in the gaming machine 2001 according to the invention of present application, a player who carried out the bet of the highest bet amount in last 10 to 20 games is awarded with the right to select a dealer image.

As shown in FIG. 21, when a dealer image is selected in the dealer select screen 2100, the dealer image selected in the dealer select screen 2100 appears in the main game screen 2111 in a predetermined number of subsequent games. FIG. 22 and FIG. 23 show the main game screen 2111 in the case that a player selected the 1st dealer image 2101 on the dealer select screen 2100.

As shown in FIG. 22 and FIG. 23, at the approximate center of the main game screen 2111 are displayed a game table image 2112, a dealer's card image 2113 that shows the dealer's hand dealt to the dealer, and a CHIPS image 2114 to be handed to/from a player. Furthermore, when the dealer let out voice, a dialog 2115 showing content of the voice is also displayed. Then, in accordance with progress of the game, the dealer image 2101 performs dealing of cards or handing of CHIPS on the game table.

Furthermore, in the gaming machine 2001 according to this embodiment, if a player has gave a tip to a dealer, an image of a dealer who behaves according to personal data or gaming history of the player who gave the tip to the dealer is displayed. At the same time, the dealer's voice according to the personal data or gaming history of the player who gave the tip is output. Specifically, as the tip amount the player given increases, an image of the dealer who takes actions that are more beneficial to the player is displayed and the dealer's voice that is more beneficial to the player is output.

FIG. 24 is a view showing the dealer's behavior pattern based on the tip amount.

For instance, if the tip amount given to the dealer is from 1 to 5 credits, an image of the dealer's behavior of calling out user's name is displayed on the front display 2021. In addition, voice of the dealer calling out the user's name is also output from the speakers 2022, such as "your playtime is an hour, Mr. XX", "I wish you the best of luck, Ms. XX.", etc.

Furthermore, if the tip amount given to the dealer is from 6 to 10 credits, an image of the dealer's behavior of calling out user's name or of telling play hours or play number of the player is displayed on the front display 2021. In addition, voice of the dealer who tells the play hours and the play number including the user's name is output from the speakers 2022, such as "Your playtime is an hour, Mr. XX", etc.

Furthermore, if the tip amount given to the dealer is 11 to 15 credits, an image of the dealer's behavior of calling out user's name and of telling the total accumulated bet amount with the gaming machine 2001 is displayed on the front display 2012. In addition, voice of the dealer who tells the total accumulated bet amount with the gaming machine 2001 including the user's name is output from the speakers 2022, such as "Your total bet amount is 450 credits, Mr. XX", etc.

Furthermore, if the tip amount given to the dealer is 16 to 20 credits, an image of the dealer's behavior of not only calling out user's name but also telling the winning rate and total win amount is displayed on the front display 2021. In addition, voice of the dealer who tells the winning rate or the total win amount including the user's name is output from the speakers 2022, such as "Your total win is 300 credits, Mr. XX".

In addition, if the tip amount given to the dealer is 21 credits or more, an image of the dealer's behavior of calling out user's name and of giving an advice to the player is displayed on the front display 2021. In addition, voice of the dealer who gives an advice including the user's name to the player is output from the speaker 2022, such as "Hadn't you better hit, Mr. XX"?, etc.

Furthermore, if the tip amount is 26 credits or more and a predetermined condition such as lottery is satisfied, the dealer calls out user's name and an image of the dealer's action of asking the player whether or not to change cards is displayed on the front display 2021. In addition, voice of the dealer who includes user's name and asks the player whether or not to exchange dealt cards is output from the speaker 2022, such as "Do you exchange the distributed card, Mr. XX?", etc.

The characters displayed on the front display 2021 and voice output from the speakers are in a language corresponding to the nationality of the player who gave the tip. For instance, if the nationality of a player who gave a tip is American or Australian, English is used as shown in FIG. 23. If the nationality of a player who gave a tip is Japanese, then Japanese is used.

Furthermore, when the game ends, an image of cards showing those dealt to the dealer is displayed on the main game screen 2111. Furthermore, an image of cards showing those dealt to respective players (up to 5 players) who plays the game at the respective player's terminals 2004, and win/lose result image that shows winning/losing of each player and the dealer are also displayed. Thus, by referring to the main game screen 2111, the player can learn kinds of cards dealt to the dealer, those of cards dealt to other players who simultaneously play the game, and win/lose result of the other players as well as his/her own win/lose result.

In the following, with reference to FIG. 25 to FIG. 27, description is made on a game processing program executed by the CPU 2041 of the main control unit 2031, and a game processing program on the side of the player's terminal executed by the CPU 2051 of the player's terminal 2004 in the gaming machine 2001 according to this embodiment having the above configuration. The respective programs shown by flow charts in these FIG. 25 to FIG. 27 are stored in the RAM 2042 or the ROM 2043 with which the main control unit 2031 is equipped or the RAM 2052 or the ROM 2053 with which the player's terminal 2004 is equipped, and executed by the CPU 2041 or the CPU 2051.

First of all, with reference to FIG. 25 to FIG. 27, description is made on the game processing program executed by the main control unit 2031. In Step (hereinafter to be abbreviated as S) 2001, the CPU 2041 performs to-be-dealt card lottery process of selecting in drawing cards to be associated with the player or dealer. Specifically, if there are N cards to be used in one game (N=52 in blackjack), each card is associated with any number (order of dealing) from 1 to N. Then, the cards are associated with the dealer or player (i.e., dealt to the dealer or player) following this order.

Then, in S2002, the CPU 2041 transmits to the respective player's terminals 2004 a bet period start command that accepts betting operation by the player.

Next, in S2003, the CPU 2041 receives the bet information, tip information, and player's personal data and gaming history that were transmitted from the respective player's terminals 2004. Now, the bet information is the information on the bet amount (credit number) the player bet in this game for obtaining a prize. In addition, the tip information is the information on the tip amount that the player gave to the dealer in this game and that is not associated with a prize. The player's personal data and the gaming history are transmitted from the player's terminal 2004 only when the player gave the tip to the dealer in this game. The received information from the respective player's terminals 2004 is once stored in the RAM 2042.

Next, in S2004, the CPU 2041 updates the pooled amount pooled in the pooled amount storing area 42A based on the tip information received in the S2003. Specifically, it pools a predetermined percentage (e.g., 10%) of the tip amount the player gave to the dealer in this game, in the pooled amount storing area 2042A of the RAM 2042. Then, the pooled amount pooled in the pooled amount storing area 2042A will be paid out to the player's terminal 2004 of a corresponding player, when the player wins the blackjack in spades in subsequent games.

Then, in S2005, based on lottery result of the to-be-dealt card lottery process in the S2001, the CPU 2041 transmits to the respective player's terminals 2004 information on the first and the second cards (to be dealt) (e.g., "7 of hearts" or "A of spades", etc.) to be associated with the player who plays the game on the each player's terminal 2004.

Furthermore, in S2006, based on the tip information received in the S2003, the CPU 2041 judges whether or not there is some player who gave a tip to the dealer in this game, from among the players participating in the game.

As a result, if it is judged that there is a player who gave a tip to the dealer in this game (S2006: YES), the process proceeds to S2007. In contrast, if it is judged that there is no player who gave a tip to the dealer in this game (S2006: NO), the process proceeds to S2008.

In S2007, based on the personal data and the gaming history, and the tip amount of the player who gave the tip, which was received in the S2003, the CPU 2041 generates individual images and individual sound. The individual images are images of the dealer who behaves according to the player's personal data and the gaming history. Furthermore, the individual sound is the dealer's voice according to the player's personal data and the gaming history. Additionally, language to be displayed or output is language corresponding to the player's nationality. The contents of the individual images and individual sound, which have been described earlier with reference to FIG. 24, are omitted here.

Then, in S2008, an image of the dealer who deals 2 cards each to the player and the dealer is displayed as a main game screen 2111 (see FIG. 23) on the front display 2021. For the 2 cards dealt to the dealer, kinds of their marks are hidden when they were dealt. Then, if the individual images were generated in the S2007, the generated individual images are displayed by a given timing (e.g., before a card is dealt, while a card is being dealt, or after a card is dealt). Similarly, the individual sound is output from the speakers 2022 by the given timing.

Next, in S2009, the CPU 2041 receives a new request for to-be-dealt card transmitted from the player's terminal 2004. Then, in response to the request, it transmits information on the third card or later to the requesting player's terminal 2004 (S2010). Furthermore in S2011, the CPU 2041 displays on the front display 2021 an image of the dealer who deals a new card to the requesting player. In addition, if the individual image was generated in the S2007, the CPU 2041 displays the generated individual image by the given timing (e.g., before a card is dealt, or after a card is dealt). Similarly, the individual sound is output from the speakers 2022 by the given timing.

Then, in S2012, the CPU 2041 receives a dealt card change request transmitted from the player's terminal that desired to change dealt cards. Then, in response to the change request, it transmits to-be-newly-dealt card information that replaces once dealt cards, to the player's terminal 2004 that made the dealt card change request (S2013). Furthermore, in S2014, on the front display 2021 the CPU 2041 displays an image of the dealer re-dealing a card to the player who requested for card change, as the main game screen 2111.

Then, in S2015, the CPU 2041 receives selected card information transmitted from the respective player's terminals 2004. The selected card information is the information to be transmitted when the player opts to play the game with the dealer with the currently dealt cards, and transmitted to the main control unit 2031 when the STAND button 2078 is selected at the player's terminal 2004, as described below.

In S2016, the CPU 2041 compares the hand of cards associated with the dealer with the hand of cards associated with the player, and judges who won the game. Specifically, as long as a sum of numbers shown on the cards does not exceed "21", one having the hand of cards whose sum of numbers is closer to "21" is judges as a winner. If both have a same sum, the game is judged as a draw.

Then, in S2017, the CPU 2041 transmits said win/lose result in the S2016 to the respective player's terminals 2004. In addition, in S2018, CPU 2041 displays on the front display 2021 the win/lose result image showing the result of win/lose judgment of the respective player's terminals 2004.

Next, in S2019, the CPU 2041 judges whether or not the number of games executed has reached a predetermined game number (e.g., 20 games). Then, if it is judged that the predetermined game number was not reached (S2019: NO), the main game processing is terminated. Then, the process returns to S2001 if a game continues to be played subsequently.

In contrast, if it is judged the predetermined game number was reached (S2019: YES), the process proceeds to S2020. Then, in S2020, the CPU 2041 compares the accumulated bet amount of each player's terminal 2004 after the dealer's last image was changed, and identifies the player (player's terminal 2004) with the highest accumulated bet amount.

Then, in S2021, the CPU 2041 transmits a notice instructing to award the player's terminal 2004 played by the player identified in the S2020 with the right-to-select a dealer. Furthermore, in S2022, the CPU 2041 displays on the front display 2021 a dealer select screen 2100 (see FIG. 21) showing images of 6 types of dealers that can be selected by the player.

Next, in S2023, the CPU 2041 receives the selection result of a dealer's image to be transmitted from the player's terminal 2004 of the player awarded with the right-to-select.

Then, in S2024, based on the selection result received in the S2023, the CPU 2041 exercises controls so as to change the dealer's image to be displayed on the front display 2021. Specifically, if the player selects a dealer's image that is different from the dealer's image displayed in last game, the CPU 2041 switches the image to the newly selected dealer's image. If the game continues to be played subsequently, the process returns to S2001.

In the following, with reference to FIG. 25 to FIG. 27, description is made on the game processing program executed by the player's terminal 2004. In S2101, the CPU 2051 acquires personal data and gaming history of a player who plays with the player's terminal 2004. Specifically, it obtains the player's personal data and the gaming history, by reading with the card reader/writer 2017 data stored in the ID card 2016 inserted into the card insertion slot 2014. It is also possible to have the player directly enter the player's personal data and the gaming history, using the touch panel 2011, in which case, the need for the ID card is eliminated.

Next, in S2102, the CPU 2051 receives the bet period start command before the game starts, from the main control unit 2031.

Then, in S2103, the CPU 2051 starts betting operation acceptance process, displays the bet screen 2070 (refer to FIG. 15 and FIG. 20) on the liquid crystal display 2010, and identifies the bet amount (credit number) bet based on the operation information from the touch panel 2011. The CPU 2051 also identifies the tip amount (credit number) given based on the operation information of the Tip button 2086. However, tipping operation of the player can only be accepted after the player's betting operation of at least 1 credit is accepted.

Next, in S2104, the CPU 2051 judges whether or not the bet period has been terminated. Specifically, it is judged whether or not a predetermined duration (e.g., 20 see) has elapsed since acceptance of the betting operation started in the S2103.

Then, if it is judged that the bet period did not terminate (S2104: NO), the acceptance of betting operations continues, while the process proceeds to S2105 if it is judged that the bet period has been terminated (S2104: YES).

In S2105, the CPU 2051 transmits bet information, tip information, and a player's personal data and a gaming history to the main control unit 2031. Now, the bet information is the information on the bet amount (credit number) bet for obtaining a prize in the bet operation acceptance process started in the S2103. Furthermore, the tip information is the information on the tip amount that the player similarly gave to the dealer in the betting operation acceptance process and that is not associated with a prize. The player's personal data and gaming history is the information obtained in the S2101 and transmitted only when the player gave the tip to the dealer in this game.

Next, in S2106, the CPU 2051 receives from the main control unit 2031 information (kinds of marks) on the first and second cards associated with the player who games with the player's terminal 2004. Then, in S2107, based on the card information received in the S2106, the CPU 2051 displays on the bet screen 2070 the card that is associated with the screen.

Then, in S2108, the CPU 2051 starts to accept operations of various operation buttons 2078 to 2083 displayed on the bet screen 2070. In S2109, in particular, it is judged whether or not the HIT button 2079 was selected. If it is judged that the HIT button 2079 was selected (S2109: YES), the CPU 2051 requests the main control unit 2031 to deal a new card (S2110). Next, in S2111, the CPU 2051 receives card information newly transmitted from the main control unit 2031, and displays on the bet screen 2070 the card that is newly associated with the screen, based on the received card information (S2112). When the player executed Double Down, however, dealing of only one new card can be requested.

In contrast, if it is judged that the HIT button 2079 was not selected (S2109: NO), the process proceeds to S2120.

In S2113, the CPU 2051 judges whether or not the player has given a tip of the predetermined amount or more to the dealer.

If it is judged that the tip of the predetermined amount or more was given (S2113: YES), the lottery process is executed to select by lottery whether or not to award the player with the right-to-change the last dealt card with another card (S2114). In contrast, if it is judged that the tip was not given or the tip less than the predetermined amount was given (S2113: NO), the process proceeds to S2120.

In the following, description is made on the lottery process in the S2114 in more detail with reference to FIG. 28. Specifically, the CPU 2051 first executes the lottery program, and samples a random number value in a predetermined range of random number values (0 to 2559 in FIG. 28). Then, based on the sampled random number value and a table that associates the random number value with the decision of awarding or not awarding the right, the CPU 2051 determines whether or not to award the player with the right-to-change a dealt card with another card. For instance, in the case in which the table as shown in FIG. 28 is used and the CPU 2051 sampled the random number value "111", the player is to be awarded with the right-to-change the dealt card with another card. In contrast, when the CPU 2051 sampled the random number value "856", the player is not to be awarded with the right-to-change the dealt card with another card.

In S2115, based on the lottery result in the S2114, the CPU 2051 judges whether or not to award the player with the right-to-change the last dealt card with another card. As a result, if it is judged that the player is awarded with the right-to-change the last dealt card with another card (S2115:

YES), the process proceeds to S2116. In contrast, if it is judged that the player is not awarded with the right-to-change the last dealt card with another card (S2115: NO), the process proceeds to S2120.

In S2116, to the left side of the player's card display area 2071, the CPU 2051 displays a selection of whether or not to change the last dealt card with another card (i.e., to redo dealing of cards by the dealer). Then, in S2117, based on the operation information from the touch panel 2011, the CPU 2051 judges whether or not the player opted to change the dealt card.

If it is judged that the player opted to change the dealt card (S2117: YES), the process proceeds to S2118. In contrast, if it is judged that the player opted not to change the dealt card (S2117: NO), the process proceeds to S2120.

In S2118, the CPU 2051 requests the main control unit 2031 for dealing of new cards after the change. Next, in S2119, the CPU 2051 receives the card information newly transmitted from the main control unit 2031, and displays on the bet screen 2070 the card that is newly associated with the screen, based on the received card information. In addition, the image of the last card dealt to the player that is a target of the change is erased from the bet screen 2070.

Furthermore, in S2120, it is judged whether or not the STAND button 2078 was selected. If it is judged that the STAND button 78 was selected (S2120: YES), it is transmitted to the main control unit 2031 that the player selected to play the game with the currently displayed cards (S2121). In contrast, if it is judged that the STAND button 2078 was not selected (S2120: NO), the process returns to S2109. If any other operation button 2080 to 2084 was selected, process according to the selected button is performed.

Next, in S2122, the CPU 2051 receives win/lose judgment result transmitted from the main control unit 2031. Then, in S2123, based on the win/lose judgment result received in the S2122, the CPU 2051 displays on the liquid crystal display 2010 the win/lose judgment result of the player who plays a game with the player's terminal. Specifically, when the game ends in a draw, characters of "DRAW" appear on the bet screen 2070. In addition, when the player won, characters of "YOU WON" are displayed. Furthermore, when the player lost, characters of "YOU LOST" appear.

Then, in S2124, based on the bet amount accepted in the S2103 and win/lose judgment result, the CPU 2051 calculates a prize to be awarded to the player. In S2125, the CPU 2051 awards the prize calculated in the S2124 to the player. Specifically, when the player has beaten the dealer, the player is awarded with credit worth of twice as much as the total bet amount. In addition, when the player drew with the dealer, the player is awarded with credit equivalent to the total bet amount. Furthermore, if a predetermined condition of paying out the pooled amount pooled in the pooled amount storing area 2042A has been satisfied, the pooled amount so far pooled in the pot is awarded as a prize. Now, in the gaming machine 2001 according to this embodiment, the condition of paying out the pooled amount is that the hand of the cards associated with the player achieves blackjack in spades.

If more than one player satisfied the predetermined condition at the same time, in other words, if the hands of the cards associated with more than one player achieved blackjack in spades, the pooled amount is equally divided by a percentage for dividing the pooled amount by the number of players who satisfied the condition (e.g., 50% for two players).

Next, in S2126, the CPU 2051 receives from the main control unit 2031 a notice that the player's terminal 2004 is of the player awarded with a right-to-select. Then, in S2127, the CPU 2051 displays on the liquid crystal display 2010 the dealer select screen 2100 (refer to FIG. 22) having the same contents as the front display 2021.

In S2128, the CPU 2051 enables the operation of selecting a dealer's image by using the touch panel 2011 only in the player's terminal 2004 of the player awarded with the right-to-select identified in the S2020, and accepts the select operation. Specifically, at the player's terminal 2004 of the player awarded with the right-to-select, selecting any of a 1st dealer's image 2101 to a 6th dealer's image 2106 from the dealer select screen 2100, using the touch panel 2011 is enabled.

In S2129, the CPU 2051 transmits selected result of the player in the S2128 to the main control unit 2031. If the player awarded with the right-to-select did not perform the select operation, default select result that is determined in advance (e.g., the character is the 1st dealer's image 2101) is transmitted to the main control unit 2031.

Then, based on the transmitted select result, the main control unit 2031 displays the selected dealer's image on the front display 2021.

As described above, the gaming machine 2001 according to this embodiment causes a player who satisfied the predetermined condition to select one dealer's image from 6 types of dealer's images (S2128). The game progresses with the dealer's image selected subsequently displayed on the front display 2021 (S2024). Then, when the bet acceptance period starts, tipping operation to a dealer displayed on the front display 2021 is accepted (S2103), separately from betting operation for obtaining a prize. When the player gave the tip to the dealer, the individual image that is an image of the dealer who behaves according to personal data or gaming history of the player who gave the tip and individual sound that is the dealer's voice according to the personal data or gaming history of the player who gave the tip are generated (S2007). Then, the generated individual image and individual sound are output by the given timing (S2008, S2011, S2014). This enables the gaming machine to increase player's sense of tension or sensations to the game. It also allows the player to empathize with the dealer displayed on the display, and enables improved entertainment quality or increased operating rate.

Further, as dealer's behavior varies in many ways depending on the tip amount to be given, a new taste can be offered to players.

Furthermore, in the condition in which the player has given the dealer the tip of the predetermined amount or more, as the player is awarded with the right-to-change the last dealt card with another card (i.e., to ask the dealer to redo dealing of the card) based on the result of the lottery process to be executed after dealing of card (S2114), entertainment quality, which has not been possible with the prior art, can be enhanced.

It is needless to say that the present invention is not limited to the second embodiment described above, and various modifications and variations can be made within the scope of the present invention.

For instance, in this embodiment, although the player's personal data or the gaming history shall be obtained from an ID card (S2101), it may be configured to cause a player to enter his/her personal data or gaming history when a game starts.

Furthermore, a dealer's image may be displayed not only on the front display 2021, but also on the liquid crystal display 2010 of the respective player's terminals 2004. Additionally, speakers that output the dealer's voice may be provided in the respective player's terminals 2004.

Furthermore, not only the last card dealt to the user but also any card dealt by the dealer when the game started may also be a target of exchange. Additionally, more than one card may be a target of exchange. Moreover, the condition of awarding the right-to-change cards may not only be payment of a tip that is greater than the predetermined amount, but may also be just the payment of a tip.

Additionally, the condition of paying out as a prize the pooled amount pooled in the pot may include the condition that the dealer achieves a specified hand.

Furthermore, the gaming machine according to the invention of present application can be applied in any gaming machine for playing a game to be run by the dealer, such as baccarat, draw poker, roulette game, etc., in addition to blackjack.

Furthermore, the invention of present application can be implemented as a gaming method for executing the processes described above. The present invention can also be implemented as a program for causing the gaming method to be executed on a computer and a recording medium in which the program is recorded.

The gaming method of the gaming machine according to the invention of present application can also be applied to blackjack (so-called table game) to be played by the dealer 2202 and a player (not shown) on the gaming table 2201, as shown in FIG. 29.

In the table game as shown in FIG. 29, the dealer 2202 deals cards to the dealer and the player, respectively, on the gaming table 2201. In contrast, the player places a bet by putting a tip in a predetermined area on the gaming table 2201.

The player can also give a tip to the dealer 2202, separately from betting. Then, the dealer gives data on gaming history or an advice to the player who gave the tip.

Furthermore, if the player has given the dealer the tip of the predetermined amount or more, the player is awarded with the right-to-change the last dealt card with another card (i.e., to ask the dealer to redo dealing of the card) by the random timing.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

[3. The Third Embodiment]

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A gaming machine, a server, and a game system according to one or more aspects of the invention will be described in detail with reference to the drawings based on an embodiment embodying one or more aspects of the invention. However, it is appreciated that one or more aspects of the present invention may be embodied in distributable (via CD and the like) or downloadable software games, console games, and the like. In this regard, the slot machine may be a virtual slot machine that is displayed on a multi-purpose computer and/or dedicated kiosk. Aspects of the invention are described by way of hardware elements. However, it is appreciated that these elements may also be software modules that are executable in a computer. The software modules may be stored on a computer readable medium, including but not limited to a USB drive, CD, DVD, computer-readable memory, tape, diskette, floppy disk, and the like. For instance, aspects of the invention may be embodied in a JAVA-based application or the like that runs in a processor or processors. Further, the terms "CPU", "processor", and "controller" are inclusive by nature, including at least one of hardware, software, or firmware. These terms may include a portion of a processing unit in a computer (for instance, in multiple core processing units), multiple cores, a functional processor (as running virtually on at least one of processor or server, which may be local or remote). Further, in network-based gaming systems, the processor may include only a local processor, only a remote server, or a combination of a local processor and a remote server.

It is contemplated that one or more aspects of the invention may be implemented as computer executable instructions on a computer readable medium such as a non-volatile memory, a magnetic or optical disc. Further, one or more aspects of the invention may be implemented with a carrier signal in the form of, for instance, an audio-frequency, radio-frequency, or optical carrier wave.

In the following, based on a substantiated embodiment, description is made on a detailed description of a gaming machine according to the present invention and with reference to the drawings. Now, the gaming machine according to this embodiment is a type of a multiplayer gaming machine that comprises a plurality of player's terminals and that plays blackjack, one of card games, as a game to be executed. In the blackjack herein, first of all, each player bets a predetermined amount of gaming value. Then, if a total of numbers of subsequently dealt cards is closer to "21" than that of numbers of cards dealt to the dealer, the condition of winning a prize is satisfied, and payout of the prize according to the bet amount takes place.

The gaming machine according to the present invention displays on the display an image of a virtual dealer who runs the game. In addition, the dealer displayed on the display takes various actions in accordance with progress of the game. Furthermore, the gaming machine according to the present invention is characterized in that it enables, if the player selects to execute Double Down when the player gave the dealer a tip that is not associated with a prize separately from the bet operation for obtaining a prize, the operation of placing an additional bet of the amount that is twice to four times as much as the bet amount currently being bet (typically, only the operation of placing an additional bet of the same amount as the bet amount currently bet is permitted), as shown in FIG. 30.

With reference to FIG. 31, description is made on the schematic configuration of a gaming machine 3001 according to this embodiment FIG. 31 is an appearance diagram of the gaming machine 3001 according to this embodiment.

Basically, a gaming machine 3001 according to this embodiment comprises a table portion 3002 where players takes a seat and plays a game, and a panel portion 3003 that is placed behind the table portion 3002 and that displays an animation picture of the dealer, etc.

In the following, the table portion 3002 is first described. In the table portion 3002, more than one (5 units in FIG. 31) player's terminals called a satellite are positioned almost in fan-like fashion. FIG. 32 is an appearance diagram showing one player's terminal 3004 according to this embodiment.

As shown in FIG. 32, the player's terminal 3004 comprises a liquid crystal display 3010 for displaying a bet screen to be described later (refer to FIG. 30 and FIG. 35) or gaming results, etc., a touch panel 3011 that is positioned on the front face of the liquid crystal display 3010 and that is used in selecting a button to be displayed on the liquid crystal display 3010 when selecting a bet target or setting a bet amount, operation buttons 3012 for executing payout operation, etc., a coin insertion slot 3013 through which a coin or medal is inserted, a card insertion slot 3014 into which an ID card containing player's personal data is inserted, and a coin payout port 3015 that pays out a coin or medal corresponding to credit being pooled when the payout operation is executed.

Furthermore, as shown in FIG. 31, the panel portion 3 comprises the front display 3021 that displays an image of a dealer who deals cards or passes CHIPS, or contents of dealt card, speakers 3022 that are positioned on the upper part of the front display 3021 and output music, sound effect, and the dealer's voice in accordance with the progress of a game, and LEDs 3023 that are turned on during various types of effects.

Additionally, a pooled amount display portion 3024 is provided on the upper part of the front panel 3021. In the gaming machine 3001 according to this embodiment, as will be described below, when the player gave a tip to the dealer, a predetermined percentage of the given a tip (e.g., 10%) is pooled in the pot, and is paid out collectively when the hand (combination) of the player's card achieves "blackjack" of spades. Then, the currently pooled amount is displayed on the pooled amount display portion 3024.

Here, the cards to be used in the gaming machine 3001 according to the present embodiment are the tramp cards which are generally employed, and display a "mark" consisting of a "suit" and "number" (refer to FIG. 30).

Here, "suit" refers to the mark of a tramp card and includes the spade, heart, diamond and club.

The "number" refers to the number or alphabetical character on the tramp cards and includes A (Ace, corresponding to 1), 2, 3, 4, 5, 6, 7, 8, 9, 10, J (Jack, corresponding to 11), Q (Queen, corresponding to 12) and K (King, corresponding to 13).

The "mark" refers to the card's type which is decided based on the combination of the "suit" and "number" of the tramp card, and includes, for instance, "A of hearts", "K of spades" and the like.

Furthermore, the card insertion slot 3014 provided in the player's terminal 3004 is an insertion slot into which an ID card 3016 is inserted. The ID card 3016 is a card in which player's personal data or gaming history is stored, and a player obtains it in advance in a shop either being charged or free of charge. When a player obtains an ID card and enters his/her name, sex, age, nationality, etc., the personal data is stored in the ID card 3016. At the same time, by the player playing a game with his/her ID card 3016 inserted into the card insertion slot 3014, the gaming history (e.g., the number of games played with the gaming machine 3001, game hours, gaming value used in the games, winning rate, total won prizes, etc.) is stored or updated in the ID card 3016.

Furthermore, the gaming machine 3001 has a card reader/writer 3017 which is read or writes a data is stored in the ID card 3016 into the card insertion slot 3014 (refer to FIG. 34).

Furthermore, in the gaming machine 3001 according to this embodiment, if a player gave a tip to a dealer, personal data or gaming history of the player who gave the tip is acquired through the ID card 3016 and the card reader/writer 3017.

In the following, description is made on a method of playing the gaming machine 3001 configured as described above. A player who is to play a game takes a seat in front of the player's terminal 3004, and places a bet depending on a desired bet amount, using the bet screen displayed on the liquid crystal display 3010. In addition, the player can arbitrarily give a tip to the dealer, in addition to the betting operation. Then, the images of cards dealt to the player and the dealer, respectively, are displayed on the front display 3021 and respective liquid crystal displays 3010. Furthermore, if there is any player who gave a tip to the dealer, on the front display 3021 is displayed an image 3101 of the dealer who takes action that is different from normal ones according to personal data or gaming history of the player who given the tip. Furthermore, the dealer's voice that is different from normal one is output from the speakers 3022 according to the personal data or gaming history of the player who gave the tip. Furthermore, when the player has given a tip to the dealer, a right to bet additionally the amount that is twice to four times as much as the bet amount currently being bet is awarded to the tip-giver player. Then, based on kinds of dealt cards, an effect image that decides a winner from either the player or dealer, or an effect image that calls a draw is displayed. In addition, in each player's terminal 3004, if the player has beaten the dealer, as a prize he/she is awarded with credit that is twice as much as the bet amount (credit number) that was bet. In contrast, if the player was beaten by the dealer, he/she cannot be awarded with a prize. Furthermore, if the player drew with the dealer, credit equivalent to the bet amount that was bet is returned to the player. In addition, if the hand of the player's cards is blackjack, the pooled amount that has been so far pooled in the pot is paid out.

In the following, description is made on the configuration related to the control system of the gaming machine 3001 with reference to FIG. 33. FIG. 33 is a block diagram schematically showing the control system of the gaming machine 3001 according to this embodiment.

As shown in FIG. 33, the gaming machine 3001 according to this embodiment comprises a main control unit 3031, a plurality of player's terminals 3004 connected to the main control unit 3031, and various types of peripheral devices.

The main control unit 3031 comprises as a core a microcomputer 3045 basically consisting of a CPU 3041, a RAM 3042, a ROM 3043, and a bus 3044 for performing data transfers mutually among them. The ROM 3043 stores various programs, data tables, etc., for performing necessary processes in controlling the gaming machine 3001. In addition, the RAM 3042 is a memory that temporarily stores various types of data operated in the CPU 3041. Then in the RAM 3042, there is provided a pooled amount storing area 3042A in which the pooled amount that has been pooled in the pot is accumulated and stored. In addition, the CPU 3041 is connected to an image processing circuit 3047, a sound circuit 3048, an LED driving circuit 3049 and a communication interface 3050 via an I/O interface 3046.

The main control unit 3031 receives bet operation information such as the bet amount from the respective player's terminals 3004 and judges whether a game start condition is satisfied. Then, when a game is started, among 52 playing cards, a predetermined number of cards (at least 2 cards) are associated with the player and the dealer based on lottery result (on the screen, the card is dealt to the player and the dealer, respectively). Consequently, based on the hands of the associated cards, win/lose (any of player's win, dealer's win, or draw) judgment is made and the judgment result is transmitted to the respective player's terminals 3004. Then, the respective player's terminals 3004 increase or decrease the pooled credit according to the win/lose result received from the main control unit 3031.

The main control unit 3031 also outputs an image signal displayed on the front display 3021 and drivingly controls the speakers 3022 and the LEDs 3023. In addition, when the main control unit 3031 receives tipping information from the respective player's terminals 3004, it obtains player's personal data and gaming history from the player's terminals 3004. Then, individual images and individual sound are generated based on the acquired personal data and gaming history. The individual images refer to images of a dealer who behaves according to the personal data and gaming history, such as, calls out a player's name, gives an advice to a player who gave a tip. Additionally, the individual sound is the dealer's voice according to the personal data and gaming history, such as voice of a dealer calling out player's name or gives an advice to a player who gave a tip. The main control unit 3031 outputs the generated individual images and individual sound to the front display 3021 or from the speakers 3022.

Furthermore, if a Double Down operation is performed in the respective player's terminals 3004, the main control unit 3031 executes the additional bet process of increasing the current bet amount.

In the following, with reference to FIG. 34 description is made on the configuration according to the control system of the player's terminal 3004. FIG. 34 is a block diagram schematically showing the control system of the player's terminal 3004 according to this embodiment.

As shown in FIG. 34, the player's terminal 3004 according to this embodiment comprises as a core a microcomputer 3055 basically consisting of a CPU 3051, a RAM 3052, a ROM 3053, and a bus 3054 for performing data transfers mutually among them. The ROM 3053 stores various programs, data tables, etc., for performing necessary processes in controlling the player's terminal 3004. In addition, the RAM 3052 is a memory that temporarily stores various types of the data operated on the CPU 3051, in addition to the credit number currently pooled on the player's terminal 3004, bet target bet by a player, and bet amount (credit number) of the bet target bet by a player. In the RAM 3052, there are provided a bet amount storing area 3052A that stores the bet amount bet by a player, a tip amount storing area 3052B that stores the tip amount that a player gave to a dealer, a personal data storing area 3052C that stores player's personal data read from the ID card 3016, and a gaming history storing area 3052D that stores player's gaming history that is similarly read from the ID card 3016 and that is updated based on game result at each end of a game.

The CPU 3051 is also connected to a liquid crystal panel driving circuit 3057, a touch panel driving circuit 3058, a hopper driving circuit 3059, a payout completion signal circuit 3060, a communication interface 3061, and a card reader/writer 3017 via an I/O interface 3056. Furthermore, the liquid crystal display 3010 is connected to the liquid crystal panel driving circuit 3057, the touch panel 3011 is connected to the touch panel driving circuit 3058, a hopper 3062 is connected to the hopper driving circuit 3059, and a coin detection portion 3063 is connected to the payout completion signal circuit 3060, respectively.

Furthermore, the card reader/writer 3017 is a device that is placed inside the card insertion slot 3014 and that executes reading/writing of information stored in the ID card 3016 inserted into the card insertion slot 3014. Then, if the ID card 3016 is inserted into the card insertion slot 3014 when a game starts, CPU 3051 reads player's personal data and gaming history stored in the ID card 3016, and stores them into the personal data storing area 3052C and the gaming history storing area 3052D, respectively. When the game ends, it also writes updated gaming history into the ID card 3016.

Based on the operation information to be output from the touch panel 3011, the CPU 3051 computes the bet amount (credit number) for which a player placed a bet, and stores it in the bet amount storing area 3052A of the RAM 3052 and transmits it to the main control unit 3031. Furthermore, following the win/lose information transmitted from the main control unit 3031, the CPU 3051 increases or decreases the pooled credit. Based on the operation information to be output from the touch panel 3011, the CPU 3051 similarly computes the tip amount (credit number) given by a player to a dealer, and stores it in the tip amount storing area 3052B of the RAM 3052 and transmits it to the main control unit 3031.

Furthermore, the CPU 3051 outputs an image signal to be displayed on the front display 3021 and also controls payout of coins from the coin payout port 3015 by a hopper 3062 or a coin detection portion 3063.

Furthermore, the CPU 3051 executes the process of selecting additional bet amount if it accepted an operation of tipping of the predetermined amount or more and the player who plays a game at this player's terminal selected Double Down.

In the following, with reference to FIG. 30 and FIG. 35, description is made on the bet screen 3070 to be displayed on the liquid crystal display 3010 of the player's terminal 3004 when blackjack is played in the gaming machine 3001 according to this embodiment.

FIG. 30 and FIG. 35 are views illustrating the bet screen 3070 to be displayed on the liquid crystal display 3010 of the player's terminal 3004. Now, in the gaming machine 3001 according to this embodiment, using the bet screen 3070 and touch panel 3011, the player performs betting operation for betting credit worth of a predetermined value. The player can also perform operations of requesting for addition of the hand or increasing of the bet amount, etc.

As shown in FIG. 30 and FIG. 35, the bet screen 3070 comprises a player's card display area 3071 that displays an image 3087 of cards to be dealt to the player, CHIPS display area 3073 that displays an image 3072 of bet CHIPS, a pool amount display area 3074 that displays the pooled amount pooled in the pot, and data display area displaying various operation buttons and player's data.

The player's card display area 3071 is a display area for displaying the image 3087 of the cards dealt to the player. Then, the image 3087 of a plurality of cards displayed in the player's card display area 3071 are the cards dealt to the player who takes a seat and plays a game at this player's terminal 3004.

Furthermore, the CHIPS display area 3073 displays the image 3072 of the CHIPS that is equivalent to the bet amount bet by the player. (For instance, in FIG. 30 and FIG. 35, CHIPS worth of 50 credits are bet.) Before starting the game, the player selects the bet amount with a bet button 3075 to be described later and enters the bet amount by touching the CHIPS display area 3073. Then, the entered bet amount is transmitted to the main control unit 3031. The gaming machine 3001 determines the contents of a prize based on the bet amount entered with the bet button 3075 and the game result (any of win, loss, or draw).

Furthermore, the pooled amount display area 3074 is an area that displays the pooled amount pooled in the pot. In the gaming machine 3001 according to this embodiment, when a player gave a tip to the dealer, a predetermined percentage (e.g., 10%) of given tip is pooled in the pot.

Furthermore, a plurality of bet buttons 3075 (3 types: "1 Credit", "10 Credit" and "100 Credit" in this embodiment) are provided in the lower right part of the CHIPS display area 3073. By touching one of the bet buttons 3075, the player can select the bet amount to bet in this game.

Furthermore, a Repeat-bet button 3076, an UNDO-bet button 3077, and a Tip button 3086 are provided above the bet buttons 3075. By touching the Repeat-bet button 3076, the player can bet the same bet amount as last game. By touching the UNDO-bet button 3077, the player can also cancel the betting operation that he/she has once performed. By touching the Tip button 3086, the player can also give a tip to the dealer displayed on the front display 3021. Specifically, whenever the Tip button 3086 is pressed, one credit is given to the dealer as a tip. Above the Tip button 3086 is displayed a total value of the tip that is currently being given. However, tipping operation of the player through the Tip button 3086 can only be accepted after the player's betting operation of at least 1 credit is accepted.

In contrast, in the lower left part of the CHIPS display area 3073 are displayed a group of operation buttons to be used when the player bargains with the dealer. To be specific, as operation buttons, a STAND button 3078, a HIT button 3079, a SURRENDER button 3080, an INSURANCE button 3081, a SPLIT button 3082, and a Double Down button 3087 are provided.

The STAND button 3078 is a button to be touched when the player plays the game with the dealer, with the currently dealt cards instead of requesting any further card to be dealt. The HIT button 3079 is a button to be touched when the player requests for a new card in addition to the currently dealt cards. The HIT button 3079 can be used until a total of numbers shown on the dealt cards is "21" or more.

The SURRENDER button 3080 is a button to be touched when the player withdraw from this match of the game. When the player selects the SURRENDER button 3080, half of the bet amount at the time is collected, and the other half is returned to the player. The INSURANCE button 3081 is a button to be touched when the player insures against when cards dealt to the dealer make a blackjack.

The SPLIT button 3082 is a button to be touched when numbers displayed on 2 cards dealt during the game are same, and the cards are divided into 2 hands. Then, when the SPLIT button 3082 is selected, the player can now play with the dealer by the hands of more than one pair of the cards. The Double Down button 3083 is a button to be touched when double down is performed, i.e., an additional bet is placed, during the game. Normally, the bet amount that can be bet additionally by selecting Double Down is same as the bet amount currently being bet (i.e., 50 credits can be additionally bet in FIG. 30). However, if the player has given a tip to the dealer, the operation of placing an additional bet that is twice to four times as much as the currently bet amount is enabled (i.e., 100, 150, and 200 credits can be additionally bet in FIG. 30).

Furthermore, a HELP button 3084 is provided below the STAND button 3078. The HELP button 3084 is a button to be touched when the player displays a method of operating the gaming machine 3001 on the liquid crystal display 3010. In addition, to the right side of the HELP button 3084 is provided a message area 3085 where a message supporting progress of the game is displayed.

In the lower part of the bet screen are provided a total-bet display area 3090 where the bet amount the player is currently betting is displayed, a total-win display area 3091 where the amount the player was awarded with prizes during the game is displayed, a credit display area 3092 where the credit number the player now possesses is displayed, a minimum-bet display area 3093 where the lower limit of the bet amount the player can bet is shown, and a maximum-bet display area 3094 where the upper limit of the bet amount the player can bet is shown.

Additionally, as shown in FIG. 30, to the left side of the player's card display area 3071 is provided the message display area 3095 where the contents of the voice of a dealer displayed on the front display 3021 is displayed.

Furthermore, if Double Down was selected with the player having given a tip, the message display area 3095 also displays a selection of selecting the bet amount to be additionally bet, together with the contents of the dealer's voice. Then, to the bet amount currently being bet is added the amount determined by multiplying the scaling factor the player selected with the selection displayed in the message display area 3095 by the bet amount currently being bet.

Furthermore, as shown in FIG. 30, to the right side of the player's card display area 3071 is provided a player's data display area 3096 where player's personal data or gaming history is displayed. The data to be displayed in the player's data display area 3096 includes a player's name, sex, age, and nationality, number of games in which the gaming machine 3001 was played, game hours, gaming value used in games, winning rate, total win amount, etc. The player's personal data or gaming history is displayed in the player information display area 3096 only when the ID card 3016 is inserted into the card insertion slot 3014.

In the following, with reference to FIG. 37 and FIG. 38, we describe a main game screen to be displayed on the front display 3021 when blackjack is played in the gaming machine 3001 according to this embodiment. FIG. 37 and FIG. 38 are views of the main game screen to be displayed on the front display 3021.

Now, in the gaming machine 3001 according to this embodiment, images of a virtual dealer that animate dealing of cards in accordance with progress of the game to enhance realistic sensation of the game are displayed on the main game screen. These images of the dealer are changed into different types of images based on selections of a player at predetermined intervals of the number of the games.

FIG. 36 is a view showing a dealer select screen 3100 that is displayed on the front display 3021 at predetermined intervals of the game numbers. As shown in FIG. 36, more than one type of images (in FIG. 36, 6 types of a 1st dealer's image 3101 to 6th dealer's image 3106) of virtual dealers serving to run the game is displayed on the dealer select screen 3100. Then, a player awarded with a right-to-select can select an image of virtual dealer who serves to run the game, from a plurality of dealers displayed on the dealer select screen 3100 (in other words, selecting a type of character who plays a dealer, from a plurality of types of characters). Then, with the images 3101 to 3106 of the selected dealers displayed on the front display 3021, the subsequent game progresses (refer to FIG. 37 and FIG. 38). Furthermore, in the gaming machine 3001 according to the invention of present application, a player who carried out the bet of the highest bet amount in last 10 to 20 games is awarded with the right to select a dealer image.

As shown in FIG. 36 when a dealer image is selected in the dealer select screen 3100, the dealer image selected in the dealer select screen 3100 appears in the main game screen 3111 in a predetermined number of subsequent games. FIG. 37 and FIG. 38 show the main game screen 3111 in the case that a player selected the 1st dealer image 101 on the dealer select screen 3100.

As shown in FIG. 37 and FIG. 38, at the approximate center of the main game screen 3111 are displayed a game table image 3112, a dealer's card image 3113 that shows the dealer's hand dealt to the dealer, and a CHIPS image 3114 to be handed to/from a player. Furthermore, when the dealer let out voice, a dialog 3115 showing content of the voice is also displayed. Then, in accordance with progress of the game, the dealer image 3101 performs dealing of cards or handing of CHIPS on the game table.

Furthermore, in the gaming machine 3001 according to this embodiment, if a player has gave a tip to a dealer, an image of a dealer who behaves according to personal data or gaming history of the player who gave the tip to the dealer is displayed. At the same time, the dealer's voice according to the personal data or gaming history of the player who gave the tip is output. Specifically, as the tip amount the player given increases, an image of the dealer who takes actions that are more beneficial to the player is displayed and the dealer's voice that is more beneficial to the player is output.

FIG. 39 is a view showing the dealer's behavior pattern based on the tip amount.

For instance, if the tip amount given to the dealer is from 1 to 5 credits, an image of the dealer's behavior of calling out user's name is displayed on the front display 3021. In addition, voice of the dealer calling out the user's name is also output from the speakers 3022, such as "your playtime is an hour, Mr. XX", "I wish you the best of luck, Ms. XX.", etc.

Furthermore, if the tip amount given to the dealer is from 6 to 10 credits, an image of the dealer's behavior of calling out user's name or of telling play hours or play number of the player is displayed on the front display 3021. In addition, voice of the dealer who tells the play hours and the play number including the user's name is output from the speakers 3022, such as "Your playtime is an hour, Mr. XX", etc.

Furthermore, if the tip amount given to the dealer is 11 to 15 credits, an image of the dealer's behavior of calling out user's name and of telling the total accumulated bet amount with the gaming machine 3001 is displayed on the front display 3021. In addition, voice of the dealer who tells the total accumulated bet amount with the gaming machine 3001 including the user's name is output from the speakers 3022, such as "Your total bet amount is 450 credits, Mr. XX", etc.

Furthermore, if the tip amount given to the dealer is 16 to 20 credits, an image of the dealer's behavior of not only calling out user's name but also telling the winning rate and total win amount is displayed on the front display 3021. In addition, voice of the dealer who tells the winning rate or the total win amount including the user's name is output from the speakers 3022, such as "Your total win is 300 credits, Mr. XX".

In addition, if the tip amount given to the dealer is 21 credits or more, an image of the dealer's behavior of calling out user's name and of giving an advice to the player is displayed on the front display 3021. In addition, voice of the dealer who gives an advice including the user's name to the player is output from the speaker 3022, such as "Hadn't you better hit, Mr. XX"?, etc.

Furthermore, if the tip amount given to the dealer is 26 credits or more and the player selected Double Down, the dealer calls out user's name, and an image of action of asking the amount of the bet amount to add is displayed on the front display 3021. In addition, voice of the dealer including user's name and asking the bet amount to add is output from the speaker 3022, such as "Please select the level of double down, Mr. XX", etc.

The characters displayed on the front display 3021 and voice output from the speakers are in a language corresponding to nationality of the player who gave the tip. For instance, if the nationality of a player who gave a tip is American or Australian, English is used as shown in FIG. 38. If the nationality of a player who gave a tip is Japanese, then Japanese is used.

Furthermore, when the game ends, an image of cards showing those dealt to the dealer is displayed on the main game screen 3111. Furthermore, an image of cards showing those dealt to respective players (up to 5 players) who plays the game at the respective player's terminals 3004, and win/lose result image that shows winning/losing of each player and the dealer are also displayed. Thus, by referring to the main game screen 3111, the player can learn kinds of cards dealt to the dealer, those of cards dealt to other players who simultaneously play the game, and win/lose result of the other players as well as his/her own win/lose result.

In the following, with reference to FIG. 40 to FIG. 42, description is made on a game processing program executed by the CPU 3041 of the main control unit 3031, and a game processing program on the side of the player's terminal executed by the CPU 3051 of the player's terminal 3004 in the gaming machine 3001 according to this embodiment having the above configuration. The respective programs shown by flow charts in these FIG. 40 to FIG. 42 are stored in the RAM 3042 or the ROM 3043 with which the main control unit 3031 is equipped or the RAM 3052 or the ROM 3053 with which the player's terminal 3004 is equipped, and executed by the CPU 3041 or the CPU 3051.

First of all, with reference to FIG. 40 to FIG. 42, description is made on the game processing program executed by the main control unit 3031. In Step (hereinafter to be abbreviated as S) 3001, the CPU 3041 performs to-be-dealt card lottery process of selecting in drawing cards to be associated with the player or dealer. Specifically, if there are N cards to be used in one game (N=52 in blackjack), each card is associated with any number (order of dealing) from 1 to N. Then, the cards are associated with the dealer or player (i.e., dealt to the dealer or player) following this order.

Then, in S3002, the CPU 3041 transmits to the respective player's terminals 3004 a bet period start command that accepts betting operation by the player.

Next, in S3003, the CPU 3041 receives the bet information, tip information, and player's personal data and gaming history that were transmitted from the respective player's terminals 3004. Now, the bet information is the information on the bet amount (credit number) the player bet in this game for obtaining a prize. In addition, the tip information is the information on the tip amount that the player gave to the dealer in this game and that is not associated with a prize. The player's personal data and the gaming history are transmitted from the player's terminal 3004 only when the player gave the tip to the dealer in this game. The received information from the respective player's terminals 3004 is once stored in the RAM 3042.

Next, in S3004, the CPU 3041 updates the pooled amount pooled in the pooled amount storing area 3042A based on the tip information received in the S3003. Specifically, it pools a predetermined percentage (e.g., 10%) of the tip amount the player gave to the dealer in this game, in the pooled amount storing area 3042A of the RAM 3042. Then, the pooled amount pooled in the pooled amount storing area 3042A will be paid out to the player's terminal 3004 of a corresponding player, when the player wins the blackjack in spades in subsequent games.

Then, in S3005, based on lottery result of the to-be-dealt card lottery process in the S3001, the CPU 3041 transmits to the respective player's terminals 3004 information on the first and the second cards (to be dealt) (e.g., "7 of hearts" or "A of spades", etc.) to be associated with the player who plays the game on the each player's terminal 3004.

Furthermore, in S3006, based on the tip information received in the S3003, the CPU 3041 judges whether or not there is some player who gave a tip to the dealer in this game, from among the players participating in the game.

As a result, if it is judged that there is a player who gave a tip to the dealer in this game (S3006: YES), the process proceeds to S3007. In contrast, if it is judged that there is no player who gave a tip to the dealer in this game (S3006: NO), the process proceeds to S3008.

In S3007, based on the personal data and the gaming history, and the tip amount of the player who gave the tip, which was received in the S3003, the CPU 3041 generates individual images and individual sound. The individual images are images of the dealer who behaves according to the player's personal data and the gaming history. Furthermore, the individual sound is the dealer's voice according to the player's personal data and the gaming history. Additionally, language to be displayed or output is language corresponding to the player's nationality. The contents of the individual images and individual sound, which have been described earlier with reference to FIG. 39, are omitted here.

Then, in S3008, an image of the dealer who deals 2 cards each to the player and the dealer is displayed as a main game screen 3111 (see FIG. 38) on the front display 3021. For the 2 cards dealt to the dealer, kinds of their marks are hidden when they were dealt. Then, if the individual images were generated in the S3007, the generated individual images are displayed by a given timing (e.g., before a card is dealt, while a card is being dealt, or after a card is dealt). Similarly, the individual sound is output from the speakers 3022 by the given timing.

Next, in S3009, the CPU 3041 receives additional bet information that was transmitted from the respective player's terminals 3004. Now, the additional bet information is the information on the bet amount (credit number) the player bet additionally in this game for obtaining a prize. The additional bet information from the respective player's terminals 3004 is once stored in the RAM 3042.

Next, in S3010, the CPU 3041 receives a new request for to-be-dealt card transmitted from the player's terminal 3004. Then, in response to the request, it transmits information on the third card or later to the requesting player's terminal 3004 (S3011). Furthermore in S3012, the CPU 3041 displays on the front display 3021 an image of the dealer who deals a new card to the requesting player. In addition, if the individual image was generated in the S3007, the CPU 3041 displays the generated individual image by the given timing (e.g., before a card is dealt, or after a card is dealt). Similarly, the individual sound is output from the speakers 3022 by the given timing.

Then, in S3013, the CPU 3041 receives selected card information transmitted from the respective player's terminals 3004. The selected card information is the information to be transmitted when the player opts to play the game with the dealer with the currently dealt cards, and transmitted to the main control unit 3031 when the STAND button 3078 is selected at the player's terminal 3004, as described below.

In S3014, the CPU 3041 compares the hand of cards associated with the dealer with the hand of cards associated with the player, and judges who won the game. Specifically, as long as a sum of numbers shown on the cards does not exceed "21", one having the hand of cards whose sum of numbers is closer to "21" is judges as a winner. If both have a same sum, the game is judged as a draw.

Then, in S3015, the CPU 3041 transmits said win/lose result in the S3014 to the respective player's terminals 3004. In addition, in S3016, CPU 3041 displays on the front display 3021 the win/lose result image showing the result of win/lose judgment of the respective player's terminals 3004.

Next, in S3017, the CPU 3041 judges whether or not the number of games executed has reached a predetermined game number (e.g., 20 games). Then, if it is judged that the predetermined game number was not reached (S3017: NO), the main game processing is terminated. Then, the process returns to S3001 if a game continues to be played subsequently.

In contrast, if it is judged the predetermined game number was reached (S3017: YES), the process proceeds to S3018. Then, in S3018, the CPU 3041 compares the accumulated bet amount of each player's terminal 3004 after the dealer's last image was changed, and identifies the player (player's terminal 3004) with the highest accumulated bet amount.

Then, in S3019, the CPU 3041 transmits a notice instructing to award the player's terminal 3004 played by the player identified in the S3020 with the right-to-select a dealer. Furthermore, in S3020, the CPU 3041 displays on the front display 3021 a dealer select screen 3100 (see FIG. 36) showing images of 6 types of dealers that can be selected by the player.

Next, in S3021, the CPU 3041 receives the selection result of a dealer's image to be transmitted from the player's terminal 3004 of the player awarded with the right-to-select.

Then, in S3022, based on the selection result received in the S3023, the CPU 3041 exercises controls so as to change the dealer's image to be displayed on the front display 3021. Specifically, if the player selects a dealer's image that is different from the dealer's image displayed in last game, the CPU 3041 switches the image to the newly selected dealer's image. If the game continues to be played subsequently, the process returns to S3001.

In the following, with reference to FIG. 40 to FIG. 42, description is made on the game processing program executed by the player's terminal 3004. In S3101, the CPU 3051 acquires personal data and gaming history of a player who plays with the player's terminal 3004. Specifically, it obtains the player's personal data and the gaming history, by reading with the card reader/writer 3017 data stored in the ID card 3016 inserted into the card insertion slot 3014. It is also possible to have the player directly enter the player's personal data and the gaming history, using the touch panel 3011, in which case, the need for the ID card is eliminated.

Next, in S3102, the CPU 3051 receives the bet period start command before the game starts, from the main control unit 3031.

Then, in S3103, the CPU 3051 starts betting operation acceptance process, displays the bet screen 3070 (refer to FIG. 30 and FIG. 35) on the liquid crystal display 3010, and identifies the bet amount (credit number) bet based on the operation information from the touch panel 3011. The CPU 3051 also identifies the tip amount (credit number) given based on the operation information of the Tip button 3086. However, tipping operation of the player can only be accepted after the player's betting operation of at least 1 credit is accepted.

Next, in S3104, the CPU 3051 judges whether or not the bet period has been terminated. Specifically, it is judged whether or not a predetermined duration (e.g., 20 sec) has elapsed since acceptance of the betting operation started in the S3103.

Then, if it is judged that the bet period did not terminate (S3104: NO), the acceptance of betting operations continues, while the process proceeds to S3105 if it is judged that the bet period has been terminated (S3104: YES).

In S3105, the CPU 3051 transmits bet information, tip information, and a player's personal data and a gaming history to the main control unit 3031. Now, the bet information is the information on the bet amount (credit number) bet for obtaining a prize in the bet operation acceptance process started in the S3103. Furthermore, the tip information is the information on the tip amount that the player similarly gave to the dealer in the betting operation acceptance process and that is not associated with a prize. The player's personal data and gaming history is the information obtained in the S3101 and transmitted only when the player gave the tip to the dealer in this game.

Next, in S3106, the CPU 3051 receives from the main control unit 3031 information (kinds of marks) on the first and second cards associated with the player who games with the player's terminal 3004. Then, in S3107, based on the card information received in the S3106, the CPU 3051 displays on the bet screen 3070 the card that is associated with the screen.

Then, in S3108, the CPU 3051 starts to accept operations of various operation buttons 3078 to 3083 displayed on the bet screen 3070.

Next, in S3109, it is judged whether or not the Double Down button 3083 is selected. If it is judged that the Double Down button 3083 is selected (S3109: YES), the process proceeds to S3110. Accordingly, if it is judged that the Double Down button 3083 is not selected (S3109: NO), the process proceeds to S3114.

Then, in S3110, the CPU 3051 judges whether or not the player gave the tip to the dealer in this game and the tip amount that was given is the predetermined amount (26 credits in this embodiment) or more.

If it is judged that a tip of the predetermined amount or more has been given to the dealer (S3110: YES), the process proceeds to S3111. In contrast, if it is judged that the tip was not given or the tip less than the predetermined amount was given (S3113: NO), the process proceeds to S3120.

In S3111, to the left side of the player's card display area 3071 of the bet screen 3070 (refer to FIG. 30), the CPU 3051 displays a selection of selecting the additional bet amount from any of the "twice as much as the current bet amount", "3 times as much as the current bet amount", and "4 times as much as the current bet amount".

Then, in S3112, the CPU 3051 starts an additional bet operation acceptance process, and identifies the bet amount (credit number) to be additionally bet to any of the "twice as much as the current bet amount", "3 times as much as the current bet amount", and "4 times as much as the current bet amount", based on the operation information from the touch panel 3011.

In S3113, the CPU 3051 transmits the additional bet information to the main control unit 3031. Now, the bet information is the information on the bet amount (credit number) bet for obtaining a prize in the bet operation acceptance process started in the S3103. Now, the additional bet information is the information on the bet amount (credit number) the player bet additionally in this game.

In S3114, in particular, it is judged whether or not the HIT button 3079 was selected. If it is judged that the HIT button 3079 was selected (S3114: YES), the CPU 3051 requests the main control unit 3031 to deal a new card (S3115). Next, in S3116, the CPU 3051 receives card information newly transmitted from the main control unit 3031, and displays on the bet screen 3070 the card that is newly associated with the screen, based on the received card information (S3117). When the player executed Double Down, however, dealing of only one new card can be requested.

In contrast, if it is judged that the HIT button 3079 was not selected (S3114: NO), the process proceeds to S3118.

Furthermore, in S3118, it is judged whether or not the STAND button 3078 was selected. If it is judged that the STAND button 3078 was selected (S3118: YES), it is transmitted to the main control unit 3031 that the player selected to play the game with the currently displayed cards (S3119). In contrast, if it is judged that the STAND button 3078 was not selected (S3118: NO), the process returns to S3109. If any other operation button 3080 to 3084 was selected, process according to the selected button is performed.

Next, in S3120, the CPU 3051 receives win/lose judgment result transmitted from the main control unit 3031. Then, in S3121, based on the win/lose judgment result received in the S3120, the CPU 3051 displays on the liquid crystal display 3010 the win/lose judgment result of the player who plays a game with the player's terminal. Specifically, when the game ends in a draw, characters of "DRAW" appear on the bet screen 3070. In addition, when the player won, characters of "YOU WON" are displayed. Furthermore, when the player lost, characters of "YOU LOST" appear.

Then, in S3122, based on the bet amount accepted in the S3103 and win/lose judgment result, the CPU 3051 calculates a prize to be awarded to the player. In S3123, the CPU 3051 awards the prize calculated in the S3122 to the player. Specifically, when the player has beaten the dealer, the player is awarded with credit worth of twice as much as the total bet amount. In addition, when the player drew with the dealer, the player is awarded with credit equivalent to the total bet amount. Furthermore, if a predetermined condition of paying out the pooled amount pooled in the pooled amount storing area 3042A has been satisfied, the pooled amount so far pooled in the pot is awarded as a prize. Now, in the gaming machine 3001 according to this embodiment, the condition of paying out the pooled amount is that the hand of the cards associated with the player achieves blackjack in spades.

If more than one player satisfied the predetermined condition at the same time, in other words, if the hands of the cards associated with more than one player achieved blackjack in spades, the pooled amount is equally divided by a percentage for dividing the pooled amount by the number of players who satisfied the condition (e.g., 50% for two players).

Next, in S3124, the CPU 3051 receives from the main control unit 3031 a notice that the player's terminal 3004 is of the player awarded with a right-to-select. Then, in S3125, the CPU 3051 displays on the liquid crystal display 3010 the dealer select screen 3100 (refer to FIG. 37) having the same contents as the front display 3021.

In S3126, the CPU 3051 enables the operation of selecting a dealer's image by using the touch panel 3011 only in the player's terminal 3004 of the player awarded with the right-to-select identified in the S3018, and accepts the select operation. Specifically, at the player's terminal 3004 of the player awarded with the right-to-select, selecting any of a 1st dealer's image 3101 to a 6th dealer's image 3106 from the dealer select screen 3100, using the touch panel 3011 is enabled.

In S3127, the CPU 3051 transmits selected result of the player in the S3126 to the main control unit 3031. If the player awarded with the right-to-select did not perform the select operation, default select result that is determined in advance (e.g., the character is the 1st dealer's image 3101) is transmitted to the main control unit 3031.

Then, based on the transmitted select result, the main control unit 3031 displays the selected dealer's image on the front display 3021.

As described above, the gaming machine 3001 according to this embodiment causes a player who satisfied the predetermined condition to select one dealer's image from 6 types of dealer's images (S3126). The game progresses with the dealer's image selected subsequently displayed on the front display 3021 (S3022). Then, when the bet acceptance period starts, tipping operation to a dealer displayed on the front display 3021 is accepted (S3103), separately from betting operation for obtaining a prize. When the player gave the tip to the dealer, the individual image that is an image of the dealer who behaves according to personal data or gaming history of the player who gave the tip and individual sound that is the dealer's voice according to the personal data or gaming history of the player who gave the tip are generated (S3007). Then, the generated individual image and individual sound are output by the given timing (S3008, S3012). This enables the gaming machine to increase player's sense of tension or sensations to the game. It also allows the player to empathize with the dealer displayed on the display, and enables improved entertainment quality or increased operating rate.

Further, as dealer's behavior varies in many ways depending on the tip amount to be given, a new taste can be offered to players.

Furthermore, in the condition in which the player has given the dealer the tip of the predetermined amount or more, as the bet amount that can be additionally bet when Double Down is selected is greater than usual, entertainment quality can be enhanced, which has not been possible with the prior art.

It is needless to say that the present invention is not limited to the third embodiment described above, and various modifications and variations can be made within the scope of the present invention.

For instance, in this embodiment, although the player's personal data or the gaming history shall be obtained from an ID card (S3101), it may be configured to cause a player to enter his/her personal data or gaming history when a game starts.

Furthermore, a dealer's image may be displayed not only on the front display 3021, but also on the liquid crystal display 3010 of the respective player's terminals 3004. Additionally, speakers that output the dealer's voice may be provided in the respective player's terminals 3004.

Furthermore, the bet amount that can be added if the player selects Double Down in the condition in which the player has given the tip to the dealer may be determined by lottery, and not selected by the player. In addition, the maximum-bet amount that can be bet additionally may be varied depending on the given tip amount. For instance, if 30 credits were given as a tip, the maximum-bet amount that can be bet additionally shall be 4 times as much as the current bet amount, and if 50 credits were given as a tip, the maximum-bet amount that can be bet additionally may be 5 times as much as the current bet amount.

Additionally, the condition of paying out as a prize the pooled amount pooled in the pot may include the condition that the dealer achieves a specified hand.

Furthermore, the gaming machine according to the invention of present application can be applied in any gaming machine for playing a game to be run by the dealer, such as baccarat, draw poker, roulette game, etc., in addition to blackjack.

Furthermore, the invention of present application can be implemented as a gaming method for executing the processes described above. The present invention can also be implemented as a program for causing the gaming method to be executed on a computer and a recording medium in which the program is recorded.

The gaming method of the gaming machine according to the invention of present application can also be applied to blackjack (so-called table game) to be played by the dealer 3202 and a player (not shown) on the gaming table 3201, as shown in FIG. 43.

In the table game as shown in FIG. 43, the dealer 3202 deals cards to the dealer and the player, respectively, on the gaming table 3201. In contrast, the player places a bet by putting a tip in a predetermined area on the gaming table 3201.

The player can also give a tip to the dealer 3202, separately from betting. Then, the dealer gives data on gaming history or an advice to the player who gave the tip.

Furthermore, if the player gave the dealer 3202 a tip of the predetermined amount or more, the maximum-bet amount that can be bet additionally when the player selects Double Down shall be the amount higher than usual.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

[4-1. Characteristics of Card Gaming Machine (the Fourth Embodiment)]

A card gaming machine according to the present invention is explained in details with reference to the drawings based on the fourth embodiment. The card gaming machine according to the present embodiment is one of game machines of a multiple-players participating type having a plurality of player terminals, and executes a card game of a blackjack and awards a player payouts based on a result of win-lose and on a bet set by each player. Then, in the card gaming machine, an image of an imaginary dealer who acts as a facilitator of a card game can be selected from a plurality of kinds of images (in FIG. 55 below, six kinds of images including images that are from an image 4101 of the first dealer to an image 4106 of the sixth dealer) (in other words, one kind of character who plays a role of the dealer is selected from a plurality of kinds of characters). Then, the subsequent card game begins to be executed in a state that the image 4101-4106 of the selected dealer is being displayed on a front display 4021 (refer to FIGS. 51 and 52 below). Furthermore, in the card gaming machine, a right of selecting an image of a dealer is awarded to a player who bet the highest bet amount during the last ten to twenty games.

Then, in the card gaming machine, as shown especially in FIG. 44, when a player sets a tip for a dealer who is a facilitator of a blackjack by using a TIP button 4301 and the like, an image 4087 which turned up a part of face-down player cards and an image 4304 which enlarged the turned up part are displayed on a liquid crystal display 4010. With this, the player can see suits and rank that are owned in the player cards.

Furthermore, a message area 4085 in the liquid crystal display 4010 displays both character data which informs the player of a winning rate which the player has won with the current player cards in the past and character data of a personal name of the player. Furthermore, a speaker 4201 outputs both sounds data which informs the player of a winning rate which the dealer has won with the current dealer cards in the past and sounds data of the personal name of the player.

[4-2. Structural Overview of Card Gaming Machine (the Fourth Embodiment)]

First, a structural overview of the card gaming machine 4001 according to the present embodiment will be described based on FIG. 45. FIG. 45 is an outline view of the card gaming machine 4001 according to the present embodiment.

The card gaming machine 4001 according to the present embodiment generally comprises a table unit 4002 at which a player sits and plays a game, and a panel unit 4003 which is provided behind the table unit 4002 and displays animation images of an imaginary dealer and the like.

First, the table unit 4002 will be described below. In the table unit 4002, a plurality (five in FIG. 45) of terminals 4004 which are referred to as station arranged in generally a fan-like manner. Here, FIG. 46 is an outline view of one player terminal 4 according to the present embodiment.

As shown in FIG. 46, a player terminal 4004 comprises a liquid crystal display 4010, a touch panel 4011, operation buttons 4012, a coin insertion slot 4013, a bill insertion slot 4014, a coin payout opening 4015, a speaker 4201 and a reader/writer 40202. A liquid crystal display 4010 displays a bet screen (refer to FIG. 49) described below and a game result and the like. A touch panel 4011 is provided on a front surface of a liquid crystal display 4010. A touch panel 4011 is used for selecting an object of a bet. A touch panel 4011 is used for selecting a button displayed on a liquid crystal display 4010 while the bet amount is set. A touch panel 4011 is used for an operation of selecting an image of a dealer when a right of selecting is obtained. A payout operation and the like are performed by operation buttons 4012. Coins or medals are inserted into a coin insertion slot 4013. Bills are inserted into a bill insertion slot 4014. Coins or medals corresponding to accumulated credits are paid to a player through a coin payout opening 4015 when a payout operation is performed.

Returning to FIG. 45, the panel unit 4003 comprises the front display 4021, speakers 4022 and LEDs 4023. The front display 4021 displays images of a dealer who is deals cards or delivers chips and displays contents of the cards being dealt. The speakers 4022 are provided on the upper part of the front display 4021 and output music or sound effects along a progress of a game. The LEDs 4023 light up when a variety of effects are performed.

[4-3. Playing Method of Card Gaming Machine (the Fourth Embodiment)]

Next, a playing method of the card gaming machine 4001 which is comprised of the above will be described. In the card gaming machine 4001, a player who plays a game sits in front of a terminal 4004 and sets the desired bet amount by using a bet screen displayed on a liquid crystal display 4010. After that, images of player cards which have been dealt for players and images of dealer cards which have been dealt for a dealer are respectively displayed on the front display 4021 and each of the liquid crystal displays 4010. Then, based on kinds of the dealt cards, effect image which shows that either a player or the dealer is a winner or effect image which shows that a game result is a draw is displayed on the front display 4021 and each of the liquid crystal displays 4010. Furthermore, at each of the player terminals 4004, credits which are 1.5 times larger than the bet amount (the number of credits) are given as an award to a player if the player wins against the dealer. Alternatively, no award is given to a player if the player loses to the dealer. Furthermore, if a player ended in a draw with the dealer, no award is given to the player and the bet amount (the numbers of credits) being set by the player is pooled into a pot. Especially, when a hand of cards of a player is a blackjack of spade, the pooled amount which has been pooled in the pot until now is paid.

A right of selecting an image of a dealer is awarded to a player who has bet the highest amount throughout finishing the all games of the number determined by a lottery. Then, a dealer select screen 4100 shown in FIG. 55 is displayed on a liquid crystal display 4010 of a player terminal 4004 at which a player who is awarded a right of selecting is playing (an image of the same dealer select screen 4100 is displayed on the front display 4021). And an operation of selecting with a touch panel 4011 is validated at a player terminal 4004 in which a player who is awarded a right of selecting is playing. Thereafter, by selecting a desired image with using the touch panel 4011 from six kinds of dealer images 4101-4106 displayed on the dealer select screen 4100, a dealer who acts as a facilitator of a subsequent game is displayed by the selected image of a dealer. Incidentally, the selecting of a dealer may be validated by operation of operation buttons 4012 provided on a player terminal 4004.

[4-4. Control System of Card Gaming Machine (the Fourth Embodiment)]

Next, a control system of the card gaming machine 4001 will be described based on FIG. 47. FIG. 47 is a block diagram schematically showing the control system of the card gaming machine 4001. As shown in FIG. 47, the card gaming machine 4001 comprises a main control unit 4031, a plurality of player terminals 4004 which are connected to the main control unit 4031, a variety of peripheral devices.

The main control unit 4031 is composed of a micro computer 4045 as a kernel. The micro computer 4045 is basically composed of a CPU 4041, a RAM 4042, a ROM 4043 and a bus 4044 for transferring data mutually between these elements. The ROM 4043 stores a variety of programs, data tables and the like to execute necessary processes to control the card gaming machine 4001.

The RAM 4042 is a memory for temporarily storing a variety of data which have been operated in the CPU 4041. Furthermore, the RAM 4042 stores data (game history data) showing game results of each player terminal 4004 and a balance of each player terminal 4004 and stores track records (game result) of each dealer.

Furthermore, the ROM 4043 stores six kinds of dealer images 4101-4106 which are comprised of different characters, images of a plurality of kinds of costumes that the dealers wear and the like. The ROM 4043 stores sounds data of routine sentences described below, stores character data of sentences showing game points described below, and stores character data for informing track records described below. Furthermore, the ROM 4043 stores a program which converts character data to sounds data. The ROM 4043 stores images of a dealer who temporarily performs a gesture adapted to routine sentences described below.

In addition, the CPU 4041 is connected, via an I/O interface 4046, to an image processing circuit 4047, a sound circuit 4048, a LED driving circuit 4049, and a communication interface 4050.

Then, the main control unit 4031 receives bet operation information related to the bet amount being set by a player from each of the player terminals 4004 and determines whether or not a condition is realized to start a game. Then, upon starting a game, the main control unit 4031 assigns, based on a lottery result, a predefined number of cards (minimum, two cards) out of the 53 playing cards to a player and a dealer (on a screen, the cards are dealt to a player and a dealer, respectively), respectively. As the result, a win-lose (either a player or a dealer won, or they ended in a draw) is determined based on hands of the assigned cards, and the main control unit 4031 transmits results of the determination to each of the player terminals 4004. Subsequently, each of the player terminals 4004 increases or decreases accumulated credits according to results of a win-lose received from the main control unit 4031.

And the main control unit 4031 outputs signals of images displayed on the front display 4021, and also controls driving of the speakers 4022 and the LEDs 4023. Especially, when the main control unit 4031 receives dealer selection information from a player terminal 4004, the main control unit 4031 sets an image which has been selected from six kinds of dealer images 4101-4106 stored in the ROM 4043 as an image of an imaginary dealer, and the main control unit 4031 sets an image which has been selected from a plurality of kinds of costume images stored in the ROM 4043 as an image of a costume which the imaginary dealer wears. In the following games, the main control unit 4031 controls displaying the set images of the imaginary dealer and the costume on the front display 4021 and executes the games.

Next, a control system of a player terminal 4004 will be described based on FIG. 48. FIG. 48 is a block diagram schematically showing a control system of a player terminal 4004 according to the present embodiment.

As shown in FIG. 48, a player terminal 4004 according to the present embodiment is composed of a micro computer 4055 as a kernel. The micro computer 4055 is basically composed of a CPU 4051, a RAM 4052, a ROM 4053 and a bus 54 for transferring data mutually between these elements. The ROM 4053 includes a variety of programs, data tables and the like to execute necessary processes to control the player terminal 4004. The RAM 4052 is a memory for temporarily storing a variety of data which have been operated in the CPU 4051, such as the number of credits currently accumulated on the player terminal 4004, the bet amount (the number of credits) which a player has bet, multiplying factor of payout and the like. Furthermore, the RAM 4052 stores data (game history data) showing game results of the player terminal 4004 and stores a balance of the player terminal 4004.

In addition, the CPU 4051 is connected, via an I/O interface 4056, to a liquid crystal panel driving circuit 4057, a touch panel driving circuit 4058, a hopper driving circuit 4059, a payout completion signal circuit 4060, a communication interface 4061, a reader/writer 4202 and a speaker driving circuit 4203. Furthermore, a liquid crystal display 4010 is connected to the liquid crystal panel driving circuit 4057, a touch panel 4011 is connected to the touch panel driving circuit 4058, a hopper 4062 is connected to the hopper driving circuit 4059, a coin detecting portion 4063 is connected to the payout completion signal circuit 4060, a speaker 4201 is connected to the speaker driving circuit 4203, respectively. In the reader/writer 40202, an IC card 4204 is inserted or ejected. Additionally, the main control unit 4031 is connected to the communication interface 4061.

Then, based on operation information which is output from the touch panel 4011, the CPU 4051 calculates the bet amount (the number of credits) which a player has bet, then, stores the calculated bet amount into the RAM 4052 and transmits the calculated bet amount to the main control unit 4031. Furthermore, the CPU 4051 increases or decreases accumulated credits according to results of a win-lose received from the main control unit 4031.

And the CPU 4051 outputs signals of images displayed on the liquid crystal display 4010, and also controls paying coins from the coin payout opening 4015 by the hopper 4062 and the coin detecting portion 4063 and controls reading or writing in the reader/writer 4202.

Next, a bet screen 4070 which is displayed on a liquid crystal display 4010 of a player terminal 4004 when a blackjack is executed on the card gaming machine 4001 will be described based on FIGS. 49 and 50.

FIGS. 49 and 50 are explanatory views showing a bet screen 4070 displayed on a liquid crystal display 4010 of a player terminal 4004. Here, with the card gaming machine 4001, a player performs a bet operation of betting a certain number of credits with using a bet screen 4070 and a touch panel 4011. In addition, an operation to demand a dealing of one more card in hand, and an operation to increase the bet amount, can also be performed by a player using a bet screen 4070 and a touch panel 4011.

As shown in FIGS. 49 and 50, a bet screen 4070 comprises a player card display area 4071 for displaying an image 4087 (refer to FIG. 50) of cards dealt to a player, a chip display area 4073 for displaying an image 4072 of chips which have been bet, a pooled amount display area 4074 for displaying the pooled amount being pooled in the pot, and information display area for displaying a variety of operation buttons and information of a player.

Here, the player card display area 4071 is a display area for displaying an image 4087 (refer to FIG. 50) of cards which are dealt to a player. Then, an image 4087 (refer to FIG. 50) of a plurality of cards displayed on the player card display area 4071 is an image of cards which are dealt to a player who is sitting at the player terminal 4004 to play a game.

The chip display area 4073 displays an image 4072 of chips corresponding to the bet amount which a player has bet (for example, chips corresponding to 50 credits are bet in FIGS. 49 and 50). Then, a player selects the bet amount with using bet buttons 4075 described below, and determines the selected bet amount by touching the chip display area 4073. The player terminal 4004 transmits the determined bet amount to the main control unit 4031.

The pooled amount display area 4074 is a display area for displaying the pooled amount which is pooled in the pot. Here, with the card gaming machine 4001, when a player and a dealer ended in a draw, all of the bet amount the player has bet are pooled into the pot. With regard to this, a part (for example, 50%) of the bet amount a player has bet may be pooled into the pot. In this case, it is desirable that the rest of the bet amount which is not pooled is paid to the player.

In addition, a plurality of bet buttons 4075 (three kinds of "one credit", "10 credits" and "100 credits") are provided on the lower right hand side of the chip display area 4073. Then, a player can select the bet amount which is bet in the current game by touching the bet buttons 4075.

Furthermore, a Repeat bet button 4076 and an UNDO bet button 4077 are provided above the bet buttons 4075. A player can bet the bet amount which is the same bet amount as the previous game, by touching the Repeat bet button 4076. In addition, a player can cancel a bet operation which has been performed once, by touching the UNDO bet button 4077.

In the meantime, a group of operation buttons which is used when a player takes a tactics against a dealer are displayed on the lower left hand side of the chip display area 4073. Specifically, a STAND button 4078, a HIT button 4079, a SURRENDER button 4080, an INSURANCE button 4081, a SPLIT button 4082, and a Double Down button 4083 are provided, as the operation buttons.

Here, the STAND button 4078 is a button which is touched when a player plays by cards being dealt now with a dealer without demanding a dealing of anymore card. The HIT button 4079 is a button which is touched when a player demands newly a card in addition to cards being dealt now. Incidentally, a player can touch the HIT button 4079 till the total of a number indicated by cards being dealt is above "21".

The SURRENDER button 4080 is a button which is touched when a player gives up the current game. When the SURRENDER button 4080 is touched, whereas the half of the bet amount of the time is collected, the remaining half is repaid to the player. The INSURANCE button 4081 is a button which is touched when a player takes insurance in case cards which have been dealt to a dealer will become blackjack.

The SPLIT button 4082 is a button which is touched when a player divides two cards into two hands on condition that each number indicated by the cards which have been dealt in a game is the same number. If the SPLIT button 4082 is touched, a player can play with a dealer by hands of more than two sets of cards. The Double Down button 4083 is a button which is touched when a player increases the bet amount to double in a game.

In addition, a HELP button 4084 is provided below the STAND button 4078. The HELP button 4084 is a button which is touched when displaying operation methods of the card gaming machine 4001 on a liquid crystal display 4010. Additionally, a message area 4085 for displaying messages that support progress of a game is provided on the right hand side of the HELP button 4084.

In addition, a TIP button 4301 is provided on the left hand side of the UNDO bet button 4077. A player can give a tip to a dealer by touching the TIP button 4301. When a player selects the tip amount with the bet buttons 4075 above after touching the TIP button 4301, the selected tip amount is displayed in the message area 4085. Furthermore, the player determines the tip amount by touching the TIP button 4301 again and the determined tip amount is displayed in the message area 4085 and is transmitted to the main control unit 4031.

A CASHOUT button 4303 is provided below the HELP button 4084. If a player touches the CASHOUT button 4303, information of the number of credits which are currently being held by the player is written into an IC card 4204 by the reader/writer 4202 so as to be paid to the player. With regard to this, the number of credits which are currently being held by a player can be paid with coins corresponding to it (one credit corresponds to one coin) if the player executes a predetermined operation.

Then, at the lower part of a bet screen 4070, a bet amount display area 4090 for displaying the bet amount currently being bet by a player, an acquisition amount display area 4091 for displaying the amount which has been provided to a player as an award in games, a held credit display area 4092 for displaying the number of credits currently being held by a player, a lower-limit-of-bet-amount display area 4093 displaying the lower limit of the bet amount which a player can bet, and an upper-limit-of-bet-amount display area 4094 displaying the upper limit of the bet amount which a player can bet, are provided.

Additionally, at the left hand side of the player card display area 4071, a win-or-lose display area 4095 (refer to FIG. 50) which displays a win-lose of the current game for a player and a dealer is provided. Here, the side where the total of numbers indicated by cards being dealt is near to "21", in the range where the total do not exceed "21", is determined with a winner of a blackjack. In contrast, a draw of a blackjack is determined when the total of numbers indicated by cards being dealt to a player is equal to the total of numbers indicated by cards being dealt to a dealer. Then, a character string of "DRAW" is displayed in the win-or-lose display area 4095 (refer to FIG. 50) when a draw of a blackjack is determined. Furthermore, if a player wins, a character string of "YOU WON" is displayed in the win-or-lose display area 4095. Otherwise, if a player loses, a character string of "YOU LOST" is displayed in the win-or-lose display area 4095.

[4-5. Control System of Card Gaming Machine (the Fourth Embodiment)]

Next, a main screen 4091 displayed on the front display 4021 will be described referring to FIGS. 51 and 52. A main screen 4091 is displayed on the front display 4021 when the card gaming machine 4001 executes a blackjack.

FIGS. 51 and 52 are views showing main screens 4091 displayed on the front display 4021. In the card gaming machine 4001, so as to enhance realistic sensation, a main screen 4091 displays with action of an animation an image of an imaginary dealer who deal cards along progress of a game. The dealer image is changed to a different kind of image according to a player's selection at an interval of a predetermined number of games. Specifically, out of six kinds of images which composed of different characters, an image of a dealer selected on a dealer select screen 4100 by a player who is awarded a right of selecting will be displayed on a main screen 4091 in the following games. In the display of the image, the selected dealer is wearing the similarly selected costume. For example, FIG. 51 shows the main screen 4091 of a case that the first dealer 4101 is selected by a player on a dealer select screen 4100 and that a standard costume with a bow tie is selected as a costume. FIG. 52 shows the main screen 4091 of a case that the fifth dealer 4105 is selected by a player.

Depending on progress of a game, the dealer image 4101-4106, on a game table, deals cards and receives and gives chips.

[4-6. First Operation of Card Gaming Machine (the Fourth Embodiment)]

Next, a main game processing program executed by the CPU 4041 of the main control unit 4031, and a main game processing program of a player terminal side executed by a CPU 4051 of a player terminal 4004, will be described based on FIGS. 53 and 54. The two main game processing programs are executed respectively in the card gaming machine 4001 which has the above composition. Here, each program, which is shown in flowcharts of FIGS. 53 and 54, is stored in the RAM 4042 or the ROM 4043 which are provided in the main control unit 4031. Also, each program, which is shown in the flowcharts of FIGS. 53 and 54, is stored in a RAM 4052 or a ROM 4053 which are provided in the player terminals 4004. Furthermore, each program, which is shown in the flowcharts of FIGS. 53 and 54, is executed by the CPU 4041 or a CPU 4051 at a predetermined interval.

First, the main game processing program executed by the main control unit 4031 will be described based on FIGS. 53 and 54. In step (abbreviated to S hereafter) 4001, the CPU 4041 transmits, to each of the player terminals 4004, an instruction to start a betting period in which a player's bet operation is accepted.

Thereafter, in S4002, the CPU 4041 receives bet information transmitted from each of the player terminals 4004. Here, the bet information includes information on the bet amount (the number of credits) that a player has bet. Then, the bet information which has received from each of the player terminals 4004 is temporarily stored in the RAM 4042.

Subsequently, in S4003, the CPU 4041 classifies with respect to each player terminal 4004 the bet amounts that have been bet at all of the player terminals 4004 connected to the main control unit 4031. The classified bet amounts are accumulate-added with respect to each player terminal 4004 in the RAM 4042.

Next, the CPU 4041 starts a gaming process in S4004. In the gaming process, a game proceeds by mutual data transmission between the CPU 4041 and each player terminal 4004. The CPU 4041 transmits a proceeding result of the game to each player terminal 4004.

Furthermore, in the gaming process of S4004, so as to enhance realistic sensation of a game, the front display 4021 displays with action of an animation an image of an imaginary dealer who deal cards along progress of a game (refer to FIGS. 51 and 52). Then, the dealer image and the image of a costume which the dealer wears are changed to different kind of images based on selection of a player at an interval of a predetermined number of games which is determined by a lottery in S4011 described below.

In S4004-2, the CPU 4041 executes a history process. In this process, the CPU 4041 stores detailed game history information on a game result of each player terminal 4004 and a balance of each player terminal 4004 in the RAM 4042. Furthermore, the CPU 4041 stores in the RAM 4042 a track record (game result) with respect to each dealer who is a facilitator of a card game.

Next, in S4005, the CPU 4041 determines whether or not the number of executed games has reached the predetermined number of games which is determined by a lottery in S4011 described below. If it is determined that the number of executed games has not reached the predetermined number of games (S4005: NO), the main gaming processing is terminated. Then the flow returns to S4001 if a game is continued thereafter.

In contrast, if it is determined that the number of executed games has reached the predetermined number of games (S4005: YES), the flow proceeds to S4006. In S4006, the CPU 4041 compares the accumulated bet amounts which are added with respect to each player terminal 4004 in S4003 above and identifies a player (a player terminal 4004) having the highest accumulated bet amount.

Subsequently, in S4007, the CPU 4041 transmits information instructed to award a right of selecting a dealer to a player terminal 4004 where a player identified in S4006 above plays. Furthermore, in S4008, a dealer select screen 4100 (refer to FIG. 55) which shows images of six kinds of dealers that the player can select is displayed on the front display 4021.

Next, in S4009, the CPU 4041 receives a selection result of dealer images which is transmitted from a player terminal 4004 where a player who is awarded a right of selecting plays. A selection result received from a player terminal 4004 in S4009 above includes information on the selection result of which a player selected image between the first dealer image 4101 and the sixth dealer image 4106, and information on a kind of a costume which the selected dealer wears and a hair style.

In S4010, based on a selection result received in S4009 above, the CPU 4041 controls changing a dealer image which is displayed on the front display 4021. Specifically, when a player selects a dealer image which is different from a dealer image which has been displayed in the previous game, the dealer image is changed to the newly selected dealer image. The images of a costume and hair style are also changed to the ones that are selected by the player.

Furthermore, the CPU 4041 changes dealer's voice which is outputting at the speakers 4022 to sound quality of the selected dealer.

Next, in S4011, the CPU 4041 holds a lottery for the number of games that will be executed with a dealer image which is changed in S4010 above, and determines the number of games between ten and twenty. Incidentally, in S4005 above, the number of games is counted from the next game and it is determined whether or not the number of games has reached the one which is determined by a lottery in this S4011.

Then, in S4012, the CPU 4041 initializes (resets) the accumulated amounts of the bet amount of each player that are stored in the RAM 4042. The flow returns to S4001 if a game is continued thereafter.

Next, the main game processing program executed by a player terminal 4004 will be described based on FIGS. 53 and 54. In S4101, a CPU 4051 receives an instruction to start a betting period from the main control unit 4031.

Subsequently, in S4102, the CPU 4051 displays a bet screen 4070 on a liquid crystal display 4010 and identifies the bet amount (the number of credits) which a player has bet based on operating information of a touch panel 4011.

Next, in S4103, the CPU 4051 determines whether or not the betting period has terminated. Specifically, it is determined whether or not a predefined time length (e.g. 20 sec) has passed since accepting of a bet operation was started in S4102 above.

If it is determined that the betting period has not terminated (S4103: NO), the accepting of a bet operation is continued. In contrast, if it is determined that the betting period has terminated (S4103: YES), the flow proceeds to S4104.

In S4104, the CPU 4051 transmits bet information to the main control unit 4031. Here, the bet information includes information on the bet amount (the number of credits) that a player has bet.

In S4105, the CPU 4051 starts a gaming process. In this gaming process, a game progresses by mutual data transmission between the CPU 4051 and the main control unit 4031. Based on a result of a progressing game and a bet operation which is performed by a player, the CPU 4051 pays a prize.

In S4105-2, the CPU 4051 executes a history process. In this process, the CPU 4051 stores, in the RAM 4052, detailed game history information on a game result of a player terminal 4004 which has the CPU 4051 and on a balance of a player terminal 4004 which has the CPU 4051.

Next, in S4106, the CPU 4051 receives information showing that a player terminal 4004 which has the CPU 4051 is a player terminal of a player who is awarded a right of selecting, from the main control unit 4031. Subsequently, in S4107, the liquid crystal display 4010 displays a dealer select screen 4100 (refer to FIG. 55).

Then, in S4108, only in a player terminal 4004 of a player who is identified in S4006 above and to whom a right of selecting is awarded, a selecting operation of a dealer image with a touch panel 4011 is validated and the selecting operation is accepted. Specifically, in a player terminal 4004 of a player who is awarded a right of selecting, any one of images between the first dealer image 4101 and the sixth dealer image 4106 can be selected on a dealer select screen 4100 with a touch panel 4011.

In S4109, a selecting operation with the touch panel 4011 for selecting a costume and hair style for a dealer image of a character which is selected in S4108 above is validated and the selecting operation is accepted. Kinds of costumes that can be selected are a standard costume with a bow tie (refer to FIGS. 51 and 52), a costume with a suit and a costume with a dress. Hair styles that can be selected are a standard hair style which is previously determined for each character, a hair style with a short hair style, a hair style with a long hair style and a hair style with a pony tail.

Then, in S4110, the CPU 4051 transmits a selection result which has been selected by a player in S4108 above and S4109 above to the main control unit 4031. Incidentally, if a selecting operation is not executed by a player to whom a right of selecting is awarded, a selection result of default which is previously determined (for example, the first dealer image 4101, a standard costume and a standard hair style) is transmitted to the main control unit 4031.

Based on the transmitted selection result, the main control unit 4031 displays on the front display 4021 an image of a dealer who wears the selected costume and is with the selected hair style.

[4-7. Second Operation of Card Game Machine (the Fourth Embodiment)]

Next, an IC card processing program which is executed by the CPU 4041 of the main control unit 4031, and an IC card processing program of a player terminal side which is executed by a CPU 4051 of a player terminal 4004, will be described based on FIG. 56. Two IC card processing programs are executed respectively in the card gaming machine 4001 which has the above composition. Incidentally, each program, which is shown in a flowchart of FIG. 56, is stored in the RAM 4042 or the ROM 4043 which are provided in the main control unit 4031. Also, each program, which is shown in the flowchart of FIG. 56, is stored in a RAM 4052 or a ROM 4053 which are provided in the player terminals 4004. Furthermore, each program, which is shown in the flowchart of FIG. 56, is executed by the CPU 4041 or a CPU 4051 upon inserting an IC card 4204 to a reader/writer 4202 of a player terminal 4004.

First, the IC card processing program which is executed by the main control unit 4031 is described based on FIG. 56. In S4021, the CPU 4041 receives personal data from a player terminal 4004.

Then, in S4022, the CPU 4041 waits until a game is finished if it is during the game (S4022: YES). In contrast, if it is not during a game or a game is finished (S4022: NO), the flow proceeds to S4023.

In S4023, the CPU 4041 transmits sounds information to a player terminal 4004 which transmitted personal data in S4021 above. In this time, the CPU 4041 converts character data of a personal name included in personal data transmitted in S4021 above to sounds data. The CPU 4041 generates sounds information by adding sounds data of the routine sentence (for example, "Oh, I'm so glad to see") to the converted sounds data.

Incidentally, the routine sentence is stored in the ROM 4043. The CPU 4041 uses a conversion program being stored in the ROM 4043 when the CPU 4041 converts character data of a personal name included in personal data of S4021 above to sounds data.

In S4024, the CPU 4041 executes a dealer image changing process. In this process, the CPU 4041 controls changing a dealer image displayed on the front display 4021. Specifically, a dealer image is changed to a dealer image that performs temporarily a gesture adapted to a routine sentence included in sounds information that has been generated in S4023 above.

Next, the IC card processing program which is executed by a player terminal 4004 is described based on FIG. 56. In S4121, a CPU 4051 determines whether or not an IC card 4204 is inserted to a reader/writer 4202. In this time, only when an IC card 4204 is inserted to a reader/writer 4202 (S4121: YES), the following processes will be executed.

In S4122, the CPU 4051 executes an IC card read process. In this process, the CPU 4051 causes the reader/writer 4202 to read personal data stored in the IC card 4204.

In S4123, the CPU 4051 transmits personal data which has been read in S4122 above to the main control unit 4031. The personal data includes a player ID that identifies a player, and character data of a personal name of the player. When the IC card 4204 is issued, the player ID and personal name are stored in the IC card 4204.

In S4124, the CPU 4051 receives sounds information of S4023 above. Then, in S4125, the CPU 4051 executes a sounds output process. In this process, the CPU 4051 outputs sounds information which is received in S4124 above at the speaker 4201, as shown in FIG. 57.

In S4126, the CPU 4051 executes a display process. In this process, the CPU 4051 adds a service button 4302 to a bet screen 4070 displayed on the liquid crystal display 4010, as shown in FIG. 57. The service button 4302 comprises a personal name display area, a personal history button, a balance button, a game point button and a terminal history button.

[4-8. Third Operation of Card Game Machine (the Fourth Embodiment)]

Next, a service processing program which is executed by the CPU 4041 of the main control unit 4031, and a service processing program of a player terminal side which is executed by a CPU 4051 of a player terminal 4004, will be described based on FIG. 58. Two service processing programs are executed respectively in the card gaming machine 4001 which has the above composition. Incidentally, each program, which is shown in a flowchart of FIG. 58, is stored in the RAM 4042 or the ROM 4043 which are provided in the main control unit 4031. Also, each program, which is shown in the flowchart of FIG. 58, is stored in a RAM 4052 or a ROM 4053 which are provided in the player terminals 4004. Under a condition that an IC card 4204 is inserted to a reader/writer 4202 of a player terminal 4004, each program is executed by the CPU 4041 or a CPU 4051 at a predetermined interval upon touching by a player a CASHOUT button 4303 of a player terminal 4004 or touching by a player a service button 4302 of a player terminal 4004.

First, the service processing program executed by the main control unit 4031 is described based on FIG. 58. In S4031, the CPU 4041 receives termination information from a player terminal 4004. Then, in S4032, the CPU 4041 transmits stored information to a player terminal 4004 which transmitted termination information in S4031 above. The stored information includes game history information of the player terminal 4004 in S4004-2 above.

After a player ID is identified, for a player terminal 4004 of the identified player ID, the CPU 4041 builds data base in the RAM 4052 by classifying game history of S4004-2 above according to the player ID. Therefore, stored information of S4032 above includes the past game history information of a player ID of a player terminal 4004 which has the CPU 4051. Incidentally, for a player terminal 4004 whose a player ID is not identified, the CPU 4041 builds data base in the RAM 4052 by classifying game history of S4004-2 above according to a provisional player ID. The data base is similarly built in a RAM 4042 of a player terminal 4004.

In S33, the CPU 4041 receives service request information from a player terminal 4004. Then, in S4034, the CPU 4041 transmits service information to a player terminal 4004 which has transmitted service request information in S4033 above. The service information includes data that responds to request included in service request information of S4033 above.

Incidentally, such data is stored in the RAM 4042 or the ROM 4043. For example, if service request information of S4033 above includes data that requests information relating to a game point, data that responds to request included in service request information of S4033 above is stored in the ROM 4043. If service request information of S4033 above includes data that requests information relating to personal history or a balance, data that responds to request included in service request information of S4033 above is included in the data base stored in the RAM 4042.

Next, the service processing program executed by a player terminal 4004 is described based on FIG. 58. In S4131, a CPU 4051 determines whether or not a player has touched the CASHOUT button 4303. Now, if a player has not touched the CASHOUT button 4303 (S4131: NO), the flow proceeds to S4136 below. In contrast, if a player has touched the CASH-OUT button 4303 (S4131: YES), the flow proceeds to S4132.

In S4132, the CPU 4051 transmits termination information to the main control unit 4031. Then, in S4133, the CPU 4051 receives stored information of S4032 above. In S4134, the CPU 4051 executes a write-in process. In this process, the CPU 4051 writes the received stored information in the IC card 4204 with the reader/writer 4202.

In S4135, the CPU 4051 executes an IC card eject process. In this process, the CPU 4051 ejects the IC card 4204 from the reader/writer 4202. Then, the flow proceeds to S4136.

In S4136, the CPU 4051 determines whether or not a player has touched the service button 4302. Now, only when a player has touched the service button 4302 (S4136: YES), the following processes will be executed.

In S4137, the CPU 4051 transmits service request information to the main control unit 4031. The service request information includes data that requests information relating to a button determined to have been touched by a player in S4136 above within the each of buttons which constitutes the service button 4302. Specifically, if it is determined that a player has touched a game point button which constitutes the service button 4302 in S4136 above, data that requests information relating to a game point is included in service request information.

In S4138, the CPU 4051 receives service information of S4034 above. Then, in S4139, the CPU 4051 executes a service display process. In this process, the CPU 4051 displays data included in service information of S4034 above on the liquid crystal display 4010. Specifically, as shown in FIG. 59, data included in service information of S4034 above are displayed in an area except for the personal name display area within the service button 4302 on the bet screen 4070 displayed on the liquid crystal display 4010.

Incidentally, if information relating to a button determined to have been touched by a player in S4136 above within each of buttons which constitutes the service button 4302 is included in the data base stored in the RAM 4052, the CPU 4051 may obtain the information from the data base stored in the RAM 4052.

[4-9. Fourth Operation of Card Game Machine (the Fourth Embodiment)]

Next, a turn up processing program which is executed by the CPU 4041 of the main control unit 4031, and a turn up processing program of a player terminal side which is executed by a CPU 4051 of a player terminal 4004, will be described based on FIG. 60. Two turn up processing programs are executed respectively in the card gaming machine 4001 which has the above composition. Incidentally, each program, which is shown in a flowchart of FIG. 60, is stored in the RAM 4042 or the ROM 4043 which are provided in the main control unit 4031. Also, each program, which is shown in the flowchart of FIG. 60, is stored in a RAM 4052 or a ROM 4053 which are provided in the player terminals 4004. The each program is executed by the CPU 4041 or a CPU 4051 as a part of the gaming process of S4004 above or S4105 above.

First, the turn up processing program executed by the main control unit 4031 is described based on FIG. 60. In S4041, the CPU 4041 receives game record request information from a player terminal 4004. Then, in S4042, the CPU 4041 transmits game record information to a player terminal 4004 which transmitted the game record request information in S4041 above.

The game record information includes the following information:

(1) A winning rate which a dealer has won with the current dealer cards in the past;

(2) A winning rate which a player has won with the current player cards in the past;

(3) Sounds data that informs the player of a winning rate (1) above;

(4) Character data that informs the player of a winning rate (2) above;

(5) Character data that informs the player of a winning rate (1) above;

(6) Sounds data that informs the player of a winning rate (2) above; and (7) Sounds data that informs the player of the suits and rank of the current player cards.

Based on a player ID included in personal data of S4021 above, the CPU 4041 specifies a winning rate (1) above and a winning rate (2) above from the data base which is built in the RAM 4042. The CPU 4041 reads out, from the ROM 4043, character data which is a basis of sounds data (3) above, of sounds data (6) above and of sounds data (7) above. And, the CPU 4041 reads out, from the ROM 4043, character data of (4) above and (5) above. Incidentally, according to a conversion program stored in the ROM 4043, the CPU 4041 converts character data which is a basis of sounds data (3) above, (6) above and (7) above to sounds data. At this time, sound quality of the sounds data corresponds to voice of a dealer who progresses the current card game. Furthermore, the CPU 4041 adds character data of a personal name included in personal data of S4021 above to character data of (4) above and of (5) above. And the CPU 4041 includes the sounds data converted from the character data in sounds data of (3) above, of (6) above and of (7) above.

Next, the turn up processing program executed by a player terminal 4004 is described based on FIG. 60. In S4141, a CPU 4051 determines whether or not an image 4087 of cards dealt to a player as shown in FIG. 61 is face-down in the player card display area 4071 on the bet screen 4070 displayed on the liquid crystal display 4010. Now, only when an image 4087 of cards is face-down (S4141: YES), the following processes will be executed.

In S4142, the CPU 4051 determines whether or not an IC card 4204 is inserted to the reader/writer 4202. Now, only when an IC card 4204 is inserted to the reader/writer 4202 (S4142: YES), the following processes will be executed.

In S4143, the CPU 4051 determines whether or not a player has given a tip to a dealer by an operation of using the TIP button 4301 and the like. Now, only when a tip is given to a dealer (S4143: YES), the following processes will be executed.

In S4144, the CPU 4051 transmits game record request information to the main control unit 4031. Then, in S4145, the CPU 4051 receives game record information of S4042 above.

In S4146, the CPU 4051 executes a specific information generating process. In this process, the CPU 4051 outputs, at the speaker 4201, sounds data that informs a player of a winning rate which a dealer has won with the current dealer cards in the past. Furthermore, the CPU 4051 outputs, at the speaker 4201, sounds data that informs a player of a winning rate which the player has won with the current player cards in the past. These sounds data are included in game record information of S4145 above.

The CPU 4051 outputs character data that informs a player of a winning rate which the player has won with the current player cards in the past at the message area 4085 of the bet screen 4070 displayed on the liquid crystal display 4010, as shown in FIG. 44. Furthermore, the CPU 4051 outputs character data that informs a player of a winning rate which a dealer has won with the current dealer cards in the past at the message area 4085 of the bet screen 4070 displayed on the liquid crystal display 4010. These character data are included in game record information of S4145 above.

In S4147, the CPU 4051 executes a turn up process. In this process, as shown in FIG. 44, the CPU 4051 displays an card image 4087 which a part of the face-down cards dealt to a player has been turned up in the player card display area 4071 on the bet screen 4070 displayed on the liquid crystal display 4010. In the card image 4087, the suits and rank of the cards are shown on a part of the face-down cards which has been turned up. Furthermore, the CPU 4051 outputs, at the speaker 4201, sounds data that informs a player of the suits and rank of the current player cards. The sounds data is included in game record information of S4145 above.

In S4148, the CPU 4051 executes an enlarged display process. In this process, the CPU 4051 displays an enlarged image 4304 which enlarges a part of cards whose suits and rank are displayed in S4147 above, in the left side of the player card display area 4071 on the bet screen 4070 displayed on the liquid crystal display 4010, as shown in FIG. 62.

[4-10. Others (the Fourth Embodiment)]

The present invention is not limited to the above-described fourth embodiment but may be modified without deviating from a spirit of the invention.

For example, information which is written in an IC card 4204 in S4134 above of FIG. 58 may be stored in each storing device provided in each player terminal 4004. For that purpose, each storing device is configured to store personal data which is written in an IC card 4204 in S4122 above of FIG. 56.

When once a tip has been given to a dealer (S4143: YES), each process following to S4144 of the turn up processing program shown in FIG. 60 may be executed without giving a tip to the dealer again among card games of the predetermined number which is counted from the card game giving the tip to the dealer.

[5-1. Characteristics of Card Gaming Machine (the Fifth Embodiment)]

A card gaming machine according to the present invention is explained in details with reference to the drawings based on the fifth embodiment. The card gaming machine according to the present embodiment is one of game machines of a multiple-players participating type having a plurality of player terminals, and executes a card game of a blackjack and awards a player payouts based on a result of win-lose and on a bet set by each player. Then, in the card gaming machine, an image of an imaginary dealer who acts as a facilitator of a card game can be selected from a plurality of kinds of images (in FIG. 74 below, six kinds of images including images that are from an image 5101 of the first dealer to an image 5106 of the sixth dealer) (in other words, one kind of character who plays a role of the dealer is selected from a plurality of kinds of characters). Then, the subsequent card game begins to be executed in a state that the image 5101-5106 of the selected dealer is being displayed on a front display 5021 (refer to FIGS. 70 and 71 below). Furthermore, in the card gaming machine, a right of selecting an image of a dealer is awarded to a player who bet the highest bet amount during the last ten to twenty games.

Then, in the card gaming machine, as shown especially in FIG. 63, when a player sets a tip for a dealer who is a facilitator of a blackjack by using a TIP button 5301 and the like, an image 5087C of another player cards that is copied from an image 5087 of the current player cards is displayed on a liquid crystal display 5010. With this, the player can play with the both player cards. However, in the present embodiment, the player necessarily sets an additional bet with an ADD button 5402 so as to play with the both player cards.

Furthermore, a message area 5085 in the liquid crystal display 5010 displays, in addition to character data of a personal name of the player, character data which informs the player of a winning rate which the player has won against the dealer by the current player cards and the current dealer cards. Furthermore, a speaker 5201 outputs, in addition to sounds data of the personal name of the player, sounds data that informs the player that the player can play a game with both the current player cards and the same player cards as the current player cards.

[5-2. Structural Overview of Card Gaming Machine (the Fifth Embodiment)]

First, a structural overview of the card gaming machine 5001 according to the present embodiment will be described based on FIG. 64. FIG. 64 is an outline view of the card gaming machine 5001 according to the present embodiment.

The card gaming machine 5001 according to the present embodiment generally comprises a table unit 5002 at which a player sits and plays a game, and a panel unit 5003 which is provided behind the table unit 5002 and displays animation images of an imaginary dealer and the like.

First, the table unit 5002 will be described below. In the table unit 5002, a plurality (five in FIG. 64) of terminals 5004 which are referred to as station arranged in generally a fan-like manner. Here, FIG. 65 is an outline view of one player terminal 5004 according to the present embodiment.

As shown in FIG. 65, a player terminal 5004 comprises a liquid crystal display 5010, a touch panel 5011, operation buttons 5012, a coin insertion slot 5013, a bill insertion slot 5014, a coin payout opening 5015, a speaker 5201 and a reader/writer 5202. A liquid crystal display 5010 displays a bet screen (refer to FIG. 68) described below and a game result and the like. A touch panel 5011 is provided on a front surface of a liquid crystal display 5010. A touch panel 5011 is used for selecting an object of a bet. A touch panel 5011 is used for selecting a button displayed on a liquid crystal display 5010 while the bet amount is set. A touch panel 5011 is used for an operation of selecting an image of a dealer when a right of selecting is obtained. A payout operation and the like are performed by operation buttons 5012. Coins or medals are inserted into a coin insertion slot 5013. Bills are inserted into a bill insertion slot 5014. Coins or medals corresponding to accumulated credits are paid to a player through a coin payout opening 5015 when a payout operation is performed.

Returning to FIG. 64, the panel unit 5003 comprises the front display 5021, speakers 5022 and LEDs 5023. The front display 5021 displays images of a dealer who is deals cards or delivers chips and displays contents of the cards being dealt. The speakers 5022 are provided on the upper part of the front display 5021 and output music or sound effects along a progress of a game. The LEDs 5023 light up when a variety of effects are performed.

[5-3. Playing Method of Card Gaming Machine (the Fifth Embodiment)]

Next, a playing method of the card gaming machine 5001 which is comprised of the above will be described. In the card gaming machine 5001, a player who plays a game sits in front of a terminal 5004 and sets the desired bet amount by using a bet screen displayed on a liquid crystal display 5010. After that, images of player cards which have been dealt for players and images of dealer cards which have been dealt for a dealer are respectively displayed on the front display 5021 and each of the liquid crystal displays 5010. Then, based on kinds of the dealt cards, effect image which shows that either a player or the dealer is a winner or effect image which shows that a game result is a draw is displayed on the front display 5021 and each of the liquid crystal displays 5010. Furthermore, at each of the player terminals 4, credits which are 1.5 times larger than the bet amount (the number of credits) are given as an award to a player if the player wins against the dealer. Alternatively, no award is given to a player if the player loses to the dealer. Furthermore, if a player ended in a draw with the dealer, no award is given to the player and the bet amount (the numbers of credits) being set by the player is pooled into a pot. Especially, when a hand of cards of a player is a blackjack of spade, the pooled amount which has been pooled in the pot until now is paid.

A right of selecting an image of a dealer is awarded to a player who has bet the highest amount throughout finishing the all games of the number determined by a lottery. Then, a dealer select screen 5100 shown in FIG. 74 is displayed on a liquid crystal display 5010 of a player terminal 5004 at which a player who is awarded a right of selecting is playing (an image of the same dealer select screen 5100 is displayed on the front display 5021). And an operation of selecting with a touch panel 5011 is validated at a player terminal 5004 in which a player who is awarded a right of selecting is playing. Thereafter, by selecting a desired image with using the touch panel 5011 from six kinds of dealer images 5101-5106 displayed on the dealer select screen 5100, a dealer who acts as a facilitator of a subsequent game is displayed by the selected image of a dealer. Incidentally, the selecting of a dealer may be validated by operation of operation buttons 5012 provided on a player terminal 5004.

[5-4. Control System of Card Gaming Machine (the Fifth Embodiment)]

Next, a control system of the card gaming machine 5001 will be described based on FIG. 66. FIG. 66 is a block diagram schematically showing the control system of the card gaming machine 5001. As shown in FIG. 66, the card gaming machine 5001 comprises a main control unit 5031, a plurality of player terminals 5004 which are connected to the main control unit 5031, a variety of peripheral devices.

The main control unit 5031 is composed of a micro computer 5045 as a kernel. The micro computer 5045 is basically composed of a CPU 5041, a RAM 5042, a ROM 5043 and a bus 5044 for transferring data mutually between these elements. The ROM 5043 stores a variety of programs, data tables and the like to execute necessary processes to control the card gaming machine 5001.

The RAM 5042 is a memory for temporarily storing a variety of data which have been operated in the CPU 5041. Furthermore, the RAM 5042 stores data (game history data) showing game results of each player terminal 5004 and a balance of each player terminal 5004 and stores track records (game result) of each dealer.

Furthermore, the ROM 5043 stores six kinds of dealer images 5101-5106 which are comprised of different characters, images of a plurality of kinds of costumes that the dealers wear and the like. The ROM 5043 stores sounds data of routine sentences described below, stores character data of sentences showing game points described below, and stores character data for informing track records described below. Furthermore, the ROM 5043 stores a program which converts character data to sounds data. The ROM 5043 stores images of a dealer who temporarily performs a gesture adapted to routine sentences described below.

In addition, the CPU 5041 is connected, via an I/O interface 5046, to an image processing circuit 5047, a sound circuit 5048, a LED driving circuit 5049, and a communication interface 5050.

Then, the main control unit 5031 receives bet operation information related to the bet amount being set by a player from each of the player terminals 5004 and determines whether or not a condition is realized to start a game. Then, upon starting a game, the main control unit 5031 assigns, based on a lottery result, a predefined number of cards (minimum, two cards) out of the 53 playing cards to a player and a dealer (on a screen, the cards are dealt to a player and a dealer, respectively), respectively. As the result, a win-lose (either a player or a dealer won, or they ended in a draw) is determined based on hands of the assigned cards, and the main control unit 5031 transmits results of the determination to each of the player terminals 5004. Subsequently, each of the player terminals 5004 increases or decreases accumulated credits according to results of a win-lose received from the main control unit 5031.

And the main control unit 5031 outputs signals of images displayed on the front display 5021, and also controls driving of the speakers 5022 and the LEDs 5023. Especially, when the main control unit 5031 receives dealer selection information from a player terminal 5004, the main control unit 5031 sets an image which has been selected from six kinds of dealer images 5101-5106 stored in the ROM 5043 as an image of an imaginary dealer, and the main control unit 5031 sets an image which has been selected from a plurality of kinds of costume images stored in the ROM 5043 as an image of a costume which the imaginary dealer wears. In the following games, the main control unit 5031 controls displaying the set images of the imaginary dealer and the costume on the front display 5021 and executes the games.

Next, a control system of a player terminal 5004 will be described based on FIG. 67. FIG. 67 is a block diagram schematically showing a control system of a player terminal 5004 according to the present embodiment.

As shown in FIG. 67, a player terminal 5004 according to the present embodiment is composed of a micro computer 5055 as a kernel. The micro computer 5055 is basically composed of a CPU 5051, a RAM 5052, a ROM 5053 and a bus 5054 for transferring data mutually between these elements. The ROM 5053 includes a variety of programs, data tables and the like to execute necessary processes to control the player terminal 5004. In addition, the ROM 5053 stores character data, sounds data and the like so as to inform a player of a copy which is described below. Furthermore, the ROM 5053 stores a program which converts character data to sounds data. The RAM 5052 is a memory for temporarily storing a variety of data which have been operated in the CPU 5051, such as the number of credits currently accumulated on the player terminal 5004, the bet amount (the number of credits) which a player has bet, multiplying factor of payout and the like. Furthermore, the RAM 5052 stores data (game history data) showing game results of the player terminal 5004 and stores a balance of the player terminal 5004.

In addition, the CPU 5051 is connected, via an I/O interface 5056, to a liquid crystal panel driving circuit 5057, a touch panel driving circuit 5058, a hopper driving circuit 5059, a payout completion signal circuit 5060, a communication interface 5061, a reader/writer 5202 and a speaker driving circuit 5203. Furthermore, a liquid crystal display 5010 is connected to the liquid crystal panel driving circuit 5057, a touch panel 5011 is connected to the touch panel driving circuit 5058, a hopper 5062 is connected to the hopper driving circuit 5059, a coin detecting portion 5063 is connected to the payout completion signal circuit 5060, a speaker 5201 is connected to the speaker driving circuit 5203, respectively. In the reader/writer 5202, an IC card 5204 is inserted or ejected. Additionally, the main control unit 5031 is connected to the communication interface 5061.

Then, based on operation information which is output from the touch panel 5011, the CPU 5051 calculates the bet amount (the number of credits) which a player has bet, then, stores the calculated bet amount into the RAM 5052 and transmits the calculated bet amount to the main control unit 5031. Furthermore, the CPU 5051 increases or decreases accumulated credits according to results of a win-lose received from the main control unit 5031.

And the CPU 5051 outputs signals of images displayed on the liquid crystal display 5010, and also controls paying coins from the coin payout opening 5015 by the hopper 5062 and the coin detecting portion 5063 and controls reading or writing in the reader/writer 5202.

Next, a bet screen 5070 which is displayed on a liquid crystal display 5010 of a player terminal 5004 when a blackjack is executed on the card gaming machine 5001 will be described based on FIGS. 68 and 69.

FIGS. 68 and 69 are explanatory views showing a bet screen 5070 displayed on a liquid crystal display 5010 of a player terminal 5004. Here, with the card gaming machine 5001, a player performs a bet operation of betting a certain number of credits with using a bet screen 5070 and a touch panel 5011. In addition, an operation to demand a dealing of one more card in hand, and an operation to increase the bet amount, can also be performed by a player using a bet screen 5070 and a touch panel 5011.

As shown in FIGS. 68 and 69, a bet screen 5070 comprises a player card display area 5071 for displaying an image 5087 (refer to FIG. 69) of cards dealt to a player, a chip display area 5073 for displaying an image 5072 of chips which have been bet, a pooled amount display area 5074 for displaying the pooled amount being pooled in the pot, and information display area for displaying a variety of operation buttons and information of a player.

Here, the player card display area 5071 is a display area for displaying an image 5087 (refer to FIG. 69) of cards which are dealt to a player. Then, an image 5087 (refer to FIG. 69) of a plurality of cards displayed on the player card display area 5071 is an image of cards which are dealt to a player who is sitting at the player terminal 5004 to play a game.

The chip display area 5073 displays an image 5072 of chips corresponding to the bet amount which a player has bet (for example, chips corresponding to 50 credits are bet in FIGS. 68 and 69). Then, a player selects the bet amount with using bet buttons 5075 described below, and determines the selected bet amount by touching the chip display area 5073. The player terminal 5004 transmits the determined bet amount to the main control unit 5031.

The pooled amount display area 5074 is a display area for displaying the pooled amount which is pooled in the pot. Here, with the card gaming machine 5001, when a player and a dealer ended in a draw, all of the bet amount the player has bet are pooled into the pot. With regard to this, a part (for example, 50%) of the bet amount a player has bet may be pooled into the pot. In this case, it is desirable that the rest of the bet amount which is not pooled is paid to the player.

In addition, a plurality of bet buttons 5075 (three kinds of "one credit", "10 credits" and "100 credits") are provided on the lower right hand side of the chip display area 5073. Then, a player can select the bet amount which is bet in the current game by touching the bet buttons 5075.

Furthermore, a Repeat bet button 5076 and an UNDO bet button 5077 are provided above the bet buttons 5075. A player can bet the bet amount which is the same bet amount as the previous game, by touching the Repeat bet button 5076. In addition, a player can cancel a bet operation which has been performed once, by touching the UNDO bet button 5077.

In the meantime, a group of operation buttons which is used when a player takes a tactics against a dealer are displayed on the lower left hand side of the chip display area 5073. Specifically, a STAND button 5078, a HIT button 5079, a SURRENDER button 5080, an INSURANCE button 5081, a SPLIT button 5082, and a Double Down button 5083 are provided, as the operation buttons.

Here, the STAND button 5078 is a button which is touched when a player plays by cards being dealt now with a dealer without demanding a dealing of anymore card. The HIT button 5079 is a button which is touched when a player demands newly a card in addition to cards being dealt now. Incidentally, a player can touch the HIT button 5079 till the total of a number indicated by cards being dealt is above "21".

The SURRENDER button 5080 is a button which is touched when a player gives up the current game. When the SURRENDER button 5080 is touched, whereas the half of the bet amount of the time is collected, the remaining half is repaid to the player. The INSURANCE button 5081 is a button which is touched when a player takes insurance in case cards which have been dealt to a dealer will become blackjack.

The SPLIT button 5082 is a button which is touched when a player divides two cards into two hands on condition that each number indicated by the cards which have been dealt in a game is the same number. If the SPLIT button 5082 is touched, a player can play with a dealer by hands of more than two sets of cards. The Double Down button 5083 is a button which is touched when a player increases the bet amount to double in a game.

In addition, a HELP button 5084 is provided below the STAND button 5078. The HELP button 5084 is a button which is touched when displaying operation methods of the card gaming machine 5001 on a liquid crystal display 5010. Additionally, a message area 5085 for displaying messages that support progress of a game is provided on the right hand side of the HELP button 5084.

In addition, a TIP button 5301 is provided on the left hand side of the UNDO bet button 5077. A player can give a tip to a dealer by touching the TIP button 5301. When a player selects the tip amount with the bet buttons 6075 above after touching the TIP button 5301, the selected tip amount is displayed in the message area 5085. Furthermore, the player determines the tip amount by touching the TIP button 5301 again and the determined tip amount is displayed in the message area 85 and is transmitted to the main control unit 5031.

A CASHOUT button 5303 is provided below the HELP button 5084. If a player touches the CASHOUT button 5303, information of the number of credits which are currently being held by the player is written into an IC card 5204 by the reader/writer 5202 so as to be paid to the player. With regard to this, the number of credits which are currently being held by a player can be paid with coins corresponding to it (one credit corresponds to one coin) if the player executes a predetermined operation.

A COPY button 5401 and an ADD button 5402 are provided above the UNDO bet button 5077. The COPY button 5401 is a button which is touched by a player when the player wants to copy-display the same player cards as player cards on a liquid crystal display 5010. By touching the ADD button 5402, a player can set the same bet amount as the previously set bet amount.

Then, at the lower part of a bet screen 5070, a bet amount display area 5090 for displaying the bet amount currently being bet by a player, an acquisition amount display area 5091 for displaying the amount which has been provided to a player as an award in games, a held credit display area 5092 for displaying the number of credits currently being held by a player, a lower-limit-of-bet-amount display area 5093 displaying the lower limit of the bet amount which a player can bet, and an upper-limit-of-bet-amount display area 5094 displaying the upper limit of the bet amount which a player can bet, are provided.

Additionally, at the left hand side of the player card display area 5071, a win-or-lose display area 5095 (refer to FIG. 69) which displays a win-lose of the current game for a player and a dealer is provided. Here, the side where the total of numbers indicated by cards being dealt is near to "21", in the range where the total do not exceed "21", is determined with a winner of a blackjack. In contrast, a draw of a blackjack is determined when the total of numbers indicated by cards being dealt to a player is equal to the total of numbers indicated by cards being dealt to a dealer. Then, a character string of "DRAW" is displayed in the win-or-lose display area 5095 (refer to FIG. 69) when a draw of a blackjack is determined. Furthermore, if a player wins, a character string of "YOU WON" is displayed in the win-or-lose display area 5095. Otherwise, if a player loses, a character string of "YOU LOST" is displayed in the win-or-lose display area 5095.

[5-5. Control System of Card Gaming Machine (the Fifth Embodiment)]

Next, a main screen 5091 displayed on the front display 5021 will be described referring to FIGS. 70 and 71. A main screen 5091 is displayed on the front display 5021 when the card gaming machine 5001 executes a blackjack.

FIGS. 70 and 71 are views showing main screens 5091 displayed on the front display 5021. In the card gaming machine 5001, so as to enhance realistic sensation, a main screen 5091 displays with action of an animation an image of an imaginary dealer who deal cards along progress of a game. The dealer image is changed to a different kind of image according to a player's selection at an interval of a predetermined number of games. Specifically, out of six kinds of images which composed of different characters, an image of a dealer selected on a dealer select screen 5100 by a player who is awarded a right of selecting will be displayed on a main screen 5091 in the following games. In the display of the image, the selected dealer is wearing the similarly selected costume. For example, FIG. 70 shows the main screen 5091 of a case that the first dealer 5101 is selected by a player on a dealer select screen 5100 and that a standard costume with a bow tie is selected as a costume. FIG. 71 shows the main screen 5091 of a case that the fifth dealer 5105 is selected by a player.

Depending on progress of a game, the dealer image 5101-5106, on a game table, deals cards and receives and gives chips.

[5-6. First Operation of Card Gaming Machine (the Fifth Embodiment)]

Next, a main game processing program executed by the CPU 5041 of the main control unit 5031, and a main game processing program of a player terminal side executed by a CPU 5051 of a player terminal 5004, will be described based on FIGS. 72 and 73. The two main game processing programs are executed respectively in the card gaming machine 5001 which has the above composition. Here, each program, which is shown in flowcharts of FIGS. 72 and 73, is stored in the RAM 5042 or the ROM 5043 which are provided in the main control unit 5031. Also, each program, which is shown in the flowcharts of FIGS. 72 and 73, is stored in a RAM 5052 or a ROM 5053 which are provided in the player terminals 5004. Furthermore, each program, which is shown in the flowcharts of FIGS. 72 and 73, is executed by the CPU 5041 or a CPU 5051 at a predetermined interval.

First, the main game processing program executed by the main control unit 5031 will be described based on FIGS. 72 and 73. In step (abbreviated to S hereafter) 5001, the CPU 5041 transmits, to each of the player terminals 5004, an instruction to start a betting period in which a player's bet operation is accepted.

Thereafter, in S5002, the CPU 5041 receives bet information transmitted from each of the player terminals 5004. Here, the bet information includes information on the bet amount (the number of credits) that a player has bet. Then, the bet information which has received from each of the player terminals 5004 is temporarily stored in the RAM 5042.

Subsequently, in S5003, the CPU 5041 classifies with respect to each player terminal 5004 the bet amounts that have been bet at all of the player terminals 5004 connected to the main control unit 5031. The classified bet amounts are accumulate-added with respect to each player terminal 5004 in the RAM 5042.

Next, the CPU 5041 starts a gaming process in S5004. In the gaming process, a game proceeds by mutual data transmission between the CPU 5041 and each player terminal 5004. The CPU 5041 transmits a proceeding result of the game to each player terminal 5004.

Furthermore, in the gaming process of S5004, so as to enhance realistic sensation of a game, the front display 5021 displays with action of an animation an image of an imaginary dealer who deal cards along progress of a game (refer to FIGS. 70 and 71). Then, the dealer image and the image of a costume which the dealer wears are changed to different kind of images based on selection of a player at an interval of a predetermined number of games which is determined by a lottery in S5011 described below.

In S5004-2, the CPU 5041 executes a history process. In this process, the CPU 5041 stores detailed game history information on a game result of each player terminal 5004 and a balance of each player terminal 5004 in the RAM 5042. Furthermore, the CPU 5041 stores in the RAM 5042 a track record (game result) with respect to each dealer who is a facilitator of a card game.

Next, in S5005, the CPU 5041 determines whether or not the number of executed games has reached the predetermined number of games which is determined by a lottery in S5011 described below. If it is determined that the number of executed games has not reached the predetermined number of games (S5005: NO), the main gaming processing is terminated. Then the flow returns to S5001 if a game is continued thereafter.

In contrast, if it is determined that the number of executed games has reached the predetermined number of games (S5005: YES), the flow proceeds to S5006. In S5006, the CPU 5041 compares the accumulated bet amounts which are added with respect to each player terminal 5004 in S5003 above and identifies a player (a player terminal 5004) having the highest accumulated bet amount.

Subsequently, in S5007, the CPU 5041 transmits information instructed to award a right of selecting a dealer to a player terminal 5004 where a player identified in S5006 above plays. Furthermore, in S5008, a dealer select screen 5100 (refer to FIG. 74) which shows images of six kinds of dealers that the player can select is displayed on the front display 5021.

Next, in S5009, the CPU 5041 receives a selection result of dealer images which is transmitted from a player terminal 5004 where a player who is awarded a right of selecting plays. A selection result received from a player terminal 5004 in S5009 above includes information on the selection result of which a player selected image between the first dealer image 5101 and the sixth dealer image 5106, and information on a kind of a costume which the selected dealer wears and a hair style.

In S5010, based on a selection result received in S5009 above, the CPU 5041 controls changing a dealer image which is displayed on the front display 5021. Specifically, when a player selects a dealer image which is different from a dealer image which has been displayed in the previous game, the dealer image is changed to the newly selected dealer image. The images of a costume and hair style are also changed to the ones that are selected by the player.

Furthermore, the CPU 5041 changes dealer's voice which is outputting at the speakers 5022 to sound quality of the selected dealer.

Next, in S5011, the CPU 5041 holds a lottery for the number of games that will be executed with a dealer image which is changed in S5010 above, and determines the number of games between ten and twenty. Incidentally, in S5005 above, the number of games is counted from the next game and it is determined whether or not the number of games has reached the one which is determined by a lottery in this S5011.

Then, in S5012, the CPU 5041 initializes (resets) the accumulated amounts of the bet amount of each player that are stored in the RAM 5042. The flow returns to S5001 if a game is continued thereafter.

Next, the main game processing program executed by a player terminal 5004 will be described based on FIGS. 72 and 73. In S5101, a CPU 5051 receives an instruction to start a betting period from the main control unit 5031.

Subsequently, in S5102, the CPU 5051 displays a bet screen 5070 on a liquid crystal display 5010 and identifies the bet amount (the number of credits) which a player has bet based on operating information of a touch panel 5011.

Next, in S5103, the CPU 5051 determines whether or not the betting period has terminated. Specifically, it is determined whether or not a predefined time length (e.g. 20 sec) has passed since accepting of a bet operation was started in S5102 above.

If it is determined that the betting period has not terminated (S5103: NO), the accepting of a bet operation is continued. In contrast, if it is determined that the betting period has terminated (S5103: YES), the flow proceeds to S5104.

In S5104, the CPU 5051 transmits bet information to the main control unit 5031. Here, the bet information includes information on the bet amount (the number of credits) that a player has bet.

In S5105, the CPU 5051 starts a gaming process. In this gaming process, a game progresses by mutual data transmission between the CPU 5051 and the main control unit 5031. Based on a result of a progressing game and a bet operation which is performed by a player, the CPU 5051 pays a prize.

In S5105-2, the CPU 5051 executes a history process. In this process, the CPU 5051 stores, in the RAM 5052, detailed game history information on a game result of a player terminal 5004 which has the CPU 5051 and on a balance of a player terminal 5004 which has the CPU 5051.

Next, in S5106, the CPU 5051 receives information showing that a player terminal 5004 which has the CPU 5051 is a player terminal of a player who is awarded a right of selecting, from the main control unit 5031. Subsequently, in S5107, the liquid crystal display 5010 displays a dealer select screen 5100 (refer to FIG. 74).

Then, in S5108, only in a player terminal 5004 of a player who is identified in S5006 above and to whom a right of selecting is awarded, a selecting operation of a dealer image with a touch panel 5011 is validated and the selecting operation is accepted. Specifically, in a player terminal 5004 of a player who is awarded a right of selecting, any one of images between the first dealer image 5101 and the sixth dealer image 5106 can be selected on a dealer select screen 5100 with a touch panel 5011.

In S5109, a selecting operation with the touch panel 5011 for selecting a costume and hair style for a dealer image of a character which is selected in S5108 above is validated and the selecting operation is accepted. Kinds of costumes that can be selected are a standard costume with a bow tie (refer to FIGS. 70 and 71), a costume with a suit and a costume with a dress. Hair styles that can be selected are a standard hair style which is previously determined for each character, a hair style with a short hair style, a hair style with a long hair style and a hair style with a pony tail.

Then, in S5110, the CPU 5051 transmits a selection result which has been selected by a player in S5108 above and S5109 above to the main control unit 5031. Incidentally, if a selecting operation is not executed by a player to whom a right of selecting is awarded, a selection result of default which is previously determined (for example, the first dealer image 5101, a standard costume and a standard hair style) is transmitted to the main control unit 5031.

Based on the transmitted selection result, the main control unit 5031 displays on the front display 5021 an image of a dealer who wears the selected costume and is with the selected hair style.

[5-7. Second Operation of Card Game Machine (the Fifth Embodiment)]

Next, an IC card processing program which is executed by the CPU 5041 of the main control unit 5031, and an IC card processing program of a player terminal side which is executed by a CPU 5051 of a player terminal 5004, will be described based on FIG. 75. Two IC card processing programs are executed respectively in the card gaming machine 5001 which has the above composition. Incidentally, each program, which is shown in a flowchart of FIG. 75, is stored in the RAM 5042 or the ROM 5043 which are provided in the main control unit 5031. Also, each program, which is shown in the flowchart of FIG. 75, is stored in a RAM 5052 or a ROM 5053 which are provided in the player terminals 5004. Furthermore, each program, which is shown in the flowchart of FIG. 75, is executed by the CPU 5041 or a CPU 5051 upon inserting an IC card 5204 to a reader/writer 5202 of a player terminal 5004.

First, the IC card processing program which is executed by the main control unit 5031 is described based on FIG. 75. In S5021, the CPU 5041 receives personal data from a player terminal 5004.

Then, in S5022, the CPU 5041 waits until a game is finished if it is during the game (S5022: YES). In contrast, if it is not during a game or a game is finished (S5022: NO), the flow proceeds to S5023.

In S5023, the CPU 5041 transmits sounds information to a player terminal 5004 which transmitted personal data in S5021 above. In this time, the CPU 5041 converts character data of a personal name included in personal data transmitted in S5021 above to sounds data. The CPU 5041 generates sounds information by adding sounds data of the routine sentence (for example, "Oh, I'm so glad to see") to the converted sounds data.

Incidentally, the routine sentence is stored in the ROM 5043. The CPU 5041 uses a conversion program being stored in the ROM 5043 when the CPU 5041 converts character data of a personal name included in personal data of S5021 above to sounds data.

In S5024, the CPU 5041 executes a dealer image changing process. In this process, the CPU 5041 controls changing a dealer image displayed on the front display 5021. Specifically, a dealer image is changed to a dealer image that performs temporarily a gesture adapted to a routine sentence included in sounds information that has been generated in S5023 above.

Next, the IC card processing program which is executed by a player terminal 5004 is described based on FIG. 75. In S5121, a CPU 5051 determines whether or not an IC card 5204 is inserted to a reader/writer 5202. In this time, only when an IC card 5204 is inserted to a reader/writer 5202 (S5121: YES), the following processes will be executed.

In S5122, the CPU 5051 executes an IC card read process. In this process, the CPU 5051 causes the reader/writer 5202 to read personal data stored in the IC card 5204.

In S5123, the CPU 5051 transmits personal data which has been read in S5122 above to the main control unit 5031. The personal data includes a player ID that identifies a player, and character data of a personal name of the player. When the IC card 5204 is issued, the player ID and personal name are stored in the IC card 5204.

In S5124, the CPU 5051 receives sounds information of S5023 above. Then, in S5125, the CPU 5051 executes a sounds output process. In this process, the CPU 5051 outputs sounds information which is received in S5124 above at the speaker 5201, as shown in FIG. 76.

In S5126, the CPU 5051 executes a display process. In this process, the CPU 5051 adds a service button 5302 to a bet screen 5070 displayed on the liquid crystal display 5010, as shown in FIG. 76. The service button 5302 comprises a personal name display area, a personal history button, a balance button, a game point button and a terminal history button.

[5-8. Third Operation of Card Game Machine (the Fifth Embodiment)]

Next, a service processing program which is executed by the CPU 5041 of the main control unit 5031, and a service processing program of a player terminal side which is executed by a CPU 5051 of a player terminal 5004, will be described based on FIG. 77. Two service processing programs are executed respectively in the card gaming machine 5001 which has the above composition. Incidentally, each program, which is shown in a flowchart of FIG. 77, is stored in the RAM 5042 or the ROM 5043 which are provided in the main control unit 5031. Also, each program, which is shown in the flowchart of FIG. 77, is stored in a RAM 5052 or a ROM 5053 which are provided in the player terminals 5004. Under a condition that an IC card 5204 is inserted to a reader/writer 5202 of a player terminal 5004, each program is executed by the CPU 5041 or a CPU 5051 at a predetermined interval upon touching by a player a CASHOUT button 5303 of a player terminal 5004 or touching by a player a service button 5302 of a player terminal 5004.

First, the service processing program executed by the main control unit 5031 is described based on FIG. 77. In S5031, the CPU 5041 receives termination information from a player terminal 5004. Then, in S5032, the CPU 5041 transmits stored information to a player terminal 5004 which transmitted termination information in S5031 above. The stored information includes game history information of the player terminal 5004 in S5004-2 above.

After a player ID is identified, for a player terminal 5004 of the identified player ID, the CPU 5041 builds data base in the RAM 5052 by classifying game history of S5004-2 above according to the player ID. Therefore, stored information of S5032 above includes the past game history information of a player ID of a player terminal 5004 which has the CPU 5051.

Incidentally, for a player terminal 5004 whose a player ID is not identified, the CPU 5041 builds data base in the RAM 5052 by classifying game history of S5004-2 above according to a provisional player ID. The data base is similarly built in a RAM 5042 of a player terminal 5004.

In S5033, the CPU 5041 receives service request information from a player terminal 5004. Then, in S5034, the CPU 5041 transmits service information to a player terminal 5004 which has transmitted service request information in S5033 above. The service information includes data that responds to request included in service request information of S5033 above.

Incidentally, such data is stored in the RAM 5042 or the ROM 5043. For example, if service request information of S5033 above includes data that requests information relating to a game point, data that responds to request included in service request information of S5033 above is stored in the ROM 5043. If service request information of S5033 above includes data that requests information relating to personal history or a balance, data that responds to request included in service request information of S5033 above is included in the data base stored in the RAM 5042.

Next, the service processing program executed by a player terminal 5004 is described based on FIG. 77. In S5131, a CPU 5051 determines whether or not a player has touched the CASHOUT button 5303. Now, if a player has not touched the CASHOUT button 5303 (S5131: NO), the flow proceeds to S5136 below. In contrast, if a player has touched the CASHOUT button 5303 (S5131: YES), the flow proceeds to S5132.

In S5132, the CPU 5051 transmits termination information to the main control unit 5031. Then, in S5133, the CPU 5051 receives stored information of S5032 above. In S5134, the CPU 5051 executes a write-in process. In this process, the CPU 5051 writes the received stored information in the IC card 5204 with the reader/writer 5202.

In S5135, the CPU 5051 executes an IC card eject process. In this process, the CPU 5051 ejects the IC card 5204 from the reader/writer 5202. Then, the flow proceeds to S5136.

In S5136, the CPU 5051 determines whether or not a player has touched the service button 5302. Now, only when a player has touched the service button 5302 (S5136: YES), the following processes will be executed.

In S5137, the CPU 5051 transmits service request information to the main control unit 5031. The service request information includes data that requests information relating to a button determined to have been touched by a player in S5136 above within the each of buttons which constitutes the service button 5302. Specifically, if it is determined that a player has touched a game point button which constitutes the service button 5302 in S5136 above, data that requests information relating to a game point is included in service request information.

In S5138, the CPU 5051 receives service information of S5034 above. Then, in S5139, the CPU 5051 executes a service display process. In this process, the CPU 5051 displays data included in service information of S5034 above on the liquid crystal display 5010. Specifically, as shown in FIG. 78, data included in service information of S5034 above are displayed in an area except for the personal name display area within the service button 5302 on the bet screen 5070 displayed on the liquid crystal display 5010.

Incidentally, if information relating to a button determined to have been touched by a player in S5136 above within each of buttons which constitutes the service button 5302 is included in the data base stored in the RAM 5052, the CPU 5051 may obtain the information from the data base stored in the RAM 5052.

[5-9. Fourth Operation of Card Game Machine (the Fifth Embodiment)]

Next, a copy and play processing program which is executed by the CPU 5041 of the main control unit 5031, and a copy and play processing program of a player terminal side which is executed by a CPU 5051 of a player terminal 5004, will be described based on FIG. 79. Two copy and play processing programs are executed respectively in the card gaming machine 5001 which has the above composition. Incidentally, each program, which is shown in a flowchart of FIG. 79, is stored in the RAM 5042 or the ROM 5043 which are provided in the main control unit 5031. Also, each program, which is shown in the flowchart of FIG. 79, is stored in a RAM 5052 or a ROM 5053 which are provided in the player terminals 5004. The each program is executed by the CPU 5041 or a CPU 5051 as a part of the gaming process of S5004 above or S5105 above.

First, the copy and play processing program executed by the main control unit 5031 is described based on FIG. 79. In S5041, the CPU 5041 receives game record request information from a player terminal 5004. Then, in S5042, the CPU 5041 transmits game record information to a player terminal 5004 which transmitted the game record request information in S5041 above.

The game record information includes the following information:

(1) A winning rate which a player has won against a dealer by the current player cards and the current dealer cards;

(2) Sounds data that informs the player of a winning rate (1) above;

(3) Character data that informs the player of a winning rate (1) above;

(4) Character data that informs a player that the player can play a game with both the current player cards and the same player cards as the current player cards;

(5) Sounds data that informs a player that the player can play a game with both the current player cards and the same player cards as the current player cards.

Based on a player ID included in personal data of S5021 above, the CPU 5041 specifies a winning rate (1) above from the data base which is built in the RAM 5042. The CPU 5041 reads out, from the ROM 5043, character data which is a basis of sounds data (2) above and (5) above. And, the CPU 5041 reads out, from the ROM 5043, character data of (3) above and (4) above. Incidentally, according to a conversion program stored in the ROM 5043, the CPU 5041 converts character data which is a basis of sounds data (2) above and (5) above to sounds data. At this time, sound quality of the sounds data corresponds to voice of a dealer who progresses the current card game. Furthermore, the CPU 5041 adds character data of a personal name included in personal data of S5021 above to character data of (3) above and of (4) above. And the CPU 5041 includes the sounds data converted from the character data in sounds data of (2) above and (5) above.

In step S5043, the CPU 5041 executes a copy and play process. In this process, the CPU 5041 controls playing by a player with both the current player cards and the same player cards as the current player cards.

Next, a copy and play processing program executed by a player terminal 5004 is described based on FIG. 79. In S5141, the CPU 5051 determines whether or not an image 5087 of cards dealt to a player is a face-up one which shows rank and suits of the cards as shown in FIG. 80. Now, only when an image 5087 of cards is a face-up one (S5141: YES), the following processes will be executed.

In S5142, the CPU 5051 determines whether or not an IC card 5204 is inserted to the reader/writer 5202. Now, only when an IC card 5204 is inserted to the reader/writer 5202 (S5142: YES), the following processes will be executed.

In S5143, the CPU 5051 determines whether or not a player has given a tip to a dealer by an operation of using the TIP button 5301 and the like. Now, only when a tip is given to a dealer (S5143: YES), the following processes will be executed.

The CPU 5051 executes an output process in S5144. In this process, the CPU 5051 outputs at the speaker 5201 sounds data that informs a player that the same player cards as the current player cards can be copied if a player makes an additional bet, as shown in FIG. 80. Furthermore, the CPU 5051 outputs at the message area 5085 on the bet screen 5070 displayed on the liquid crystal display 5010 character data that informs a player that the same player cards as the current player cards can be copied if a player makes an additional bet, as shown in FIG. 80. These sounds data and character data are stored in the ROM 5053. Furthermore, the CPU 5051 outputs, in addition to the character data and the sounds data that are the above information, both character data of a personal name included in personal data stored in an IC card 5204 and sounds data that is converted from the character data.

In S5145, the CPU 5051 a COPY button validation process. In this process, the CPU 5051 validates touching of a player to the COPY button 5401. At this time, by changing a displaying color of the COPY button 5401, the CPU 5051 informs a player that a player's touch of the COPY button 5401 is validated.

In S5146, the CPU 5051 determines whether or not a player has touched the COPY button 5401. Now, only when a player has touched the COPY button 5401 (S5146: YES), the following processes will be executed.

In S5147, the CPU 5051 determines whether or not a player makes an additional bet by an operation of using the ADD button 5402. Only when a player makes an additional bet (S5147: YES), the following processes will be executed.

In S5148, the CPU 5051 transmits game record request information to the main control unit 5031. Then, in S5149, the CPU 5051 receives game record information of S5042 above.

In S5150, the CPU 5051 executes a specific information generating process. In this process, as shown in FIG. 63, the CPU 5051 outputs, at the speaker 5201, sounds data that informs a player that the player can play a game with both the current player cards and the same player cards as the current player cards, and the CPU 5051 outputs, at the speaker 5201, sounds data that informs the player of a winning rate which the player has won against the dealer by the current player cards and the current dealer cards. These sound data are included in game record information of S5149 above.

As shown in FIG. 63, the CPU 5051 outputs, at the message area 5085 on the bet screen 5070 displayed on the liquid crystal display 5010, character data that informs a player that the player can play a game with both the current player cards and the same player cards as the current player cards, and the CPU 5051 outputs, at the message area 5085 on the bet screen 5070 displayed on the liquid crystal display 5010, character data that informs the player of a winning rate which the player has won against the dealer by the current player cards and the current dealer cards. These character data are included in game record information of S5149 above.

In S5151, the CPU 5051 executes a copy display process. In this process, the CPU 5051 provides a copy display area 5071C on the left hand side of the player card display area 5071 on the bet screen 5070 displayed on the liquid crystal display 5010. The player card display area 71 is same as the copy display area 5071C. The CPU 5051 displays an image 5087C of copied cards in the copy display area 5071C. The image 5087C of the copied cards is same as the image 5087 of the cards. Furthermore, a copy display area 5073C is provided on the left hand side of the tip display area 5073. The tip display area 5073 is same as the copy display area 5073C. The CPU 5051 displays an image 5072C of copied tip in the copy display area 5073C. The image 5072C of the copied tip corresponds to an additional bet by the ADD button 5402 and is same as the image 5072 of the tip.

[5-10. Others (the Fifth Embodiment)]

The present invention is not limited to the above-described fifth embodiment but may be modified without deviating from a spirit of the invention.

For example, information which is written in an IC card 5204 in S5134 above of FIG. 77 may be stored in each storing device provided in each player terminal 5004. For that purpose, each storing device is configured to store personal data which is written in an IC card 5204 in S5122 above of FIG. 75.

When once a tip has been given to a dealer (S5143: YES), each process following to S5144 of the copy and play processing program shown in FIG. 79 may be executed without giving a tip to the dealer again among card games of the predetermined number which is counted from the card game giving the tip to the dealer.

In the copy and play processing program shown in FIG. 79, S5147 of the process which determines whether or not a player makes an additional bet may be omitted.

[6-1. Characteristics of Card Gaming Machine (the Sixth Embodiment)]

A card gaming machine according to the present invention is explained in details with reference to the drawings based on the sixth embodiment. The card gaming machine according to the present embodiment is one of game machines of a multiple-players participating type having a plurality of player terminals, and executes a card game of a blackjack and awards a player payouts based on a result of win-lose and on a bet set by each player. Then, in the card gaming machine, an image of an imaginary dealer who acts as a facilitator of a card game can be selected from a plurality of kinds of images (in FIG. 92 below, six kinds of images including images that are from an image 6101 of the first dealer to an image 6106 of the sixth dealer) (in other words, one kind of character who plays a role of the dealer is selected from a plurality of kinds of characters). Then, the subsequent card game begins to be executed in a state that the image 6101-6106 of the selected dealer is being displayed on a front display 6021 (refer to FIGS. 88 and 89 below). Furthermore, in the card gaming machine, a right of selecting an image of a dealer is awarded to a player who bet the highest bet amount during the last ten to twenty games.

Then, in the card gaming machine, as shown especially in FIG. 81, when a player sets a tip for a dealer who is a facilitator of a blackjack by using a TIP button 6301 and the like, an image 6401 of two cards that are designated by a dealer is displayed on a liquid crystal display 6010. Then, when player cards are same as the two cards of the image 6401, a jackpot prize is awarded to the player. The amount of the jackpot prize is accumulate-added for each dealer. The amount of the jackpot prize that is accumulate-added corresponding to a dealer who currently progresses a card game is awarded to the player.

Furthermore, a message area 6085 in the liquid crystal display 6010 displays both character data which informs the player of a success rate of making the two cards of the dealer's designation the player cards when the player plays against the current dealer and character data of a personal name of the player. Furthermore, a speaker 6201 outputs both sounds data which informs the player of the two cards of the dealer's designation and sounds data of the personal name of the player.

[6-2. Structural Overview of Card Gaming Machine (the Sixth Embodiment)]

First, a structural overview of the card gaming machine 6001 according to the present embodiment will be described based on FIG. 82. FIG. 82 is an outline view of the card gaming machine 6001 according to the present embodiment.

The card gaming machine 6001 according to the present embodiment generally comprises a table unit 6002 at which a player sits and plays a game, and a panel unit 6003 which is provided behind the table unit 6002 and displays animation images of an imaginary dealer and the like.

First, the table unit 6002 will be described below. In the table unit 6002, a plurality (five in FIG. 82) of terminals 6004 which are referred to as station arranged in generally a fan-like manner. Here, FIG. 83 is an outline view of one player terminal 6004 according to the present embodiment.

As shown in FIG. 83, a player terminal 6004 comprises a liquid crystal display 6010, a touch panel 6011, operation buttons 6012, a coin insertion slot 6013, a bill insertion slot 6014, a coin payout opening 6015, a speaker 6201 and a reader/writer 6202. A liquid crystal display 6010 displays a bet screen (refer to FIG. 86) described below and a game result and the like. A touch panel 6011 is provided on a front surface of a liquid crystal display 6010. A touch panel 6011 is used for selecting an object of a bet. A touch panel 6011 is used for selecting a button displayed on a liquid crystal display 6010 while a bet amount is set. A touch panel 6011 is used for an operation of selecting an image of the dealer when a right of selecting is obtained. A payout operation and the like are performed by operation buttons 6012. Coins or medals are inserted into a coin insertion slot 6013. Bills are inserted into a bill insertion slot 6014. Coins or medals corresponding to accumulated credits are paid to a player through a coin payout opening 6015 when a payout operation is performed.

Returning to FIG. 82, the panel unit 6003 comprises the front display 6021, speakers 6022 and LEDs 6023. The front display 6021 displays images of a dealer who is deals cards or delivers chips and displays contents of the cards being dealt. The speakers 6022 are provided on the upper part of the front display 6021 and output music or sound effects along a progress of a game. The LEDs 6023 light up when a variety of effects are performed.

[6-3. Playing Method of Card Gaming Machine (the Sixth Embodiment)]

Next, a playing method of the card gaming machine 6001 which is comprised of the above will be described. In the card gaming machine 6001, a player who plays a game sits in front of a terminal 6004 and sets the desired bet amount by using a bet screen displayed on a liquid crystal display 6010. After that, images of player cards which have been dealt for players and images of dealer cards which have been dealt for a dealer are respectively displayed on the front display 6021 and each of the liquid crystal displays 6010. Then, based on kinds of the dealt cards, effect image which shows that either a player or the dealer is a winner or effect image which shows that a game result is a draw is displayed on the front display 6021 and each of the liquid crystal displays 6010. Furthermore, at each of the player terminals 4, credits which are 1.5 times larger than the bet amount (the number of credits) are given as an award to a player if the player wins against the dealer. Alternatively, no award is given to a player if the player loses to the dealer. Furthermore, if a player ended in a draw with the dealer, no award is given to the player and the bet amount (the numbers of credits) being set by the player is pooled into a pot. Especially, when a hand of cards of a player is a blackjack of spade, the pooled amount which has been pooled in the pot until now is paid.

A right of selecting an image of a dealer is awarded to a player who has bet the highest amount throughout finishing the all games of the number determined by a lottery. Then, a dealer select screen 6100 shown in FIG. 92 is displayed on a liquid crystal display 6010 of a player terminal 6004 at which a player who is awarded a right of selecting is playing (an image of the same dealer select screen 6100 is displayed on the front display 6021). And an operation of selecting with a touch panel 6011 is validated at a player terminal 6004 in which a player who is awarded a right of selecting is playing. Thereafter, by selecting a desired image with using the touch panel 6011 from six kinds of dealer images 6101-6106 displayed on the dealer select screen 6100, a dealer who acts as a facilitator of a subsequent game is displayed by the selected image of a dealer. Incidentally, the selecting of a dealer may be validated by operation of operation buttons 6012 provided on a player terminal 6004.

[6-4. Control System of Card Gaming Machine (the Sixth Embodiment)]

Next, a control system of the card gaming machine 6001 will be described based on FIG. 84. FIG. 84 is a block diagram schematically showing the control system of the card gaming machine 6001. As shown in FIG. 84, the card gaming machine 6001 comprises a main control unit 6031, a plurality of player terminals 6004 which are connected to the main control unit 6031, a variety of peripheral devices.

The main control unit 6031 is composed of a micro computer 6045 as a kernel. The micro computer 6045 is basically composed of a CPU 6041, a RAM 6042, a ROM 6043 and a bus 6044 for transferring data mutually between these elements. The ROM 6043 stores a variety of programs, data tables and the like to execute necessary processes to control the card gaming machine 6001.

The RAM 6042 is a memory for temporarily storing a variety of data which have been operated in the CPU 6041. Furthermore, the RAM 6042 stores data (game history data) showing game results of each player terminal 6004 and a balance of each player terminal 6004 and stores track records (game result) of each dealer.

Furthermore, the ROM 6043 stores six kinds of dealer images 6101-6106 which are comprised of different characters, images of a plurality of kinds of costumes that the dealers wear and the like. The ROM 6043 stores sounds data of routine sentences described below, stores character data of sentences showing game points described below, and stores character data for informing success rates described below. Furthermore, the ROM 6043 stores a program which converts character data to sounds data. The ROM 6043 stores images of a dealer who temporarily performs a gesture adapted to routine sentences described below.

In addition, the CPU 6041 is connected, via an I/O interface 6046, to an image processing circuit 6047, a sound circuit 6048, a LED driving circuit 6049, and a communication interface 6050.

Then, the main control unit 6031 receives bet operation information related to the bet amount being set by a player from each of the player terminals 6004 and determines whether or not a condition is realized to start a game. Then, upon starting a game, the main control unit 6031 assigns, based on a lottery result, a predefined number of cards (minimum, two cards) out of the 53 playing cards to a player and a dealer (on a screen, the cards are dealt to a player and a dealer, respectively), respectively. As the result, a win-lose (either a player or a dealer won, or they ended in a draw) is determined based on hands of the assigned cards, and the main control unit 6031 transmits results of the determination to each of the player terminals 6004. Subsequently, each of the player terminals 6004 increases or decreases accumulated credits according to results of a win-lose received from the main control unit 6031.

And the main control unit 6031 outputs signals of images displayed on the front display 6021, and also controls driving of the speakers 6022 and the LEDs 6023. Especially, when the main control unit 6031 receives dealer selection information from a player terminal 6004, the main control unit 6031 sets an image which has been selected from six kinds of dealer images 6101-6106 stored in the ROM 6043 as an image of an imaginary dealer, and the main control unit 6031 sets an image which has been selected from a plurality of kinds of costume images stored in the ROM 6043 as an image of a costume which the imaginary dealer wears. In the following games, the main control unit 6031 controls displaying the set images of the imaginary dealer and the costume on the front display 6021 and executes the games.

Next, a control system of a player terminal 6004 will be described based on FIG. 85. FIG. 85 is a block diagram schematically showing a control system of a player terminal 6004 according to the present embodiment.

As shown in FIG. 85, a player terminal 6004 according to the present embodiment is composed of a micro computer 6055 as a kernel. The micro computer 6055 is basically composed of a CPU 6051, a RAM 6052, a ROM 6053 and a bus 6054 for transferring data mutually between these elements. The ROM 6053 includes a variety of programs, data tables and the like to execute necessary processes to control the player terminal 6004. Furthermore, the ROM 6053 stores a program which converts character data to sounds data. The RAM 6052 is a memory for temporarily storing a variety of data which have been operated in the CPU 6051, such as the number of credits currently accumulated on the player terminal 6004, the bet amount (the number of credits) which a player has bet, multiplying factor of payout and the like. Furthermore, the RAM 6052 stores data (game history data) showing game results of the player terminal 6004 and stores a balance of the player terminal 6004.

In addition, the CPU 6051 is connected, via an I/O interface 6056, to a liquid crystal panel driving circuit 6057, a touch panel driving circuit 6058, a hopper driving circuit 6059, a payout completion signal circuit 6060, a communication interface 6061, a reader/writer 6202 and a speaker driving circuit 6203. Furthermore, a liquid crystal display 6010 is connected to the liquid crystal panel driving circuit 6057, a touch panel 6011 is connected to the touch panel driving circuit 6058, a hopper 6062 is connected to the hopper driving circuit 6059, a coin detecting portion 6063 is connected to the payout completion signal circuit 6060, a speaker 6201 is connected to the speaker driving circuit 6203, respectively. In the reader/writer 6202, an IC card 6204 is inserted or ejected. Additionally, the main control unit 6031 is connected to the communication interface 6061.

Then, based on operation information which is output from the touch panel 6011, the CPU 6051 calculates the bet amount (the number of credits) which a player has bet, then, stores the calculated bet amount into the RAM 6052 and transmits the calculated bet amount to the main control unit 6031. Furthermore, the CPU 6051 increases or decreases accumulated credits according to results of a win-lose received from the main control unit 6031.

And the CPU 6051 outputs signals of images displayed on the liquid crystal display 6010, and also controls paying coins from the coin payout opening 6015 by the hopper 6062 and the coin detecting portion 6063 and controls reading or writing in the reader/writer 6202.

Next, a bet screen 6070 which is displayed on a liquid crystal display 6010 of a player terminal 6004 when a blackjack is executed on the card gaming machine 6001 will be described based on FIGS. 86 and 87.

FIGS. 86 and 87 are explanatory views showing a bet screen 6070 displayed on a liquid crystal display 6010 of a player terminal 6004. Here, with the card gaming machine 6001, a player performs a bet operation of betting a certain number of credits with using a bet screen 6070 and a touch panel 6011. In addition, an operation to demand a dealing of one more card in hand, and an operation to increase the bet amount, can also be performed by a player using a bet screen 6070 and a touch panel 6011.

As shown in FIGS. 86 and 87, a bet screen 6070 comprises a player card display area 6071 for displaying an image 6087 (refer to FIG. 87) of cards dealt to a player, a chip display area 6073 for displaying an image 6072 of chips which have been bet, a pooled amount display area 6074 for displaying the pooled amount being pooled in the pot, and information display area for displaying a variety of operation buttons and information of a player.

Here, the player card display area 6071 is a display area for displaying an image 6087 (refer to FIG. 87) of cards which are dealt to a player. Then, an image 6087 (refer to FIG. 87) of a plurality of cards displayed on the player card display area 6071 is an image of cards which are dealt to a player who is sitting at the player terminal 6004 to play a game.

The chip display area 6073 displays an image 6072 of chips corresponding to the bet amount which a player has bet (for example, chips corresponding to 50 credits are bet in FIGS. 86 and 87). Then, a player selects the bet amount with using bet buttons 6075 described below, and determines the selected bet amount by touching the chip display area 6073. The player terminal 6004 transmits the determined bet amount to the main control unit 6031.

The pooled amount display area 6074 is a display area for displaying the pooled amount which is pooled in the pot. Here, with the card gaming machine 6001, when a player and a dealer ended in a draw, all of the bet amount the player has bet are pooled into the pot. With regard to this, a part (for example, 50%) of the bet amount a player has bet may be pooled into the pot. In this case, it is desirable that the rest of the bet amount which is not pooled is paid to the player.

In addition, a plurality of bet buttons 6075 (three kinds of "one credit", "10 credits" and "100 credits") are provided on the lower right hand side of the chip display area 6073. Then, a player can select the bet amount which is bet in the current game by touching the bet buttons 6075.

Furthermore, a Repeat bet button 6076 and an UNDO bet button 6077 are provided above the bet buttons 6075. A player can bet the bet amount which is the same bet amount as the previous game, by touching the Repeat bet button 6076. In addition, a player can cancel a bet operation which has been performed once, by touching the UNDO bet button 6077.

In the meantime, a group of operation buttons which is used when a player takes a tactics against a dealer are displayed on the lower left hand side of the chip display area 6073. Specifically, a STAND button 6078, a HIT button 6079, a SURRENDER button 6080, an INSURANCE button 6081, a SPLIT button 6082, and a Double Down button 6083 are provided, as the operation buttons.

Here, the STAND button 6078 is a button which is touched when a player plays by cards being dealt now with a dealer without demanding a dealing of anymore card. The HIT button 6079 is a button which is touched when a player demands newly a card in addition to cards being dealt now. Incidentally, a player can touch the HIT button 6079 till the total of a number indicated by cards being dealt is above "21".

The SURRENDER button 6080 is a button which is touched when a player gives up the current game. When the SURRENDER button 6080 is touched, whereas the half of the bet amount of the time is collected, the remaining half is repaid to the player. The INSURANCE button 6081 is a button which is touched when a player takes insurance in case cards which have been dealt to a dealer will become blackjack.

The SPLIT button 6082 is a button which is touched when a player divides two cards into two hands on condition that each number indicated by the cards which have been dealt in a game is the same number. If the SPLIT button 6082 is touched, a player can play with a dealer by hands of more than two sets of cards. The Double Down button 6083 is a button which is touched when a player increases the bet amount to double in a game.

In addition, a HELP button 6084 is provided below the STAND button 6078. The HELP button 6084 is a button which is touched when displaying operation methods of the card gaming machine 6001 on a liquid crystal display 6010. Additionally, a message area 6085 for displaying messages that support progress of a game is provided on the right hand side of the HELP button 6084.

In addition, a TIP button 6301 is provided on the left hand side of the UNDO bet button 6077. A player can give a tip to a dealer by touching the TIP button 6301. When a player selects the tip amount with the bet buttons 6075 above after touching the TIP button 6301, the selected tip amount is displayed in the message area 6085. Furthermore, the player determines the tip amount by touching the TIP button 6301 again and the determined tip amount is displayed in the message area 6085 and is transmitted to the main control unit 6031.

A CASHOUT button 6303 is provided below the HELP button 6084. If a player touches the CASHOUT button 6303, information of the number of credits which are currently being held by the player is written into an IC card 6204 by the reader/writer 6202 so as to be paid to the player. With regard to this, the number of credits which are currently being held by a player can be paid with coins corresponding to it (one credit corresponds to one coin) if the player executes a predetermined operation.

Then, at the lower part of a bet screen 6070, a bet amount display area 6090 for displaying the bet amount currently being bet by a player, an acquisition amount display area 6091 for displaying the amount which has been provided to a player as an award in games, a held credit display area 6092 for displaying the number of credits currently being held by a player, a lower-limit-of-bet-amount display area 6093 displaying the lower limit of the bet amount which a player can bet, and an upper-limit-of-bet-amount display area 6094 displaying the upper limit of the bet amount which a player can bet, are provided.

Additionally, at the left hand side of the player card display area 6071, a win-or-lose display area 6095 (refer to FIG. 87) which displays a win-lose of the current game for a player and a dealer is provided. Here, the side where the total of numbers indicated by cards being dealt is near to "21", in the range where the total do not exceed "21", is determined with a winner of a blackjack. In contrast, a draw of a blackjack is determined when the total of numbers indicated by cards being dealt to a player is equal to the total of numbers indicated by cards being dealt to a dealer. Then, a character string of "DRAW" is displayed in the win-or-lose display area 6095 (refer to FIG. 87) when a draw of a blackjack is determined. Furthermore, if a player wins, a character string of "YOU WON" is displayed in the win-or-lose display area 6095. Otherwise, if a player loses, a character string of "YOU LOST" is displayed in the win-or-lose display area 6095.

[6-5. Control System of Card Gaming Machine (the Sixth Embodiment)]

Next, a main screen 6091 displayed on the front display 6021 will be described referring to FIGS. 88 and 89. A main screen 6091 is displayed on the front display 6021 when the card gaming machine 6001 executes a blackjack.

FIGS. 88 and 89 are views showing main screens 6091 displayed on the front display 6021. In the card gaming machine 6001, so as to enhance realistic sensation, a main screen 6091 displays with action of an animation an image of an imaginary dealer who deal cards along progress of a game. The dealer image is changed to a different kind of image according to a player's selection at an interval of a predetermined number of games. Specifically, out of six kinds of images which composed of different characters, an image of a dealer selected on a dealer select screen 6100 by a player who is awarded a right of selecting will be displayed on a main screen 6091 in the following games. In the display of the image, the selected dealer is wearing the similarly selected costume. For example, FIG. 88 shows the main screen 6091 of a case that the first dealer 6101 is selected by a player on a dealer select screen 6100 and that a standard costume with a bow tie is selected as a costume. FIG. 89 shows the main screen 6091 of a case that the fifth dealer 6105 is selected by a player.

Depending on progress of a game, the dealer image 6101-6106, on a game table, deals cards and receives and gives chips.

[6-6. First Operation of Card Gaming Machine (the Sixth Embodiment)]

Next, a main game processing program executed by the CPU 6041 of the main control unit 6031, and a main game processing program of a player terminal side executed by a CPU 6051 of a player terminal 6004, will be described based on FIGS. 90 and 91. The two main game processing programs are executed respectively in the card gaming machine 6001 which has the above composition. Here, each program, which is shown in flowcharts of FIGS. 90 and 91, is stored in the RAM 6042 or the ROM 6043 which are provided in the main control unit 6031. Also, each program, which is shown in the flowcharts of FIGS. 90 and 91, is stored in a RAM 6052 or a ROM 6053 which are provided in the player terminals 6004. Furthermore, each program, which is shown in the flowcharts of FIGS. 90 and 91, is executed by the CPU 6041 or a CPU 6051 at a predetermined interval.

First, the main game processing program executed by the main control unit 6031 will be described based on FIGS. 90 and 91. In step (abbreviated to S hereafter) 6001, the CPU 6041 transmits, to each of the player terminals 6004, an instruction to start a betting period in which a player's bet operation is accepted.

Thereafter, in S6002, the CPU 6041 receives bet information transmitted from each of the player terminals 6004. Here, the bet information includes information on the bet amount (the number of credits) that a player has bet. Then, the bet information which has received from each of the player terminals 6004 is temporarily stored in the RAM 6042.

Subsequently, in S6003, the CPU 6041 classifies with respect to each player terminal 6004 the bet amounts that have been bet at all of the player terminals 6004 connected to the main control unit 6031. The classified bet amounts are accumulate-added with respect to each player terminal 6004 in the RAM 6042.

Next, the CPU 6041 starts a gaming process in S6004. In the gaming process, a game proceeds by mutual data transmission between the CPU 6041 and each player terminal 6004. The CPU 6041 transmits a proceeding result of the game to each player terminal 6004.

Furthermore, in the gaming process of S6004, so as to enhance realistic sensation of a game, the front display 6021 displays with action of an animation an image of an imaginary dealer who deal cards along progress of a game (refer to FIGS. 88 and 89). Then, the dealer image and the image of a costume which the dealer wears are changed to different kind of images based on selection of a player at an interval of a predetermined number of games which is determined by a lottery in S6011 described below.

In S6004-2, the CPU 6041 executes a history process. In this process, the CPU 6041 stores detailed game history information on a game result of each player terminal 6004 and a balance of each player terminal 6004 in the RAM 6042. Furthermore, the CPU 6041 stores in the RAM 6042 a track record (game result) with respect to each dealer who is a facilitator of a card game.

Next, in S6005, the CPU 6041 determines whether or not the number of executed games has reached the predetermined number of games which is determined by a lottery in S6011 described below. If it is determined that the number of executed games has not reached the predetermined number of games (S6005: NO), the main gaming processing is terminated. Then the flow returns to S6001 if a game is continued thereafter.

In contrast, if it is determined that the number of executed games has reached the predetermined number of games (S6005: YES), the flow proceeds to S6006. In S6006, the CPU 6041 compares the accumulated bet amounts which are added with respect to each player terminal 6004 in S6003 above and identifies a player (a player terminal 6004) having the highest accumulated bet amount.

Subsequently, in S6007, the CPU 6041 transmits information instructed to award a right of selecting a dealer to a player terminal 6004 where a player identified in S6006 above plays. Furthermore, in S6008, a dealer select screen 6100 (refer to FIG. 92) which shows images of six kinds of dealers that the player can select is displayed on the front display 6021.

Next, in S6009, the CPU 6041 receives a selection result of dealer images which is transmitted from a player terminal 6004 where a player who is awarded a right of selecting plays. A selection result received from a player terminal 6004 in S6009 above includes information on the selection result of which a player selected image between the first dealer image 6101 and the sixth dealer image 6106, and information on a kind of a costume which the selected dealer wears and a hair style.

In S6010, based on a selection result received in S6009 above, the CPU 6041 controls changing a dealer image which is displayed on the front display 6021. Specifically, when a player selects a dealer image which is different from a dealer image which has been displayed in the previous game, the dealer image is changed to the newly selected dealer image. The images of a costume and hair style are also changed to the ones that are selected by the player.

Furthermore, the CPU 6041 changes dealer's voice which is outputting at the speakers 6022 to sound quality of the selected dealer.

Next, in S6011, the CPU 6041 holds a lottery for the number of games that will be executed with a dealer image which is changed in S6010 above, and determines the number of games between ten and twenty. Incidentally, in S6005 above, the number of games is counted from the next game and it is determined whether or not the number of games has reached the one which is determined by a lottery in this S6011.

Then, in S6012, the CPU 6041 initializes (resets) the accumulated amounts of the bet amount of each player that are stored in the RAM 6042. The flow returns to S6001 if a game is continued thereafter.

Next, the main game processing program executed by a player terminal 6004 will be described based on FIGS. 90 and 91. In S6101, a CPU 6051 receives an instruction to start a betting period from the main control unit 6031.

Subsequently, in S6102, the CPU 6051 displays a bet screen 6070 on a liquid crystal display 6010 and identifies the bet amount (the number of credits) which a player has bet based on operating information of a touch panel 6011.

Next, in S6103, the CPU 6051 determines whether or not the betting period has terminated. Specifically, it is determined whether or not a predefined time length (e.g. 20 sec) has passed since accepting of a bet operation was started in S6102 above.

If it is determined that the betting period has not terminated (S6103: NO), the accepting of a bet operation is continued. In contrast, if it is determined that the betting period has terminated (S6103: YES), the flow proceeds to S6104.

In S6104, the CPU 6051 transmits bet information to the main control unit 6031. Here, the bet information includes information on the bet amount (the number of credits) that a player has bet.

In S6105, the CPU 6051 starts a gaming process. In this gaming process, a game progresses by mutual data transmission between the CPU 6051 and the main control unit 6031. Based on a result of a progressing game and a bet operation which is performed by a player, the CPU 6051 pays a prize.

In S6105-2, the CPU 6051 executes a history process. In this process, the CPU 6051 stores, in the RAM 6052, detailed game history information on a game result of a player terminal 6004 which has the CPU 6051 and on a balance of a player terminal 6004 which has the CPU 6051.

Next, in S6106, the CPU 6051 receives information showing that a player terminal 6004 which has the CPU 6051 is a player terminal of a player who is awarded a right of selecting, from the main control unit 6031. Subsequently, in S6107, the liquid crystal display 6010 displays a dealer select screen 6100 (refer to FIG. 92).

Then, in S6108, only in a player terminal 6004 of a player who is identified in S6006 above and to whom a right of selecting is awarded, a selecting operation of a dealer image with a touch panel 6011 is validated and the selecting operation is accepted. Specifically, in a player terminal 6004 of a player who is awarded a right of selecting, any one of images between the first dealer image 6101 and the sixth dealer image 6106 can be selected on a dealer select screen 6100 with a touch panel 6011.

In S6109, a selecting operation with the touch panel 6011 for selecting a costume and hair style for a dealer image of a character which is selected in S6108 above is validated and the selecting operation is accepted. Kinds of costumes that can be selected are a standard costume with a bow tie (refer to FIGS. 88 and 89), a costume with a suit and a costume with a dress. Hair styles that can be selected are a standard hair style which is previously determined for each character, a hair style with a short hair style, a hair style with a long hair style and a hair style with a pony tail.

Then, in S6110, the CPU 6051 transmits a selection result which has been selected by a player in S6108 above and S6109 above to the main control unit 6031. Incidentally, if a selecting operation is not executed by a player to whom a right of selecting is awarded, a selection result of default which is previously determined (for example, the first dealer image 6101, a standard costume and a standard hair style) is transmitted to the main control unit 6031.

Based on the transmitted selection result, the main control unit 6031 displays on the front display 6021 an image of a dealer who wears the selected costume and is with the selected hair style.

[6-7. Second Operation of Card Game Machine (the Sixth Embodiment)]

Next, an IC card processing program which is executed by the CPU 6041 of the main control unit 6031, and an IC card processing program of a player terminal side which is executed by a CPU 6051 of a player terminal 6004, will be described based on FIG. 93. Two IC card processing programs are executed respectively in the card gaming machine 6001 which has the above composition. Incidentally, each program, which is shown in a flowchart of FIG. 93, is stored in the RAM 6042 or the ROM 6043 which are provided in the main control unit 6031. Also, each program, which is shown in the flowchart of FIG. 93, is stored in a RAM 6052 or a ROM 6053 which are provided in the player terminals 6004. Furthermore, each program, which is shown in the flowchart of FIG. 93, is executed by the CPU 6041 or a CPU 6051 upon inserting an IC card 6204 to a reader/writer 6202 of a player terminal 6004.

First, the IC card processing program which is executed by the main control unit 6031 is described based on FIG. 93. In S6021, the CPU 6041 receives personal data from a player terminal 6004.

Then, in S6022, the CPU 6041 waits until a game is finished if it is during the game (S6022: YES). In contrast, if it is not during a game or a game is finished (S6022: NO), the flow proceeds to S6023.

In S6023, the CPU 6041 transmits sounds information to a player terminal 6004 which transmitted personal data in S6021 above. In this time, the CPU 6041 converts character data of a personal name included in personal data transmitted in S6021 above to sounds data. The CPU 6041 generates sounds information by adding sounds data of the routine sentence (for example, "Oh, I'm so glad to see") to the converted sounds data.

Incidentally, the routine sentence is stored in the ROM 6043. The CPU 6041 uses a conversion program being stored in the ROM 6043 when the CPU 6041 converts character data of a personal name included in personal data of S6021 above to sounds data.

In S6024, the CPU 6041 executes a dealer image changing process. In this process, the CPU 6041 controls changing a dealer image displayed on the front display 6021. Specifically, a dealer image is changed to a dealer image that performs temporarily a gesture adapted to a routine sentence included in sounds information that has been generated in S6023 above.

Next, the IC card processing program which is executed by a player terminal 6004 is described based on FIG. 93. In S6121, a CPU 6051 determines whether or not an IC card 6204 is inserted to a reader/writer 6202. In this time, only when an IC card 6204 is inserted to a reader/writer 6202 (S6121: YES), the following processes will be executed.

In S6122, the CPU 6051 executes an IC card read process. In this process, the CPU 6051 causes the reader/writer 6202 to read personal data stored in the IC card 6204.

In S6123, the CPU 6051 transmits personal data which has been read in S6122 above to the main control unit 6031. The personal data includes a player ID that identifies a player, and character data of a personal name of the player. When the IC card 6204 is issued, the player ID and personal name are stored in the IC card 6204.

In S6124, the CPU 6051 receives sounds information of S6023 above. Then, in S6125, the CPU 6051 executes a sounds output process. In this process, the CPU 6051 outputs sounds information which is received in S6124 above at the speaker 6201, as shown in FIG. 94.

In S6126, the CPU 6051 executes a display process. In this process, the CPU 6051 adds a service button 6302 to a bet screen 6070 displayed on the liquid crystal display 6010, as shown in FIG. 94. The service button 6302 comprises a personal name display area, a personal history button, a balance button, a game point button and a terminal history button.

[6-8. Third Operation of Card Game Machine (the Sixth Embodiment)]

Next, a service processing program which is executed by the CPU 6041 of the main control unit 6031, and a service processing program of a player terminal side which is executed by a CPU 6051 of a player terminal 6004, will be described based on FIG. 95. Two service processing programs are executed respectively in the card gaming machine 6001 which has the above composition. Incidentally, each program, which is shown in a flowchart of FIG. 95, is stored in the RAM 6042 or the ROM 6043 which are provided in the main control unit 6031. Also, each program, which is shown in the flowchart of FIG. 95, is stored in a RAM 6052 or a ROM 6053 which are provided in the player terminals 6004. Under a condition that an IC card 6204 is inserted to a reader/writer 6202 of a player terminal 6004, each program is executed by the CPU 6041 or a CPU 6051 at a predetermined interval upon touching by a player a CASHOUT button 6303 of a player terminal 6004 or touching by a player a service button 6302 of a player terminal 6004.

First, the service processing program executed by the main control unit 6031 is described based on FIG. 95. In S6031, the CPU 6041 receives termination information from a player terminal 6004. Then, in S6032, the CPU 6041 transmits stored information to a player terminal 6004 which transmitted termination information in S6031 above. The stored information includes game history information of the player terminal 6004 in S6004-2 above.

After a player ID is identified, for a player terminal 6004 of the identified player ID, the CPU 6041 builds data base in the RAM 6052 by classifying game history of S6004-2 above according to the player ID. Therefore, stored information of S6032 above includes the past game history information of a player ID of a player terminal 6004 which has the CPU 6051. Incidentally, for a player terminal 6004 whose a player ID is not identified, the CPU 6041 builds data base in the RAM 6052 by classifying game history of S6004-2 above according to a provisional player ID. The data base is similarly built in a RAM 6042 of a player terminal 6004.

In S6033, the CPU 6041 receives service request information from a player terminal 6004. Then, in S6034, the CPU 6041 transmits service information to a player terminal 6004 which has transmitted service request information in S6033 above. The service information includes data that responds to request included in service request information of S6033 above.

Incidentally, such data is stored in the RAM 6042 or the ROM 6043. For example, if service request information of S6033 above includes data that requests information relating to a game point, data that responds to request included in service request information of S6033 above is stored in the ROM 6043. If service request information of S6033 above includes data that requests information relating to personal history or a balance, data that responds to request included in service request information of S6033 above is included in the data base stored in the RAM 6042.

Next, the service processing program executed by a player terminal 6004 is described based on FIG. 95. In S6131, a CPU 6051 determines whether or not a player has touched the CASHOUT button 6303. Now, if a player has not touched the CASHOUT button 6303 (S6131: NO), the flow proceeds to S6136 below. In contrast, if a player has touched the CASHOUT button 6303 (S6131: YES), the flow proceeds to S6132.

In S6132, the CPU 6051 transmits termination information to the main control unit 6031. Then, in S6133, the CPU 6051 receives stored information of S6032 above. In S6134, the CPU 6051 executes a write-in process. In this process, the CPU 6051 writes the received stored information in the IC card 6204 with the reader/writer 6202.

In S6135, the CPU 6051 executes an IC card eject process. In this process, the CPU 6051 ejects the IC card 6204 from the reader/writer 6202. Then, the flow proceeds to S6136.

In S6136, the CPU 6051 determines whether or not a player has touched the service button 6302. Now, only when a player has touched the service button 6302 (S6136: YES), the following processes will be executed.

In S6137, the CPU 6051 transmits service request information to the main control unit 6031. The service request information includes data that requests information relating to a button determined to have been touched by a player in S6136 above within the each of buttons which constitutes the service button 6302. Specifically, if it is determined that a player has touched a game point button which constitutes the service button 6302 in S6136 above, data that requests information relating to a game point is included in service request information.

In S6138, the CPU 6051 receives service information of S6034 above. Then, in S6139, the CPU 6051 executes a service display process. In this process, the CPU 6051 displays data included in service information of S6034 above on the liquid crystal display 6010. Specifically, as shown in FIG. 96, data included in service information of S6034 above are displayed in an area except for the personal name display area within the service button 6302 on the bet screen 6070 displayed on the liquid crystal display 6010.

Incidentally, if information relating to a button determined to have been touched by a player in S6136 above within each of buttons which constitutes the service button 6302 is included in the data base stored in the RAM 6052, the CPU 6051 may obtain the information from the data base stored in the RAM 6052.

[6-9. Fourth Operation of Card Game Machine (the Sixth Embodiment)]

Next, a designated combination processing program which is executed by the CPU 6041 of the main control unit 6031, and a designated combination processing program of a player terminal side which is executed by a CPU 6051 of a player terminal 6004, will be described based on FIGS. 97 and 98. Two designated combination processing programs are executed respectively in the card gaming machine 6001 which has the above composition. Incidentally, each program, which is shown in flowcharts of FIGS. 97 and 98, is stored in the RAM 6042 or the ROM 6043 which are provided in the main control unit 6031. Also, each program, which is shown in the flowcharts of FIGS. 97 and 98, is stored in a RAM 6052 or a ROM 6053 which are provided in the player terminals 6004. The each program is executed by the CPU 6041 or a CPU 6051 as a part of the gaming process of S6004 above or S6105 above.

First, the designated combination processing program executed by the main control unit 6031 is described based on FIGS. 97 and 98. In S6041, the CPU 6041 of FIG. 97 receives progressive information from a player terminal 6004. Then, in S6042, the CPU 6041 executes a progressive jackpot inclusion process. In this process, based on progressive information received in S6041 above, the CPU 6041 includes a part of the bet amount which is set by a player with a player terminal 6004 into the prize amount of a progressive jackpot.

In this respect, the CPU 6041 controls the prize amount of a progressive jackpot for each of dealers according to data table shown in FIG. 99. Specifically, the CPU 6041 includes a part of the bet amount which is set by a player with a player terminal 6004 into the prize amount of a jackpot corresponding to a dealer who currently progresses a card game. Such data table is stored in the RAM 6042.

In S6043, the CPU 6041 transmits designated combination information to a player terminal 6004 which transmitted progressive information in S6041 above. The CPU 6041 includes data that specifies suits and rank of two cards into the designated combination information when transmitting the designated combination information. Incidentally, suits and rank of two cards are specified at random by the CPU 6041.

In S6044, the CPU 6041 transmits success rate information to a player terminal which transmitted progressive information in S6041 above.

The success rate information includes the following information:

(1) A success rate of making two cards that are specified according to data included in designated combination information of S6043 above player cards when the player plays against the current dealer;

(2) Sounds data that informs the player of a success rate (1) above;

(3) Character data that informs the player of a success rate (1) above;

(4) Sounds data that informs the player of two cards that are specified according to data included in designated combination information of S6043 above; and (5) Character data that informs the player of two cards that are specified according to data included in designated combination information of S6043 above.

Based on a player ID included in personal data of S6021 above, the CPU 6041 specifies a success rate (1) above from the data base which is built in the RAM 6042. The CPU 6041 reads out, from the ROM 6043, character data which is a basis of sounds data (2) above and (4) above. And, the CPU 6041 reads out, from the ROM 6043, character data of (3) above and (5) above. Incidentally, according to a conversion program stored in the ROM 6043, the CPU 6041 converts character data which is a basis of sounds data (2) above and (4) above to sounds data. At this time, sound quality of the sounds data corresponds to voice of a dealer who progresses the current card game. Furthermore, the CPU 6041 adds character data of a personal name included in personal data of S6021 above to character data of (3) above and of (5) above. And the CPU 6041 includes the sounds data converted from the character data in sounds data of (2) above and (4) above.

In S6051 of FIG. 98, the CPU 6041 receives jackpot request information from a player terminal 6004. Then, in S6052, the CPU 6041 transmits jackpot information to a player terminal 6004 which transmitted jackpot request information in S6051 above. The CPU 6041 includes data showing the prize amount of a jackpot corresponding to the current dealer based on the data table shown in FIG. 99 into jackpot information when transmitting the jackpot information. Thereafter, the CPU 6041 resets the prize amount of a jackpot corresponding to the current dealer to "0" in the data table shown in FIG. 99.

Next, the designated combination processing program executed by a player terminal 6004 is described based on FIGS. 97 and 98. In S6141 of FIG. 97, a CPU 6051 determines whether or not an IC card 6204 is inserted to the reader/writer 6202. Now, only when an IC card 6204 is inserted to the reader/writer 6202 (S6141: YES), the following processes will be executed.

In S6142, the CPU 6051 determines whether or not a player has given a tip to a dealer by an operation of using the TIP button 6301 and the like. Now, only when a tip is given to a dealer (S6142: YES), the following processes will be executed.

In S6143, the CPU 6051 transmits progressive information to the main control unit 6031. The CPU 6051 includes data showing the bet amount which is set by a player into progressive information when transmitting the progressive information. Then, in S6144, the CPU 6051 receives designated combination information of S6043 above. Furthermore, in S6145, the CPU 6051 receives success rate information of S6044 above.

In S6146, the CPU 6051 executes an output information generating process. In this process, the CPU 6051 generates an image of two cards that are specified according to data included in designated combination information of S6043 above.

In S6147, the CPU 6051 executes a designated combination output process. In this process, as shown in FIG. 81, the CPU 6051 outputs an image 6401 of two cards that is generated in S6146 above at the bet screen 6070 displayed on the liquid crystal display 6010.

In S6148, the CPU 6051 executes a success rate output process. In this process, as shown in FIG. 81, the CPU 6051 outputs at the speaker 6201 sounds data that informs a player of two cards that are specified according to data included in designated combination information of S6043 above. Furthermore, the CPU 6051 outputs at the speaker 6201 sounds data that informs a player of a success rate of making two cards that are specified according to data included in designated combination information of S6043 above player cards when the player plays against the current dealer. These sounds data are included in success rate information of S6145 above.

The CPU 6051 outputs character data that informs a player of two cards that are specified according to data included in designated combination information of S6043 above at the message area 6085 of the bet screen 6070 displayed on the liquid crystal display 6010, as shown in FIG. 81. Furthermore, the CPU 6051 outputs character data that informs a player of a success rate of making two cards that are specified according to data included in designated combination information of S6043 above player cards when the player plays against the current dealer at the message area 6085 of the bet screen 6070 displayed on the liquid crystal display 6010. These character data are included in success rate information of S6145 above.

In S6151 of FIG. 98, the CPU 6051 determines whether on not a card game is finished. Only when a card game is finished (S6151: YES), the flow proceeds to the following processes.

In S6152, the CPU 6051 determines whether or not two cards specified according to data included in designated combination information of S6043 above are player cards. Only when two cards specified according to data included in designated combination information of S6043 above are player cards (S6152: YES), the flow proceeds to the following processes.

In S6153, the CPU 6051 transmits jackpot request information to the main control unit 6031. Then, in S6154, the CPU 6051 receives jackpot information of S6052 above.

In S6155, the CPU 6051 executes a progressive jackpot process. In this process, the CPU 6051 pays a jackpot prize based on data showing the amount of a jackpot prize that is included in jackpot information of S6052 above.

Furthermore, as shown in FIG. 100, the CPU 6051 outputs at the speaker 6201 sounds data that informs that a player wins a jackpot. Simultaneously, as shown in FIG. 100, the CPU 6051 outputs at the message area 6085 on the bet screen 6070 displayed on the liquid crystal display 6010 the character data that informs that a player wins a jackpot. The character data and the sounds data are stored in the ROM 6053. In addition, the CPU 6051 outputs character data and sounds data of the player's personal name which is included in personal data stored in the IC card 6204. Incidentally, the CPU 6051 uses a conversion program being stored in the ROM 6053 when the CPU 6051 converts character data of a personal name included in personal data stored in an IC card 6204 into sounds data.

[6-10. Others (the Sixth Embodiment)]

The present invention is not limited to the above-described sixth embodiment but may be modified without deviating from a spirit of the invention.

For example, information which is written in an IC card 6204 in S6134 above of FIG. 95 may be stored in each storing device provided in each player terminal 6004. For that purpose, each storing device is configured to store personal data which is written in an IC card 6204 in S6122 above of FIG. 93.

When once a tip has been given to a dealer (S6142: YES), each process following to S6143 of the designated combination processing program shown in FIG. 97 may be executed without giving a tip to the dealer again among card games of the predetermined number which is counted from the card game giving the tip to the dealer.

What is claimed is:

1. A gaming machine comprising:

a display device that displays a screen of a game dealt by a dealer;

a tipping operation device that receives an operation of giving the dealer a tip not associated with a prize by a player;

a memory device that stores one of personal data and a gaming history of the player; and a processor:

wherein the processor (a) accepts the operation of giving the tip by the player based on an operation of the tipping operation device;

(b) reads from the memory device one of the personal data and the gaming history of a tip-giver player who has given the tip to the dealer; and (c) displays on the display device an image in which the dealer acts in accordance with one of the personal data and the gaming history of the tip-giver player that is read from the memory device.

2. The gaming machine according to claim 1 further comprising:

a speaker that outputs a voice of the dealer displayed on the display device;

wherein the processor further (d) outputs the voice of the dealer in accordance with one of the personal data and the gaming history of the tip-giver player that is read from the memory device.

3. The gaming machine according to claim 2, wherein the processor further outputs the voice calling the tip-giver player's name at (d).

4. A card gaming machine comprising:

a main monitor for displaying a card game which is progressed by one of a plurality of dealers;

a plurality of stations each provided with:

a sub monitor for outputting an image relating to the card game;

a speaker for outputting sounds relating to the card game;

a tip indication device with which a player indicates a tip amount for the dealer who is a facilitator of the card game;

an input device with which a player inputs information which is used to progress the card game;

a sub memory for storing personal data of a player who plays the card game or game history of the player; and a request indication device in which an operation is invalidated under normal conditions; and a processor:

wherein the processor is programmed for awarding a right of changing the dealer of the facilitator to another dealer to one of players who is playing at one of the stations and satisfies a predetermined condition, and is further programmed, for controlling progressing simultaneously the same card game in each of the stations, to causes the card gaming machine to perform the following (1) through (5):

in the station where personal data of a player or game history of the player is stored in the sub memory by an inputting of the player with the input device before a start of the simultaneous progress of the same card game;

(1) generate individual image information or individual sounds information, each information relating to the player, based on the personal data or game history that stored in the sub memory;

(2) output an image of the individual image information at the sub display or outputting sounds of the individual sounds information at the speaker;

(3) output at the sub display a first game image which shows the player the cards that are dealt to the player with face-up cards whose suits and rank are shown up, while the same card game is progressed;

(4) validate an operation in the request indication device upon completing an operation of indicating a tip amount for the dealer of the facilitator by the player using the tip indication device; and (5) upon completing operations of the player in the request indication device:

(5-1) output at the sub monitor a second game image which shows the player second player cards which are a copy of a first player cards which are composed of cards being dealt to the player by arranging the second player cards in parallel with the first player cards; and (5-2) progress the card game such that the player can play with using both the first player cards and the second player cards.

5. The card gaming machine of claim 4, wherein the processor is further programmed to cause the card gaming machine to perform the following:

in the station where personal data of a player or game history of the player is stored in the sub memory by an inputting of the player with the input device before a start of the simultaneous progress of the same card game;

upon completing operations of the player in the request indication device:

(5-3) output at the speaker special sounds that informs the player that the player can play with using both the first player cards and the second player cards.

6. The card gaming machine of claim 4, further comprising:

a main memory which stored dealer information relating to each of the dealers, wherein the processor is further programmed to cause the card gaming machine to perform the following:

in the station where personal data of a player or game history of the player is stored in the sub memory by an inputting of the player with the input device before a start of the simultaneous progress of the same card game;

upon completing operations of the player in the request indication device:

(5-4) generate, based on the dealer information stored in the main memory and based on the personal data stored in the sub memory or the game history stored in the sub memory, winning rate image information or winning rate sounds information that informs the player of a winning rate which the player won against the dealer of the facilitator by the first player cards or the second player cards; and (5-5) output at the sub display an image of the winning rate image information or outputting at the speaker sounds of the winning rate sounds information.

7. The card gaming machine of claim 6, further comprising:

a bet indication device with which a player indicates a bet amount for the card game, wherein the processor is further programmed to to cause the card gaming machine to perform (5-2) through (5-5) if the player completes an operation of adding a bet amount for the second player cards by using the bet indication device.

8. A card gaming machine comprising:

a main monitor for displaying a card game which is progressed by one of a plurality of dealers;

a main memory which stored dealer information relating to each of the dealers;

a plurality of progressive jackpot prizes that are provided for each of the dealers;

a plurality of stations each provided with:

a sub monitor for outputting an image relating to the card game;

a speaker for outputting sounds relating to the card game;

a tip indication device with which a player indicates a tip amount for the dealer who is a facilitator of the card game;

an input device with which a player inputs information which is used to progress the card game; and a sub memory for storing personal data of a player who plays the card game or game history of the player; and a processor:

wherein the processor is programmed for awarding a right of changing the dealer of the facilitator to another dealer to one of players who is playing at one of the stations and satisfies a predetermined condition, and is further programmed, for controlling progressing simultaneously the same card game in each of the stations, to causes the card gaming machine to perform the following (1) through (4):

in the station where personal data of a player or game history of the player is stored in the sub memory by an inputting of the player with the input device before a start of the simultaneous progress of the same card game;

(1) generate individual image information or individual sounds information, each information relating to the player, based on the personal data or game history that stored in the sub memory;

(2) output an image of the individual image information at the sub monitor or outputting sounds of the individual sounds information at the speaker;

(3) upon completing an operation of indicating a tip amount for the dealer of the facilitator by the player using the tip indication device:

(3-1) include the tip amount to the progressive jackpot prize of the dealer of the facilitator;

(3-2) output at the sub monitor a designated image informing the player of a combination of predetermined cards that are designated by the dealer of the facilitator or outputting at the speaker designated sounds informing the player of a combination of predetermined cards that are designated by the dealer of the facilitator;

(3-3) generate, based on the dealer information stored in the main memory and based on the personal data stored in the sub memory or the game history stored in the sub memory, success rate image information informing the player of a success rate of making the combination of predetermined cards in case that the player plays against the dealer of the facilitator; and (3-4) output an image of the success rate image information at the sub monitor; and (4) award the progressive jackpot prize of the dealer of the facilitator to the player if the player makes the combination of predetermined cards by cards that are dealt to the player during the same card game.

9. The card gaming machine of claim 8, wherein the processor is further programmed to cause the card gaming machine to perform the following (3-5) through (3-6):

in the station where personal data of a player or game history of the player is stored in the sub memory by an inputting of the player with the input device before a start of the simultaneous progress of the same card game;

upon completing an operation of indicating a tip amount for the dealer of the facilitator by the player using the tip indication device (3-5) generate, based on the dealer information stored in the main memory and based on the personal data stored in the sub memory or the game history stored in the sub memory, success rate sounds information informing the player of a success rate of making the combination of predetermined cards in case that the player plays against the dealer of the facilitator; and (3-6) output sounds of the success rate sounds information at the speaker.

* * * * *